US012735246B2

(12) United States Patent
Schwerdtfeger et al.

(10) Patent No.: US 12,735,246 B2
(45) **Date of Patent: *Sep. 15, 2026**

(54) ARRAYS OF SANITARY TISSUE PRODUCTS COMPRISING NON-WOOD(S)

(71) Applicant: The Procter & Gamble Company, Cincinnati, OH (US)

(72) Inventors: Katherine L. Schwerdtfeger, Cincinnati, OH (US); Joshua Thomas Fung, Cincinnati, OH (US); Jeffrey Glen Sheehan, Symmes Township, OH (US); Marlene Otero, Cincinnati, OH (US); Paul Thomas Weisman, Cincinnati, OH (US); Christopher M. Young, Cincinnati, OH (US); Ward William Ostendorf, Cincinnati, OH (US); Kathryn Christian Kien, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/209,506

(22) Filed: Jun. 14, 2023

(65) Prior Publication Data

US 2023/0406608 A1 Dec. 21, 2023

Related U.S. Application Data

(60) Provisional application No. 63/472,379, filed on Jun. 12, 2023, provisional application No. 63/456,020,
(Continued)

(51) Int. Cl.
*B65D 85/671* (2006.01)
*A47K 10/18* (2006.01)
(Continued)

(52) U.S. Cl.
CPC ..... *B65D 85/671* (2013.01); *A47K 10/18* (2013.01); *D21H 11/12* (2013.01); *D21H 27/002* (2013.01);
(Continued)

(58) Field of Classification Search
CPC ..... A47K 10/16; A47K 10/18; B65D 85/67; B65D 85/671; B65D 2565/382;
(Continued)

(56) References Cited

U.S. PATENT DOCUMENTS 3,004,884 A 10/1961 Eberl et al.
3,994,771 A 11/1976 Morgan, Jr. et al.
(Continued)

FOREIGN PATENT DOCUMENTS

CA 2076615 A1 10/1993
CA 2168894 A1 8/1997
(Continued)

OTHER PUBLICATIONS

PCT Search Report and Written Opinion for PCT/US2023/068391dated Aug. 7, 2023, 11 pages.
(Continued)

*Primary Examiner* — Bryon P Gehman
(74) *Attorney, Agent, or Firm* — Richard L. Alexander

(57) ABSTRACT

Arrays of sanitary tissue products of the present disclosure may comprise a first sanitary tissue product in a first package that conveys strength, absorption, and/or softness; and a second sanitary tissue product in a second package that conveys sustainability. TS750, lint, slip stick, tensile ratio, VFS, and SST may be common intensive properties of the first and second sanitary tissue products.

22 Claims, 111 Drawing Sheets

Related U.S. Application Data filed on Mar. 31, 2023, provisional application No. 63/375,858, filed on Sep. 16, 2022, provisional application No. 63/353,183, filed on Jun. 17, 2022, provisional application No. 63/353,167, filed on Jun. 17, 2022.

(51) Int. Cl.
*D21H 11/12* (2006.01)
*D21H 27/00* (2006.01)
*D21H 27/30* (2006.01)

(52) U.S. Cl.
CPC ..... *D21H 27/007* (2013.01); *D21H 27/30* (2013.01); *B65D 2565/382* (2013.01)

(58) Field of Classification Search
CPC ..... B65D 85/62; D21H 11/12; D21H 17/26; D21H 21/10; D21H 21/20; D21H 27/00; D21H 27/002; D21H 27/04; D21H 27/005; D21H 27/007; D21H 27/02; D21H 27/004; D21H 27/30
USPC ..... 206/391, 440, 494
See application file for complete search history.

(56) References Cited

U.S. PATENT DOCUMENTS 4,300,981 A 11/1981 Carstens
4,464,224 A 8/1984 Matolcsy et al.
4,857,145 A 8/1989 Villavicencio
5,320,710 A 6/1994 Reeves et al.
5,348,620 A 9/1994 Hermans et al.
5,472,569 A 12/1995 Nicolucci et al.
5,607,551 A 3/1997 Farrington, Jr. et al.
5,656,132 A 8/1997 Farrington, Jr. et al.
5,932,068 A 8/1999 Farrington, Jr. et al.
6,162,327 A 12/2000 Batra et al.
6,171,442 B1 1/2001 Farrington, Jr. et al.
6,174,412 B1 1/2001 Paterson-brown et al.
6,248,211 B1 6/2001 Jennings et al.
6,258,207 B1 7/2001 Pan
6,302,997 B1 10/2001 Hurter et al.
6,455,129 B1 9/2002 Kershaw et al.
6,511,579 B1 1/2003 Edwards et al.
6,699,360 B2 3/2004 Heath et al.
6,709,550 B2 3/2004 Holz et al.
6,796,114 B2 9/2004 Sheedy et al.
6,797,114 B2 9/2004 Hu
6,821,387 B2 11/2004 Hu
6,896,768 B2 5/2005 Dwiggins et al.
6,926,149 B2 8/2005 Tippey
6,931,313 B2 8/2005 Kato et al.
7,156,954 B2 1/2007 Farrington, Jr. et al.
7,166,190 B2 1/2007 Graef et al.
7,172,073 B2 * 2/2007 Hanson ..... B65D 5/4216 206/440
7,682,488 B2 3/2010 Yeh et al.
8,049,060 B2 11/2011 Vinson et al.
8,197,455 B2 6/2012 Zander et al.
8,287,986 B2 10/2012 Huss et al.
8,343,625 B2 1/2013 Mackey et al.
8,524,374 B2 9/2013 Shannon
8,574,400 B1 11/2013 Shannon et al.
8,662,301 B2 * 3/2014 DuVal ..... B65D 71/00 162/158
8,715,826 B2 5/2014 Mackey et al.
8,741,104 B2 6/2014 Edwards et al.
8,742,181 B2 6/2014 Sharratt et al.
8,778,505 B2 7/2014 Shannon
8,961,739 B2 2/2015 Salminen
9,175,444 B1 11/2015 Polat et al.
9,222,224 B2 12/2015 Shannon
9,242,775 B2 * 1/2016 Knobloch ..... B65D 71/00
9,327,888 B2 * 5/2016 Knobloch ..... B65D 85/67
9,404,222 B2 * 8/2016 Ostendorf ..... D21H 27/40
9,410,291 B2 8/2016 Shannon
9,447,545 B2 9/2016 Hermans et al.
9,657,443 B2 5/2017 Rekoske et al.
10,132,036 B2 11/2018 Collins et al.
10,145,066 B2 12/2018 Shannon et al.
10,145,069 B2 12/2018 Shannon et al.
10,227,729 B2 * 3/2019 Mohammadi ..... D21H 27/30
10,337,149 B2 7/2019 Rouse et al.
10,428,465 B2 10/2019 Rouse et al.
10,472,771 B2 11/2019 Maladen et al.
10,519,601 B2 12/2019 Shannon et al.
10,550,522 B2 2/2020 Shannon et al.
10,731,301 B2 8/2020 Sze et al.
10,907,304 B2 2/2021 Tan et al.
10,914,039 B2 2/2021 Shannon et al.
10,954,417 B2 3/2021 Sumnicht et al.
10,982,392 B2 4/2021 Sealey et al.
11,053,643 B2 7/2021 Rouse et al.
11,090,900 B2 * 8/2021 Kraus ..... D21H 27/02
11,097,881 B2 * 8/2021 Marsh ..... B65D 75/54
11,123,951 B2 9/2021 Kleinwaechter et al.
11,124,357 B2 * 9/2021 Knobloch ..... B65D 85/67
11,179,913 B2 11/2021 Kleinwaechter et al.
11,198,972 B2 12/2021 Wang et al.
11,634,863 B2 4/2023 Bilodeau et al.
11,634,870 B2 4/2023 Rouse et al.
11,795,619 B2 10/2023 Wei et al.
11,834,785 B2 12/2023 Laleg et al.
11,926,138 B2 3/2024 Kleinwaechter et al.
12,122,137 B2 10/2024 Young et al.
12,128,665 B2 10/2024 Young et al.
12,180,654 B2 12/2024 Martin et al.
12,203,222 B2 1/2025 Mckee et al.
12,359,376 B2 7/2025 Wang et al.
2002/0096287 A1 7/2002 Jewell et al.
2002/0134520 A1 9/2002 Behnke et al.
2002/0148574 A1 10/2002 Van et al.
2002/0148584 A1 10/2002 Edwards et al.
2003/0111197 A1 6/2003 Hu
2003/0121629 A1 7/2003 Hu
2003/0192662 A1 10/2003 Heath et al.
2003/0196772 A1 10/2003 Awofeso et al.
2004/0084165 A1 5/2004 Shannon et al.
2004/0140076 A1 7/2004 Hermans et al.
2004/0163781 A1 8/2004 Hernandez-munoa et al.
2004/0163782 A1 8/2004 Hernandez-munoa et al.
2004/0168780 A1 9/2004 Dwiggins et al.
2004/0194901 A1 10/2004 Hu et al.
2004/0226673 A1 11/2004 Edwards et al.
2005/0236122 A1 10/2005 Mullally et al.
2005/0238682 A1 10/2005 Anast et al.
2006/0168914 A1 * 8/2006 Steeves-Kiss ..... A47K 10/16 162/125
2006/0288639 A1 12/2006 Vinson et al.
2007/0011762 A1 1/2007 Vinson et al.
2007/0051484 A1 3/2007 Hermans et al.
2007/0107863 A1 5/2007 Edwards et al.
2007/0298995 A1 12/2007 Eggers et al.
2008/0008853 A1 1/2008 Hupp et al.
2008/0078685 A1 4/2008 Patterson et al.
2008/0110783 A1 * 5/2008 Burgdorf ..... A61B 90/90 206/440
2008/0202954 A1 8/2008 Knobloch et al.
2008/0202968 A1 8/2008 Knobloch et al.
2008/0245491 A1 * 10/2008 Knobloch ..... D21H 27/002 206/391
2009/0022960 A1 * 1/2009 Suer ..... A47K 10/16 427/285
2009/0056891 A1 3/2009 Wiwi et al.
2009/0068633 A1 3/2009 Cohen et al.
2009/0194435 A1 * 8/2009 Heilman ..... B65D 83/08 206/37
2009/0266500 A1 10/2009 Schubert et al.
2009/0297781 A1 12/2009 Huss et al.
2009/0311660 A1 * 12/2009 Imholt ..... G06Q 30/0241 434/365

(56) References Cited

U.S. PATENT DOCUMENTS

| | | | | |
|---|---|---|---|---|
| 2009/0311661 | A1* | 12/2009 | Weaver | G06Q 30/02 434/367 |
| 2010/0032113 | A1 | 2/2010 | Awofeso et al. | |
| 2010/0043989 | A1 | 2/2010 | Shannon et al. | |
| 2010/0126685 | A1 | 5/2010 | Fike et al. | |
| 2011/0017631 | A1 | 1/2011 | Sheasley | |
| 2011/0168342 | A1 | 7/2011 | Mohammadi | |
| 2011/0287275 | A1 | 11/2011 | Tan et al. | |
| 2011/0297343 | A1 | 12/2011 | Li et al. | |
| 2011/0303375 | A1 | 12/2011 | Shannon et al. | |
| 2012/0018964 | A1 | 1/2012 | Edelblut | |
| 2012/0247696 | A1 | 10/2012 | Bogren et al. | |
| 2013/0068867 | A1 | 3/2013 | Hermans et al. | |
| 2013/0068868 | A1 | 3/2013 | Hermans et al. | |
| 2013/0071655 | A1 | 3/2013 | Zwick et al. | |
| 2013/0071678 | A1 | 3/2013 | Shannon | |
| 2013/0199741 | A1 | 8/2013 | Stage et al. | |
| 2013/0269892 | A1 | 10/2013 | Pawar et al. | |
| 2013/0299107 | A1 | 11/2013 | Shannon | |
| 2013/0312924 | A1 | 11/2013 | Shi et al. | |
| 2014/0044883 | A1 | 2/2014 | Kleinwaechter et al. | |
| 2014/0093704 | A1 | 4/2014 | Shi et al. | |
| 2014/0093705 | A1 | 4/2014 | Shi et al. | |
| 2014/0096924 | A1 | 4/2014 | Rekoske et al. | |
| 2014/0205777 | A1 | 7/2014 | Hawkins et al. | |
| 2014/0284010 | A1 | 9/2014 | Shannon | |
| 2015/0007953 | A1 | 1/2015 | Tan et al. | |
| 2015/0129143 | A1 | 5/2015 | Hawkins et al. | |
| 2015/0144280 | A1 | 5/2015 | Shannon et al. | |
| 2016/0038353 | A1 | 2/2016 | Bonilla | |
| 2016/0051422 | A1 | 2/2016 | Warner | |
| 2016/0069029 | A1 | 3/2016 | Shannon | |
| 2016/0097163 | A1 | 4/2016 | Rekoske et al. | |
| 2016/0130762 | A1 | 5/2016 | Ramaratnam et al. | |
| 2016/0138224 | A1 | 5/2016 | Shannon et al. | |
| 2016/0145809 | A1 | 5/2016 | Hermans et al. | |
| 2016/0304818 | A1 | 10/2016 | Cordial et al. | |
| 2016/0355987 | A1 | 12/2016 | Hermans et al. | |
| 2016/0355990 | A1 | 12/2016 | Zwick et al. | |
| 2017/0198436 | A1 | 7/2017 | Tan et al. | |
| 2017/0254025 | A1 | 9/2017 | Miller et al. | |
| 2017/0282519 | A1* | 10/2017 | Cabell | A47K 10/16 |
| 2017/0325640 | A1* | 11/2017 | Trokhan | A47K 10/16 |
| 2018/0030654 | A1 | 2/2018 | Chute | |
| 2018/0044859 | A1 | 2/2018 | Hermans et al. | |
| 2018/0135248 | A1 | 5/2018 | Collins et al. | |
| 2018/0135249 | A1 | 5/2018 | Shannon et al. | |
| 2018/0142419 | A1 | 5/2018 | Rouse et al. | |
| 2018/0142420 | A1 | 5/2018 | Rouse et al. | |
| 2018/0142421 | A1 | 5/2018 | Rouse et al. | |
| 2018/0155873 | A1 | 6/2018 | Seger et al. | |
| 2018/0155875 | A1 | 6/2018 | Ankerfors et al. | |
| 2018/0230344 | A1 | 8/2018 | Sumnicht et al. | |
| 2019/0100878 | A1 | 4/2019 | Shannon et al. | |
| 2019/0100883 | A1 | 4/2019 | Shannon et al. | |
| 2019/0169798 | A1 | 6/2019 | Rouse et al. | |
| 2019/0249367 | A1 | 8/2019 | Rouse et al. | |
| 2019/0264395 | A1 | 8/2019 | Rouse et al. | |
| 2019/0276985 | A1 | 9/2019 | Anderson et al. | |
| 2019/0366676 | A1 | 12/2019 | Kleinwaechter et al. | |
| 2020/0040529 | A1 | 2/2020 | Rouse et al. | |
| 2020/0102705 | A1 | 4/2020 | Rouse et al. | |
| 2020/0115853 | A1 | 4/2020 | Shannon et al. | |
| 2020/0129013 | A1 | 4/2020 | Mitchell et al. | |
| 2020/0131707 | A1 | 4/2020 | Mitchell et al. | |
| 2020/0181848 | A1 | 6/2020 | Polat et al. | |
| 2020/0232166 | A1 | 7/2020 | Rouse et al. | |
| 2020/0270813 | A1 | 8/2020 | Rekoske et al. | |
| 2020/0347549 | A1 | 11/2020 | Bilodeau et al. | |
| 2021/0001597 | A1 | 1/2021 | Kleinwaechter et al. | |
| 2021/0017710 | A1 | 1/2021 | Seger et al. | |
| 2021/0054572 | A1 | 2/2021 | Zawadzki et al. | |
| 2021/0071364 | A1 | 3/2021 | Martin et al. | |
| 2021/0087748 | A1 | 3/2021 | Sze et al. | |
| 2021/0140114 | A1 | 5/2021 | Redd et al. | |
| 2021/0140115 | A1 | 5/2021 | Redd et al. | |
| 2021/0237964 | A1 | 8/2021 | Sheehan et al. | |
| 2021/0262165 | A1 | 8/2021 | Tan et al. | |
| 2021/0285156 | A1 | 9/2021 | Laleg et al. | |
| 2021/0292973 | A1 | 9/2021 | Rouse | |
| 2021/0321831 | A1 | 10/2021 | Vogt et al. | |
| 2021/0332531 | A1 | 10/2021 | Bailey et al. | |
| 2021/0370637 | A1 | 12/2021 | Kleinwaechter et al. | |
| 2021/0381172 | A1 | 12/2021 | Goulet et al. | |
| 2022/0010495 | A1 | 1/2022 | Bailey et al. | |
| 2022/0356648 | A1 | 11/2022 | Pande et al. | |
| 2023/0071802 | A1 | 3/2023 | Husmark et al. | |
| 2023/0295878 | A1 | 9/2023 | Arnoul-jarriault et al. | |
| 2023/0320539 | A1 | 10/2023 | Young et al. | |
| 2023/0320540 | A1 | 10/2023 | Young et al. | |
| 2023/0320541 | A1 | 10/2023 | Young et al. | |
| 2023/0323598 | A1 | 10/2023 | Young et al. | |
| 2023/0323604 | A1 | 10/2023 | Young et al. | |
| 2023/0323605 | A1 | 10/2023 | Kien et al. | |
| 2024/0076077 | A1 | 3/2024 | Ross | |
| 2024/0110336 | A1 | 4/2024 | Young | |
| 2025/0043511 | A1 | 2/2025 | Mitchell et al. | |
| 2025/0116067 | A1 | 4/2025 | Kreider et al. | |
| 2025/0122671 | A1 | 4/2025 | Mckee et al. | |

FOREIGN PATENT DOCUMENTS

| | | | |
|---|---|---|---|
| CN | 104116454 | A | 10/2014 |
| DE | 9300201 | U1 | 5/1994 |
| DE | 102008053858 | A1 | 5/2010 |
| EP | 1319749 | A1 | 6/2003 |
| EP | 2758593 | B1 | 3/2019 |
| EP | 3929261 | A1 | 12/2021 |
| EP | 4234812 | A1 | 8/2023 |
| GB | 1374198 | A | 11/1974 |
| GB | 2574744 | A | 12/2019 |
| JP | 10102392 | A | 4/1998 |
| JP | 05321190 | A | 7/2001 |
| JP | 07197400 | A | 10/2003 |
| JP | 4202892 | B2 | 10/2008 |
| KR | 20050002715 | A | 1/2005 |
| KR | 100547592 | B1 | 1/2006 |
| KR | 20090036284 | A | 4/2009 |
| KR | 100933462 | B1 | 12/2009 |
| KR | 20100070240 | A | 6/2010 |
| KR | 1020110060510 | A | 1/2016 |
| MX | 2010001159 | A | 7/2011 |
| WO | 1996006223 | A1 | 2/1996 |
| WO | 9704956 | A1 | 2/1997 |
| WO | 2007004757 | A1 | 1/2007 |
| WO | 2007059789 | A1 | 5/2007 |
| WO | 2007112916 | A1 | 10/2007 |
| WO | 2008003343 | A1 | 1/2008 |
| WO | 2008044860 | A1 | 4/2008 |
| WO | 2008063014 | A1 | 5/2008 |
| WO | 10008331 | A1 | 1/2010 |
| WO | 2010021572 | A1 | 2/2010 |
| WO | 12010181 | A1 | 1/2012 |
| WO | 2013041986 | A2 | 3/2013 |
| WO | 2014053947 | A1 | 4/2014 |
| WO | 14200455 | A | 12/2014 |
| WO | 14200456 | A | 12/2014 |
| WO | 2016173641 | A1 | 11/2016 |
| WO | 16195625 | A | 12/2016 |
| WO | 16195627 | A1 | 12/2016 |
| WO | 16195629 | A1 | 12/2016 |
| WO | 2016195625 | A1 | 12/2016 |
| WO | 2016195627 | A1 | 12/2016 |
| WO | 2016195629 | A1 | 12/2016 |
| WO | 2017019421 | A1 | 2/2017 |
| WO | 2018039623 | A1 | 3/2018 |
| WO | 18080492 | A1 | 5/2018 |
| WO | 2018144309 | A1 | 8/2018 |
| WO | 2018156109 | A1 | 8/2018 |
| WO | 2018200501 | A1 | 11/2018 |
| WO | 2018229336 | A1 | 12/2018 |
| WO | 2021061718 | A1 | 4/2021 |
| WO | 2022236005 | A1 | 11/2022 |
| WO | 2023282811 | A1 | 1/2023 |

(56) References Cited

FOREIGN PATENT DOCUMENTS

| | | | |
|---|---|---|---|
| WO | 2023282812 | A1 | 1/2023 |
| WO | 2023282813 | A1 | 1/2023 |
| WO | 2023282818 | A1 | 1/2023 |
| WO | 2023196449 | A1 | 10/2023 |
| WO | 2023196450 | A1 | 10/2023 |
| WO | 2023196451 | A1 | 10/2023 |
| WO | 2023245027 | A1 | 12/2023 |
| WO | 2025165801 | A1 | 8/2025 |

OTHER PUBLICATIONS

PCT Search Report and Written Opinion for PCT/US2023/068392dated Aug. 7, 2023, 11 pages.
PCT Search Report and Written Opinion for PCT/US2023/068393 dated Aug. 10, 2023, 11 pages.
PCT Search Report and Written Opinion for PCT/US2023/068394 dated Aug. 10, 2023, 11 pages.
All Office Actions: U.S. Appl. No. 18/131,383, filed Apr. 6, 2023.
All Office Actions: U.S. Appl. No. 18/131,387, filed Apr. 6, 2023.
All Office Actions: U.S. Appl. No. 18/131,392, filed Apr. 6, 2023.
All Office Actions: U.S. Appl. No. 18/131,384, filed Apr. 6, 2023.
All Office Actions; U.S. Appl. No. 18/131,381, filed Apr. 6, 2023.
All Office Actions; U.S. Appl. No. 18/131,382, filed Apr. 6, 2023.
All Office Actions; U.S. Appl. No. 18/131,388, filed Apr. 6, 2023.
All Office Actions; U.S. Appl. No. 18/209,508, filed Jun. 14, 2023.
All Office Actions; U.S. Appl. No. 18/209,509, filed Jun. 14, 2023.
All Office Actions; U.S. Appl. No. 18/209,510, filed Jun. 14, 2023.
Darraga, G. et al., "Pulp and Paper from Blue Agave Waste from Tequila Production," Journal of Agricultural androod Chemistry, vol. 47, No. 10, Sep. 4, 1999, pp. 4450-4455.
Deniz et al. in "Kraft and Modified Kraft Pulping of Bamboo (Phyllostachys Bambusoides),", vol. 60, No. 200, 2017, 17 Pages.
Economic Research Services, "Natural Fibers Hesperaloe Has Properties That Interest Papermakers", Online retrieved from "https://www.ers.usda.gov/webdoc,s/Jublications/37342/32911 jus6d_002.pdf?v=41471", XP055526919, Sep. 1, 1996, pp. 24-26.
Escoto-Garcia, T. et al., "Fermentative-Chemical and Mechanical Treatment of Agave Bagasse (Agave TequilanaNeber) for its Application in Hand Crafted Paper," Revista Mexicana de Ingenieria Quimica, Nov. 30, 2006, vol. 5, No. Suppl. 1, pp. 23-27.
Eugenio et al., in "Evalution of Hesperaloe funifera pulps obtained by a low energy consumption process as a-einforcement material in reycled pulps," Forest Systems 21(3), No Known Date, pp. 460-467.
Ghosh, A. K., "Fundamentals of Paper Drying—Theory and Application from Industrial Perspective," Evaporation,Sondensation and Heat Transfer, Sep. 12, 2011, 50 Pages.
Haun, J.R. et al., "Fiber and Papermaking Characteristics of Bamboo." Technical Bulletin No. 1361, Agriculture Research Service, USDA, Aug. 1966, 26 Pages.
Horn et al., "Fiber Morphology and New Crops," Internet webpage "http://www.hort.purdue.edu/newcrop/proceedings1990/v1-270.html", Aug. 28, 1997, pp. 270-275.
Hurter, Robert W., in "Nonwood Plant Fiber Characteristics" HurterConsult, No Known Date, 4 Pages.
Iniguez-Covarrubias, G. et al., "Utilization of By-Products from the Tequila Industry. Part 2: Potential Value of" gave Tequilana Weber Azul Leaves," Bioresource Technology, vol. 77, No. 2, Jan. 4, 2001, pp. 61-74.
Jaouadi, M. et al., "A Study of the Physical and Mechanical Properties of Paper Made from Agave Americana L.=fibers," Materials and Manufacturing Processes, vol. 26, No. 4, Apr. 22, 2011, pp. 567-572.
Kamthai, Suphatand Pratung Puthson, "Effect of Beating Revolution on Sweet Bamboo (*Dendrocalamus asper* Backer) Kraft Pulp Properties." CMU Journal, vol. 4, No. 2, 2005, 11 Pages.
Mclaughlin, Steven, in "Properties of Paper Made From Fibers of *Hesperaloe funifera* (Agavaceae)," Economicbotany, 54(20), No Known Date, 1 Page.
Morphology, Online retrieved from "http://www.inbar.int/publication/txt/tr18/MORPHOLOGY.htm", Mar. 31, 2011, 4 Pages.
Protasio et al. in "Brazilian Lignocellulosic Wastes for Bioenergy Production: Characterization and Comparison with Fossil Fuels," Bio Resources 8(1), No Known Date, 20 Pages.
Sekyere, Daniel, Potential of Bamboo (*Bambusa vulgaris*) as a Source of Raw Material for Pulp and Paper in Ghana, Ghana Journal of Forestry, vol. 1, 1994, 8 Pages.
Sood, Y.V. et al., "Quality Improvement of Paper from Bamboo and Hardwood Furnish Through Fiber Fractionation." Journal of Scientific & Industrial Research, vol. 64, Apr. 2005, pp. 299-305.
Tamolang, Francisco N. et al., Properties and Utilization of Philip pine Erect Bamboos. Bamboo Research in Asia, proceedings of workshop, Singapore, May 28-30, 1980, pp. 189-200.
Unpublished U.S. Appl. No. 18/131,384, filed Apr. 6, 2023, Christopher Michael Youn et al.
Unpublished U.S. Appl. No. 18/209,508, filed Jun. 14, 2023, to Katherine L. Schwerdtfeger et al.
Unpublished U.S. Appl. No. 18/209,509, filed Jun. 14, 2023, to Katherine L. Schwerdtfeger et al.
Unpublished U.S. Appl. No. 18/209,510, filed Jun. 14, 2023, to Katherine L. Schwerdtfeger et al.
Zhao, Guanglei et al., "Replacement of Softwood Kraft Pulp with ECF-Bleached Bamboo Kraft Pulp in Fine Paper." Bio Resources, vol. 5, No. 3, 2010, pp. 1733-1744.
All Office Actions; U.S. Appl. No. 19/314,005, filed Aug. 29, 2025; See Patent Center.
Unpublished U.S. Appl. No. 19/314,005, filed Aug. 29, 2025, to Katherine L. Schwerdtfeger et al. (See Patent Center).
All Office Actions; U.S. Appl. No. 19/335,035, filed Sep. 22, 2025; See Patent Center.
Unpublished U.S. Appl. No. 19/335,035, filed Sep. 22, 2025, to Katherine L. Schwerdtfeger et al. (See Patent Center).

* cited by examiner

| | | | | | | | | | | | | X% change of listed product relative to sustainable product | | | | |
|---|---|---|---|---|---|---|---|---|---|---|---|---|---|---|---|---|
| Package | Brand | Plies | Array | Tier | Connotes | BW | TDT | Lint | TS7 | VFS g/g | | BW | TDT | Lint | TS7 | VFS g/g |
| 1 | Brand A | 2 | A | 1 | Soft | 31.0 | 525 | 9.0 | 8.5 | 11.5 | | 0.0% | -1.9% | 20.0% | -15.3% | 15.0% |
| 2 | Brand A | 2 | A | 1 | Strong | 24.5 | 750 | 4.0 | 11.0 | 13.0 | | -21.0% | 40.2% | -46.7% | 10.0% | 30.0% |
| 3 | Brand A | 2 | A | 2 | Soft | 22.0 | 715 | 4.0 | 10.5 | 15.0 | | -29.1% | 33.6% | -46.7% | 5.0% | 50.0% |
| 4 | Brand A | 1 | A | 2 | Strong | 18.0 | 675 | 3.5 | 14.0 | 10.5 | | -41.9% | 26.2% | -54.0% | 40.0% | 5.0% |
| 5 | Brand A | 2 | A | 1 | Gentle | 28.5 | 470 | 4.0 | 10.5 | 10.5 | | -8.1% | -12.1% | -46.7% | 5.0% | 4.7% |
| 6 | Brand A | 2 | A | 1 | Sustainable | 31.0 | 535 | 7.5 | 10.0 | 10.0 | | | | | | |

FIG. 22A

| | | | | | | | | | | | | X% change of listed product relative to sustainable product | | | | |
|---|---|---|---|---|---|---|---|---|---|---|---|---|---|---|---|---|
| Package | Brand | Plies | Array | Tier | Connotes | BW | TDT | Lint | TS7 | VFS g/g | | BW | TDT | Lint | TS7 | VFS g/g |
| 1 | Brand A | 2 | AA | 1 | Soft | 31.0 | 525 | 9.0 | 8.5 | 11.5 | | 26.5% | -30.0% | 350.0% | -37.3% | 0.0% |
| 2 | Brand A | 2 | AA | 1 | Strong | 24.5 | 750 | 4.0 | 11.0 | 13.0 | | 0.0% | 0.0% | 100.0% | -18.5% | 13.0% |
| 3 | Brand A | 2 | AA | 2 | Soft | 22.0 | 715 | 4.0 | 10.5 | 15.0 | | -10.2% | -4.7% | 100.0% | -22.2% | 30.4% |
| 4 | Brand A | 1 | AA | 2 | Strong | 18.0 | 675 | 3.5 | 14.0 | 10.5 | | -26.5% | -10.0% | 72.5% | 3.7% | -8.7% |
| 5 | Brand A | 2 | AA | 1 | Gentle | 28.5 | 470 | 4.0 | 10.5 | 10.5 | | 16.3% | -37.3% | 100.0% | -22.2% | -9.0% |
| 6 | Brand A | 2 | AA | 1 | Sustainable | 24.5 | 750 | 2.0 | 13.5 | 11.5 | | | | | | |

FIG. 22B

| | | | | | | | | | | | | X% change of listed product relative to sustainable product | | | | |
|---|---|---|---|---|---|---|---|---|---|---|---|---|---|---|---|---|
| Package | Brand | Plies | Array | Tier | Connotes | BW | TDT | Lint | TS7 | VFS g/g | | BW | TDT | Lint | TS7 | VFS g/g |
| 1 | Brand B | 2 | B | 1 | Soft | 30.0 | 700 | 7.5 | 11.5 | 11.5 | | 25.0% | 47.4% | 66.7% | -23.3% | 35.3% |
| 2 | Brand B | 1 | B | 1 | Strong | 25.0 | 530 | 6.5 | 12.0 | 8.5 | | 4.2% | 11.6% | 44.4% | -20.0% | 0.0% |
| 3 | Brand B | 1 | B | 1 | Gentle | 25.0 | 500 | 5.0 | 12.0 | 7.5 | | 4.2% | 5.3% | 11.1% | -20.0% | -11.8% |
| 4 | Brand B | 1 | B | 2 | Soft | 22.0 | 535 | 4.5 | 14.5 | 9.5 | | -8.3% | 12.6% | 0.0% | -3.3% | 11.8% |
| 5 | Brand B | 1 | B | 3 | Value | 10.1 | 640 | 0.9 | 19.0 | 10.5 | | -57.9% | 34.7% | -80.0% | 26.7% | 23.5% |
| 6 | Brand B | 1 | B | 2 | Sustainable | 24.0 | 475 | 4.5 | 15.0 | 8.5 | | | | | | |

FIG. 22C

| | | | | | | | | | | | | X% change of listed product relative to sustainable product | | | | |
|---|---|---|---|---|---|---|---|---|---|---|---|---|---|---|---|---|
| Package | Brand | Plies | Array | Tier | Connotes | BW | TDT | Lint | TS7 | VFS g/g | | BW | TDT | Lint | TS7 | VFS g/g |
| 1 | Brand B | 2 | B | 1 | Soft | 30.0 | 700 | 7.5 | 11.5 | 11.5 | | 25.0% | 47.4% | 66.7% | -23.3% | 35.3% |
| 2 | Brand B | 1 | B | 1 | Strong | 25.0 | 530 | 6.5 | 12.0 | 8.5 | | 4.2% | 11.6% | 44.4% | -20.0% | 0.0% |
| 3 | Brand B | 1 | B | 1 | Gentle | 25.0 | 500 | 5.0 | 12.0 | 7.5 | | 4.2% | 5.3% | 11.1% | -20.0% | -11.8% |
| 4 | Brand B | 1 | B | 2 | Soft | 22.0 | 535 | 4.5 | 14.5 | 9.5 | | -8.3% | 12.6% | 0.0% | -3.3% | 11.8% |
| 5 | Brand B | 1 | B | 3 | Value | 10.1 | 640 | 0.9 | 19.0 | 10.5 | | -57.9% | 34.7% | -80.0% | 26.7% | 23.5% |
| 6 | Brand B | 1 | B | 2 | Sustainable | 24.0 | 475 | 4.5 | 15.0 | 8.5 | | | | | | |

FIG. 22D

| | | | | | | | | | | | | X% change of listed product relative to sustainable product | | | | |
|---|---|---|---|---|---|---|---|---|---|---|---|---|---|---|---|---|
| Package | Brand | Plies | Array | Tier | Connotes | BW | TDT | Lint | TS7 | VFS g/g | | BW | TDT | Lint | TS7 | VFS g/g |
| 1 | Brand C | 3 | C | 1 | Soft | 31.5 | 550 | 3.5 | 11.5 | 9.0 | | 14.5% | -8.3% | -50.0% | -17.9% | -5.3% |
| 2 | Brand C | 2 | C | 1 | Soft & Strong | 27.5 | 600 | 9.0 | 12.5 | 10.5 | | 0.0% | 0.0% | 28.6% | -10.7% | 10.5% |
| 3 | Brand C | 2 | C | 2 | Soft | 24.5 | 600 | 3.0 | 15.5 | 8.0 | | -10.9% | 0.0% | -57.1% | 10.7% | -15.8% |
| 4 | Brand C | 2 | C | 1 | Sustainable | 27.5 | 600 | 8.0 | 11.0 | 10.5 | | 0.0% | 0.0% | 14.3% | -21.4% | 10.5% |
| 5 | Brand C | 2 | C | 1 | Sustainable | 27.5 | 600 | 7.0 | 14.0 | 9.5 | | | | | | |

FIG. 22E

| | | | | | | | | | | | | X% change of listed product relative to sustainable product | | | | |
|---|---|---|---|---|---|---|---|---|---|---|---|---|---|---|---|---|
| Package | Brand | Plies | Array | Tier | Connotes | BW | TDT | Lint | TS7 | VFS g/g | | BW | TDT | Lint | TS7 | VFS g/g |
| 1 | Brand C | 3 | CC | 1 | Soft | 31.5 | 550 | 3.5 | 11.5 | 9.0 | | 28.6% | -8.3% | 75.0% | -32.4% | 5.9% |
| 2 | Brand C | 2 | CC | 1 | Strong | 27.5 | 600 | 9.0 | 12.5 | 10.5 | | 12.2% | 0.0% | 350.0% | -26.5% | 23.5% |
| 3 | Brand C | 2 | CC | 2 | Soft | 24.5 | 600 | 3.0 | 15.5 | 8.5 | | 0.0% | 0.0% | 50.0% | -8.8% | 0.0% |
| 4 | Brand C | 2 | CC | 1 | Sustainable | 27.5 | 600 | 8.0 | 11.0 | 10.5 | | 12.2% | 0.0% | 300.0% | -35.3% | 23.5% |
| 5 | Brand C | 2 | CC | 2 | Sustainable | 24.5 | 600 | 2.0 | 17.0 | 8.5 | | | | | | |

FIG. 22F

| | | | | | | | | | | | | X% change of listed product relative to sustainable product | | | | |
|---|---|---|---|---|---|---|---|---|---|---|---|---|---|---|---|---|
| Package | Brand | Plies | Array | Tier | Connotes | BW | TDT | Lint | TS7 | VFS g/g | | BW | TDT | Lint | TS7 | VFS g/g |
| 1 | Brand D | 3 | D | 1 | Soft | 32.0 | 535 | 9.0 | 8.5 | 11.0 | | 3.2% | 0.0% | 20.0% | -15.0% | 10.0% |
| 2 | Brand D | 2 | D | 1 | Strong | 25.0 | 750 | 4.5 | 12.0 | 11.5 | | -19.4% | 40.2% | -40.0% | 20.0% | 15.0% |
| 3 | Brand D | 2 | D | 1 | Soft & Strong | 28.0 | 650 | 6.0 | 10.0 | 11.0 | | -9.7% | 21.5% | -20.0% | 0.0% | 10.0% |
| 4 | Brand D | 2 | D | 1 | Gentle | 27.0 | 500 | 4.5 | 11.0 | 10.5 | | -12.9% | -6.5% | -40.0% | 10.0% | 5.0% |
| 5 | Brand D | 2 | D | 2 | Soft | 25.0 | 650 | 7.0 | 11.0 | 11.0 | | -19.4% | 21.5% | -6.7% | 10.0% | 10.0% |
| 6 | Brand D | 2 | D | 2 | Strong | 23.0 | 800 | 4.0 | 12.5 | 12.0 | | -25.8% | 49.5% | -46.7% | 25.0% | 20.0% |
| 7 | Brand D | 2 | D | 2 | Soft & Strong | 24.0 | 650 | 6.0 | 12.0 | 11.5 | | -22.6% | 21.5% | -20.0% | 20.0% | 15.0% |
| 8 | Brand D | 1 | D | 3 | Value | 11.0 | 500 | 1.2 | 20.0 | 9.5 | | -64.5% | -6.5% | -84.0% | 100.0% | -5.0% |
| 9 | Brand D | 2 | D | 1 | Sustainable | 31.0 | 535 | 7.5 | 10.0 | 10.0 | | | | | | |

FIG. 22G

| | | | | | | | | | | | | X% change of listed product relative to sustainable product | | | | |
|---|---|---|---|---|---|---|---|---|---|---|---|---|---|---|---|---|
| Package | Brand | Plies | Array | Tier | Connotes | BW | TDT | Lint | TS7 | VFS g/g | | BW | TDT | Lint | TS7 | VFS g/g |
| 1 | Brand E | 2 | E | 1 | Soft | 31.0 | 525 | 9.0 | 8.5 | 11.5 | | 34.8% | -12.5% | 200.0% | -47.1% | 15.0% |
| 2 | Brand E | 2 | E | 1 | Strong | 27.5 | 600 | 9.0 | 12.5 | 10.5 | | 19.6% | 0.0% | 200.0% | -21.9% | 5.0% |
| 3 | Brand E | 2 | E | 1 | Soft & Strong | 28.0 | 650 | 7.0 | 10.0 | 11.0 | | 21.7% | 8.3% | 133.3% | -37.5% | 10.0% |
| 4 | Brand E | 1 | E | 1 | Gentle | 25.0 | 500 | 5.0 | 12.0 | 7.5 | | 8.7% | -16.7% | 66.7% | -25.0% | -25.0% |
| 5 | Brand E | 2 | E | 2 | Soft | 23.0 | 625 | 4.0 | 12.0 | 14.0 | | 0.0% | 4.2% | 33.3% | -25.0% | 40.0% |
| 6 | Brand E | 1 | E | 2 | Strong | 20.0 | 625 | 3.5 | 14.0 | 10.0 | | -13.0% | 4.2% | 16.7% | -12.5% | 0.0% |
| 7 | Brand E | 2 | E | 2 | Soft & Strong | 22.0 | 700 | 3.5 | 13.0 | 12.0 | | -4.3% | 16.7% | 16.7% | -18.8% | 20.0% |
| 8 | Brand E | 1 | E | 3 | Value | 11.0 | 500 | 1.2 | 20.0 | 9.5 | | -52.2% | -16.7% | -60.0% | 25.0% | -5.0% |
| 9 | Brand E | 2 | E | 2 | Sustainable | 23.0 | 600 | 3.0 | 16.0 | 10.0 | | | | | | |

FIG. 22H

| | | | | | | | | | | | | X% change of listed product relative to sustainable product | | | | |
|---|---|---|---|---|---|---|---|---|---|---|---|---|---|---|---|---|
| Package | Brand | Plies | Array | Tier | Connotes | BW | TDT | Lint | TS7 | VFS g/g | | BW | TDT | Lint | TS7 | VFS g/g |
| 1 | Brand F | 2 | F | 1 | Soft | 31.0 | 525 | 9.0 | 8.5 | 11.5 | | 72.2% | -30.0% | 500.0% | -57.7% | 27.8% |
| 2 | Brand F | 2 | F | 1 | Strong | 24.5 | 750 | 4.0 | 11.0 | 13.0 | | 36.1% | 0.0% | 166.7% | -45.0% | 44.4% |
| 3 | Brand F | 2 | F | 1 | Soft & Strong | 28.0 | 600 | 7.0 | 10.0 | 11.0 | | 55.6% | -20.0% | 366.7% | -50.0% | 22.2% |
| 4 | Brand F | 2 | F | 1 | Gentle | 28.5 | 470 | 4.0 | 10.5 | 10.5 | | 58.3% | -37.3% | 166.7% | -47.5% | 16.3% |
| 5 | Brand F | 2 | F | 2 | Soft | 22.0 | 715 | 4.0 | 10.5 | 15.0 | | 22.2% | -4.7% | 166.7% | -47.5% | 66.7% |
| 6 | Brand F | 1 | F | 2 | Strong | 18.0 | 675 | 3.5 | 14.0 | 10.5 | | 0.0% | -10.0% | 130.0% | -30.0% | 16.7% |
| 7 | Brand F | 2 | F | 2 | Soft & Strong | 20.0 | 700 | 3.5 | 13.0 | 12.0 | | 11.1% | -6.7% | 133.3% | -35.0% | 33.3% |
| 8 | Brand F | 1 | F | 3 | Value | 11.0 | 500 | 1.2 | 20.0 | 9.5 | | -38.9% | -33.3% | -20.0% | 0.0% | 5.6% |
| 9 | Brand F | 1 | F | 3 | Sustainable | 18.0 | 750 | 1.5 | 20.0 | 9.0 | | | | | | |

FIG. 22I

| | | | | | | | | | PVD | | |
|---|---|---|---|---|---|---|---|---|---|---|---|
| Substrate | Type | Non-wood | Sample ID | Ply Count | Process | Crepe | Differential Density | Dry Tensile Ratio | 2.5-100 micron PVD Hysteresis | 2.5-160 micron PVD Absorption | 2.5-160 micron PVD Desorption |
| Bath tissue | Comparative | Bamboo | A | 2 | CWP | Y | N | 3.9 | 236 | 621 | 702 |
| Bath tissue | Comparative | Bamboo | B | 2 | CWP | Y | N | 4.4 | 110 | 791 | 814 |
| Bath tissue | Comparative | Bamboo | C | 2 | CWP | Y | N | 2.2 | 139 | 449 | 561 |
| Bath tissue | Comparative | Bamboo | D | 3 | CWP | Y | N | 2.2 | 50 | 797 | 828 |
| Bath tissue | Comparative | Bamboo | E | 3 | CWP | Y | N | 2.8 | 47 | 633 | 671 |
| Bath tissue | Comparative | Bamboo | F | 1 | UCTAD | N | N | 1.1 | 42 | 656 | 667 |
| Bath tissue | Comparative | Bamboo | G | 2 | CWP | Y | N | 3.4 | 79 | 402 | 536 |
| Bath tissue | Comparative | Bamboo/ Sugarcane | H | 2 | CWP | Y | N | 4.1 | 82 | 439 | 573 |
| Bath tissue | Comparative | Wheat Straw | AA | 3 | CWP | Y | N | 2.7 | 92 | 725 | 691 |
| Bath tissue | Comparative | Wheat Straw | BB | 4 | CWP | Y | N | 2.4 | 292 | 993 | 1062 |
| Bath tissue | Inventive | Bamboo | 16 | 2 | TAD | Y | Y | 1.5 | 492 | 1095 | 1411 |
| Bath tissue | Inventive | Bamboo | 18 | 2 | TAD | Y | Y | 1.5 | 545 | 1034 | 1373 |
| Bath tissue | Inventive | Bamboo | 19 | 2 | TAD | Y | Y | 1.4 | 573 | 933 | 1453 |
| Bath tissue | Inventive | Bamboo | 22 | 2 | TAD | Y | Y | 2 | 517 | 1173 | 1372 |
| Bath tissue | Inventive | Bamboo | 25 | 2 | TAD | Y | Y | 1.2 | 645 | 1177 | 1444 |
| Bath tissue | Inventive | Bamboo | 26 | 2 | TAD | Y | Y | 1.3 | 629 | 1192 | 1490 |
| Bath tissue | Traditional | | Z6 | 2 | TAD | Y | Y | 1.7 | 390 | 1132 | 1279 |
| Bath tissue | Inventive | Bamboo | 27 | 2 | TAD | Y | Y | 1.4 | 765 | 967 | 1526 |
| Bath tissue | Inventive | Bamboo | 20 | 2 | TAD | Y | Y | 2.1 | 587 | 1037 | 1352 |
| Bath tissue | Inventive | Bamboo | 21 | 2 | TAD | Y | Y | 1.9 | 512 | 1024 | 1296 |
| Bath tissue | Inventive | Bamboo | 21 | 2 | TAD | Y | Y | 1.9 | 482 | 1036 | 1262 |
| Bath tissue | Inventive | Bamboo | 23 | 2 | TAD | Y | Y | 1.7 | 720 | 956 | 1433 |
| Bath tissue | Inventive | Bamboo | 24 | 2 | TAD | Y | Y | 1.6 | 816 | 896 | 1557 |
| Towel | Inventive | Abaca | 59 | 2 | TAD | Y | Y | | 292 | 785 | 1496 |
| Towel | Inventive | Abaca | 56 | 2 | TAD | Y | Y | | 435 | 874 | 1618 |
| Towel | Inventive | Abaca | 57 | 2 | TAD | Y | Y | | 362 | 787 | 1631 |
| Towel | Inventive | Abaca | 61 | 2 | TAD | Y | Y | 1.35 | 421 | 1060 | 1599 |
| Towel | Inventive | Abaca | 64 | 2 | TAD | Y | Y | 1.38 | 423 | 1023 | 1551 |
| Towel | Inventive | Bamboo | 10 | 2 | TAD | Y | Y | 1.44 | 552 | 885 | 1611 |
| Towel | Inventive | Bamboo | 12 | 2 | TAD | Y | Y | 1.41 | 519 | 835 | 1583 |
| Towel | Inventive | Bamboo | 14 | 2 | TAD | Y | Y | 1.68 | 430 | 835 | 1561 |
| Bath tissue | Inventive | Abaca | 31 | 2 | TAD | Y | Y | 1.51 | 473 | 1296 | 1487 |
| Bath tissue | Traditional | | Z8 | 2 | TAD | Y | Y | 1.73 | 405 | 812 | 1088 |
| Bath tissue | Inventive | Abaca | 39 | 2 | TAD | Y | Y | 1.83 | 383 | 844 | 1075 |
| Towel | Comparative | Bamboo/ Sugarcane | U | 2 | CWP | Y | N | | 147 | 582 | 735 |
| Towel | Comparative | Bamboo | V | 2 | CWP | Y | N | | 138 | 466 | 696 |
| Towel | Comparative | Bamboo | W | 2 | CWP | Y | N | | 17 | 482 | 745 |
| Towel | Comparative | Bamboo/ Sugarcane | X | 2 | CWP | Y | N | | 133 | 524 | 689 |
| Towel | Comparative | Bamboo | Y | 2 | CWP | Y | N | | 130 | 502 | 679 |

FIG. 23A

| Substrate | Type | Non-wood | Sample Id | Roll Bulk | Percent Roll Compressibility | Roll Firmness | Formation Index Outside | Formation Index Inside | Formation Index Average | Coverage (Fiber Layers) | Fiber Count -area (C/m) | Fiber Count -area (C/l) |
|---|---|---|---|---|---|---|---|---|---|---|---|---|
| Bath tissue | Comparative | Bamboo | A | 7.1 | 1.24 | 3.38 | 157 | 171 | 164 | 4.21 | 714 | 265 |
| Bath tissue | Comparative | Bamboo | B | 8.3 | 4.51 | 7.52 | 141 | 130 | 136 | 4.67 | 779 | 294 |
| Bath tissue | Comparative | Bamboo | C | 8.4 | 3.07 | 7.03 | 115 | 113 | 114 | 3.22 | 530 | 200 |
| Bath tissue | Comparative | Bamboo | D | 6.1 | 1.54 | 3.09 | 123 | 116 | 120 | 6.39 | 782 | 534 |
| Bath tissue | Comparative | Bamboo | E | 7.7 | 2.22 | 4.51 | 99 | 103 | 101 | 4.71 | 805 | 289 |
| Bath tissue | Comparative | Bamboo | F | 12.5 | 6.35 | 10.55 | 73 | 67 | 70 | 4.94 | 815 | 256 |
| Bath tissue | Comparative | Bamboo | G | 8.0 | 3.76 | 6.55 | 149 | 142 | 146 | 2.38 | 502 | 177 |
| Bath tissue | Comparative | Bamboo/ Sugarcane | H | 8.3 | 3.32 | 5.55 | 142 | 136 | 139 | 2.80 | 374 | 162 |
| Bath tissue | Comparative | Wheat Straw | AA | 10.0 | 2.92 | 8.14 | 111.5 | 110 | 111 | 6.38 | 714 | 367 |
| Bath tissue | Comparative | Wheat Straw | BB | 9.0 | 3.46 | 9.25 | 113 | 94 | 104 | 6.84 | 723 | 374 |
| Bath tissue | Inventive | Bamboo | 16 | 9.0 | 3.98 | 7.83 | 72 | 72 | 72 | 8.34 | 895 | 457 |
| Bath tissue | Inventive | Bamboo | 18 | 9.3 | 3.90 | 8.22 | 68 | 68 | 68 | 7.27 | 672 | 391 |
| Bath tissue | Inventive | Bamboo | 19 | 9.3 | 4.07 | 7.23 | 64 | 66 | 65 | 6.89 | 1027 | 367 |
| Bath tissue | Inventive | Bamboo | 22 | 9.4 | 2.98 | 5.27 | 58 | 57 | 57 | 8.23 | 925 | 491 |
| Bath tissue | Inventive | Bamboo | 25 | 8.9 | 2.98 | 5.53 | 74 | 67 | 71 | 5.60 | 779 | 261 |
| Bath tissue | Inventive | Bamboo | 26 | 10.0 | 3.27 | 6.54 | 68 | 67 | 68 | 6.07 | 850 | 291 |
| Bath tissue | Traditional | | 76 | 9.7 | 3.20 | 6.14 | 78 | 79 | 79 | 8.93 | 834 | 527 |
| Bath tissue | Inventive | Bamboo | 27 | 9.6 | 2.99 | 6.23 | 67 | 65 | 66 | 5.74 | 806 | 285 |
| Bath tissue | Inventive | Bamboo | 20 | | | | 60 | 56 | 58 | | | |
| Bath tissue | Inventive | Bamboo | 21 | | | | | | | | | |
| Bath tissue | Inventive | Bamboo | 21 | | | | 64 | 62 | 63 | | | |
| Bath tissue | Inventive | Bamboo | 23 | | | | 69 | 63 | 66 | | | |
| Bath tissue | Inventive | Bamboo | 24 | | | | 52 | 50 | 51 | | | |
| Towel | Inventive | Abaca | 58 | | | | | | | | | |
| Towel | Inventive | Abaca | 55 | 19.2 | 4.10 | 10.12 | 47 | 47 | 47 | | | |
| Towel | Inventive | Abaca | 57 | 19.3 | 4.13 | 10.07 | 48 | 47 | 48 | | | |
| Towel | Inventive | Abaca | 61 | 17.4 | 3.66 | 7.97 | 38 | 38 | 38 | | | |
| Towel | Inventive | Abaca | 64 | 18.0 | 3.70 | 8.07 | 37 | 38 | 37 | | | |
| Towel | Inventive | Bamboo | 10 | 18.9 | 3.70 | 8.59 | 51 | 50 | 51 | | | |
| Towel | Inventive | Bamboo | 12 | | | | | | | | | |
| Towel | Inventive | Bamboo | 14 | 20.9 | 4.03 | 9.70 | 47 | 43 | 45 | | | |
| Bath tissue | Inventive | Abaca | 31 | 9.3 | 3.33 | 6.83 | 76 | 76 | 76 | | | |
| Bath tissue | Traditional | | 73 | 12.4 | 4.55 | 8.97 | 74 | 72 | 73 | | | |
| Bath tissue | Inventive | Abaca | 39 | 12.1 | 4.36 | 8.19 | 55 | 53 | 54 | | | |
| Towel | Comparative | Bamboo/ Sugarcane | U | 8.3 | 4.49 | 6.88 | 120 | 115.5 | 118 | | | |
| Towel | Comparative | Bamboo | V | 10.1 | 4.12 | 6.22 | 99 | 102 | 100 | | | |
| Towel | Comparative | Bamboo | W | 8.8 | 3.02 | 5.67 | 67.5 | 71 | 69 | | | |
| Towel | Comparative | Bamboo/ Sugarcane | X | 7.7 | 2.28 | 4.77 | 121 | 118 | 120 | | | |
| Towel | Comparative | Bamboo | Y | 7.8 | 1.98 | 3.81 | 102 | 101 | 102 | | | |

FIG. 23B

| Sample ID | Type | Non-wood | Substrate | Basis Weight | Compressive Modulus slope | Dry Caliper | Wet Caliper | Peak Load CD Tensile | CD Elongation (dry) | CD TEA | CD Modulus |
|---|---|---|---|---|---|---|---|---|---|---|---|
| 1 | Inventive | Bamboo | Bath tissue | 33.3 | -7.8 | 22.6 | | 190 | 11.4 | 13.2 | 784 |
| 2 | Inventive | Bamboo | Bath tissue | 32.9 | -7.8 | 22.2 | | 188 | 11.4 | 13.0 | 769 |
| 3 | Inventive | Bamboo | Bath tissue | 33.0 | -8.1 | 22.6 | | 212 | 11.1 | 14.0 | 900 |
| 4 | Inventive | Bamboo | Bath tissue | 33.7 | -8.6 | 22.3 | | 256 | 11.4 | 17.7 | 1120 |
| 5 | Inventive | Bamboo | Bath tissue | 33.0 | -8.8 | 23.0 | | 180 | 11.6 | 12.7 | 705 |
| 6 | Inventive | Bamboo | Bath tissue | 33.7 | -8.6 | 22.6 | | 181 | 11.9 | 13.3 | 739 |
| 7 | Inventive | Bamboo | Bath tissue | 33.3 | -9.0 | 22.4 | | 184 | 11.6 | 13.0 | 756 |
| 8 | Inventive | Bamboo | Bath tissue | 33.0 | -8.8 | 22.2 | | 182 | 11.8 | 13.3 | 746 |
| 15 | Inventive | Bamboo | Bath tissue | 31.2 | -9.4 | 20.7 | | 206 | 14.2 | 16.7 | 697 |
| 16 | Inventive | Bamboo | Bath tissue | 32.7 | -9.7 | 20.6 | | 233 | 12.9 | 17.0 | 870 |
| 17 | Inventive | Bamboo | Bath tissue | 32.7 | -9.4 | 21.0 | | 229 | 12.3 | 15.9 | 886 |
| 18 | Inventive | Bamboo | Bath tissue | 32.0 | -8.4 | 20.1 | | 194 | 12.2 | 13.4 | 755 |
| 19 | Inventive | Bamboo | Bath tissue | 32.8 | -9.1 | 20.9 | | 260 | 11.4 | 17.1 | 1135 |
| 20 | Inventive | Bamboo | Bath tissue | 28.7 | -6.0 | 22.8 | | 166 | 14.5 | 13.7 | 549 |
| 21 | Inventive | Bamboo | Bath tissue | 31.1 | -5.5 | 23.1 | | 179 | 11.8 | 12.0 | 732 |
| 22 | Inventive | Bamboo | Bath tissue | 31.0 | -5.5 | 23.1 | | 171 | 14.4 | 14.1 | 561 |
| 23 | Inventive | Bamboo | Bath tissue | 31.5 | -5.6 | 23.7 | | 223 | 11.3 | 14.1 | 945 |
| 24 | Inventive | Bamboo | Bath tissue | 32.3 | -5.9 | 24.7 | | 177 | 15.2 | 15.6 | 589 |
| 25 | Inventive | Bamboo | Bath tissue | 34.7 | -5.4 | 23.4 | | 247 | 15.0 | 20.8 | 751 |
| 26 | Inventive | Bamboo | Bath tissue | 30.2 | -4.8 | 21.6 | | 225 | 14.9 | 18.8 | 703 |
| 27 | Inventive | Bamboo | Bath tissue | 29.9 | -6.1 | 21.5 | | 194 | 12.5 | 13.6 | 761 |
| 28 | Inventive | Abaca | Bath tissue | 34.7 | -9.0 | 24.3 | | 264 | 9.6 | 15.2 | 1220 |
| 29 | Inventive | Abaca | Bath tissue | 33.6 | -9.0 | 23.5 | | 246 | 9.7 | 14.3 | 1149 |
| 30 | Inventive | Abaca | Bath tissue | 33.1 | -8.7 | 24.1 | | 235 | 11.1 | 15.3 | 897 |
| 31 | Inventive | Abaca | Bath tissue | 34.3 | -7.7 | 24.1 | | 257 | 10.5 | 16.6 | 1170 |
| 32 | Inventive | Abaca | Bath tissue | 33.0 | -7.3 | 23.8 | | 234 | 10.9 | 15.7 | 1003 |
| 33 | Inventive | Abaca | Bath tissue | 32.6 | -9.0 | 24.7 | | 234 | 10.3 | 15.2 | 1081 |
| 34 | Inventive | Abaca | Bath tissue | 24.7 | -7.9 | 20.7 | | 307 | 9.7 | 17.2 | 1261 |
| 35 | Inventive | Abaca | Bath tissue | 24.8 | -8.0 | 20.9 | | 295 | 9.6 | 16.5 | 1240 |
| 36 | Inventive | Abaca | Bath tissue | 25.1 | -7.2 | 23.1 | | 293 | 9.2 | 15.7 | 1283 |
| 37 | Inventive | Abaca | Bath tissue | 24.5 | -8.1 | 22.5 | | 254 | 10.4 | 15.7 | 1035 |
| 38 | Inventive | Abaca | Bath tissue | 24.5 | -6.5 | 20.0 | | 297 | 9.0 | 15.9 | 1396 |
| 39 | Inventive | Abaca | Bath tissue | 24.8 | -6.7 | 21.6 | | 283 | 10.0 | 17.1 | 1250 |
| 40 | Inventive | Unbleached Bamboo | Bath tissue | 29.0 | -4.87 | 21.1 | | 149 | | | |
| 41 | Inventive | Hemp | Bath tissue | 28.9 | -5.17 | 20.7 | | 310 | | | |
| 42 | Inventive | Bagasse | Bath tissue | 28.6 | -4.27 | 20.8 | | 198 | | | |
| 43 | Inventive | Cotton | Bath tissue | 29.6 | -6.10 | 21.4 | | 128 | | | |
| 44 | Inventive | Bleached Bamboo | Bath tissue | 29.8 | -5.03 | 23.5 | | 385 | 10.5 | 22.4 | 1874 |

FIG. 24A

| Sample ID | Peak Load MD Tensile | MD Elongation (dry) | MD TEA | MD Modulus | Total Dry Tensile | Geometric Mean (GM) Dry Modulus | Tensile Ratio | Flexural Rigidity-MD mg-cm | Flexural Rigidity-CD mg-cm | Flexural Rigidity-Avg mg-cm |
|---|---|---|---|---|---|---|---|---|---|---|
| 1 | 297 | 21.5 | 36.9 | 747 | 487 | 765 | 1.57 | | | |
| 2 | 259 | 19.2 | 29.9 | 747 | 447 | 758 | 1.38 | | | |
| 3 | 293 | 20.7 | 35.3 | 770 | 505 | 832 | 1.38 | | | |
| 4 | 340 | 20.9 | 41.9 | 897 | 596 | 1002 | 1.33 | | | |
| 5 | 262 | 20.4 | 31.1 | 673 | 443 | 689 | 1.45 | | | |
| 6 | 250 | 20.5 | 30.6 | 656 | 431 | 696 | 1.38 | | | |
| 7 | 263 | 20.4 | 30.9 | 628 | 446 | 689 | 1.43 | | | |
| 8 | 251 | 19.0 | 28.5 | 691 | 433 | 718 | 1.38 | | | |
| 15 | 294 | 18.7 | 31.7 | 842 | 500 | 766 | 1.43 | 42.4 | 46.3 | 44.3 |
| 16 | 339 | 18.2 | 35.7 | 962 | 572 | 914 | 1.46 | 45.6 | 52.3 | 49.0 |
| 17 | 345 | 19.9 | 38.5 | 875 | 573 | 880 | 1.51 | 48.9 | 57.2 | 53.0 |
| 18 | 299 | 17.6 | 29.5 | 845 | 493 | 797 | 1.55 | 44.2 | 50.0 | 47.1 |
| 19 | 354 | 23.1 | 45.1 | 777 | 614 | 939 | 1.36 | 51.9 | 71.5 | 61.7 |
| 20 | 346 | 24.1 | 49.0 | 1044 | 512 | 756 | 2.09 | 225.6 | 94.2 | 159.9 |
| 21 | 345 | 22.8 | 43.3 | 877 | 523 | 801 | 1.93 | 201.9 | 117.8 | 159.9 |

FIG. 24B-1

| | | | | | | | | | | |
|---|---|---|---|---|---|---|---|---|---|---|
| 22 | 339 | 25.8 | 52.5 | 1002 | 509 | 750 | 1.99 | 263.7 | 121.8 | 192.7 |
| 23 | 370 | 26.1 | 53.2 | 907 | 593 | 915 | 1.66 | 256.9 | 186.3 | 221.6 |
| 24 | 281 | 20.5 | 39.0 | 1310 | 458 | 878 | 1.59 | 338.1 | 150.2 | 244.1 |
| 25 | 295 | 19.5 | 38.4 | 1012 | 541 | 872 | | 207.2 | 139.9 | 173.5 |
| 26 | 287 | 20.4 | 39.4 | 1000 | 512 | 837 | | 221.7 | 138.0 | 179.8 |
| 27 | 269 | 29.0 | 45.2 | 636 | 463 | 693 | 1.39 | | | |
| 28 | 363 | 25.5 | 54.3 | 866 | 627 | 1028 | 1.37 | 64.8 | 98.0 | 81.4 |
| 29 | 345 | 24.9 | 51.0 | 861 | 591 | 994 | 1.40 | 58.7 | 80.1 | 69.4 |
| 30 | 338 | 24.1 | 48.4 | 892 | 573 | 893 | 1.44 | 57.5 | 70.7 | 64.1 |
| 31 | 387 | 27.2 | 59.6 | 842 | 645 | 992 | 1.51 | 58.5 | 82.5 | 70.5 |
| 32 | 378 | 25.8 | 55.8 | 918 | 612 | 959 | 1.62 | 56.4 | 66.8 | 61.6 |
| 33 | 344 | 25.1 | 49.7 | 843 | 579 | 954 | 1.47 | 52.2 | 68.7 | 60.5 |
| 34 | 537 | 19.4 | 56.7 | 1348 | 844 | 1303 | 1.75 | 248.0 | 201.2 | 224.6 |
| 35 | 515 | 19.3 | 54.2 | 1320 | 810 | 1279 | 1.74 | 243.3 | 201.4 | 222.3 |

FIG. 24B-2

| | | | | | | | | | | |
|---|---|---|---|---|---|---|---|---|---|---|
| 36 | 504 | 19.7 | 54.7 | 1298 | 797 | 1290 | 1.72 | 273.9 | 226.5 | 250.2 |
| 37 | 463 | 18.9 | 48.7 | 1272 | 717 | 1146 | 1.82 | 249.0 | 208.2 | 228.6 |
| 38 | 530 | 18.6 | 54.5 | 1447 | 827 | 1420 | 1.79 | 251.1 | 207.5 | 229.3 |
| 39 | 519 | 19.5 | 55.3 | 1335 | 802 | 1291 | 1.83 | 273.8 | 199.3 | 236.5 |
| 40 | 254 | | | | 403 | 195 | 1.71 | | | |
| 41 | 421 | | | | 731 | 361 | 1.36 | | | |
| 42 | 302 | | | | 500 | 245 | 1.53 | | | |
| 43 | 265 | | | | 393 | 184 | 2.08 | | | |
| 44 | 491 | 19.0 | 49.3 | 1236 | 876 | 435 | 1.28 | | | |

FIG. 24B-3

| Sample ID | L | A | B | Lint-outside | Lint-Average | HFS g/sht | HFS g/g | VFS g/sht | VFS g/g | CRT capacity g/g | CRT capacity g/in | CRT rate g/s | Residual Water (%) | Wet Burst Strength | Wet Burst Strength/ Total Dry Tensile |
|---|---|---|---|---|---|---|---|---|---|---|---|---|---|---|---|
| 1 | 97.0 | -0.8 | 3.6 | 9.6 | 9.1 | 11.1 | 19.5 | 6.2 | 11.0 | | | | | | |
| 2 | 96.9 | -0.9 | 3.7 | 7.9 | 7.9 | 10.8 | 18.7 | 6.0 | 10.3 | | | | | | |
| 3 | 96.9 | -0.7 | 3.4 | 9.1 | 9.3 | 10.7 | 18.4 | 6.0 | 10.3 | | | | | | |
| 4 | 96.9 | -0.8 | 3.6 | 7.5 | 8.0 | 10.5 | 17.6 | 5.7 | 9.6 | | | | | | |
| 5 | 96.8 | -0.7 | 3.5 | 9.6 | 9.4 | 11.5 | 19.8 | 6.4 | 11.0 | | | | | | |
| 6 | 96.8 | -0.7 | 3.5 | 9.6 | 9.4 | 11.5 | 19.4 | 6.5 | 11.0 | | | | | | |
| 7 | 96.8 | -0.8 | 3.6 | 9.5 | 9.0 | 11.1 | 18.5 | 6.4 | 10.6 | | | | | | |
| 8 | 96.8 | -0.8 | 3.6 | 9.2 | 9.2 | 11.3 | 19.3 | 6.3 | 10.8 | | | | | | |
| 15 | 96.7 | -0.9 | 3.8 | 10.1 | 10.0 | 10.2 | 19.8 | 5.8 | 11.2 | | | | | 33 | 0.065 |
| 16 | 96.9 | -0.9 | 3.8 | 8.8 | 8.7 | 9.6 | 17.9 | 5.5 | 10.3 | | | | | 39 | 0.068 |
| 17 | 96.7 | -0.7 | 3.5 | 9.4 | 9.4 | 9.7 | 17.9 | 5.5 | 10.2 | | | | | 36 | 0.063 |
| 18 | 96.8 | -0.9 | 3.7 | 10.3 | 10.1 | 9.4 | 17.8 | 5.3 | 10.1 | | | | | 31 | 0.063 |
| 19 | 96.5 | -0.9 | 3.7 | 4.7 | 4.9 | 8.9 | 16.1 | 5.1 | 9.2 | | | | | 36 | 0.058 |
| 20 | 96.7 | -0.8 | 3.0 | 6.1 | 7.1 | 11.0 | 17.5 | 6.2 | 9.8 | | | | | 40 | 0.078 |

FIG. 24C-1

| | | | | | | | | | | | | | | | |
|---|---|---|---|---|---|---|---|---|---|---|---|---|---|---|---|
| 21 | 96.7 | -0.6 | 2.6 | 7.1 | 7.3 | 10.5 | 16.6 | 5.8 | 9.2 | | | | | 45 | 0.086 |
| 22 | 96.7 | -0.8 | 3.1 | 6.8 | 6.5 | 11.7 | 18.3 | 6.6 | 10.3 | | | | | 41 | 0.080 |
| 23 | 96.5 | -0.9 | 2.6 | 5.1 | 4.4 | 10.5 | 15.6 | 5.8 | 8.6 | | | | | 33 | 0.056 |
| 24 | 96.3 | -0.7 | 2.3 | 3.5 | 3.5 | 11.3 | 17.4 | 6.5 | 10.1 | | | | | 25 | 0.054 |
| 25 | 96.7 | -0.9 | 4.1 | | | 11.8 | 20.8 | 6.7 | 11.8 | | | | | 34 | 0.063 |
| 26 | 96.5 | -1.1 | 4.0 | | | 10.6 | 21.2 | 6.4 | 12.6 | | | | | 34 | 0.066 |
| 27 | | | | 5.2 | 5.1 | 9.7 | 18.9 | 5.5 | 10.7 | | | | | 38 | 0.083 |
| 28 | 96.5 | -0.8 | 4.3 | 10.2 | 10.8 | 11.6 | 20.1 | 6.4 | 11.2 | | | | | 34 | 0.054 |
| 29 | 96.0 | -0.6 | 4.6 | 8.4 | 8.6 | 11.8 | 20.9 | 6.3 | 11.2 | | | | | 37 | 0.062 |
| 30 | 95.8 | -0.6 | 4.6 | 9.8 | 8.7 | 12.5 | 22.6 | 6.6 | 12.0 | | | | | 37 | 0.064 |
| 31 | 95.2 | -0.6 | 5.4 | 7.9 | 8.0 | 12.2 | 20.6 | 6.7 | 11.3 | | | | | 38 | 0.059 |
| 32 | 95.2 | -0.5 | 5.4 | 8.3 | 8.4 | 12.1 | 21.9 | 6.5 | 11.8 | | | | | 40 | 0.065 |
| 33 | 95.3 | -0.6 | 5.2 | 8.2 | 8.4 | 12.6 | 23.0 | 6.6 | 12.0 | | | | | 39 | 0.068 |
| 34 | 95.8 | -0.4 | 3.3 | 3.3 | 3.1 | 10.5 | 25.4 | 5.3 | 12.9 | | | | | 47 | 0.056 |
| 35 | 95.5 | -0.4 | 3.7 | 2.9 | 3.0 | 10.4 | 25.1 | 5.3 | 12.7 | | | | | 44 | 0.054 |

FIG. 24C-2

| | | | | | | | | | | | | | | | |
|---|---|---|---|---|---|---|---|---|---|---|---|---|---|---|---|
| 36 | 95.1 | -0.2 | 4.1 | 3.0 | 3.1 | 10.4 | 24.3 | 5.4 | 12.6 | | | | | 43 | 0.054 |
| 37 | 95.1 | -0.6 | 4.3 | 4.6 | 4.6 | 10.7 | 25.2 | 5.4 | 12.8 | | | | | 52 | 0.073 |
| 38 | 94.6 | -0.1 | 5.0 | 3.0 | 3.1 | 9.6 | 23.2 | 4.9 | 12.0 | | | | | 41 | 0.049 |
| 39 | 94.6 | -0.1 | 4.9 | 3.0 | 3.1 | 9.9 | 23.7 | 5.1 | 12.1 | | | | | 39 | 0.049 |
| 40 | | | | 7.5 | 7.2 | 11.1 | 21.2 | 6.5 | 12.5 | | | | | 27 | 0.067 |
| 41 | | | | 2.5 | 2.7 | 11.3 | 21.7 | 6.2 | 11.9 | | | | | 43 | 0.058 |
| 42 | | | | 2.9 | 2.9 | 11.4 | 22.2 | 6.5 | 12.6 | | | | | 30 | 0.060 |
| 43 | | | | 8.0 | 7.8 | 12.5 | 24.0 | 6.8 | 13.0 | | | | | 28 | 0.072 |
| 44 | | | | 2.8 | | 11.5 | 20.8 | 6.4 | 11.5 | | | | | 37 | 0.042 |

FIG. 24C-3

| Sample ID | CD Wet Tensile Strength-Finch | CD Wet Peak Elongation-Finch | CD Wet Peak TEA-Finch | MD Wet Tensile Strength-Finch | MD Wet Peak Elongation-Finch | MD Wet Peak TEA-Finch | Total Wet Tensile-Finch | Total Wet Tensile Decay-Finch | SST |
|---|---|---|---|---|---|---|---|---|---|
| 1 | 19.0 | 12.9 | 1.9 | 30.3 | 13.9 | 2.7 | 49.3 | | 0.38 |
| 2 | 17.7 | 12.0 | 1.7 | 25.3 | 12.7 | 2.1 | 43.0 | | 0.38 |
| 3 | 20 | 12.3 | 1.9 | 30 | 14.7 | 2.8 | 50.7 | | 0.41 |
| 4 | 23 | 12.5 | 2.1 | 34 | 15.1 | 3.1 | 57.7 | | 0.38 |
| 5 | 17 | 12.0 | 1.7 | 27 | 13.6 | 2.4 | 44.0 | | 0.43 |
| 6 | 16 | 12.5 | 1.7 | 24 | 12.5 | 2.1 | 40.3 | | 0.41 |
| 7 | 18 | 12.3 | 1.8 | 28 | 13.1 | 2.4 | 46.3 | | 0.42 |
| 8 | 18 | 12.9 | 1.8 | 26 | 14.2 | 2.4 | 44.3 | | 0.45 |
| 15 | 19 | 12.3 | 1.8 | 28 | 13.8 | 2.7 | 46.8 | 21.0 | 0.42 |
| 16 | 22 | 12.2 | 2.0 | 34 | 15.0 | 3.3 | 56.5 | 24.5 | 0.37 |
| 17 | 22 | 12.6 | 2.2 | 33 | 14.6 | 3.0 | 55.0 | 23.0 | 0.36 |
| 18 | 18 | 12.3 | 1.9 | 27 | 13.4 | 2.4 | 45.0 | 20.8 | 0.36 |
| 19 | 25 | 12.1 | 2.2 | 34 | 14.6 | 3.2 | 58.0 | 28.0 | 0.34 |
| 20 | 15 | 12.1 | 1.6 | 31 | 14.1 | 2.9 | 45.3 | 15.8 | 0.57 |
| 21 | 19 | 11.8 | 1.8 | 35 | 12.1 | 2.7 | 53.8 | 18.8 | 0.52 |

FIG. 24D-1

| | | | | | | | | | |
|---|---|---|---|---|---|---|---|---|---|
| 22 | 18 | 13.4 | 2.0 | 36 | 15.2 | 3.3 | 53.5 | 19.3 | 0.59 |
| 23 | 17 | 9.6 | 1.4 | 27 | 9.7 | 1.9 | 43.8 | 22.3 | 0.71 |
| 24 | 13 | 11.1 | 1.4 | 23 | 14.1 | 2.4 | 35.5 | 20.5 | 0.70 |
| 25 | 20 | 12.9 | 2.0 | 32 | 18.0 | 3.6 | | | |
| 26 | 23 | 13.9 | 2.4 | 35 | 19.9 | 4.2 | | | |
| 27 | 21 | 12.6 | 2.0 | 32 | 13.3 | 2.6 | 52.7 | | |
| 28 | 27 | 11.9 | 2.2 | 40 | 15.9 | 3.5 | 66.3 | 21.8 | 0.39 |
| 29 | 24 | 11.1 | 1.9 | 38 | 16.2 | 3.5 | 61.3 | 20.0 | 0.41 |
| 30 | 22 | 11.7 | 2.0 | 35 | 14.8 | 3.0 | 56.8 | 18.8 | 0.43 |
| 31 | 23 | 11.5 | 2.0 | 41 | 15.0 | 3.3 | 63.5 | 22.5 | 0.40 |
| 32 | 23 | 13.6 | 2.3 | 41 | 15.9 | 3.4 | 63.5 | 22.3 | 0.47 |
| 33 | 23 | 12.1 | 2.1 | 38 | 16.0 | 3.2 | 60.8 | 22.0 | 0.43 |
| 34 | 36 | 12.8 | 2.9 | 58 | 16.1 | 4.9 | 93.5 | 26.0 | 0.65 |
| 35 | 35 | 13.0 | 2.9 | 56 | 15.6 | 4.7 | 90.5 | 23.5 | 0.66 |

FIG. 24D-2

| | | | | | | | | | |
|---|---|---|---|---|---|---|---|---|---|
| 36 | 33 | 12.7 | 2.8 | 55 | 16.0 | 4.7 | 88.0 | 24.3 | 0.61 |
| 37 | 28 | 12.4 | 2.4 | 45 | 14.3 | 3.6 | 72.3 | 24.5 | 0.68 |
| 38 | 31 | 11.6 | 2.4 | 53 | 14.5 | 4.2 | 84.0 | 25.3 | 0.53 |
| 39 | 28 | 12.2 | 2.4 | 52 | 15.0 | 4.2 | 79.8 | 23.0 | 0.52 |
| 40 | | | | | | | 52 | 12.7 | |
| 41 | | | | | | | 66 | 16.0 | |
| 42 | | | | | | | 56 | 15.7 | |
| 43 | | | | | | | 53 | 13.0 | |
| 44 | 32 | 10.8 | 2.2 | 39 | 12.7 | 2.7 | 71 | 26.7 | |

FIG. 24D-3

| Sample ID | Stack Compressibility | Resilient Bulk | Stack Compressibility x Resilient Bulk | TS7 Avg | TS750 Avg | Plate Stiffness | Slip Stick CoF Avg | Kinetic CoF Avg | Bulk (cc/g) |
|---|---|---|---|---|---|---|---|---|---|
| 1 | 37.0 | 50.8 | 1881 | 5.2 | 36.4 | 1.9 | 346 | 0.96 | 10.6 |
| 2 | 36.0 | 50.2 | 1806 | 5.9 | 38.9 | 2.1 | 353 | 1.01 | 10.5 |
| 3 | 40.0 | 51.5 | 2063 | 5.6 | 37.8 | 2.1 | 333 | 1.02 | 10.7 |
| 4 | 35.9 | 49.3 | 1771 | 5.9 | 36.0 | 2.2 | 325 | 0.98 | 10.3 |
| 5 | 38.5 | 52.5 | 2020 | 5.3 | 36.8 | 1.9 | 387 | 1.07 | 10.9 |
| 6 | 38.9 | 51.3 | 1997 | 5.0 | 35.9 | 2.1 | 290 | 1.00 | 10.5 |
| 7 | 39.9 | 52.0 | 2074 | 5.3 | 34.9 | 2.1 | 282 | 0.98 | 10.5 |
| 8 | 37.2 | 51.6 | 1918 | 5.0 | 33.5 | 2.0 | 301 | 1.04 | 10.5 |
| 15 | 33.8 | 53.0 | 1792 | 5.1 | 31.0 | 1.8 | 331 | 1.00 | 10.3 |
| 16 | 34.2 | 51.2 | 1748 | 5.7 | 35.7 | 1.9 | 373 | 0.94 | 9.9 |
| 17 | 33.8 | 51.6 | 1743 | 5.5 | 32.5 | 2.1 | 368 | 1.04 | 10.0 |
| 18 | 33.9 | 51.4 | 1742 | 6.0 | 31.2 | 2.0 | 410 | 1.03 | 9.8 |
| 19 | 34.9 | 50.7 | 1770 | 7.9 | 34.0 | 2.1 | 537 | 1.03 | 9.9 |
| 20 | 30.3 | 65.9 | 1993 | 9.4 | 19.4 | 3.2 | 404 | 0.94 | 12.4 |
| 21 | 30.0 | 62.0 | 1859 | 9.3 | 26.1 | 3.1 | 371 | 0.90 | 11.6 |

FIG. 24E-1

| | | | | | | | | | |
|---|---|---|---|---|---|---|---|---|---|
| 22 | 29.0 | 63.0 | 1828 | 9.6 | 19.9 | 3.6 | 417 | 0.95 | 11.6 |
| 23 | 32.1 | 62.9 | 2016 | 9.3 | 17.6 | 3.9 | 491 | 0.99 | 11.7 |
| 24 | 31.9 | 65.4 | 2082 | 10.4 | 15.9 | 4.4 | 534 | 0.96 | 11.9 |
| 25 | 29.2 | 58.2 | 1697 | 9.3 | 23.5 | 3.2 | 465 | 1.06 | 10.5 |
| 26 | 28.2 | 60.1 | 1695 | 9.4 | 16.2 | 3.3 | 462 | 1.01 | 11.1 |
| 27 | 30.1 | 61.4 | 1847 | 10.0 | 16.9 | 3.2 | 463 | 1.02 | 11.2 |
| 28 | 33.4 | 56.2 | 1876 | 6.0 | 41.7 | 2.2 | 391 | 0.95 | 10.9 |
| 29 | 33.1 | 56.8 | 1882 | 5.9 | 39.6 | 2.1 | 373 | 0.96 | 10.9 |
| 30 | 37.6 | 57.5 | 2159 | 5.4 | 36.8 | 2.3 | 407 | 1.03 | 11.3 |
| 31 | 32.2 | 58.3 | 1878 | 5.8 | 39.6 | 2.5 | 410 | 0.99 | 10.9 |
| 32 | 34.1 | 59.1 | 2014 | 5.5 | 35.5 | 2.2 | 437 | 0.99 | 11.2 |
| 33 | 34.4 | 60.5 | 2081 | 5.2 | 34.8 | 2.1 | 378 | 1.02 | 11.8 |
| 34 | 43.0 | 67.2 | 2887 | 12.6 | 26.3 | 4.9 | 472 | 0.88 | 13.0 |
| 35 | 40.6 | 67.9 | 2756 | 12.1 | 26.6 | 4.8 | 452 | 0.93 | 13.2 |

FIG. 24E-2

| | | | | | | | | | |
|---|---|---|---|---|---|---|---|---|---|
| 36 | 41.4 | 68.6 | 2841 | 12.0 | 27.1 | 5.3 | 443 | 0.87 | 14.3 |
| 37 | 35.2 | 64.9 | 2283 | 10.7 | 23.3 | 5.2 | 450 | 0.89 | 14.3 |
| 38 | 36.4 | 66.7 | 2427 | 11.4 | 23.9 | 5.0 | 489 | 0.90 | 12.7 |
| 39 | 39.1 | 67.6 | 2640 | 11.4 | 22.7 | 4.7 | 464 | 0.87 | 13.5 |
| 40 | | | | | | | | | 11.4 |
| 41 | | | | | | | | | 11.2 |
| 42 | | | | | | | | | 11.4 |
| 43 | | | | | | | | | 11.3 |
| 44 | | | | | | | | | 12.3 |

FIG. 24E-3

| Sample ID | Type | Non-wood | Substrate | Basis Weight | Compressive Modulus slope | Dry Caliper | Wet Caliper | Peak Load CD Tensile | CD Elongation (dry) | CD TEA | CD Modulus |
|---|---|---|---|---|---|---|---|---|---|---|---|
| A.1 | Comparative | Bamboo | Bath Tissue | 17.2 | -4.0 | 8.9 | | 251 | 7.6 | 12.2 | 2119 |
| A.2 | Comparative | Bamboo | Bath Tissue | 16.4 | | | | 232 | 9.0 | 14.2 | 1953 |
| B.1 | Comparative | Bamboo | Bath Tissue | 27.1 | | | | 185 | 8.6 | 10.0 | 1308 |
| B.2 | Comparative | Bamboo | Bath Tissue | 26.3 | | 14.4 | | 178 | 8.5 | 9.5 | 1285 |
| E.1 | Comparative | Bamboo | Bath Tissue | 26.2 | | | | 218 | 11.5 | 15.7 | 1188 |
| F.1 | Comparative | Bamboo | Bath Tissue | 23.7 | -9.8 | 24.4 | | 226 | 11.3 | 9.8 | 534 |
| H.1 | Comparative | Bamboo/Sugar Cane | Bath Tissue | 20.5 | | 11.8 | | 151 | 3.4 | 5.8 | 1394 |
| I | Comparative | Bamboo | Bath Tissue | 18.1 | -4.1 | 12.7 | | 172 | 6.8 | 7.1 | 1561 |
| I.1 | Comparative | Bamboo | Bath Tissue | 18.2 | | | | 213 | 5.5 | 7.4 | 2148 |
| I.2 | Comparative | Bamboo | Bath Tissue | 18.1 | -4.6 | | | 148 | 8.3 | 8.0 | 1128 |
| I.3 | Comparative | Bamboo | Bath Tissue | 19.1 | | 11.9 | | 199 | 9.8 | 12.3 | 1322 |
| J | Comparative | Bamboo | Bath Tissue | 18.0 | | | | 180 | 5.1 | 5.3 | 1903 |
| K | Comparative | Bamboo/Sugar Cane | Bath Tissue | 28.4 | | 17.2 | | 212 | 9.3 | 12.2 | 1428 |
| M | Comparative | Bamboo/Sugar Cane | Bath Tissue | 27.0 | | 17.2 | | 411 | 4.8 | 11.6 | 3729 |
| N | Comparative | Bamboo | Bath Tissue | 27.2 | -4.3 | 15.0 | | 285 | 9.0 | 16.8 | 2056 |

FIG. 24F-1

| | | | | | | | | | | | |
|---|---|---|---|---|---|---|---|---|---|---|---|
| O | Comparative | Bamboo/Sugar Cane | Bath Tissue | 17.3 | | 11.1 | | 151 | 7.3 | 6.8 | 1193 |
| P | Comparative | Bamboo/Sugar Cane | Bath Tissue | 27.3 | | 23.2 | | 340 | 12.0 | 21.7 | 1134 |
| Q | Comparative | Bamboo/Sugar Cane | Bath Tissue | 25.7 | | 14.0 | | 162 | 6.8 | 6.4 | 1288 |
| Q.1 | Comparative | Bamboo | Bath Tissue | 27.4 | | | | 217 | 10.1 | 13.9 | 1392 |
| Q.2 | Comparative | Bamboo/Sugar Cane | Bath Tissue | 23.3 | | 14.8 | | 210 | 7.7 | 10.1 | 1587 |
| AA | Comparative | Wheat Straw | Bath Tissue | 29.6 | -5.2 | 17.8 | | 407 | 7.9 | 18.3 | 2289.8 |
| BB | Comparative | Wheat Straw | Bath Tissue | 30.2 | -3.4 | 19.0 | | 555 | 6.5 | 20.2 | 3232.9 |
| Z01 | Traditional | | Bath Tissue | 32.9 | -7.8 | 23.0 | | 216 | 11.8 | 15.4 | 847 |
| Z03 | Traditional | | Bath Tissue | 30.4 | -5.9 | 22.6 | | 189 | 10.5 | 11.3 | 860 |
| Z06 | Traditional | | Bath Tissue | 31.3 | -5.1 | 22.1 | | 198 | 9.4 | 10.6 | 994 |
| Z07 | Traditional | | Bath Tissue | 33.2 | -7.9 | 23.4 | | 221 | 10.2 | 13.4 | 964 |
| Z08 | Traditional | | Bath Tissue | 24.4 | -8.6 | 20.3 | | 298 | 10.6 | 18.2 | 1157 |
| Z09 | Traditional | | Bath Tissue | 28.6 | -4.37 | 21.8 | | 227 | | | |
| Z10 | Traditional | | Bath Tissue | 29.4 | -4.53 | 20.8 | | 251 | | | |
| Z11 | Traditional | | Bath Tissue | 29.8 | -6.43 | 23.5 | | 215 | 10.5 | 13.3 | 1176 |
| Z13 | Traditional | | Bath Tissue | 31.9 | -8.7 | 21.1 | | 242 | 12.1 | 16.0 | 914 |

FIG. 24F-2

| Sample ID | Peak Load MD Tensile | MD Elongation (dry) | MD TEA | MD Modulus | Total Dry Tensile | Geometric Mean (GM) Dry Modulus | Tensile Ratio | Flexural Rigidity-MD mg-cm | Flexural Rigidity-CD mg-cm | Flexural Rigidity-Avg mg-cm |
|---|---|---|---|---|---|---|---|---|---|---|
| A.1 | 687 | 63.3 | 233.4 | 1011 | 937 | 1460 | 2.74 | 44.2 | 59.3 | 51.8 |
| A.2 | 648 | 72.6 | 236.4 | 720 | 881 | 1186 | 2.79 | | | |
| B.1 | 817 | 22.0 | 96.3 | 1735 | 992 | 1487 | 4.41 | | | |
| B.2 | 792 | 22.9 | 105.3 | 1919 | 970 | 375 | 4.46 | 79.2 | 68.4 | 73.8 |
| E.1 | 708 | 57.0 | 203.1 | 778 | 926 | 960 | 3.25 | | | |
| F.1 | 248 | 19.4 | 25.8 | 622 | 475 | 576 | 1.10 | 112.8 | 40.3 | 76.6 |
| H.1 | 617 | 19.7 | 64.7 | 1425 | 768 | 1409 | 4.10 | 26.7 | 44.7 | 35.7 |
| I | 445 | 19.6 | 44.0 | 1004 | 618 | 1252 | 2.58 | 58.9 | 50.9 | 54.9 |
| I.1 | 359 | 22.4 | 51.0 | 1190 | 572 | 1599 | 1.68 | | | |
| I.2 | 332 | 19.4 | 35.8 | 853 | 480 | 979 | 2.24 | 30.5 | 46.2 | 38.4 |
| I.3 | 659 | 22.4 | 85.3 | 1719 | 858 | 1497 | 3.31 | 57.2 | 44.8 | 51.0 |
| J | 722 | 33.7 | 114.5 | 1030 | 902 | 1389 | 4.02 | | | |
| K | 935 | 39.2 | 169.6 | 1274 | 1147 | 1349 | 4.42 | 84.0 | 79.0 | 81.0 |
| M | 688 | 33.9 | 112.1 | 839 | 1099 | 1769 | 1.67 | 37.0 | 243.0 | 140.0 |

FIG. 24G-1

| | | | | | | | | | | |
|---|---|---|---|---|---|---|---|---|---|---|
| N | 699 | 18.1 | 78.9 | 2444 | 984 | 2239 | 2.45 | 114.7 | 83.0 | 98.9 |
| O | 421 | 33.0 | 76.9 | 943 | 572 | 1061 | 2.79 | 30.0 | 49.0 | 40.0 |
| P | | | | | | | | 194.2 | 76.4 | 135.3 |
| Q | 660 | 19.1 | 64.9 | 1574 | 822 | 1424 | 4.07 | 30.5 | 56.7 | 43.6 |
| Q.1 | | | | | | | | | | |
| Q.2 | 368 | 23.6 | 46.2 | 727 | 578 | 1074 | 1.75 | 65.0 | 89.6 | 77.3 |
| AA | 1111.0 | 14.4 | 83 | 2426 | 1518 | 2357 | 2.7 | 206.1 | 314.8 | 260.5 |
| BB | 1325.5 | 17.0 | 114 | 2638 | 1880 | 2920 | 2.4 | 238.4 | 391.8 | 315.1 |
| Z01 | 316 | 22.9 | 40.2 | 698 | 532 | 769 | 1.46 | | | |
| Z03 | 306 | 22.4 | 39.9 | 892 | 495 | 875 | 1.62 | 205.8 | 128.7 | 167.3 |
| Z06 | 340 | 25.4 | 46.2 | 741 | 538 | 858 | 1.72 | 170.5 | 164.9 | 167.7 |
| Z07 | 301 | 23.3 | 42.6 | 816 | 521 | 886 | 1.36 | 56.5 | 75.3 | 65.9 |
| Z08 | 516 | 19.5 | 54.4 | 1281 | 814 | 1217 | 1.73 | 234.4 | 183.2 | 208.8 |
| Z09 | 336 | | | | 562 | 276 | 1.48 | | | |
| Z10 | 315 | | | | 566 | 281 | 1.25 | | | |
| Z11 | 344 | 18.8 | 32.0 | 772 | 559 | 272 | 1.60 | | | |
| Z13 | 331 | 17.4 | 33.3 | 992 | 572 | 952 | 1.37 | 46.9 | 59.9 | 53.4 |

FIG. 24G-2

| Sample ID | L | A | B | Lint-outside | Lint-Average | HFS g/sht | HFS g/g | VFS g/sht | VFS g/g | CRT capacity g/g | CRT capacity g/in | CRT rate g/s | Residual Water (%) | Wet Burst Strength | Wet Burst Strength/ Total Dry Tensile |
|---|---|---|---|---|---|---|---|---|---|---|---|---|---|---|---|
| A.1 | 95.1 | -0.9 | 4.4 | 1.1 | 1.1 | 6.7 | 24.3 | 2.7 | 9.7 | | | | | 16 | 0.017 |
| A.2 | | | | | | | | | | | | | | | |
| B.1 | | | | | | | | | | | | | | | |
| B.2 | | | | 2.0 | | | | | | | | | | 10 | 0.010 |
| E.1 | | | | | | | | | | | | | | | |
| F.1 | | | | 5.4 | 4.9 | 7.4 | 18.5 | 3.4 | 8.7 | | | | | 16 | 0.033 |
| H.1 | | | | 1.0 | 1.0 | 5.0 | 17.6 | 2.3 | 8.1 | | | | | 9 | 0.011 |
| I | 93.9 | -0.9 | 5.6 | 1.3 | 1.3 | 6.4 | 20.9 | 2.5 | 8.3 | | | | | 4 | 0.007 |
| I.1 | | | | | | | | | | | | | | | |
| I.2 | | | | 1.2 | 1.2 | 7.2 | 23.6 | 2.9 | 9.6 | | | | | 3 | 0.006 |
| I.3 | | | | 1.1 | 1.1 | 6.3 | 18.6 | 2.9 | 8.5 | | | | | 4 | 0.005 |
| J | | | | | | | | | | | | | | | |
| K | | | | 1.4 | 1.4 | 8.7 | 4.2 | 17.5 | 8.5 | | | | | 9 | 0.008 |

FIG. 24H-1

| | | | | | | | | | | | | | | | |
|---|---|---|---|---|---|---|---|---|---|---|---|---|---|---|---|
| M | | | | 1.0 | 1.0 | 7.8 | 16.9 | 3.6 | 7.7 | | | | | 13 | 0.012 |
| N | 96.2 | -0.8 | 3.7 | 1.5 | 1.7 | 6.3 | 13.8 | 3.7 | 8.0 | | | | | 6 | 0.006 |
| O | | | | 1.0 | 1.0 | 6.8 | 22.6 | 2.6 | 8.7 | | | | | 5 | 0.009 |
| P | | | | 0.9 | 0.9 | 9.0 | 18.7 | 4.0 | 8.4 | | | | | 22 | |
| Q | | | | 2.3 | 2.3 | 6.7 | 15.7 | 3.4 | 8.1 | | | | | 9 | 0.011 |
| Q.1 | | | | | | | | | | | | | | | |
| Q.2 | | | | 3.7 | 3.7 | 8.4 | 19.8 | 3.7 | 8.7 | | | | | 3 | 0.005 |
| AA | 94.3 | -1.4 | 6.9 | 0.9 | 1.4 | | | | | | | | | 9.4 | 0.006 |
| BB | 94.3 | -1.4 | 7.2 | 0.2 | 0.5 | | | | | | | | | 7.2 | 0.004 |
| Z01 | 96.9 | -0.8 | 3.6 | 10.3 | 9.8 | 11.8 | 21.2 | 6.4 | 11.4 | | | | | | 0.000 |
| Z03 | 96.7 | -0.8 | 3.5 | 9.6 | 10.5 | 11.0 | 20.3 | 6.3 | 11.6 | | | | | 30 | 0.060 |
| Z06 | 96.8 | -0.9 | 3.4 | | | 11.0 | 20.6 | 6.1 | 11.5 | | | | | 29 | 0.053 |
| Z07 | 96.8 | -0.8 | 4.1 | 11.8 | 11.2 | 11.8 | 21.3 | 6.4 | 11.5 | | | | | 28 | 0.053 |
| Z08 | 96.1 | -0.5 | 3.0 | 3.5 | 3.4 | 11.0 | 26.8 | 5.5 | 13.4 | | | | | 45 | 0.056 |
| Z09 | | | | 7.7 | 7.6 | 10.9 | 20.9 | 6.6 | 12.7 | | | | | 30 | 0.053 |
| Z10 | | | | 7.3 | 7.6 | 11.8 | 22.3 | 6.4 | 12.0 | | | | | 26 | 0.046 |
| Z11 | | | | 7.1 | | 12.3 | 22.3 | 6.9 | 12.7 | | | | | 28 | 0.049 |
| Z13 | 96.8 | -0.7 | 3.3 | 9.7 | 10.1 | 10.4 | 19.5 | 5.9 | 11.1 | | | | | 34 | 0.059 |

FIG. 24H-2

| Sample ID | CD Wet Tensile Strength - Finch | CD Wet Peak Elongation - Finch | CD Wet Peak TEA - Finch | MD Wet Tensile Strength - Finch | MD Wet Peak Elongation - Finch | MD Wet Peak TEA - Finch | Total Wet Tensile - Finch | Total Wet Tensile Decay - Finch | SST |
|---|---|---|---|---|---|---|---|---|---|
| A.1 | 11 | 6.1 | 0.73 | 43 | 15.1 | 3.6 | 53.7 | | |
| A.2 | 10 | 5.6 | 0.63 | 38 | 15.3 | 3.5 | 48.0 | | |
| B.1 | 8 | 2.8 | 0.37 | 32 | 5.9 | 1.3 | 39.7 | | |
| B.2 | 7.3 | 2.6 | 0.40 | 21.3 | 5.1 | 0.9 | 28.6 | | |
| E.1 | 6 | 2.4 | 0.40 | 20 | 8.1 | 1.3 | 26.0 | | |
| F.1 | 13 | 5.1 | 0.77 | 14 | 12.4 | 1.6 | 27.3 | 19.0 | |
| H.1 | 6 | 1.6 | 0.37 | 16 | 5.8 | 0.8 | 21.7 | | |
| I | 8 | 3.4 | 0.43 | 13 | 4.4 | 0.7 | 21.3 | | |
| I.1 | 7 | 2.1 | 0.33 | 13 | 4.2 | 0.6 | 19.7 | | |
| I.2 | 3 | | 0.15 | 8 | 2.0 | 0.4 | 10.5 | | |
| I.3 | 4 | | 0.23 | 11 | 3.5 | 0.5 | 15.0 | | |
| J | 8 | 2.1 | 0.27 | 26 | 5.3 | 1.0 | 34.0 | | |
| K | 7 | 2.6 | 0.40 | 25 | 5.9 | 1.1 | 31.3 | | |
| M | 18 | 4.3 | 0.67 | 31 | 6.9 | 1.4 | 48.7 | | |
| N | 7 | 3.2 | 0.28 | 17 | 4.0 | 0.6 | 23.8 | 20.3 | |
| O | 5 | | 0.30 | 16 | 6.3 | 0.9 | 21.3 | | |
| P | 15 | 7.6 | 1.00 | 48 | 10.6 | 3.1 | 63.3 | | |
| Q | 5 | | 0.20 | 21 | 4.4 | 0.7 | 25.5 | | |
| Q.1 | 6 | 2.6 | 0.20 | 22 | 4.8 | 0.9 | 27.3 | | |
| Q.2 | 3 | 13.8 | 0.20 | 9 | 17.7 | 0.6 | 11.5 | | |
| AA | 7.4 | 2.5 | 0.3 | 20.3 | 5.3 | 1.0 | 27.7 | | |
| BB | 7.1 | 2.6 | 0.3 | 14.3 | 5.1 | 0.7 | 21.4 | | |
| Z01 | 22.0 | 12.9 | 2.1 | 33.0 | 14.5 | 2.9 | 55.0 | 22.0 | 0.44 |
| Z03 | 13 | 8.9 | 1.2 | 21 | 11.0 | 1.9 | 34.5 | 9.8 | 0.47 |
| Z06 | 21 | 10.3 | 1.7 | 37 | 11.6 | 2.6 | 57.3 | 17.0 | |
| Z07 | 21 | 11.7 | 1.9 | 31 | 16.3 | 3.0 | 52.3 | 17.0 | 0.35 |
| Z08 | 35 | 13.4 | 3.0 | 53 | 16.1 | 4.7 | 88.5 | 25.0 | 0.73 |
| Z09 | | | | | | | 60 | 16.7 | |
| Z10 | | | | | | | 57 | 14.7 | |
| Z11 | 21 | 11.5 | 1.6 | 30 | 13.5 | 2.1 | 52 | 15.3 | |
| Z13 | 23 | 11.7 | 2.0 | 34 | 14.5 | 3.1 | 56.5 | 22.8 | 0.38 |

FIG. 24I

| Sample ID | Stack Compressibility | Resilient Bulk | Stack Compressibility x Resilient Bulk | TS7 Avg | TS750 Avg | Plate Stiffness | Slip Stick CoF Avg | Kinetic CoF Avg | Bulk (cc/g) |
|---|---|---|---|---|---|---|---|---|---|
| A.1 | | | | | | | | | 8.1 |
| A.2 | | | | | | | | | |
| B.1 | | | | | | | | | |
| B.2 | 16.5 | 45.9 | | 16.7 | 22.2 | 1.49 | 647 | | 8.5 |
| E.1 | | | | | | | | | |
| F.1 | 44.8 | 59.0 | 2647 | 14.7 | 51.7 | 3.5 | 675 | 1.00 | 16.1 |
| H.1 | 15.6 | 47.5 | 741 | 15.0 | 25.2 | 1.4 | 587 | | 9.0 |
| I | | | | | | | | | 11.0 |
| I.1 | | | | | | | | | |
| I.2 | | | | | | | | | |
| I.3 | | | | | | | | | 9.7 |
| J | | | | | | | | | |
| K | 23.1 | 64.6 | 1492 | 19.8 | 58.3 | 2.3 | 907 | | 9.4 |
| M | 16.3 | 49.8 | 812 | 15.0 | 25.0 | 1.5 | 625 | | 10.0 |
| N | 17.67 | 45.85 | 810 | 22.2 | 66.9 | 4.12 | 940 | 1.01 | 8.6 |
| O | 13.3 | 52.6 | 700 | 26.6 | 30.2 | 1.2 | 741 | | 10.0 |
| P | 31.5 | 53.7 | 1692 | 25.7 | 100.1 | 3.6 | 920 | | 13.3 |
| Q | 10.8 | 34.6 | 374 | 18.5 | 22.4 | 1.1 | 486 | | 8.5 |
| Q.1 | | | | | | | | | |
| Q.2 | 13.6 | 46.1 | 627 | 15.2 | 23.1 | 1.2 | 543 | | 9.9 |
| AA | 10.2 | 50.8 | 518 | 21.8 | 51.6 | 7.0 | 529 | 0.69 | 9.4 |
| BB | 17.0 | 47.1 | 807 | 19.9 | 48.1 | 6.2 | 636 | 0.82 | 9.8 |
| Z01 | 35.8 | 52.0 | 1860 | 5.6 | 38.1 | 2.3 | 305 | 1.03 | 10.9 |
| Z03 | 28.9 | 63.9 | 1848 | 8.1 | 21.9 | 2.8 | 327 | 0.92 | 11.6 |
| Z06 | 28.2 | 60.5 | 1708 | 7.8 | 22.5 | 2.9 | 333 | 0.96 | 11.0 |
| Z07 | 34.2 | 57.3 | 1958 | 5.8 | 40.8 | 2.2 | 325 | 0.95 | 11.0 |
| Z08 | 44.3 | 68.6 | 3039 | 12.3 | 24.5 | 4.7 | 487 | 0.91 | 13.0 |
| Z09 | | | | | | | | | 11.9 |
| Z10 | | | | | | | | | 11.0 |
| Z11 | | | | | | | | | 12.3 |
| Z13 | 31.9 | 53.9 | 1719 | 5.4 | 35.8 | 2.0 | 303 | 0.92 | 10.3 |

FIG. 24J

| Sample ID | Type | Non-wood | Substrate | Basis Weight | Compressive Modulus slope | Dry Caliper | Wet Caliper | Peak Load CD Tensile | CD Elongation (dry) |
|---|---|---|---|---|---|---|---|---|---|
| 9 | Inventive | Bamboo | Towel | 35.0 | -10.8 | 45.9 | 35.2 | 855 | 12.3 |
| 10 | Inventive | Bamboo | Towel | 35.2 | -11.3 | 47.0 | 34.0 | 871 | 12.2 |
| 11 | Inventive | Bamboo | Towel | 35.1 | -10.9 | 51.2 | 35.2 | 904 | 12.9 |
| 12 | Inventive | Bamboo | Towel | 35.0 | -10.8 | 49.9 | 33.8 | 800 | 14.9 |
| 13 | Inventive | Bamboo | Towel | 34.5 | -10.7 | 48.3 | 31.3 | 794 | 12.2 |
| 14 | Inventive | Bamboo | Towel | 35.0 | -11.3 | 50.2 | 34.7 | 723 | 16.3 |
| 45 | Inventive | Bagasse | Towel | 33.2 | -8.07 | 32.3 | 29.6 | 644 | 13.5 |
| 46 | Inventive | Flax | Towel | 33.2 | -7.17 | 30.7 | 27.3 | 480 | 13.7 |
| 47 | Inventive | Hemp | Towel | 32.7 | -8.60 | 30.8 | 28.2 | 563 | 13.3 |
| 48 | Inventive | Unbleached Bamboo | Towel | 32.6 | -8.17 | 30.8 | 28.1 | 478 | 14.8 |
| 49 | Inventive | Abaca | Towel | 34.3 | -7.67 | 29.5 | 24.6 | 499 | 10.3 |
| 56 | Inventive | Abaca | Towel | 34.6 | -12.1 | 43.9 | 32.4 | 978 | 11.5 |
| 57 | Inventive | Abaca | Towel | 34.1 | -12.4 | 44.3 | 32.3 | 871 | 10.8 |
| 58 | Inventive | Abaca | Towel | 34.3 | -10.6 | 44.9 | 32.2 | 799 | 13.2 |
| 59 | Inventive | Abaca | Towel | 34.8 | -10.5 | 44.3 | 33.4 | 1081 | 12.2 |
| 60 | Inventive | Abaca | Towel | 34.6 | -10.8 | 44.4 | 32.6 | 1110 | 11.3 |
| 61 | Inventive | Abaca | Towel | 38.9 | -11.8 | 49.2 | 30.6 | 1061 | 9.1 |
| 62 | Inventive | Abaca | Towel | 38.8 | -12.4 | 49.0 | 32.0 | 961 | 9.9 |
| 63 | Inventive | Abaca | Towel | 39.2 | -12.1 | 49.4 | 32.5 | 961 | 9.9 |
| 64 | Inventive | Abaca | Towel | 38.2 | -13.4 | 49.9 | 34.3 | 998 | 10.2 |
| R | Comparative | | Towel | 28.9 | -4.6 | 24.3 | 8.93 | 311 | 7.2 |
| S | Comparative | Bamboo | Towel | 31.3 | -6.9 | 24.1667 | 13.6 | 442 | 6.2 |
| T | Comparative | Bamboo | Towel | 27.2 | -4.8 | 16.1667 | 8.3 | 1057 | 4.8 |
| U | Comparative | Bamboo/Sugar Cane | Towel | 32.7 | -5.7 | 20.9 | 11.2 | 720 | 4.7 |
| V | Comparative | Bamboo | Towel | 27.7 | -5.7 | 21.8 | 11.5 | 699 | 6.0 |
| W | Comparative | Bamboo | Towel | 34.2 | -5.4 | 25.6 | 13.4 | 509 | 6.3 |
| X | Comparative | Bamboo/Sugar Cane | Towel | 30.4 | -5.3 | 19.1 | 10.6 | 672 | 6.0 |
| Y | Comparative | Bamboo | Towel | 28.0 | 5.8 | 17.7 | 11.5 | 836 | 5.1 |
| Z02 | Traditional | | Towel | 35.5 | -11.3 | 46.4 | 35.9 | 935 | 12.7 |
| Z12 | Traditional | | Towel | 33.4 | -8.3 | 28.0 | 26.6 | 616 | 14.5 |
| Z14 | Traditional | | Towel | 34.1 | -11.5 | 45.2 | 30.6 | 1034 | 10.7 |
| Z15 | Traditional | | Towel | 34.8 | -11.3 | 47.0 | 34.6 | 1144 | 11.9 |
| Z16 | Traditional | | Towel | 39.0 | -14.2 | 50.3 | 35.2 | 840 | 11.2 |

FIG. 25A

| Sample ID | CD TEA | CD Modulus | Peak Load MD Tensile | MD Elongation (dry) | MD TEA | MD Modulus | Total Dry Tensile | Geometric Mean (GM) Dry Modulus | Tensile Ratio |
|---|---|---|---|---|---|---|---|---|---|
| 9 | 55.3 | 2289 | 1250 | 14.8 | 94.4 | 2043 | 2105 | 2163 | 1.46 |
| 10 | 56.3 | 2460 | 1250 | 16.3 | 104.3 | 1949 | 2121 | 2189 | 1.44 |
| 11 | 62.2 | 2434 | 1272 | 16.6 | 106.7 | 1893 | 2176 | 2146 | 1.41 |
| 12 | 66.0 | 2305 | 1131 | 16.0 | 94.4 | 2020 | 1931 | 2157 | 1.41 |
| 13 | 51.3 | 2349 | 1129 | 15.8 | 90.9 | 1866 | 1923 | 2093 | 1.42 |
| 14 | 65.0 | 1998 | 1218 | 15.5 | 98.8 | 2247 | 1942 | 2118 | 1.68 |
| 45 | 44.9 | 1970 | 587 | 18.7 | 56.7 | 1190 | 1231 | 615 | 0.91 |
| 46 | 33.8 | 1266 | 639 | 17.9 | 57.1 | 1116 | 1119 | 554 | 1.33 |
| 47 | 38.5 | 1605 | 733 | 18.8 | 68.5 | 1281 | 1295 | 642 | 1.30 |
| 48 | 38.5 | 1526 | 570 | 17.6 | 54.0 | 1311 | 1047 | 522 | 1.19 |
| 49 | 28.7 | 1982 | 813 | 16.1 | 65.3 | 1490 | 1312 | 637 | 1.63 |
| 56 | 65.7 | 3500 | 1705 | 15.2 | 131.7 | 2470 | 2683 | 2941 | 1.74 |
| 57 | 53.0 | 3229 | 1418 | 13.4 | 96.8 | 2482 | 2289 | 2831 | 1.63 |
| 58 | 60.5 | 2273 | 1292 | 17.8 | 112.9 | 1446 | 2090 | 1812 | 1.62 |
| 59 | 75.7 | 3234 | 1720 | 18.4 | 152.9 | 1868 | 2800 | 2457 | 1.59 |
| 60 | 70.9 | 3442 | 1600 | 18.2 | 144.7 | 1883 | 2771 | 2545 | 1.44 |
| 61 | 47.1 | 2842 | 1428 | 13.0 | 90.2 | 2269 | 2489 | 2539 | 1.35 |
| 62 | 47.0 | 2511 | 1338 | 13.1 | 88.4 | 2433 | 2300 | 2472 | 1.39 |
| 63 | 48.4 | 2601 | 1277 | 13.6 | 86.8 | 2226 | 2238 | 2407 | 1.33 |
| 64 | 51.1 | 2403 | 1377 | 13.4 | 92.1 | 2227 | 2375 | 2313 | 1.38 |
| R | 14.3 | 2653 | 773 | 12.6 | 51.1 | 2782 | 1084 | 2717 | 2.49 |
| S | 16.5 | 3280 | 1731 | 17.8 | 154.5 | 3367 | 2174 | 3323 | 3.9 |
| T | 30.8 | 9159 | 2062 | 22.7 | 244.9 | 4301 | 3119 | 6276 | 2.0 |
| U | 21.0 | 6481 | 1384 | 28.7 | 200.3 | 2248 | 2104 | 3808.6 | 1.9 |
| V | 24.3 | 4333 | 1786 | 35.9 | 284.3 | 1949 | 2485 | 2876.0 | 2.6 |
| W | 18.6 | 2876 | 1797 | 20.0 | 167.3 | 2654 | 2306 | 2762.7 | 3.5 |
| X | 22.5 | 4313 | 1535 | 30.1 | 252.6 | 2540 | 2207 | 3289.2 | 2.3 |
| Y | 25.0 | 6121 | 2291 | 27.7 | 286.9 | 3184 | 3127 | 4409.6 | 2.7 |
| Z02 | 63.1 | 2553 | 1373 | 14.7 | 102.5 | 2069 | 2308 | 2295 | 1.47 |
| Z12 | 46.3 | 1727 | 767 | 19.7 | 76.6 | 1285 | 1383 | 687 | 1.24 |
| Z14 | 60.1 | 3439 | 1368 | 12.9 | 86.1 | 2305 | 2401 | 1189 | 1.32 |
| Z15 | 73.6 | 3034 | 1525 | 18.6 | 136.8 | 1653 | 2669 | 1321 | 1.33 |
| Z16 | 46.8 | 1936 | 1309 | 12.9 | 84.2 | 2535 | 2149 | 2215 | 1.56 |

FIG. 25B

| Sample ID | Flexural Rigidity-MD mg-cm | Flexural Rigidity - CD mg-cm | Flexural Rigidity - Avg mg-cm | L | A | B | Lint-outside | Lint - Average | HFS g/sht | HFS g/g |
|---|---|---|---|---|---|---|---|---|---|---|
| 9 | 922.9 | 1356.5 | 1139.7 | | | | | | 55.4 | 23.9 |
| 10 | 902.2 | 1447.7 | 1174.9 | | | | | | 56.5 | 23.7 |
| 11 | 1091.1 | 1616.1 | 1353.6 | | | | | | 52.5 | 22.0 |
| 12 | 1382.6 | 1478.7 | 1430.6 | | | | | | 56.4 | 25.0 |
| 13 | 964.7 | 1438.3 | 1201.5 | | | | | | 55.9 | 25.4 |
| 14 | 1361.6 | 1420.2 | 1390.9 | | | | 1.5 | | 54.7 | 24.8 |
| 45 | | | | | | | 1.7 | | 92.3 | 23.6 |
| 46 | | | | | | | 1.5 | | 88.8 | 23.5 |
| 47 | | | | | | | 1.6 | | 90.7 | 24.3 |
| 48 | | | | | | | 2.6 | | 95.0 | 25.3 |
| 49 | | | | | | | | | 81.5 | 20.9 |
| 56 | 744.1 | 1209.5 | 977 | | | | | | 52.4 | 22.8 |
| 57 | 727.1 | 1003.3 | 865 | | | | | | 53.7 | 23.7 |
| 58 | | | 717 | | | | | | 51.2 | 22.4 |
| 59 | | | 1091 | | | | | | 51.5 | 22.0 |
| 60 | | | 1073 | | | | | | 49.2 | 21.5 |
| 61 | 845.7 | 1259.7 | 1052.7 | 92.0 | -0.5 | 5.8 | | | 57.5 | 22.2 |
| 62 | 865.8 | 1077.4 | 971.6 | 92.2 | -0.6 | 5.8 | | | 58.3 | 22.9 |
| 63 | 817.6 | 1162.2 | 989.9 | 92.6 | -0.6 | 5.6 | | | 59.6 | 22.7 |
| 64 | 755.7 | 1004.8 | 880.2 | 92.0 | -0.6 | 5.8 | | | 56.5 | 22.2 |
| R | | | | | | | | | 32.0 | 10.6 |
| S | 670.9 | 693.5 | 682.2 | | | | | | 23.0 | 12.4 |
| T | 242.0 | 617.0 | 429.S | | | | | | 20.8 | 11.3 |
| U | 167.0 | 591.1 | 379.0 | | | | | | 40.6 | 12.8 |
| V | 213.3 | 754.2 | 483.7 | | | | | | 27.8 | 15.1 |
| W | 350.7 | 486.6 | 418.6 | | | | | | 23.7 | 11.5 |
| X | 280.5 | 575.4 | 427.9 | | | | | | 26.7 | 12.6 |
| Y | 279.5 | 692.6 | 486.1 | | | | | | 23.3 | 12.3 |
| Z02 | 966.5 | 1683.6 | 1325.0 | | | | | | 58.6 | 24.0 |
| Z12 | | | | | | | 1.8 | | 85.0 | 22.9 |
| Z14 | 678.5 | 1203.8 | 941.2 | | | | | | 54.6 | 24.5 |
| Z15 | | | 1342 | | | | | | 52.9 | 23.4 |
| Z16 | 765.8 | 824.4 | 795.1 | 94.17 | -0.83 | 3.1 | | | 59.9 | 23.0 |

FIG. 25C

| Sample ID | VFS g/sht | VFS g/g | CRT capacity g/g | CRT capacity g/in | CRT rate g/s | Residual Water(%) | Wet Burst Strength | Wet Burst Strength/Total Dry Tensile | SST |
|---|---|---|---|---|---|---|---|---|---|
| 9 | 22.1 | 9.6 | 22.0 | 0.8 | 0.93 | 2.7 | 488 | 0.232 | 2.06 |
| 10 | 21.1 | 8.9 | 21.8 | 0.8 | 0.87 | 2.8 | 455 | 0.214 | 2.09 |
| 11 | 21.1 | 8.8 | 22.2 | 0.8 | 0.89 | 3.4 | 521 | 0.239 | 2.19 |
| 12 | 21.7 | 9.6 | 22.9 | 0.8 | 0.93 | 3.1 | 506 | 0.262 | 2.35 |
| 13 | 21.1 | 9.6 | 22.1 | 0.8 | 0.83 | 3.3 | 443 | 0.231 | 2.10 |
| 14 | 21.0 | 9.5 | 23.4 | 0.9 | 0.84 | 3.8 | 503 | 0.259 | 2.40 |
| 45 | 37.9 | 9.7 | 21.1 | | 0.51 | | 273 | 0.222 | |
| 46 | 36.6 | 9.7 | 21.0 | | 0.38 | | 292 | 0.261 | |
| 47 | 37.0 | 9.9 | 20.2 | | 0.44 | | 320 | 0.247 | |
| 48 | 39.1 | 10.4 | 21.6 | | 0.47 | | 233 | 0.223 | |
| 49 | 40.2 | 10.3 | 17.2 | | 0.38 | | 307 | 0.234 | |
| 56 | 21.2 | 9.2 | 19.0 | 0.67 | 0.58 | 2.5 | 692 | 0.258 | 1.69 |
| 57 | 19.9 | 8.8 | 19.6 | 0.69 | 0.62 | 2.6 | 553 | 0.242 | 1.80 |
| 58 | 20.9 | 9.1 | 18.9 | 0.67 | 0.60 | 2.5 | 481 | 0.230 | 1.58 |
| 59 | 20.6 | 8.8 | 18.6 | 0.67 | 0.58 | 2.7 | 634 | 0.226 | 1.67 |
| 60 | 20.0 | 8.7 | 18.3 | 0.65 | 0.57 | 2.7 | 533 | 0.192 | 1.61 |
| 61 | 24.0 | 9.2 | | 0.8 | 0.7 | 1.6 | 580 | 0.233 | 2.01 |
| 62 | 23.6 | 9.3 | | 0.8 | 0.7 | 1.7 | 539 | 0.234 | 2.06 |
| 63 | 24.6 | 9.4 | | 0.8 | 0.7 | 1.8 | 558 | 0.249 | 1.98 |
| 64 | 23.7 | 9.3 | | 0.8 | 0.8 | 1.7 | 565 | 0.238 | 1.99 |
| R | 14.1 | 4.7 | | | | | 50 | 0.046 | |
| S | 9.5 | 5.2 | 7.1 | 0.23 | 0.24 | 5.33 | 176.7 | 0.081 | |
| T | 9.0 | 4.9 | 5.4 | 0.15 | 0.13 | 12.1 | 98.3 | 0.032 | |
| U | 18.4 | 5.8 | 7.2 | 0.2 | 0.2 | 5.1 | 64.2 | 0.031 | 0.26 |
| V | 12.1 | 6.6 | 8.4 | 0.2 | 0.2 | 3.8 | 105.9 | 0.043 | 0.29 |
| W | 9.5 | 4.6 | 6.3 | 0.2 | 0.3 | 3.8 | 172.9 | 0.075 | 0.38 |
| X | 12.1 | 5.7 | 8.0 | 0.3 | 0.2 | 3.8 | 60.6 | 0.027 | 0.27 |
| Y | 11.4 | 6.0 | 7.7 | 0.2 | 0.2 | 6.4 | 93.4 | 0.030 | 0.27 |
| Z02 | 22.6 | 9.3 | 22.3 | 0.8 | 0.89 | 2.5 | 497 | 0.215 | 2.07 |
| Z12 | 37.9 | 10.2 | 19.6 | | 0.39 | | 282 | 0.204 | |
| Z14 | 21.0 | 9.4 | 18.5 | 0.64 | 0.66 | 2.8 | 488 | 0.203 | 1.73 |
| Z15 | 20.3 | 8.9 | 19.2 | 0.68 | 0.68 | 2.8 | 492 | 0.184 | 1.72 |
| Z16 | 24.1 | 9.3 | | 0.84 | 0.94 | 2.19 | 414 | 0.193 | 2.34 |

FIG. 25D

| Sample ID | Stack Compressibility | Resilient Bulk | Stack Compressibility x Resilient Bulk | TS7 Avg | TS750 Avg | Plate Stiffness | Slip Stick CoF Avg | Kinetic CoF Avg | Bulk (cc/g) |
|---|---|---|---|---|---|---|---|---|---|
| 9 | 70.6 | 100.4 | 7086 | 18.3 | 43.6 | 12.5 | 964 | 0.99 | 20.5 |
| 10 | 71.6 | 100.8 | 7218 | 17.8 | 43.0 | 13.8 | 812 | 0.94 | 20.8 |
| 11 | 76.9 | 108.6 | 8354 | 19.3 | 41.5 | 15.9 | 810 | 0.94 | 22.8 |
| 12 | 75.4 | 107.9 | 8140 | 19.9 | 45.0 | 15.2 | 766 | 0.91 | 22.3 |
| 13 | 69.8 | 97.6 | 6812 | 20.2 | 43.3 | 13.5 | 827 | 0.94 | 21.9 |
| 14 | 71.6 | 105.0 | 7514 | 20.3 | 49.7 | 15.2 | 808 | 0.90 | 22.4 |
| 45 | | | | | | | | | 15.2 |
| 46 | | | | | | | | | 14.4 |
| 47 | | | | | | | | | 14.7 |
| 48 | | | | | | | | | 14.8 |
| 49 | | | | | | | | | 13.4 |
| 56 | 73.4 | 96.7 | 7098 | 16.6 | 49.3 | 11.3 | 1329 | 1.311 | 19.8 |
| 57 | 72.3 | 99.9 | 7223 | 18.1 | 49.8 | 11.2 | 1034 | 1.129 | 20.3 |
| 58 | 68.8 | 97.1 | 6680 | 17.9 | 43.95 | 10.2 | 1227 | 1.181 | 20.4 |
| 59 | 66.6 | 99 | 6593 | 20.52 | 52.89 | 13.2 | 872 | 1.06 | 19.9 |
| 60 | 67.3 | 96.9 | 6521 | 19.53 | 50.82 | 13.6 | 1117 | 1.059 | 20.0 |
| 61 | 80.2 | 92.4 | 7415 | 12.50 | 47.46 | 14.0 | 932 | 1.247 | 19.7 |
| 62 | 80.6 | 91.5 | 7375 | 11.94 | 45.20 | 13.5 | 990 | 1.240 | 19.7 |
| 63 | 74.1 | 91.7 | 6792 | 12.66 | 50.83 | 13.2 | 910 | 1.140 | 19.7 |
| 64 | 79.9 | 92.5 | 7388 | 12.97 | 44.31 | 13.1 | 892 | 1.154 | 20.4 |
| R | | | | | | | | | 13.1 |
| S | | | | | | | | | 12.0 |
| T | | | | | | | | | 9.3 |
| U | 35.1 | 43.6 | 1533 | 25.86 | 95.12 | 6.6 | 573 | 0.732 | |
| V | 30.9 | 51.4 | 1588 | 32.97 | 132.16 | 7.0 | 808 | 0.754 | |
| W | 40.6 | 56.2 | 2282 | 30.51 | 242.26 | 11.1 | 711 | 0728 | |
| X | 27.3 | 42.4 | 1158 | 34.39 | 113.71 | 6.8 | 679 | 0.741 | |
| Y | 22.5 | 47.0 | 1057 | 24.74 | 87.06 | 7.6 | 764 | 0.749 | |
| Z02 | 72.7 | 97.8 | 7115 | 17.3 | 45.9 | 14.3 | 812 | 0.95 | 20.4 |
| Z12 | | | | | | | | | 13.1 |
| Z14 | 68.3 | 101.2 | 6913 | 15.7 | 62.2 | 11.6 | 899.0 | 1.17 | 20.7 |
| Z15 | 71 | 106.3 | 7547 | 19.5 | 53.67 | 14.0 | 1071 | 1.023 | 21.1 |
| Z16 | 80.3 | 86.2 | 6918 | 13.62 | 41.17 | 11.7 | 845 | 1.053 | 20.2 |

FIG. 25E

| Sample ID | Total Wet Tensile | Wet Tensile Geometric Mean Modulus (38.1g/in) | MD Wet Tensile Strength | CD Wet Tensile Strength | MD Wet Peak Elongation | CD Wet Peak Elongation | MD Wet Peak TEA | CD Wet Peak TEA | MD Wet Modulus (38.1g/in) | CD Wet Modulus (38.1g/in) |
|---|---|---|---|---|---|---|---|---|---|---|
| 9 | 723 | 401 | 424 | 299 | 23.2 | 18.4 | 37.5 | 22.9 | 380 | 423 |
| 10 | 730 | 404 | 419 | 311 | 23.0 | 19.3 | 37.4 | 25.3 | 389 | 420 |
| 11 | 770 | 395 | 451 | 319 | 24.0 | 19.2 | 40.6 | 25.7 | 372 | 420 |
| 12 | 738 | 370 | 428 | 310 | 23.5 | 22.6 | 38.5 | 29.8 | 375 | 364 |
| 13 | 713 | 390 | 423 | 290 | 22.9 | 19.3 | 36.0 | 23.9 | 374 | 406 |
| 14 | 774 | 347 | 472 | 302 | 24.6 | 24.8 | 43.5 | 32.2 | 359 | 335 |
| 45 | | | | | | | | | | |
| 46 | | | | | | | | | | |
| 47 | | | | | | | | | | |
| 48 | | | | | | | | | | |
| 49 | | | | | | | | | | |
| 56 | 854 | 464 | 555 | 299 | 21.7 | 17.6 | 45.6 | 24.5 | 428 | 502 |
| 57 | 782 | 440 | 491 | 291 | 21.3 | 18.9 | 38.4 | 26.2 | 420 | 460 |
| 58 | 704 | 390 | 440 | 263 | 24.7 | 21.7 | 38.5 | 28.7 | 363 | 420 |
| 59 | 979 | 442 | 606 | 373 | 24.1 | 19.3 | 48.9 | 34.4 | 382 | 512 |
| 60 | 914 | 459 | 526 | 388 | 24.6 | 17.2 | 46.9 | 29.7 | 380 | 554 |
| 61 | 936 | 569 | 534 | 402 | 18.8 | 13.8 | 37.5 | 24.5 | 502 | 646 |
| 62 | 858 | 525 | 489 | 370 | 19.0 | 15.7 | 34.9 | 26.6 | 477 | 578 |
| 63 | 838 | 521 | 481 | 357 | 20.0 | 15.4 | 36.5 | 24.7 | 473 | 574 |
| 64 | 826 | 522 | 474 | 352 | 18.7 | 15.3 | 33.4 | 23.8 | 484 | 563 |
| R | | | | | | | | | | |
| S | | | | | | | | | | |
| T | | | | | | | | | | |
| U | 232 | 421 | 144.8 | 87.6 | 14.1 | 8.8 | 8.5 | 3.9 | 325.5 | 544.4 |
| V | 295 | 385 | 194.0 | 101.1 | 17.8 | 11.4 | 14.2 | 6.4 | 306.9 | 481.8 |
| W | 426 | 494 | 332.0 | 93.8 | 15.4 | 10.8 | 20.0 | 5.7 | 519.8 | 470.2 |
| X | 205 | 336 | 135.5 | 69.5 | 16.6 | 8.2 | 9.9 | 3.0 | 255.3 | 443.0 |
| Y | 303 | 498 | 196.4 | 107.1 | 15.1 | 9.6 | 12.8 | 5.7 | 405.3 | 611.2 |
| Z02 | 733 | 420 | 431 | 303 | 21.6 | 18.9 | 36.2 | 24.8 | 416 | 424 |
| Z12 | | | | | | | | | | |
| Z14 | | | | | | | | | | |
| Z15 | 791 | 425 | 450 | 341 | 21.5 | 17.1 | 33.7 | 26.0 | 362 | 500 |
| Z16 | 660 | 450 | 390 | 270 | 18.0 | 16.3 | 25.9 | 18.7 | 452 | 447 |

FIG. 25F

| Fiber | Description | Sample IDs | Length-weighted Fiber Length L(l) | Fiber Width (microns) | Cell Wall Thickness (microns) | Coarseness mg/m | L/W | Fiber Count (million/g) number average | Fiber Count (million/g) length average | Instrument |
|---|---|---|---|---|---|---|---|---|---|---|
| Bamboo | Bleached | 1-19 | 1.42 | 18.7 | | 0.170 | 76 | 11.5 | 4.14 | Valmet FS5 |
| Bamboo | Bleached | 20-24 | 1.51 | 19.0 | | 0.200 | 80 | 14.0 | 3.31 | Valmet FS5 |
| Bamboo | Bleached | 25-27, 50-55 | 1.54 | 19.4 | | 0.210 | 80 | 13.5 | 3.09 | Valmet FS5 |
| Bamboo | Unbleached | | 1.51 | 19.1 | | 0.204 | 79 | 13.5 | 3.25 | Valmet FS5 |
| Hemp | Bleached | | 1.26 | 23.9 | 6.66 | 0.216 | 53 | 10.1 | 3.67 | Valmet FS5 |
| Hemp | Unbleached | | 1.26 | 25.5 | 5.09 | 0.211 | 49 | 10.4 | 3.76 | Valmet FS5 |
| Bagasse | Bleached | | 0.92 | 18.5 | 3.27 | 0.094 | 50 | 30.3 | 11.51 | Valmet FS5 |
| Abaca | Bleached | 28-39 | 2.55 | 22.5 | 5.46 | 0.170 | 114 | 7.5 | 2.31 | Valmet FS5 |
| NSK | | 1-39, 50-55 | 2.21 | 22.9 | 4.2 | 0.153 | 96 | 5.6 | 2.96 | Valmet FS5 |
| SSK | | | 2.38 | 27.5 | 5.2 | 0.246 | 87 | 4.3 | 1.71 | Valmet FS5 |
| Euc | | 1-39, 50-55 | 0.72 | 15.7 | 3.0 | 0.060 | 46 | 39.4 | 23.31 | Valmet FS5 |
| Wheat Straw | Never dried | | 0.839 | 20.69 | | | 41 | 14.3 | 5.30 | Valmet FS5 |
| Bamboo | Unbleached | 40, 48 | 0.88 | 16.7 | 7.3 | | 53 | | | Kajaani Fiber Lab |
| Bamboo | Unbleached | | 0.88 | 16.4 | 7.3 | 0.099 | 54 | 18.1 | 11.48 | Kajaani Fiber Lab |
| Bamboo | Bleached | 44 | 0.93 | 19.8 | 7.7 | | 47 | | | Kajaani Fiber Lab |
| NSK | | | 2.24 | 24.7 | 6.9 | 0.162 | 91 | | 2.75 | Kajaani Fiber Lab |
| SSK | | | 2.29 | 29.1 | 8.2 | 0.250 | 78 | | 1.75 | Kajaani Fiber Lab |
| SSK | | | 2.40 | 28.3 | 11.9 | 0.308 | 85 | 3.7 | 1.35 | Kajaani Fiber Lab |
| Hemp | | 41 | 0.96 | 19.0 | 7.1 | 0.101 | 51 | 17.7 | 10.31 | Kajaani Fiber Lab |
| Abaca | | 49 | 3.13 | 19.3 | 7.8 | 0.185 | 162 | 4.8 | 1.73 | Kajaani Fiber Lab |
| Bagasse | | 42, 45 | 0.96 | 19.0 | 7.1 | 0.101 | 51 | 15.4 | 10.31 | Kajaani Fiber Lab |
| Bamboo (edulis) | Bamboo | | 1.23 | 8.4 | | 0.105 | 146 | | 7.72 | Kajaani FS-100 or FS-200 |
| Bamboo (vulgaris) | Bamboo | | 2.09 | 10.9 | | 0.104 | 192 | | 4.61 | Kajaani FS-100 or FS-200 |
| Bamboo (nigra) | Bamboo | | 1.65 | 9.0 | | 0.109 | 183 | | 5.59 | Kajaani FS-100 or FS-200 |
| Bamboo | | | 1.3 | | | 0.092 | | | 8.39 | FQA |

FIG. 26

| | Sample ID | 26 | | 27 | | 16 | | 18 | | 19 | |
|---|---|---|---|---|---|---|---|---|---|---|---|
| Effective Radius | Direction | weight (mg) | 147 | weight (mg) | 149 | weight (mg) | 163 | weight (mg) | 156.2 | weight (mg) | 152.2 |
| | | Pore Vol. | Thickness | Pore Vol. | Thickness | Pore Vol. | Thickness | Pore Vol. | Thickness | Pore Vol. | Thickness |
| μm | | mg | μm | mg | μm | mg | μm | mg | μm | mg | μm |
| 2.5 | | 13 | 645 | 17.9 | 677 | 18.9 | 654 | 16.9 | 616 | 15.9 | 653 |
| 5 | | 19 | 652 | 23 | 686 | 23 | 663 | 21 | 624 | 21 | 663 |
| 10 | | 28 | 660 | 33 | 698 | 28 | 670 | 25 | 629 | 25 | 671 |
| 15 | | 61 | 672 | 66 | 717 | 139.9 | 707 | 29 | 634 | 100.9 | 719 |
| 20 | | 121.7 | 684 | 120.9 | 732 | 193.5 | 707 | 137.5 | 654 | 156.5 | 722 |
| 30 | | 196.9 | 684 | 191.9 | 734 | 279.1 | 707 | 221.9 | 664 | 236.9 | 722 |
| 40 | | 252.9 | 682 | 243.9 | 734 | 362.9 | 705 | 280.9 | 662 | 303.6 | 722 |
| 50 | | 289.9 | 680 | 276.9 | 733 | 422.8 | 703 | 342.8 | 659 | 346.8 | 721 |
| 60 | | 337 | 678 | 321.2 | 731 | 495.8 | 699 | 403.8 | 656 | 395.8 | 720 |
| 70 | | 402.8 | 675 | 386.8 | 730 | 572.8 | 697 | 483 | 654 | 461.8 | 719 |
| 80 | | 467.9 | 673 | 451.9 | 728 | 653.8 | 694 | 556.9 | 651 | 528.8 | 717 |
| 90 | | 534.9 | 671 | 520.9 | 727 | 723.8 | 692 | 639 | 649 | 588.8 | 716 |
| 100 | | 598.9 | 669 | 586.9 | 725 | 768.8 | 690 | 712.8 | 646 | 647.8 | 715 |
| 120 | | 724.9 | 666 | 720.8 | 722 | 900.7 | 687 | 837.7 | 643 | 755.7 | 712 |
| 140 | Advancing | 858.8 | 663 | 856 | 719 | 1013.7 | 685 | 953.7 | 640 | 857.7 | 710 |
| 160 | | 998.8 | 658 | 984.5 | 716 | 1110.6 | 683 | 1050.9 | 638 | 948.8 | 709 |
| 180 | | 1136.8 | 655 | 1108.7 | 714 | 1196.6 | 682 | 1143.6 | 637 | 1035.8 | 708 |
| 200 | | 1265.9 | 653 | 1220.7 | 712 | 1273.6 | 681 | 1221.6 | 636 | 1122.6 | 707 |
| 225 | | 1402.7 | 650 | 1341.7 | 710 | 1355.5 | 680 | 1306.5 | 635 | 1220.5 | 706 |
| 250 | | 1474.7 | 650 | 1421.6 | 710 | 1413.5 | 680 | 1392.9 | 635 | 1311.5 | 705 |
| 275 | | 1522.7 | 650 | 1484.6 | 710 | 1453.5 | 680 | 1427.5 | 635 | 1387.4 | 705 |
| 300 | | 1549.6 | 650 | 1533.6 | 710 | 1483.5 | 681 | 1460.5 | 635 | 1449.4 | 705 |
| 350 | | 1575 | 651 | 1602.6 | 710 | 1523.4 | 681 | 1502.4 | 636 | 1544.3 | 705 |
| 400 | | 1594.6 | 652 | 1647.5 | 710 | 1553.4 | 682 | 1523.4 | 637 | 1610.3 | 705 |
| 500 | | 1609.6 | 654 | 1705.5 | 712 | 1584.4 | 684 | 1544.4 | 639 | 1670.3 | 707 |
| 600 | | 1619.7 | 655 | 1739.6 | 713 | 1602.5 | 685 | 1564.5 | 640 | 1692.4 | 707 |
| 800 | | 1628.7 | 657 | 1771.6 | 714 | 1615.5 | 687 | 1584.5 | 642 | 1707.4 | 709 |
| 1000 | | 1639.3 | 659 | 1784.2 | 715 | 1623.1 | 689 | 1570.1 | 644 | 1715 | 710 |

FIG. 27A-1

| | | | | | | | | | | | |
|---|---|---|---|---|---|---|---|---|---|---|---|
| 1000 | | 1639.3 | 659 | 1784.2 | 715 | 1623.1 | 689 | 1570.1 | 644 | 1716 | 710 |
| 800 | | 1635.7 | 658 | 1781.6 | 715 | 1623.5 | 689 | 1569.5 | 643 | 1714.4 | 710 |
| 600 | | 1629.7 | 658 | 1776.5 | 715 | 1620.5 | 688 | 1565.5 | 642 | 1708.4 | 709 |
| 500 | | 1625.6 | 657 | 1769.5 | 714 | 1616.9 | 687 | 1562.5 | 642 | 1703.3 | 708 |
| 400 | | 1618 | 655 | 1757.5 | 712 | 1610.4 | 686 | 1554.4 | 640 | 1695.3 | 707 |
| 350 | | 1611.6 | 654 | 1746.5 | 711 | 1604.4 | 685 | 1549.4 | 639 | 1687.3 | 706 |
| 300 | | 1602 | 652 | 1733.5 | 709 | 1596.4 | 683 | 1541.4 | 638 | 1677.3 | 704 |
| 275 | | 1595.6 | 650 | 1726.5 | 707 | 1589.4 | 682 | 1535.4 | 636 | 1668.3 | 703 |
| 250 | | 1586.6 | 648 | 1709.5 | 705 | 1580.4 | 681 | 1528.4 | 635 | 1656.3 | 701 |
| 225 | | 1576.6 | 646 | 1690.5 | 702 | 1570.4 | 679 | 1518.4 | 633 | 1644.3 | 699 |
| 200 | | 1563.7 | 643 | 1667.2 | 699 | 1553.5 | 676 | 1506.5 | 630 | 1624.4 | 697 |
| 180 | | 1548.7 | 640 | 1643.5 | 695 | 1537.5 | 674 | 1494.5 | 628 | 1595 | 694 |
| 160 | | 1524.2 | 634 | 1618.5 | 691 | 1515.5 | 670 | 1474.3 | 624 | 1557.3 | 690 |
| 140 | | 1495.6 | 628 | 1579.5 | 685 | 1475.4 | 665 | 1447.4 | 619 | 1506.3 | 686 |
| 120 | Receding | 1455.6 | 618 | 1523.5 | 677 | 1432.4 | 658 | 1405 | 612 | 1430.1 | 681 |
| 100 | | 1395.6 | 606 | 1426.5 | 667 | 1366.4 | 648 | 1342.4 | 602 | 1309.5 | 674 |
| 90 | | 1337.6 | 599 | 1335.4 | 663 | 1317.4 | 642 | 1292.4 | 595 | 1218.3 | 672 |
| 80 | | 1199.5 | 594 | 1208.4 | 658 | 1258.8 | 635 | 1249.4 | 590 | 1110.2 | 671 |
| 70 | | 1006.5 | 594 | 1055.4 | 657 | 1173.9 | 631 | 1140.3 | 585 | 1004.2 | 671 |
| 60 | | 839.5 | 594 | 862.3 | 658 | 1057.3 | 627 | 1013.3 | 583 | 897.2 | 670 |
| 50 | | 697.4 | 595 | 726.3 | 659 | 919.3 | 627 | 885.3 | 582 | 773.2 | 670 |
| 40 | | 577.4 | 594 | 598.3 | 659 | 779.3 | 627 | 746.3 | 582 | 636.2 | 670 |
| 30 | | 459.4 | 594 | 471.3 | 659 | 635.2 | 627 | 601.3 | 581 | 538.1 | 670 |
| 20 | | 316.5 | 595 | 322.4 | 660 | 457.3 | 627 | 415.3 | 581 | 378.2 | 670 |
| 15 | | 237.5 | 595 | 241.4 | 660 | 319.3 | 627 | 236.3 | 582 | 283.2 | 670 |
| 10 | | 167.5 | 595 | 169.4 | 660 | 213.5 | 627 | 200.3 | 582 | 196.2 | 670 |
| 5 | | 115.5 | 594 | 114.3 | 660 | 132.3 | 626 | 127.3 | 581 | 128.2 | 669 |
| 2.5 | | 94.4 | 592 | 92.3 | 656 | 103.9 | 623 | 101.3 | 578 | 104.2 | 666 |

FIG. 27A-2

| | Sample ID | 22 | | A | | H | | C | | D | |
|---|---|---|---|---|---|---|---|---|---|---|---|
| Effective Radius | Direction | weight (mg) | 154.8 | weight (mg) | 95 | weight (mg) | 91 | weight (mg) | 81 | weight (mg) | 135 |
| | | Pore Vol. | Thickness | Pore Vol. | Thickness | Pore Vol. | Thickness | Pore Vol. | Thickness | Pore Vol. | Thickness |
| μm | | mg | μm | mg | μm | mg | μm | mg | μm | mg | μm |
| 2.5 | | 11.9 | 620 | 12 | 248 | 17 | 331 | 11.9 | 364 | 12.9 | 498 |
| 5 | | 17 | 630 | 23 | 267 | 28.4 | 352 | 23 | 372 | 34 | 560 |
| 10 | | 51 | 658 | 71 | 338 | 67 | 371 | 66 | 332 | 114 | 609 |
| 15 | | 138.9 | 682 | 92 | 341 | 94 | 373 | 84 | 332 | 159 | 613 |
| 20 | | 166.5 | 683 | 108.6 | 343 | 110.6 | 373 | 100.6 | 332 | 192.5 | 613 |
| 30 | | 266.9 | 683 | 137 | 343 | 137 | 373 | 129 | 331 | 247.9 | 613 |
| 40 | | 342.1 | 681 | 157 | 343 | 156.9 | 373 | 153 | 330 | 301.9 | 611 |
| 50 | | 395.9 | 679 | 161.9 | 343 | 160.9 | 371 | 156.9 | 379 | 348.9 | 608 |
| 60 | | 456.8 | 676 | 178.9 | 342 | 173.9 | 370 | 169.9 | 378 | 406.9 | 606 |
| 70 | | 534.6 | 673 | 220.9 | 341 | 206.9 | 370 | 200.9 | 376 | 479.3 | 606 |
| 80 | | 610.9 | 671 | 270 | 340 | 241 | 369 | 235 | 376 | 544 | 605 |
| 90 | | 685.9 | 668 | 319 | 340 | 273 | 369 | 267 | 375 | 592.9 | 605 |
| 100 | | 757.9 | 666 | 366 | 339 | 302 | 368 | 297 | 374 | 636.1 | 605 |
| 120 | | 909.8 | 662 | 459 | 339 | 358 | 368 | 353 | 374 | 706.9 | 605 |
| 140 | Advancing | 1055.8 | 658 | 547.9 | 338 | 409 | 368 | 406 | 373 | 761.9 | 605 |
| 160 | | 1194.8 | 656 | 632.9 | 337 | 456 | 368 | 461 | 372 | 809.5 | 605 |
| 180 | | 1296.7 | 654 | 683.9 | 337 | 502.9 | 368 | 512.9 | 372 | 848.9 | 605 |
| 200 | | 1363.7 | 653 | 716.9 | 337 | 545.9 | 368 | 558.9 | 372 | 885.9 | 605 |
| 225 | | 1416.7 | 653 | 746.9 | 338 | 602.9 | 368 | 607.9 | 372 | 932.4 | 605 |
| 250 | | 1447.7 | 654 | 769.9 | 338 | 660.9 | 368 | 650.9 | 372 | 974.8 | 605 |
| 275 | | 1468.7 | 654 | 785.9 | 339 | 736.9 | 368 | 693.9 | 372 | 1013.8 | 605 |
| 300 | | 1487.6 | 655 | 795.8 | 339 | 820.8 | 368 | 726.9 | 372 | 1056.2 | 605 |
| 350 | | 1509.6 | 657 | 806.8 | 340 | 888.8 | 368 | 755.9 | 373 | 1212.8 | 606 |
| 400 | | 1523 | 658 | 813.8 | 341 | 905.8 | 368 | 764.9 | 374 | 1350.7 | 606 |
| 500 | | 1539.6 | 660 | 822.8 | 342 | 914.8 | 369 | 773.9 | 375 | 1446.7 | 607 |
| 600 | | 1550.7 | 662 | 827.9 | 343 | 917.9 | 370 | 779.9 | 376 | 1479.8 | 608 |
| 800 | | 1563.7 | 664 | 833.7 | 345 | 920.9 | 371 | 785.9 | 377 | 1491.8 | 610 |
| 1000 | | 1573.3 | 667 | 837.5 | 346 | 922.5 | 371 | 791.5 | 378 | 1502.4 | 611 |

FIG. 27B-1

| | | | | | | | | | | | |
|---|---|---|---|---|---|---|---|---|---|---|---|
| 1000 | | 1573.3 | 667 | 837.5 | 346 | 922.5 | 371 | 791.5 | 378 | 1502.4 | 611 |
| 800 | | 1570.7 | 667 | 835.9 | 346 | 921.9 | 372 | 788.9 | 379 | 1498.8 | 611 |
| 600 | | 1565.6 | 666 | 833.9 | 346 | 921.9 | 372 | 783.9 | 378 | 1492.7 | 611 |
| 500 | | 1561.6 | 665 | 830.9 | 345 | 919.9 | 371 | 780.9 | 378 | 1485.7 | 610 |
| 400 | | 1553.6 | 664 | 827.8 | 344 | 917.8 | 371 | 773.9 | 377 | 1475.7 | 609 |
| 350 | | 1547.6 | 662 | 823.8 | 344 | 913.8 | 370 | 768.9 | 376 | 1465.5 | 608 |
| 300 | | 1540.6 | 661 | 819.8 | 343 | 908.8 | 369 | 760.9 | 375 | 1438.7 | 607 |
| 275 | | 1533.6 | 659 | 814.8 | 343 | 901.8 | 368 | 752.9 | 374 | 1388.7 | 606 |
| 250 | | 1524.6 | 658 | 809.8 | 342 | 892.8 | 367 | 738.8 | 373 | 1326.7 | 605 |
| 225 | | 1516.6 | 656 | 804.8 | 342 | 866.8 | 366 | 716.8 | 372 | 1227.7 | 605 |
| 200 | | 1504.7 | 653 | 795.9 | 341 | 815.9 | 365 | 685.9 | 370 | 1127.7 | 604 |
| 180 | | 1488.7 | 650 | 785.9 | 340 | 739.9 | 364 | 654.9 | 369 | 1015.7 | 603 |
| 160 | | 1470.6 | 646 | 767.9 | 339 | 644 | 363 | 614.9 | 368 | 932.7 | 603 |
| 140 | | 1450.6 | 642 | 740.9 | 337 | 556.8 | 362 | 568.9 | 366 | 883.7 | 602 |
| 120 | Receding | 1407.6 | 633 | 701.6 | 335 | 498.8 | 362 | 532.9 | 364 | 827.7 | 602 |
| 100 | | 1361.6 | 623 | 655.8 | 332 | 437.8 | 362 | 477.9 | 361 | 777.7 | 602 |
| 90 | | 1322.6 | 615 | 617.8 | 331 | 414.8 | 361 | 450.8 | 360 | 754.6 | 601 |
| 80 | | 1276.5 | 607 | 568.8 | 330 | 385.8 | 361 | 421.8 | 359 | 730.6 | 601 |
| 70 | | 1180.5 | 600 | 466.8 | 331 | 354.8 | 361 | 372.8 | 359 | 698.6 | 600 |
| 60 | | 1028.5 | 598 | 393.8 | 332 | 320.7 | 361 | 316.8 | 359 | 657.6 | 600 |
| 50 | | 826.5 | 599 | 310.8 | 333 | 272.7 | 361 | 265.8 | 359 | 631.6 | 599 |
| 40 | | 690.4 | 599 | 242.7 | 333 | 233.7 | 361 | 222.8 | 360 | 578.6 | 598 |
| 30 | | 563.4 | 600 | 199.7 | 333 | 204.7 | 360 | 192.8 | 360 | 459.6 | 597 |
| 20 | | 400.5 | 600 | 157.8 | 334 | 163.8 | 361 | 151.9 | 360 | 315.6 | 597 |
| 15 | | 298.5 | 600 | 133.8 | 334 | 138.8 | 360 | 122.9 | 360 | 248.6 | 597 |
| 10 | | 203.5 | 600 | 109.8 | 334 | 113.8 | 360 | 95.8 | 360 | 192.6 | 597 |
| 5 | | 128.5 | 600 | 82.8 | 333 | 87.8 | 360 | 69.8 | 359 | 136.6 | 597 |
| 2.5 | | 98.4 | 597 | 65.8 | 330 | 70.8 | 357 | 53.8 | 356 | 104.6 | 594 |

FIG. 27B-2

| | Sample ID | F | | G | | E | | B | | 25 | |
|---|---|---|---|---|---|---|---|---|---|---|---|
| Effective Radius | Direction | weight (mg) | 120.5 | weight (mg) | 75.4 | weight (mg) | 123 | weight (mg) | 134 | weight (mg) | 166 |
| | | Pore Vol. | Thickness | Pore Vol. | Thickness | Pore Vol. | Thickness | Pore Vol. | Thickness | Pore Vol. | Thickness |
| μm | | mg | μm | mg | μm | mg | μm | mg | μm | mg | μm |
| 2.5 | | 10.9 | 704 | 15.9 | 357 | 11.9 | 563 | 10.9 | 397 | 16.5 | 699 |
| 5 | | 16 | 709 | 24 | 366 | 23 | 578 | 18 | 412 | 21 | 707 |
| 10 | | 38 | 717 | 75 | 377 | 102 | 620 | 80 | 458 | 28 | 717 |
| 15 | | 121.9 | 726 | 95 | 378 | 132 | 620 | 125 | 461 | 70 | 738 |
| 20 | | 163.5 | 725 | 114.4 | 378 | 161.6 | 621 | 159.5 | 461 | 152.9 | 750 |
| 30 | | 227.9 | 724 | 147 | 376 | 210.9 | 620 | 211.9 | 461 | 226.5 | 750 |
| 40 | | 298.9 | 722 | 175 | 374 | 257.9 | 619 | 261.9 | 458 | 290.9 | 749 |
| 50 | | 344.9 | 720 | 182.9 | 373 | 285.9 | 618 | 301.9 | 455 | 332.8 | 748 |
| 60 | | 385.9 | 717 | 195.9 | 372 | 320.9 | 617 | 353.9 | 453 | 381.8 | 746 |
| 70 | | 432.8 | 714 | 225.9 | 371 | 370.9 | 616 | 427.9 | 451 | 457.9 | 743 |
| 80 | | 473.9 | 712 | 254 | 371 | 418 | 615 | 497.9 | 449 | 539.9 | 741 |
| 90 | | 508.9 | 710 | 280 | 370 | 460 | 614 | 558.5 | 448 | 624.9 | 738 |
| 100 | | 539.9 | 709 | 303 | 370 | 497 | 614 | 605.9 | 448 | 707.8 | 735 |
| 120 | | 589.9 | 707 | 344 | 370 | 557 | 614 | 690.9 | 447 | 870.8 | 730 |
| 140 | Advancing | 630.9 | 706 | 382 | 369 | 604.9 | 613 | 755.9 | 447 | 1096.8 | 725 |
| 160 | | 666.9 | 705 | 418 | 369 | 644.9 | 613 | 801.9 | 447 | 1193.7 | 721 |
| 180 | | 698.9 | 704 | 455.5 | 369 | 679.9 | 613 | 833.9 | 447 | 1314.9 | 719 |
| 200 | | 726.9 | 703 | 495.3 | 369 | 715.7 | 613 | 858.9 | 447 | 1406.7 | 718 |
| 225 | | 761.8 | 702 | 548.9 | 369 | 759.5 | 613 | 883.8 | 448 | 1471.7 | 717 |
| 250 | | 792.8 | 702 | 623.9 | 369 | 794.9 | 612 | 909.8 | 449 | 1509.6 | 718 |
| 275 | | 823.8 | 702 | 725.9 | 369 | 840.9 | 612 | 924.8 | 449 | 1530.6 | 718 |
| 300 | | 854.8 | 701 | 792.9 | 369 | 894.9 | 612 | 939 | 450 | 1548.6 | 718 |
| 350 | | 913.8 | 701 | 833.8 | 369 | 1012.8 | 612 | 954.8 | 451 | 1564.6 | 719 |
| 400 | | 977.6 | 701 | 845.8 | 370 | 1151.2 | 612 | 961.8 | 452 | 1577.6 | 720 |
| 500 | | 1487.7 | 694 | 854.8 | 370 | 1370.8 | 612 | 971.8 | 453 | 1592.7 | 722 |
| 600 | | 1974.7 | 692 | 861.5 | 371 | 1397.9 | 612 | 979.9 | 455 | 1604.1 | 724 |
| 800 | | 2093.7 | 692 | 866.9 | 372 | 1416.9 | 613 | 989.9 | 457 | 1615.6 | 726 |
| 1000 | | 2098.3 | 693 | 870.9 | 373 | 1424.4 | 614 | 990.5 | 459 | 1626.6 | 728 |

FIG. 27C-1

| | | | | | | | | | | | |
|---|---|---|---|---|---|---|---|---|---|---|---|
| 1000 | | 2098.3 | 693 | 870.9 | 373 | 1424.4 | 614 | 999.5 | 459 | 1626.6 | 728 |
| 800 | | 2093.7 | 692 | 869.9 | 373 | 1420.8 | 614 | 995.8 | 459 | 1626.6 | 729 |
| 600 | | 2080.7 | 691 | 865.9 | 373 | 1410.8 | 613 | 990.8 | 458 | 1623.6 | 728 |
| 500 | | 2065.5 | 689 | 861.9 | 372 | 1401.4 | 612 | 985.8 | 458 | 1619.2 | 727 |
| 400 | | 2015.6 | 683 | 852.9 | 371 | 1364.8 | 610 | 979.8 | 456 | 1611.6 | 725 |
| 350 | | 1908.6 | 680 | 847.8 | 371 | 1323.6 | 609 | 975.2 | 456 | 1605.6 | 724 |
| 300 | | 1443.6 | 678 | 838.8 | 370 | 1246.4 | 607 | 969.8 | 455 | 1596.6 | 722 |
| 275 | | 1146.5 | 679 | 831.8 | 369 | 1167.7 | 606 | 964.8 | 454 | 1589.7 | 721 |
| 250 | | 992.5 | 679 | 817.8 | 368 | 1079.7 | 605 | 958.8 | 453 | 1583.7 | 720 |
| 225 | | 846.5 | 679 | 799.2 | 367 | 988.7 | 604 | 951.8 | 452 | 1575.6 | 718 |
| 200 | | 805.6 | 679 | 767.9 | 366 | 897.8 | 603 | 937.9 | 451 | 1564.6 | 715 |
| 180 | | 779.6 | 679 | 747.9 | 365 | 836.8 | 602 | 920.8 | 450 | 1553.6 | 712 |
| 160 | | 752.6 | 678 | 597.9 | 365 | 770.8 | 602 | 899.8 | 448 | 1538.4 | 708 |
| 140 | | 723.6 | 678 | 497.8 | 364 | 716.8 | 602 | 870.8 | 446 | 1512.6 | 703 |
| 120 | Receding | 691.5 | 678 | 456.8 | 363 | 667.8 | 602 | 840.8 | 443 | 1480.4 | 695 |
| 100 | | 656.5 | 677 | 427.8 | 362 | 631.7 | 601 | 791 | 439 | 1430.6 | 682 |
| 90 | | 635.5 | 677 | 408.8 | 361 | 613.7 | 601 | 758.8 | 437 | 1388.5 | 673 |
| 80 | | 613.5 | 676 | 387.8 | 360 | 589.7 | 601 | 721.8 | 436 | 1337.3 | 666 |
| 70 | | 587.5 | 676 | 347.8 | 360 | 561.7 | 601 | 669.7 | 435 | 1242.5 | 657 |
| 60 | | 559.5 | 675 | 312.8 | 360 | 524.7 | 600 | 622.7 | 434 | 1002.1 | 657 |
| 50 | | 524.5 | 675 | 269.8 | 360 | 465.7 | 600 | 544.7 | 435 | 815.4 | 658 |
| 40 | | 487.1 | 675 | 238.8 | 360 | 403.7 | 600 | 476.7 | 435 | 675.4 | 658 |
| 30 | | 434.5 | 674 | 212.8 | 360 | 337.7 | 600 | 389.7 | 435 | 531.5 | 658 |
| 20 | | 318.5 | 674 | 169.8 | 360 | 250.4 | 600 | 275.8 | 435 | 352.5 | 659 |
| 15 | | 234.5 | 674 | 139.8 | 360 | 201.7 | 600 | 218.8 | 436 | 262.5 | 659 |
| 10 | | 162.5 | 674 | 110.8 | 360 | 157.7 | 600 | 165.7 | 436 | 181.5 | 659 |
| 5 | | 107.5 | 673 | 79.8 | 359 | 118.9 | 599 | 112.7 | 435 | 118.5 | 659 |
| 2.5 | | 85.5 | 670 | 61.8 | 357 | 99.7 | 596 | 85.7 | 432 | 94.4 | 656 |

FIG. 27C-2

| | Sample ID | 20 | | 23 | | 24 | | 21 | | 59 | |
|---|---|---|---|---|---|---|---|---|---|---|---|
| Effective Radius | Direction | weight (mg) | 145 | weight (mg) | 156.5 | weight (mg) | 154 | weight (mg) | 151.2 | weight (mg) | 167.7 |
| | | Pore Vol. | Thickness | Pore Vol. | Thickness | Pore Vol. | Thickness | Pore Vol. | Thickness | Pore Vol. | Thickness |
| μm | | mg | μm | mg | μm | mg | μm | mg | μm | mg | μm |
| 2.5 | | 9.9 | 661 | 10.9 | 629 | 12.9 | 728 | 10.9 | 597 | 12.8 | 1155 |
| 5 | | 15 | 668 | 17 | 636 | 18 | 738 | 16 | 604 | 17 | 1154 |
| 10 | | 21 | 675 | 29 | 649 | 31 | 754 | 55 | 626 | 25.8 | 1154 |
| 15 | | 86 | 701 | 68 | 667 | 59 | 767 | 131.9 | 641 | 134.7 | 1155 |
| 20 | | 148.9 | 705 | 129.1 | 683 | 118.3 | 788 | 190.9 | 641 | 193.7 | 1155 |
| 30 | | 223.9 | 704 | 194.9 | 684 | 193.9 | 789 | 257.9 | 641 | 260.7 | 1154 |
| 40 | | 290.9 | 702 | 252.9 | 684 | 254.9 | 789 | 328.9 | 640 | 310.8 | 1153 |
| 50 | | 334 | 699 | 288.8 | 682 | 290.8 | 787 | 372.8 | 638 | 344.6 | 1152 |
| 60 | | 375.8 | 696 | 321.8 | 681 | 322.8 | 785 | 419 | 635 | 361.6 | 1151 |
| 70 | | 438.9 | 694 | 377.9 | 679 | 375.9 | 784 | 490.9 | 633 | 397.6 | 1149 |
| 80 | | 507.9 | 692 | 439.9 | 678 | 433.9 | 783 | 547.3 | 631 | 443.7 | 1147 |
| 90 | | 575.9 | 689 | 504.3 | 676 | 491.9 | 781 | 615.9 | 629 | 489.7 | 1146 |
| 100 | | 642.8 | 686 | 569.8 | 674 | 551.8 | 780 | 680 | 627 | 535.7 | 1145 |
| 120 | | 780.8 | 682 | 702.8 | 671 | 670.8 | 777 | 805.8 | 624 | 623.6 | 1143 |
| 140 | Advancing | 920.8 | 678 | 828.8 | 669 | 785.8 | 775 | 929.8 | 620 | 711.6 | 1140 |
| 160 | | 1046.7 | 674 | 966.7 | 666 | 908.7 | 772 | 1046.7 | 617 | 797.6 | 1139 |
| 180 | | 1170.7 | 671 | 1094.7 | 664 | 1040.7 | 769 | 1145.7 | 616 | 884 | 1136 |
| 200 | | 1270.7 | 669 | 1213.7 | 663 | 1165.1 | 767 | 1216.7 | 615 | 972.6 | 1134 |
| 225 | | 1346.8 | 669 | 1329.6 | 660 | 1315.6 | 765 | 1273.6 | 615 | 1080.6 | 1132 |
| 250 | | 1392 | 669 | 1392.6 | 660 | 1439.6 | 763 | 1305.6 | 615 | 1197.7 | 1131 |
| 275 | | 1425.6 | 670 | 1439.6 | 660 | 1523.5 | 763 | 1334.6 | 615 | 1331.5 | 1128 |
| 300 | | 1447.6 | 670 | 1479.6 | 660 | 1571.5 | 763 | 1355.6 | 616 | 1453.7 | 1127 |
| 350 | | 1477.6 | 671 | 1533.5 | 661 | 1642.5 | 764 | 1382.6 | 617 | 1736.5 | 1125 |
| 400 | | 1502.6 | 672 | 1567.5 | 662 | 1699.4 | 764 | 1402.6 | 618 | 1918 | 1124 |
| 500 | | 1533.6 | 674 | 1619.6 | 664 | 1779.5 | 765 | 1422.7 | 620 | 2100.5 | 1124 |
| 600 | | 1549.6 | 676 | 1639.6 | 665 | 1815.5 | 766 | 1435.6 | 622 | 2214.3 | 1125 |
| 800 | | 1567.6 | 678 | 1657.6 | 667 | 1848.5 | 768 | 1448.6 | 624 | 2319.6 | 1127 |
| 1000 | | 1580.6 | 680 | 1671.6 | 668 | 1868.5 | 769 | 1461.6 | 626 | 2339.4 | 1128 |

FIG. 27D-1

| | | | | | | | | | | | |
|---|---|---|---|---|---|---|---|---|---|---|---|
| 1000 | | 1580.6 | 680 | 1671.6 | 668 | 1868.5 | 769 | 1461.6 | 626 | 2339.4 | 1128 |
| 800 | | 1576.6 | 680 | 1667.6 | 668 | 1861.5 | 769 | 1459.6 | 626 | 2326.4 | 1128 |
| 600 | | 1569.6 | 679 | 1660.5 | 667 | 1850.5 | 768 | 1456.6 | 625 | 2302.8 | 1126 |
| 500 | | 1563.6 | 678 | 1653.5 | 666 | 1840.4 | 766 | 1451.6 | 624 | 2265.4 | 1124 |
| 400 | | 1553.6 | 676 | 1642.5 | 664 | 1824.4 | 765 | 1443.6 | 623 | 2184.4 | 1121 |
| 350 | | 1545.6 | 676 | 1634.5 | 663 | 1810.4 | 764 | 1436.6 | 622 | 2133.4 | 1119 |
| 300 | | 1534.6 | 673 | 1622.5 | 661 | 1793.4 | 762 | 1426.6 | 620 | 2021.4 | 1116 |
| 275 | | 1524.6 | 671 | 1613.6 | 660 | 1780.5 | 760 | 1418.7 | 619 | 1969.3 | 1113 |
| 250 | | 1514.6 | 670 | 1602.6 | 658 | 1762.5 | 758 | 1411.6 | 618 | 1934.4 | 1110 |
| 225 | | 1502.6 | 668 | 1588.6 | 656 | 1737.5 | 755 | 1401.6 | 616 | 1883.2 | 1105 |
| 200 | | 1485.6 | 665 | 1568.6 | 652 | 1713.5 | 752 | 1388.6 | 613 | 1817.4 | 1101 |
| 180 | | 1466.6 | 661 | 1549.5 | 648 | 1687.4 | 747 | 1375.6 | 611 | 1733 | 1097 |
| 160 | | 1442 | 656 | 1527.3 | 644 | 1650.2 | 742 | 1357.4 | 607 | 1598.4 | 1093 |
| 140 | | 1408.6 | 650 | 1495.5 | 639 | 1607.4 | 736 | 1326.6 | 602 | 1284.3 | 1093 |
| 120 | Receding | 1367.3 | 642 | 1450.3 | 630 | 1554.2 | 727 | 1289.4 | 596 | 1108.3 | 1092 |
| 100 | | 1309.5 | 631 | 1373.5 | 620 | 1448 | 717 | 1246.5 | 584 | 917.3 | 1093 |
| 90 | | 1269.5 | 623 | 1320.5 | 613 | 1341.3 | 711 | 1214.5 | 578 | 848.3 | 1093 |
| 80 | | 1217.5 | 616 | 1231.4 | 606 | 1159.1 | 711 | 1166.5 | 569 | 777.9 | 1093 |
| 70 | | 1143.4 | 607 | 1085.4 | 603 | 973.3 | 712 | 1079.5 | 563 | 708.3 | 1093 |
| 60 | | 965.4 | 604 | 865.4 | 605 | 823.3 | 713 | 915 | 561 | 635.3 | 1094 |
| 50 | | 773.4 | 607 | 710.1 | 606 | 697.2 | 713 | 756.4 | 563 | 556.2 | 1094 |
| 40 | | 650.4 | 607 | 591.3 | 606 | 589.2 | 713 | 644.4 | 564 | 481.2 | 1094 |
| 30 | | 533.5 | 608 | 474.4 | 606 | 478.3 | 713 | 538.5 | 564 | 407.3 | 1094 |
| 20 | | 368.3 | 608 | 322.4 | 607 | 326.3 | 713 | 390.5 | 565 | 300.3 | 1095 |
| 15 | | 272.5 | 608 | 244.4 | 607 | 246.3 | 713 | 288.5 | 565 | 240.3 | 1095 |
| 10 | | 185.4 | 609 | 173.4 | 607 | 172.7 | 714 | 198.5 | 565 | 178.3 | 1095 |
| 5 | | 116.4 | 608 | 116.4 | 607 | 116.3 | 712 | 124.4 | 565 | 121.3 | 1094 |
| 2.5 | | 89.4 | 604 | 94.3 | 604 | 93.2 | 709 | 95.4 | 562 | 102.2 | 1091 |

FIG. 27D-2

| | Sample ID | 61 | | 10 | | 12 | | 14 | | 39 | |
|---|---|---|---|---|---|---|---|---|---|---|---|
| Effective Radius | Direction | weight (mg) | 120.5 | weight (mg) | 75.4 | weight (mg) | 123 | weight (mg) | 134 | weight (mg) | 166 |
| | | Pore Vol. | Thickness | Pore Vol. | Thickness | Pore Vol. | Thickness | Pore Vol. | Thickness | Pore Vol. | Thickness |
| μm | | mg | μm | mg | μm | mg | μm | mg | μm | mg | μm |
| 2.5 | | 12.2 | 1347 | 12.2 | 1309 | 14.2 | 1341 | 12.3 | 1325 | 12.2 | 573 |
| 5 | | 16.4 | 1346 | 16.4 | 1310 | 16.4 | 1341 | 16.4 | 1327 | 16.4 | 578 |
| 10 | | 22.2 | 1346 | 26.2 | 1311 | 32.2 | 1345 | 36.2 | 1337 | 42.2 | 586 |
| 15 | | 117.1 | 1347 | 150.7 | 1329 | 154.1 | 1358 | 189.1 | 1356 | 114.2 | 600 |
| 20 | | 217.5 | 1346 | 209.1 | 1329 | 219.7 | 1358 | 241.1 | 1356 | 155.1 | 600 |
| 30 | | 312 | 1345 | 281.1 | 1329 | 293.1 | 1358 | 311.1 | 1355 | 226.1 | 598 |
| 40 | | 391 | 1343 | 333.1 | 1328 | 345 | 1357 | 359.1 | 1354 | 293.7 | 596 |
| 50 | | 455 | 1341 | 366 | 1328 | 376 | 1356 | 388 | 1354 | 346.3 | 594 |
| 60 | | 499 | 1339 | 382 | 1327 | 387 | 1355 | 398 | 1353 | 380.1 | 592 |
| 70 | | 559 | 1337 | 418 | 1326 | 416 | 1354 | 427 | 1352 | 432 | 589 |
| 80 | | 626 | 1335 | 466.1 | 1324 | 461.1 | 1353 | 469.1 | 1351 | 488.1 | 587 |
| 90 | | 690 | 1333 | 517.1 | 1322 | 506.1 | 1351 | 513.1 | 1349 | 541.1 | 585 |
| 100 | | 750 | 1330 | 569.1 | 1320 | 554.1 | 1348 | 558.1 | 1347 | 591.1 | 583 |
| 120 | | 865 | 1327 | 681.1 | 1317 | 653 | 1345 | 655.1 | 1344 | 685.1 | 581 |
| 140 | Advancing | 971 | 1324 | 792 | 1314 | 755 | 1343 | 756.1 | 1342 | 774 | 579 |
| 160 | | 1072 | 1322 | 897 | 1311 | 849 | 1341 | 847 | 1340 | 856 | 577 |
| 180 | | 1170.9 | 1319 | 991 | 1310 | 934 | 1339 | 930 | 1338 | 941 | 575 |
| 200 | | 1270.9 | 1316 | 1080.4 | 1308 | 1012 | 1338 | 1006 | 1337 | 1015 | 574 |
| 225 | | 1387.9 | 1314 | 1183 | 1306 | 1103 | 1336 | 1096 | 1336 | 1077.9 | 574 |
| 250 | | 1503.9 | 1311 | 1284.6 | 1305 | 1191 | 1335 | 1184.6 | 1335 | 1129.7 | 574 |
| 275 | | 1617.9 | 1310 | 1365.9 | 1304 | 1278.9 | 1334 | 1278 | 1333 | 1161.9 | 574 |
| 300 | | 1728.2 | 1308 | 1487.9 | 1303 | 1371.9 | 1333 | 1367.9 | 1332 | 1182.9 | 574 |
| 350 | | 1951.8 | 1306 | 1748.9 | 1301 | 1592.9 | 1331 | 1592.3 | 1331 | 1211.9 | 575 |
| 400 | | 2153.8 | 1305 | 2087.8 | 1298 | 1892.8 | 1329 | 1920.8 | 1329 | 1230.3 | 576 |
| 500 | | 2446.6 | 1305 | 2597.9 | 1298 | 2651.9 | 1325 | 2648.9 | 1327 | 1253.9 | 578 |
| 600 | | 2536.6 | 1306 | 2703.7 | 1298 | 2943.6 | 1325 | 2940.5 | 1327 | 1261.7 | 579 |
| 800 | | 2598.8 | 1309 | 2741.9 | 1300 | 3117.8 | 1326 | 2885.9 | 1328 | 1273.9 | 581 |
| 1000 | | 2633.8 | 1311 | 2755.8 | 1302 | 3139.8 | 1328 | 2910.8 | 1330 | 1282.9 | 583 |

FIG. 27E-1

| | | | | | | | | | | | |
|---|---|---|---|---|---|---|---|---|---|---|---|
| 1000 | | 2633.8 | 1311 | 2765.8 | 1302 | 3139.8 | 1328 | 2910.8 | 1330 | 1282.9 | 583 |
| 800 | | 2614.8 | 1311 | 2744.8 | 1301 | 3119.8 | 1327 | 2888.8 | 1329 | 1280.9 | 583 |
| 600 | | 2583.8 | 1308 | 2716.8 | 1299 | 3081.8 | 1325 | 2856.8 | 1327 | 1278.9 | 582 |
| 500 | | 2549.7 | 1305 | 2687.8 | 1297 | 3046.7 | 1322 | 2829.8 | 1325 | 1275.7 | 582 |
| 400 | | 2470.7 | 1301 | 2628.8 | 1293 | 2996.7 | 1318 | 2766.8 | 1321 | 1267.9 | 580 |
| 350 | | 2408.7 | 1297 | 2571.8 | 1290 | 2776.7 | 1314 | 2714.8 | 1318 | 1260.9 | 579 |
| 300 | | 2329.7 | 1291 | 2496.7 | 1285 | 2656.7 | 1309 | 2580.7 | 1314 | 1250.8 | 577 |
| 275 | | 2261.6 | 1286 | 2445.7 | 1281 | 2562.7 | 1307 | 2494.7 | 1310 | 1242.8 | 576 |
| 250 | | 2170.7 | 1282 | 2393.8 | 1278 | 2415.7 | 1304 | 2425.4 | 1307 | 1231.9 | 574 |
| 225 | | 2061.7 | 1277 | 2154.8 | 1275 | 2294.7 | 1300 | 2117.8 | 1307 | 1216.9 | 572 |
| 200 | | 1932.7 | 1274 | 1880.8 | 1273 | 1905.7 | 1300 | 1934.8 | 1305 | 1198.9 | 569 |
| 180 | | 1810.7 | 1270 | 1793.7 | 1271 | 1796.7 | 1298 | 1795.3 | 1303 | 1181.9 | 567 |
| 160 | | 1710.4 | 1267 | 1711.7 | 1268 | 1691.7 | 1296 | 1680.7 | 1301 | 1156.9 | 563 |
| 140 | | 1540.6 | 1263 | 1609.7 | 1264 | 1580.6 | 1293 | 1546.7 | 1299 | 1128.9 | 558 |
| 120 | Receding | 1408.6 | 1260 | 1429.7 | 1261 | 1433.6 | 1289 | 1364.7 | 1295 | 1095.8 | 552 |
| 100 | | 1270.6 | 1258 | 1209.7 | 1259 | 1167.6 | 1288 | 1085.7 | 1296 | 1043.6 | 542 |
| 90 | | 1183.6 | 1257 | 1075.6 | 1259 | 1029 | 1288 | 955.7 | 1296 | 1013.4 | 537 |
| 80 | | 1091.5 | 1257 | 933.6 | 1258 | 869.1 | 1289 | 822.6 | 1298 | 972.8 | 532 |
| 70 | | 1002.5 | 1257 | 781.6 | 1260 | 752.5 | 1290 | 719.6 | 1299 | 892.8 | 529 |
| 60 | | 907.5 | 1257 | 687.6 | 1260 | 653.5 | 1291 | 638.6 | 1299 | 782.6 | 528 |
| 50 | | 801.5 | 1257 | 589.6 | 1261 | 568.5 | 1291 | 561.6 | 1300 | 662.7 | 529 |
| 40 | | 685.5 | 1257 | 505.6 | 1261 | 496.5 | 1292 | 497.6 | 1300 | 561.7 | 530 |
| 30 | | 574.6 | 1257 | 428.7 | 1262 | 432.6 | 1292 | 440.7 | 1301 | 472.8 | 530 |
| 20 | | 399.6 | 1258 | 319.1 | 1262 | 331.6 | 1293 | 345.7 | 1301 | 333.8 | 531 |
| 15 | | 305.6 | 1258 | 256.6 | 1262 | 271.6 | 1293 | 286.7 | 1301 | 247.8 | 531 |
| 10 | | 216.5 | 1258 | 190.6 | 1262 | 203.6 | 1293 | 216.7 | 1301 | 166.8 | 531 |
| 5 | | 140.5 | 1258 | 124.6 | 1262 | 102.5 | 1292 | 144.6 | 1300 | 104.8 | 530 |
| 2.5 | | 111.5 | 1254 | 100.4 | 1259 | 108.5 | 1289 | 119.6 | 1297 | 81.7 | 528 |

FIG. 27E-2

| | Sample ID | 64 | | 56 | | 57 | | 31 | | V | |
|---|---|---|---|---|---|---|---|---|---|---|---|
| Effective Radius | Direction | weight (mg) | 184 | weight (mg) | 172.2 | weight (mg) | 166.5 | weight (mg) | 167 | weight (mg) | 133 |
| | | Pore Vol. | Thickness | Pore Vol. | Thickness | Pore Vol. | Thickness | Pore Vol. | Thickness | Pore Vol. | Thickness |
| μm | | mg | μm | mg | μm | mg | μm | mg | μm | mg | μm |
| 2.5 | | 9.9 | 1352 | 10.9 | 1147 | 12.9 | 1151 | 10.4 | 685 | 11.9 | 570 |
| 5 | | 15 | 1350 | 16 | 1144 | 18 | 1149 | 15.4 | 691 | 33 | 624 |
| 10 | | 20 | 1348 | 21 | 1142 | 22 | 1148 | 19.4 | 696 | 110.2 | 674 |
| 15 | | 126.9 | 1345 | 66 | 1140 | 69.4 | 1146 | 80.4 | 729 | 140 | 674 |
| 20 | | 206.9 | 1342 | 152.9 | 1137 | 160.3 | 1144 | 164.3 | 735 | 157 | 674 |
| 30 | | 289.8 | 1340 | 226.9 | 1135 | 227.9 | 1143 | 250.5 | 734 | 181.9 | 675 |
| 40 | | 360.8 | 1338 | 277.8 | 1134 | 274.3 | 1141 | 356.3 | 732 | 198.9 | 674 |
| 50 | | 406.8 | 1337 | 305.8 | 1132 | 295.8 | 1140 | 440.2 | 729 | 194.9 | 674 |
| 60 | | 456.8 | 1335 | 339.8 | 1130 | 322.8 | 1138 | 525.2 | 726 | 199.9 | 672 |
| 70 | | 521.8 | 1332 | 392.8 | 1128 | 367.8 | 1137 | 630.2 | 721 | 223.9 | 671 |
| 80 | | 586.8 | 1330 | 449.9 | 1126 | 415.9 | 1135 | 727.2 | 718 | 250 | 671 |
| 90 | | 648.8 | 1327 | 506.9 | 1124 | 464.9 | 1133 | 816.2 | 715 | 280 | 670 |
| 100 | | 708.8 | 1325 | 563.9 | 1122 | 512.9 | 1132 | 904.2 | 712 | 309 | 669 |
| 120 | | 821.8 | 1322 | 674.8 | 1119 | 610.8 | 1129 | 1063.1 | 707 | 364 | 668 |
| 140 | Advancing | 928.8 | 1319 | 776.8 | 1116 | 704.8 | 1127 | 1188.1 | 705 | 421.9 | 667 |
| 160 | | 1032.8 | 1316 | 884.8 | 1113 | 799.8 | 1124 | 1306 | 703 | 477.9 | 667 |
| 180 | | 1131.8 | 1313 | 989.8 | 1110 | 894.8 | 1121 | 1356.2 | 702 | 538.9 | 666 |
| 200 | | 1227.7 | 1311 | 1093.8 | 1108 | 991.8 | 1118 | 1459.9 | 701 | 603.9 | 666 |
| 225 | | 1343.7 | 1309 | 1233.7 | 1104 | 1119.7 | 1115 | 1529.9 | 701 | 692.9 | 665 |
| 250 | | 1461.7 | 1306 | 1374.7 | 1102 | 1249.7 | 1113 | 1563.9 | 701 | 782.9 | 665 |
| 275 | | 1590.7 | 1303 | 1518.7 | 1100 | 1393.7 | 1110 | 1589.9 | 702 | 869.8 | 664 |
| 300 | | 1725.6 | 1300 | 1662.7 | 1098 | 1563.7 | 1107 | 1606.3 | 703 | 948.4 | 664 |
| 350 | | 1967.6 | 1298 | 1889.6 | 1097 | 1863.6 | 1104 | 1631.8 | 704 | 1091 | 664 |
| 400 | | 2171.6 | 1297 | 2001.6 | 1097 | 2039.6 | 1104 | 1650.8 | 705 | 1226.8 | 664 |
| 500 | | 2391.1 | 1298 | 2128.6 | 1097 | 2218.1 | 1104 | 1675.8 | 707 | 1374.9 | 665 |
| 600 | | 2484.6 | 1299 | 2190.7 | 1099 | 2306.6 | 1105 | 1667.9 | 709 | 1407.8 | 665 |
| 800 | | 2547.6 | 1301 | 2226.7 | 1101 | 2378.6 | 1107 | 1703.9 | 712 | 1433.8 | 667 |
| 1000 | | 2576.6 | 1304 | 2238.7 | 1102 | 2393.6 | 1108 | 1713.9 | 714 | 1447.8 | 668 |

FIG. 27F-1

| | | | | | | | | | | | |
|---|---|---|---|---|---|---|---|---|---|---|---|
| 1000 | | 2576.6 | 1304 | 2238.7 | 1102 | 2393.6 | 1108 | 1713.9 | 714 | 1447.8 | 668 |
| 800 | | 2560.6 | 1303 | 2228.6 | 1102 | 2382.6 | 1108 | 1711.9 | 714 | 1436.4 | 668 |
| 600 | | 2532.6 | 1301 | 2209.6 | 1101 | 2362.6 | 1106 | 1709.8 | 713 | 1420.8 | 667 |
| 500 | | 2502.6 | 1298 | 2189.6 | 1099 | 2331.6 | 1104 | 1705.8 | 712 | 1406.8 | 666 |
| 400 | | 2422.3 | 1294 | 2151.4 | 1096 | 2258.4 | 1101 | 1698.6 | 711 | 1369.6 | 664 |
| 350 | | 2372.1 | 1290 | 2102.6 | 1093 | 2194.5 | 1098 | 1690.8 | 709 | 1316.7 | 663 |
| 300 | | 2246.5 | 1285 | 2061.4 | 1089 | 2101.5 | 1094 | 1681.8 | 708 | 1235.7 | 661 |
| 275 | | 2206.5 | 1281 | 2016.6 | 1086 | 2057.5 | 1091 | 1674.8 | 706 | 1169.7 | 660 |
| 250 | | 2143.4 | 1276 | 1967.5 | 1082 | 2019.5 | 1088 | 1666.8 | 705 | 1139.7 | 658 |
| 225 | | 2063.5 | 1271 | 1922.6 | 1078 | 1954.6 | 1083 | 1655.1 | 703 | 1088.8 | 657 |
| 200 | | 1943.5 | 1266 | 1878.6 | 1073 | 1899.5 | 1079 | 1639.9 | 701 | 925.8 | 656 |
| 180 | | 1828.5 | 1263 | 1807.6 | 1068 | 1824.5 | 1074 | 1623.9 | 698 | 868.7 | 655 |
| 160 | | 1659.9 | 1260 | 1719.4 | 1061 | 1732.9 | 1068 | 1598.2 | 693 | 800.1 | 654 |
| 140 | | 1512.2 | 1257 | 1592.5 | 1056 | 1378.5 | 1067 | 1572.8 | 689 | 738.7 | 653 |
| 120 | Receding | 1354.4 | 1255 | 1275.5 | 1056 | 1159.4 | 1067 | 1535.8 | 682 | 668.7 | 652 |
| 100 | | 1231.4 | 1252 | 1086.5 | 1056 | 964.4 | 1067 | 1478.8 | 672 | 539.3 | 653 |
| 90 | | 1140.4 | 1251 | 992.5 | 1056 | 803.2 | 1067 | 1444.4 | 666 | 494.7 | 653 |
| 80 | | 1040.4 | 1251 | 893.5 | 1056 | 798.4 | 1067 | 1397.8 | 659 | 458.7 | 653 |
| 70 | | 952.4 | 1251 | 804.5 | 1056 | 720.4 | 1067 | 1342.7 | 651 | 405.6 | 653 |
| 60 | | 864.3 | 1251 | 715.4 | 1056 | 636.4 | 1067 | 1254.7 | 642 | 352.6 | 653 |
| 50 | | 761.3 | 1251 | 617.4 | 1056 | 547.4 | 1068 | 1083.7 | 642 | 279.6 | 654 |
| 40 | | 663.3 | 1251 | 524.4 | 1056 | 469.4 | 1068 | 924.7 | 641 | 253.6 | 654 |
| 30 | | 544.3 | 1251 | 422.4 | 1057 | 387.3 | 1068 | 727.6 | 641 | 238.6 | 655 |
| 20 | | 379.4 | 1252 | 293.5 | 1057 | 280.4 | 1068 | 477.7 | 641 | 200.7 | 655 |
| 15 | | 291.4 | 1252 | 228.5 | 1057 | 222.4 | 1068 | 342.7 | 641 | 178.7 | 656 |
| 10 | | 208.4 | 1252 | 167.5 | 1057 | 168.4 | 1068 | 226.7 | 641 | 155.7 | 656 |
| 5 | | 133.3 | 1251 | 117.4 | 1057 | 118.4 | 1068 | 140.7 | 640 | 126.6 | 655 |
| 2.5 | | 109.3 | 1248 | 101.4 | 1054 | 102.4 | 1065 | 111.7 | 638 | 104.6 | 653 |

FIG. 27F-2

| | Sample ID | U | | Y | | W | | X | | AA | | BB | |
|---|---|---|---|---|---|---|---|---|---|---|---|---|---|
| Effective Radius | Direction | weight (mg) | 160.1 | weight (mg) | 137.1 | weight (mg) | 171 | weight (mg) | 151.1 | weight (mg) | 148.2 | weight (mg) | 151.1 |
| | | Pore Vol. | Thickness | Pore Vol. | Thickness | Pore Vol. | Thickness | Pore Vol. | Thickness | Pore Vol. | Thickness | Pore Vol. | Thickness |
| μm | | mg | μm | mg | μm | mg | μm | mg | μm | mg | μm | mg | μm |
| 2.5 | | 10.9 | 456 | 10.9 | 444 | 11.5 | 673 | 8.9 | 529 | 12.9 | 424 | 14.9 | 598 |
| 5 | | 43 | 523 | 46 | 514 | 47 | 684 | 25 | 563 | 27 | 435 | 30 | 612 |
| 10 | | 130 | 556 | 126 | 544 | 153 | 684 | 98 | 619 | 140 | 452 | 160.9 | 652 |
| 15 | | 161 | 557 | 147 | 545 | 187 | 684 | 131.9 | 621 | 173 | 452 | 206.9 | 654 |
| 20 | | 182.9 | 558 | 163.9 | 546 | 204.9 | 683 | 151.9 | 622 | 197 | 452 | 237.9 | 654 |
| 30 | | 212.9 | 558 | 187.9 | 546 | 231.9 | 682 | 176.9 | 623 | 242.9 | 459 | 284.9 | 653 |
| 40 | | 232.9 | 558 | 205.5 | 546 | 248.9 | 680 | 193.9 | 623 | 282.9 | 456 | 327.9 | 650 |
| 50 | | 232.5 | 558 | 202.9 | 546 | 243.9 | 679 | 191.9 | 622 | 321.9 | 454 | 371.8 | 647 |
| 60 | | 241.9 | 557 | 208.9 | 545 | 243.9 | 677 | 199.9 | 622 | 366.9 | 451 | 420.8 | 644 |
| 70 | | 272.9 | 557 | 233.9 | 544 | 263.9 | 676 | 227.9 | 621 | 409.5 | 449 | 473 | 642 |
| 80 | | 308 | 556 | 263 | 543 | 286 | 675 | 260 | 620 | 456 | 447 | 536.9 | 639 |
| 90 | | 347 | 555 | 292 | 543 | 310 | 674 | 294.9 | 620 | 502.8 | 446 | 595.9 | 637 |
| 100 | | 382.9 | 554 | 323 | 542 | 334 | 673 | 328.9 | 619 | 548.9 | 445 | 658.3 | 635 |
| 120 | | 457.9 | 554 | 384.9 | 541 | 384.9 | 672 | 399.9 | 618 | 632.9 | 445 | 771.9 | 633 |
| 140 | Advancing | 524.9 | 553 | 446.9 | 540 | 437.9 | 670 | 466.9 | 618 | 699.9 | 445 | 893.8 | 631 |
| 160 | | 592.9 | 552 | 512.9 | 540 | 493.9 | 669 | 532.9 | 617 | 737.9 | 445 | 1007.4 | 630 |
| 180 | | 662.9 | 552 | 584.9 | 539 | 555.9 | 668 | 602.1 | 617 | 762.3 | 445 | 1101.2 | 629 |
| 200 | | 730.9 | 551 | 649.3 | 539 | 618.9 | 667 | 665.9 | 617 | 779.9 | 446 | 1159.8 | 629 |
| 225 | | 803.9 | 551 | 729.9 | 539 | 699.9 | 666 | 743.8 | 616 | 799.9 | 447 | 1205.7 | 630 |
| 250 | | 865.8 | 551 | 805.9 | 539 | 761.8 | 665 | 819.8 | 616 | 812.9 | 448 | 1226.7 | 630 |
| 275 | | 911.8 | 551 | 869.8 | 539 | 870.8 | 664 | 888.8 | 616 | 822.8 | 448 | 1246.7 | 631 |
| 300 | | 965.8 | 552 | 934.8 | 539 | 936.8 | 663 | 957.8 | 616 | 830.8 | 449 | 1260.7 | 632 |
| 350 | | 1049.8 | 552 | 1058.8 | 539 | 1029.8 | 663 | 1081.8 | 616 | 842.9 | 450 | 1278.8 | 633 |
| 400 | | 1098.8 | 553 | 1111.8 | 539 | 1056.8 | 663 | 1219.9 | 616 | 851.9 | 452 | 1291.8 | 634 |
| 500 | | 1124.8 | 554 | 1136.8 | 540 | 1211.7 | 663 | 1368.7 | 617 | 859.9 | 453 | 1305.8 | 636 |
| 600 | | 1134.9 | 555 | 1146.8 | 541 | 1231.8 | 664 | 1389.8 | 618 | 868.9 | 455 | 1317.8 | 638 |
| 800 | | 1148.8 | 557 | 1161.8 | 543 | 1254.8 | 665 | 1409.4 | 619 | 875.9 | 457 | 1331.8 | 640 |
| 1000 | | 1156.8 | 558 | 1167.8 | 544 | 1266.8 | 665 | 1418.8 | 620 | 882.9 | 459 | 1343.7 | 642 |

FIG. 27G-1

| | | | | | | | | | | | | | |
|---|---|---|---|---|---|---|---|---|---|---|---|---|---|
| 1000 | | 1156.8 | 558 | 1167.8 | 544 | 1265.8 | 665 | 1418.8 | 620 | 882.9 | 459 | 1343.7 | 642 |
| 800 | | 1151.8 | 558 | 1162.8 | 544 | 1253.8 | 664 | 1412.8 | 620 | 881.9 | 459 | 1340.7 | 642 |
| 600 | | 1147.8 | 557 | 1157.8 | 543 | 1242.8 | 663 | 1404.7 | 620 | 879.7 | 458 | 1335.5 | 641 |
| 500 | | 1141.8 | 557 | 1151.8 | 542 | 1228.8 | 661 | 1395.7 | 619 | 876.8 | 458 | 1331.7 | 641 |
| 400 | | 1131.6 | 556 | 1140.6 | 541 | 1201.6 | 658 | 1374.5 | 617 | 872.8 | 457 | 1324.7 | 639 |
| 350 | | 1120.8 | 555 | 1125.4 | 540 | 1169.7 | 656 | 1340.7 | 616 | 868.9 | 456 | 1317.8 | 638 |
| 300 | | 1097.8 | 553 | 1099.8 | 538 | 1115.7 | 654 | 1275.7 | 615 | 862.9 | 455 | 1308.8 | 637 |
| 275 | | 1075.8 | 552 | 1075.7 | 537 | 1088.7 | 653 | 1216.7 | 614 | 855.9 | 455 | 1300.8 | 636 |
| 250 | | 1037.7 | 551 | 1041.1 | 536 | 1042.5 | 651 | 1147.7 | 613 | 850.9 | 454 | 1291.8 | 634 |
| 225 | | 993.8 | 550 | 976.8 | 535 | 1003.8 | 649 | 1073.7 | 612 | 840.9 | 453 | 1279.7 | 633 |
| 200 | | 953.4 | 548 | 917.8 | 534 | 960.8 | 646 | 955.7 | 610 | 832.9 | 451 | 1262.7 | 631 |
| 180 | | 902.2 | 546 | 851.8 | 533 | 917.2 | 643 | 878.7 | 610 | 821.9 | 450 | 1245.7 | 629 |
| 160 | | 848.2 | 545 | 788.2 | 532 | 868.1 | 640 | 791.1 | 609 | 809.3 | 449 | 1220.7 | 626 |
| 140 | | 794.8 | 543 | 726.8 | 530 | 785.7 | 638 | 709.5 | 609 | 792.8 | 446 | 1187.7 | 623 |
| 120 | Receding | 724.7 | 541 | 640.7 | 530 | 626.7 | 639 | 642.7 | 609 | 774.8 | 444 | 1145.3 | 617 |
| 100 | | 632.3 | 541 | 551.7 | 530 | 462.7 | 641 | 555.6 | 609 | 746.8 | 440 | 1093.7 | 611 |
| 90 | | 584.7 | 541 | 505.7 | 530 | 421.7 | 641 | 528.6 | 609 | 729.8 | 437 | 1057.6 | 607 |
| 80 | | 532.7 | 541 | 455.7 | 530 | 382.7 | 641 | 492.2 | 609 | 710.8 | 434 | 1000.6 | 602 |
| 70 | | 467.7 | 542 | 398.7 | 530 | 348.7 | 641 | 445.6 | 609 | 684.8 | 431 | 877.6 | 600 |
| 60 | | 417.7 | 542 | 341.7 | 530 | 315.6 | 642 | 390.6 | 609 | 614.9 | 429 | 745.7 | 600 |
| 50 | | 365.7 | 543 | 283.7 | 531 | 280.6 | 642 | 308.6 | 609 | 497.8 | 430 | 626.7 | 601 |
| 40 | | 311.7 | 544 | 256.7 | 531 | 275.6 | 643 | 252.6 | 609 | 433.8 | 431 | 522.7 | 603 |
| 30 | | 278.6 | 544 | 237.6 | 532 | 275.6 | 643 | 229.5 | 610 | 360.8 | 431 | 421.6 | 604 |
| 20 | | 234.7 | 545 | 202.7 | 532 | 249.7 | 644 | 192.6 | 611 | 284.8 | 431 | 330.6 | 605 |
| 15 | | 210.7 | 545 | 183.7 | 533 | 226.3 | 644 | 173.6 | 611 | 243 | 432 | 285.6 | 606 |
| 10 | | 181.7 | 545 | 162.7 | 533 | 201.7 | 644 | 152.6 | 611 | 198.8 | 432 | 240.6 | 607 |
| 5 | | 140.7 | 544 | 132.7 | 532 | 158.7 | 643 | 123.6 | 610 | 148.8 | 432 | 189.6 | 607 |
| 2.5 | | 113.7 | 541 | 109.7 | 529 | 123.6 | 640 | 102.6 | 606 | 118.7 | 430 | 158.6 | 605 |

FIG. 27G-2

| | | BWCT | | Breaking Length | Fiber Length [L(l)] ~ FS5 | | Breaking Length/ Fiber Length (Breaking Length Ratio) |
|---|---|---|---|---|---|---|---|
| Fiber | Never Dried? | g/in | kN/m | m | mm | micron | m/micron |
| Wheat Straw | Y | 1857 | 0.717 | 2725 | 0.839 | 839 | 3.25 |
| Bagasse | N | 1132 | 0.437 | 1661 | 0.924 | 924 | 1.80 |
| Hemp | N | 915 | 0.353 | 1343 | 1.26 | 1260 | 1.07 |
| Abaca | N | 712 | 0.275 | 1045 | 2.55 | 2550 | 0.41 |
| Bamboo | N | 461 | 0.178 | 676 | 1.51 | 1510 | 0.45 |
| Acacia | N | 558 | 0.215 | 819 | 0.722 | 722 | 1.13 |
| SSK | N | 485 | 0.187 | 712 | 2.38 | 2380 | 0.30 |
| NSK | N | 821 | 0.317 | 1205 | 2.205 | 2205 | 0.55 |
| Euc | N | 428 | 0.165 | 628 | 0.715 | 715 | 0.88 |

FIG. 28

| | | | | | | Fabric Layer | | | Center Layer | | | Wire Layer | | | % of total Sheet | | | |
|---|---|---|---|---|---|---|---|---|---|---|---|---|---|---|---|---|---|---|
| Substrate | Type | Sample ID | Fractionation | # Unique Layers | Non-wood | EUC | NSK /SW | Non-wood | EUC | NSK /SW | Non-wood | EUC | NSK /SW | Non-wood | EUC | Softwood | Non-wood | FSO/ WSO |
| Bath tissue | Inventive | 1 | Accepts to fabric | 2 | Bamboo | 84% | 0% | 16% | 32% | 54% | 14% | 32% | 54% | 14% | 52% | 33% | 15% | FSO |
| Bath tissue | Inventive | 2 | Accepts to fabric | 2 | Bamboo | 69% | 0% | 31% | 32% | 39% | 29% | 32% | 39% | 29% | 46% | 24% | 30% | FSO |
| Bath tissue | Inventive | 3 | Rejects to fabric | 2 | Bamboo | 77% | 0% | 23% | 32% | 59% | 10% | 32% | 59% | 10% | 49% | 36% | 15% | FSO |
| Bath tissue | Inventive | 4 | Rejects to fabric | 2 | Bamboo | 53% | 0% | 47% | 32% | 49% | 19% | 32% | 49% | 19% | 40% | 30% | 30% | FSO |
| Bath tissue | Inventive | 5 | Accepts to C/W, sewer rejects | 2 | Bamboo | 100% | 0% | 0% | 27% | 49% | 24% | 27% | 49% | 24% | 55% | 30% | 15% | FSO |
| Bath tissue | Inventive | 6 | Accepts to C/W, sewer rejects | 2 | Bamboo | 100% | 0% | 0% | 13% | 39% | 48% | 13% | 39% | 48% | 46% | 24% | 30% | FSO |
| Bath tissue | Inventive | 7 | No fractionation | 2 | Bamboo | 100% | 0% | 0% | 27% | 49% | 24% | 27% | 49% | 24% | 55% | 30% | 15% | FSO |
| Bath tissue | Inventive | 8 | No fractionation | 2 | Bamboo | 100% | 0% | 0% | 13% | 39% | 48% | 13% | 39% | 48% | 46% | 24% | 30% | FSO |
| Bath tissue | Inventive | 15 | No fractionation | 2 | Bamboo | 100% | 0% | 0% | 13% | 39% | 48% | 13% | 39% | 48% | 46% | 24% | 30% | FSO |
| Bath tissue | Inventive | 16 | Rejects to fabric | 2 | Bamboo | 53% | 0% | 47% | 32% | 49% | 19% | 32% | 49% | 19% | 40% | 30% | 30% | FSO |
| Bath tissue | Inventive | 17 | Rejects to fabric | 2 | Bamboo | 53% | 0% | 47% | 32% | 49% | 19% | 32% | 49% | 19% | 40% | 30% | 30% | FSO |
| Bath tissue | Inventive | 18 | Rejects to fabric | 2 | Bamboo | 21% | 0% | 79% | 32% | 36% | 32% | 32% | 36% | 32% | 28% | 22% | 50% | FSO |
| Bath tissue | Inventive | 19 | Rejects to fabric | 2 | Bamboo | 0% | 0% | 100% | 0% | 0% | 100% | 0% | 0% | 100% | 0% | 0% | 100% | FSO |
| Bath tissue | Inventive | 20 | Rejects to Wire | 2 | Bamboo | 47% | 35% | 18% | 47% | 35% | 18% | 47% | 0% | 53% | 47% | 23% | 30% | WSO |
| Bath tissue | Inventive | 21 | No frac. C/F only | 2 | Bamboo | 20% | 35% | 45% | 20% | 35% | 45% | 100% | 0% | 0% | 47% | 23% | 30% | WSO |
| Bath tissue | Inventive | 22 | No frac. both layers | 2 | Bamboo | 47% | 35% | 18% | 47% | 35% | 18% | 47% | 0% | 53% | 47% | 23% | 30% | WSO |
| Bath tissue | Inventive | 23 | Rejects to wire | 2 | Bamboo | 0% | 0% | 100% | 0% | 0% | 100% | 0% | 0% | 100% | 0% | 0% | 100% | WSO |

FIG. 29A-1

| | | | | | | | | | | | | | | | | | | |
|---|---|---|---|---|---|---|---|---|---|---|---|---|---|---|---|---|---|---|
| Bath tissue | Inventive | 24 | No fractionation | 1 | Bamboo | | | | | | | | | | 0% | 0% | 100% | WSO |
| Bath tissue | Inventive | 25 | | 1 | Bamboo | | | | | | | | | | 0% | 0% | 100% | WSO |
| Bath tissue | Inventive | 26 | | 1 | Bamboo | | | | | | | | | | 0% | 0% | 100% | WSO |
| Bath tissue | Inventive | 27 | | 1 | Bamboo | | | | | | | | | | 0% | 0% | 100% | WSO |
| Bath tissue | Inventive | 28 | | 2 | Abaca | 100% | 0% | 0% | 67% | 33% | 0% | 67% | 33% | 0% | 55% | 37% | 8.0% | FSO |
| Bath tissue | Inventive | 29 | | 2 | Abaca | 100% | 0% | 0% | 33% | 50% | 17% | 33% | 50% | 17% | 55% | 22.5% | 22.5% | FSO |
| Bath tissue | Inventive | 30 | | 2 | Abaca | 100% | 0% | 0% | 25% | 38% | 38% | 25% | 38% | 38% | 55% | 22.5% | 22.5% | FSO |
| Bath tissue | Inventive | 31 | | 2 | Abaca | 100% | 0% | 0% | 25% | 0% | 75% | 25% | 0% | 75% | 55% | 0% | 45% | FSO |
| Bath tissue | Inventive | 32 | | 2 | Abaca | 100% | 0% | 0% | 25% | 0% | 75% | 25% | 0% | 75% | 55% | 0% | 45% | FSO |
| Bath tissue | Inventive | 33 | | 2 | Abaca | 100% | 0% | 0% | 25% | 0% | 75% | 25% | 0% | 75% | 55% | 0% | 45% | FSO |

FIG. 29A-2

| | | | | | | Fabric Layer | | | Center Layer | | | Wire Layer | | | % of total Sheet | | | |
|---|---|---|---|---|---|---|---|---|---|---|---|---|---|---|---|---|---|---|
| Substrate | Type | Sample ID | Fractionation | # Unique Layers | Non-wood | EUC | NSK /SW | Non-wood | EUC | NSK /SW | Non-wood | EUC | NSK /SW | Non-wood | EUC | Softwood | Non-wood | FSO/ WSO |
| Bath tissue | Inventive | 34 | | 2 | Abaca | 23% | 65% | 12% | 23% | 65% | 12% | 100% | 0% | 0% | 50% | 42.5% | 7.5% | WSO |
| Bath tissue | Inventive | 35 | | 2 | Abaca | 23% | 54% | 23% | 23% | 54% | 23% | 100% | 0% | 0% | 50% | 35% | 15% | WSO |
| Bath tissue | Inventive | 36 | | 2 | Abaca | 23% | 38% | 38% | 23% | 38% | 38% | 100% | 0% | 0% | 50% | 25% | 25% | WSO |
| Bath tissue | Inventive | 37 | | 2 | Abaca | 23% | 38% | 8% | 23% | 38% | 8% | 100% | 0% | 0% | 50% | 25% | 25% | WSO |
| Bath tissue | Inventive | 38 | | 2 | Abaca | 23% | 0% | 77% | 23% | 0% | 77% | 100% | 0% | 0% | 50% | 0% | 50% | WSO |
| Bath tissue | Inventive | 39 | | 2 | Abaca | 23% | 0% | 77% | 23% | 0% | 77% | 100% | 0% | 0% | 50% | 0% | 50% | WSO |
| Bath tissue | Inventive | 40 | | 2 | Unbleached Bamboo | 67% | 33% | 0% | 67% | 33% | 0% | 0% | 0% | 100% | 43% | 21% | 36% | WSO |
| Bath tissue | Inventive | 41 | | 2 | Hemp | 67% | 33% | 0% | 67% | 33% | 0% | 0% | 0% | 100% | 44% | 22% | 34% | WSO |
| Bath tissue | Inventive | 42 | | 2 | Bagasse | 75% | 25% | 0% | 75% | 25% | 0% | 0% | 0% | 100% | 47% | 16% | 37% | WSO |
| Bath tissue | Inventive | 43 | | 2 | Cotton | 67% | 33% | 0% | 67% | 33% | 0% | 0% | 0% | 100% | 34% | 17% | 49% | WSO |
| Bath tissue | Inventive | 44 | | 3 | Bleached Bamboo | 0% | 0% | 100% | 0% | 100% | 0% | 0% | 0% | 100% | 0% | 11% | 89% | WSO |
| Bath tissue | Inventive | 50 | | 2 | Bamboo | 0% | 0% | 100% | 0% | 0% | 100% | 80% | 0% | 20% | 20% | 0% | 80% | WSO |
| Bath tissue | Inventive | 51 | | 2 | Bamboo | 0% | 0% | 100% | 0% | 0% | 100% | 80% | 0% | 20% | 20% | 0% | 80% | WSO |
| Bath tissue | Inventive | 52 | | 1 | Bamboo | | | | | | | | | | 0% | 0% | 100% | WSO |
| Bath tissue | Inventive | 53 | | 1 | Bamboo | | | | | | | | | | 0% | 0% | 100% | WSO |
| Bath tissue | Inventive | 54 | | 2 | Bamboo | 0% | 0% | 100% | 0% | 0% | 100% | 80% | 0% | 20% | 20% | 0% | 80% | WSO |
| Bath tissue | Inventive | 55 | | 2 | Bamboo | 0% | 0% | 100% | 0% | 0% | 100% | 80% | 0% | 20% | 20% | 0% | 80% | WSO |

FIG. 29B-1

| | | | | | | | | | | | | | | | | | | |
|---|---|---|---|---|---|---|---|---|---|---|---|---|---|---|---|---|---|---|
| Bath tissue | Traditional | Z01 | | 2 | | 100% | 0% | 0% | 32% | 68% | 0% | 32% | 68% | 0% | 58% | 42% | 0% | FSO |
| Bath tissue | Traditional | Z03 | | 2 | | 47% | 53% | 0% | 47% | 53% | 0% | 100% | 0% | 0% | 65% | 35% | 0% | WSO |
| Bath tissue | Traditional | Z04 | | 2 | | 47% | 53% | 0% | 47% | 53% | 0% | 100% | 0% | 0% | 65% | 35% | 0% | WSO |
| Bath tissue | Traditional | Z05 | | 2 | | 47% | 53% | 0% | 47% | 53% | 0% | 100% | 0% | 0% | 65% | 35% | 0% | WSO |
| Bath tissue | Traditional | Z06 | | 2 | | 47% | 53% | 0% | 47% | 53% | 0% | 100% | 0% | 0% | 65% | 35% | 0% | WSO |
| Bath tissue | Traditional | Z07 | | 2 | | 100% | 0% | 0% | 25% | 75% | 0% | 25% | 75% | 0% | 55% | 45% | 0% | FSO |
| Bath tissue | Traditional | Z08 | | 2 | | 23% | 77% | 0% | 23% | 77% | 0% | 100% | 0% | 0% | 50% | 50% | 0% | WSO |
| Bath tissue | Traditional | Z09 | | 2 | | 68% | 32% | 0% | 68% | 32% | 0% | 100% | 0% | 0% | 79% | 21% | 0% | WSO |
| Bath tissue | Traditional | Z10 | | 2 | | 66% | 34% | 0% | 66% | 34% | 0% | 100% | 0% | 0% | 78% | 22% | 0% | WSO |
| Bath tissue | Traditional | Z11 | | 3 | | 100% | 0% | 0% | 0% | 100% | 0% | 100% | 0% | 0% | 80% | 20% | 0% | WSO |
| Bath tissue | Traditional | Z13 | | 2 | | 100% | 0% | 0% | 32% | 68% | 0% | 32% | 68% | 0% | 58% | 42% | 0% | FSO |

FIG. 29B-2

| | | | | | % of total Sheet | | | |
|---|---|---|---|---|---|---|---|---|
| Substrate | Type | Sample ID | # Unique Layers | Non-wood | Euc | Softwood | Non-wood | FSO/ WSO |
| Towel | inventive | 9 | 1 | Bamboo | 37% | 53% | 10% | FSO |
| Towel | inventive | 10 | 1 | Bamboo | 42% | 48% | 10% | FSO |
| Towel | inventive | 11 | 1 | Bamboo | 34% | 46% | 20% | FSO |
| Towel | inventive | 12 | 1 | Bamboo | 44% | 36% | 20% | FSO |
| Towel | inventive | 13 | 1 | Bamboo | 31% | 40% | 30% | FSO |
| Towel | inventive | 14 | 1 | Bamboo | 46% | 24% | 30% | FSO |
| Towel | inventive | 45 | 1 | Bagasse | 40% | 25% | 35% | WSO |
| Towel | inventive | 46 | 1 | Flax | 40% | 25% | 35% | WSO |
| Towel | inventive | 47 | 1 | Hemp | 40% | 25% | 35% | WSO |
| Towel | inventive | 48 | 1 | Unbleached Bamboo | 40% | 25% | 35% | WSO |
| Towel | inventive | 49 | 1 | Abaca | 40% | 25% | 35% | WSO |
| Towel | inventive | 56 | 1 | Abaca | 35% | 0% | 65% | FSO |
| Towel | inventive | 57 | 1 | Abaca | 34% | 36% | 30% | FSO |
| Towel | inventive | 58 | 1 | Abaca | 36% | 33% | 31% | FSO |
| Towel | inventive | 59 | 1 | Abaca | 36% | 33% | 31% | FSO |
| Towel | inventive | 60 | 1 | Abaca | 36% | 33% | 31% | FSO |
| Towel | inventive | 61 | 1 | Abaca | 35% | 0% | 65% | FSO |
| Towel | inventive | 62 | 1 | Abaca | 40% | 0% | 60% | FSO |
| Towel | inventive | 63 | 1 | Abaca | 45% | 0% | 55% | FSO |
| Towel | inventive | 64 | 1 | Abaca | 35% | 0% | 65% | FSO |
| Towel | Traditional | Z02 | 1 | | 40% | 60% | 0% | FSO |
| Towel | Traditional | Z12 | 1 | | 40% | 60% | 0% | WSO |
| Towel | Traditional | Z14 | 1 | | 35% | 65% | 0% | FSO |
| Towel | Traditional | Z15 | 1 | | 35% | 65% | 0% | FSO |
| Towel | Traditional | Z16 | 1 | | 35% | 65% | 0% | FSO |

FIG. 30

ARRAYS OF SANITARY TISSUE PRODUCTS COMPRISING NON-WOOD(S)

CROSS REFERENCE TO RELATED APPLICATIONS

This application claims the benefit of U.S. Provisional Application No. 63/353,167, filed Jun. 17, 2022; U.S. Provisional Application No. 63/353,183, filed Jun. 17, 2022; U.S. Provisional Application No. 63/375,858, filed Sep. 16, 2022; U.S. Provisional Application No. 63/456,020, filed Mar. 31, 2023; and U.S. Provisional Application No. 63/472,379, filed Jun. 12, 2023, the entire disclosures of which are fully incorporated by reference herein.

FIELD OF THE INVENTION

The present disclosure relates to sanitary tissue products and arrays comprising non-wood fibers.

BACKGROUND OF THE INVENTION

Fibrous structures, including sanitary tissue products (e.g., paper towels, toilet tissue, facial tissue, disposable shop towels, wipes, etc.) are commonly packaged and marketed as an array of separate packages, where certain properties and/or compositions of the sanitary tissue products differ within the packages. For instance, it is currently known to be desirable to offer a first package as "strong" toilet tissue and a second package as "soft" toilet tissue. As will be described in greater detail below, the inventors of the present disclosure have made a number of improvements to the current offerings of a packaged non-wood sanitary tissue products, as well as improvements to the offering of arrays comprising sanitary tissue products comprising non-woods. As detailed herein, even though non-wood products have been previously disclosed in patent publications, as well as being marketed, there are a number of important areas that have not been regarded and there are several unmet needs.

One such area is offering a package of sanitary tissue products that comprise or consist of non-wood fibers along with one or more packages, as part of an array, of sanitary tissue products that do not comprise non-wood fibers. For instance, offering a "strong" sanitary tissue product in a first package, offering a "soft" sanitary tissue product in a second package, where neither the strong or soft offerings comprise non-wood fibers, and offering a "sustainable" sanitary tissue product in a third package, where the sustainable sanitary tissue product comprises or consists of non-wood fibers. In such a case, the sustainable offering has the challenge of fitting into the existing offering architecture that is not focused on sustainability—it takes skill to get the sustainable offering to fit into the existing architecture with harmony. There are challenges associated with what and how the new sustainable product conveys sustainability, as well as challenges with the sustainable package disposition relative to the disposition of the existing packages of products in the offering. If not done properly, shoppers may not realize that the new sustainable offering is part of the existing architecture and/or may not realize that the new sustainable offering is sold by the same maker of the existing offerings. This is especially challenging when the new sustainable offering is a premium product because users have learned that sustainable products often have lower performance characteristics than existing products; see, for example, FIGS. 21A-K, which illustrate that sanitary tissue products of the present disclosure, which comprise relevant amounts of non-wood fibers, have superior performance in a number of key parameters versus currently and previously marketed sanitary tissue products comprising non-wood fibers.

Another challenge when introducing sustainable offerings into an existing product architecture, beyond ensuring that the shopper understands that the sustainable offering is "sustainable" and that it has certain premium properties and is part of the existing architecture, is to ensure that the reputation of the existing products are not compromised. That is, while a company may effectively convey that a sustainable product is an addition to an existing architecture, the risk is that the shopper may inappropriately assume that the existing architecture has lost performance or premiumness because it is now associated with the sustainable offering. The inventors of the present disclosure disclose effective ways of maintaining the integrity of the existing products while effectively conveying the composition and properties of the new sustainable offering.

Package placement, graphics, and color scheme, among other considerations, of the new sustainable offering(s) disclosed herein, relative to those of the existing offerings, can play a key role in conveying the composition and/or performance of the new sustainable offering, while preserving the reputation of the existing products. Often, in such an arrangement as the one described above, it may be desirable use different, but complimentary colors, and it may be desirable to place the sustainable offering between the existing (e.g., soft and strong) offerings or to the far side, but still immediately adjacent to the existing offerings. In some instances, the new sustainable offering may be softer than an existing offering (e.g., the strong offering) and/or stronger than the existing offering (e.g., soft offering). Depending which existing offering the new sustainable offering is closest to, property-wise, placement of the sustainable offering may be impacted. For example, a new sustainable offering that is strong may be placed next to an existing "strong" offering or a new sustainable offering that is soft may be placed next to the existing "soft" offering. The inventors of the present disclosure detail new ways of conveying that a new sustainable product has certain properties, and how those new sustainable properties relate to the existing products.

In another array example, the existing offerings, such as the "soft" and/or the "strong" offerings, may be modified to comprise a lower percentage of non-wood fibers than the "sustainable" offering does. In such cases, there is a challenge to communicate the differences between the product compositions, while conveying what the user can expect the properties of the products to be. For example, it may be very confusing to convey that the existing products are now sustainable, but that there is also an option to buy an even more sustainable product as part of the same array. A user may be confused about why the existing products weren't made more sustainable instead of offering an additional sustainable product as part of the array. As previously said, the shopper may wonder if they are giving up performance if they choose the "sustainable" offering; and the shopper may wonder if the existing offerings (e.g., the "soft" and/or "strong" offerings) have been compromised to be more sustainable than they were.

As said above, it takes a lot of skill to get new sustainable offerings to fit into the existing architecture with harmony; and this is even more true when existing offering are also made more sustainable. Particularly, when one or more existing products have been made more sustainable in combination with adding a new sustainable offering, it may be desirable to convey the type of sustainability each product in the array has. For example, it may be desirable to convey that the "soft" offering has sustainable packaging, while conveying that the new "sustainable" offering comprises non-wood fibers, and, maybe, that the "strong" offering is made using sustainable manufacturing practices.

When modifying an existing product offering to be more sustainable and adding a new sustainable product to the offering, the shopper may question why there is a need for the new sustainable offering or may wonder if the new sustainable offering is, for example, as soft or as strong as the existing offerings. For these reasons, the inventors have found that it may be desirable to convey the level of sustainability of each product in the array, such as conveying that the existing "soft" and/or "strong" offerings have, for example, two sustainable claims, while the new sustainable offering has, for example, four sustainable claims: e.g., it is made using sustainable manufacturing practices (like 85% less water is used to make it), it is made of 100% sustainable fibers (like 100% bamboo), it is packaged in sustainable packaging (like compostable or plant-based plastic), and that actions are being taken to reverse environmental harms (like trees are planted for every package sold). This approach helps the shopper to understand the level of sustainability of each product in the offering.

As for arrays where the existing products do not comprise non-wood fibers, communication of level of sustainability for arrays where the existing products do comprise non-wood fibers may be desirable to convey product performance. Without such a conveyance, the shopper may not understand the level of performance the new sustainable offering has versus the existing product offerings of the array. Thus, it may be desirable to convey that the new sustainable offering has performance characteristics comparable to the existing products that were modified to be more sustainable.

Other approaches and embodiments that address adding a "sustainable" embodiment to an existing array are disclosed in greater detail in the specification below.

SUMMARY

In a first aspect of the present disclosure, an array of sanitary tissue products may comprise a first sanitary tissue product in a first package that conveys strength, absorption, and/or softness; and a second sanitary tissue product in a second package that conveys sustainability. TS7, TS750, lint, slip stick, tensile ratio, VFS, and SST may be common intensive properties of the first and second sanitary tissue products. At least one of TS7, TS750, lint, slip stick, tensile ratio, VFS, and SST of the first sanitary tissue product may be at least 5% different than, but within 25% of, the TS7, TS750, lint, slip stick, tensile ratio, VFS, and SST, respectively, of the second sanitary tissue product. The second sanitary tissue product may comprise a non-wood. The first and second sanitary tissue product packages may be separate from and adjacent to each other. Each of the first and second sanitary tissue product packages may comprise a common single source identifier. The first and second sanitary tissue product packages may comprise different sub-brand name portions.

BRIEF DESCRIPTION OF THE DRAWINGS

FIG. 22A is a table comprising an array of sanitary tissue products within the scope of the present disclosure. FIG. 22A of the present case illustrates Table 1 from U.S. Patent Application Ser. No. 63/375,858, titled "Sanitary Tissue Products and Arrays Comprising Non-wood Fibers," and filed on Sep. 16, 2022.

FIG. 22B is a table comprising an array of sanitary tissue products within the scope of the present disclosure. FIG. 22B of the present case illustrates Table 2 from U.S. Patent Application Ser. No. 63/375,858, titled "Sanitary Tissue Products and Arrays Comprising Non-wood Fibers," and filed on Sep. 16, 2022.

FIG. 22C is a table comprising an array of sanitary tissue products within the scope of the present disclosure. FIG. 22C of the present case illustrates Table 3 from U.S. Patent Application Ser. No. 63/375,858, titled "Sanitary Tissue Products and Arrays Comprising Non-wood Fibers," and filed on Sep. 16, 2022.

FIG. 22D is a table comprising an array of sanitary tissue products within the scope of the present disclosure. FIG. 22D of the present case illustrates Table 4 from U.S. Patent Application Ser. No. 63/375,858, titled "Sanitary Tissue Products and Arrays Comprising Non-wood Fibers," and filed on Sep. 16, 2022.

FIG. 22E is a table comprising an array of sanitary tissue products within the scope of the present disclosure. FIG. 22E of the present case illustrates Table 5 from U.S. Patent Application Ser. No. 63/375,858, titled "Sanitary Tissue Products and Arrays Comprising Non-wood Fibers," and filed on Sep. 16, 2022.

FIG. 22F is a table comprising an array of sanitary tissue products within the scope of the present disclosure. FIG. 22F of the present case illustrates Table 6 from U.S. Patent Application Ser. No. 63/375,858, titled "Sanitary Tissue Products and Arrays Comprising Non-wood Fibers," and filed on Sep. 16, 2022.

FIG. 22G is a table comprising an array of sanitary tissue products within the scope of the present disclosure. FIG. 22G of the present case illustrates Table 7 from U.S. Patent Application Ser. No. 63/375,858, titled "Sanitary Tissue Products and Arrays Comprising Non-wood Fibers," and filed on Sep. 16, 2022.

FIG. 22H is a table comprising an array of sanitary tissue products within the scope of the present disclosure. FIG. 22H of the present case illustrates Table 8 from U.S. Patent Application Ser. No. 63/375,858, titled "Sanitary Tissue Products and Arrays Comprising Non-wood Fibers," and filed on Sep. 16, 2022.

FIG. 22I is a table comprising an array of sanitary tissue products within the scope of the present disclosure. FIG. 22I of the present case illustrates Table 9 from U.S. Patent Application Ser. No. 63/375,858, titled "Sanitary Tissue Products and Arrays Comprising Non-wood Fibers," and filed on Sep. 16, 2022.

FIG. 23A is a table that details multiple inventive and comparative sanitary tissue product embodiments comprising non-wood fibers, specifically detailing multiple properties (note: common numbers between the tables indicate the same sample). FIG. 23A of the present case illustrates a portion of Table 2 from U.S. Patent Application Ser. No. 63/456,020, titled "Fibrous Structures Comprising Non-wood Fibers," and filed on Mar. 31, 2023.

FIG. 23B is a table that details multiple inventive and comparative sanitary tissue product embodiments comprising non-wood fibers, specifically detailing multiple properties (note: common numbers between the tables indicate the same sample). FIG. 23B of the present case illustrates a portion of Table 2 from U.S. Patent Application Ser. No. 63/456,020, titled "Fibrous Structures Comprising Non-wood Fibers," and filed on Mar. 31, 2023.

FIG. 24A is a table that details multiple inventive and comparative sanitary tissue product embodiments comprising non-wood fibers, specifically detailing multiple properties (note: common numbers between the tables indicate the same sample). FIG. 24A of the present case illustrates a portion of Table 3 from U.S. Patent Application Ser. No. 63/456,020, titled "Fibrous Structures Comprising Non-wood Fibers," and filed on Mar. 31, 2023.

FIGS. 24B-1, 24B-2, and 24B-3 are three segments of a table that details multiple inventive and comparative sanitary tissue product embodiments comprising non-wood fibers, specifically detailing multiple properties (note: common numbers between the tables indicate the same sample).

FIGS. 24B-1, 24B-2, and 24B-3 of the present case illustrates a portion of Table 3 from U.S. Patent Application Ser. No. 63/456,020, titled "Fibrous Structures Comprising Non-wood Fibers," and filed on Mar. 31, 2023.

FIGS. 24C-1, 24C-2, and 24C-3 are three segments of a table that details multiple inventive and comparative sanitary tissue product embodiments comprising non-wood fibers, specifically detailing multiple properties (note: common numbers between the tables indicate the same sample). FIGS. 24C-1, 24C-2, and 24C-3 of the present case illustrates a portion of Table 3 from U.S. Patent Application Ser. No. 63/456,020, titled "Fibrous Structures Comprising Non-wood Fibers," and filed on Mar. 31, 2023.

FIGS. 24D-1, 24D-2, and 24D-3 are three segments of a table that details multiple inventive and comparative sanitary tissue product embodiments comprising non-wood fibers, specifically detailing multiple properties (note: common numbers between the tables indicate the same sample). FIGS. 24D-1, 24D-2, and 24D-3 of the present case illustrates a portion of Table 3 from U.S. Patent Application Ser. No. 63/456,020, titled "Fibrous Structures Comprising Non-wood Fibers," and filed on Mar. 31, 2023.

FIGS. 24E-1, 24E-2, and 24E-3 are three segments of a table that details multiple inventive and comparative sanitary tissue product embodiments comprising non-wood fibers, specifically detailing multiple properties (note: common numbers between the tables indicate the same sample). FIGS. 24E-1, 24E-2, and 24E-3 of the present case illustrates a portion of Table 3 from U.S. Patent Application Ser. No. 63/456,020, titled "Fibrous Structures Comprising Non-wood Fibers," and filed on Mar. 31, 2023.

FIGS. 24F-1 and 24F-2 are two segments of a table that details multiple inventive and comparative sanitary tissue product embodiments comprising non-wood fibers, specifically detailing multiple properties (note: common numbers between the tables indicate the same sample). FIGS. 24F-1 and 24F-2 of the present case illustrates a portion of Table 3 from U.S. Patent Application Ser. No. 63/456,020, titled "Fibrous Structures Comprising Non-wood Fibers," and filed on Mar. 31, 2023.

FIGS. 24G-1 and 24G-2 are two segments of a table that details multiple inventive and comparative sanitary tissue product embodiments comprising non-wood fibers, specifically detailing multiple properties (note: common numbers between the tables indicate the same sample). FIGS. 24G-1 and 24G-2 of the present case illustrates a portion of Table 3 from U.S. Patent Application Ser. No. 63/456,020, titled "Fibrous Structures Comprising Non-wood Fibers," and filed on Mar. 31, 2023.

FIGS. 24H-1 and 24H-2 are two segments of a table that details multiple inventive and comparative sanitary tissue product embodiments comprising non-wood fibers, specifically detailing multiple properties (note: common numbers between the tables indicate the same sample). FIGS. 24H-1 and 24H-2 of the present case illustrates a portion of Table 3 from U.S. Patent Application Ser. No. 63/456,020, titled "Fibrous Structures Comprising Non-wood Fibers," and filed on Mar. 31, 2023.

FIG. 24I is a table that details multiple inventive and comparative sanitary tissue product embodiments comprising non-wood fibers, specifically detailing multiple properties (note: common numbers between the tables indicate the same sample). FIG. 24I of the present case illustrates a portion of Table 3 from U.S. Patent Application Ser. No. 63/456,020, titled "Fibrous Structures Comprising Non-wood Fibers," and filed on Mar. 31, 2023.

FIG. 24J is a table that details multiple inventive and comparative sanitary tissue product embodiments comprising non-wood fibers, specifically detailing multiple properties (note: common numbers between the tables indicate the same sample). FIG. 24J of the present case illustrates a portion of Table 3 from U.S. Patent Application Ser. No. 63/456,020, titled "Fibrous Structures Comprising Non-wood Fibers," and filed on Mar. 31, 2023.

FIG. 25A is a table that details multiple inventive and comparative sanitary tissue product embodiments comprising non-wood fibers, specifically detailing multiple properties (note: common numbers between the tables indicate the same sample). FIG. 25A of the present case illustrates a portion of Table 3a from U.S. Patent Application Ser. No. 63/456,020, titled "Fibrous Structures Comprising Non-wood Fibers," and filed on Mar. 31, 2023.

FIG. 25B is a table that details multiple inventive and comparative sanitary tissue product embodiments comprising non-wood fibers, specifically detailing multiple properties (note: common numbers between the tables indicate the same sample). FIG. 25B of the present case illustrates a portion of Table 3a from U.S. Patent Application Ser. No. 63/456,020, titled "Fibrous Structures Comprising Non-wood Fibers," and filed on Mar. 31, 2023.

FIG. 25C is a table that details multiple inventive and comparative sanitary tissue product embodiments comprising non-wood fibers, specifically detailing multiple properties (note: common numbers between the tables indicate the same sample). FIG. 25C of the present case illustrates a portion of Table 3a from U.S. Patent Application Ser. No.

Figure 1A:
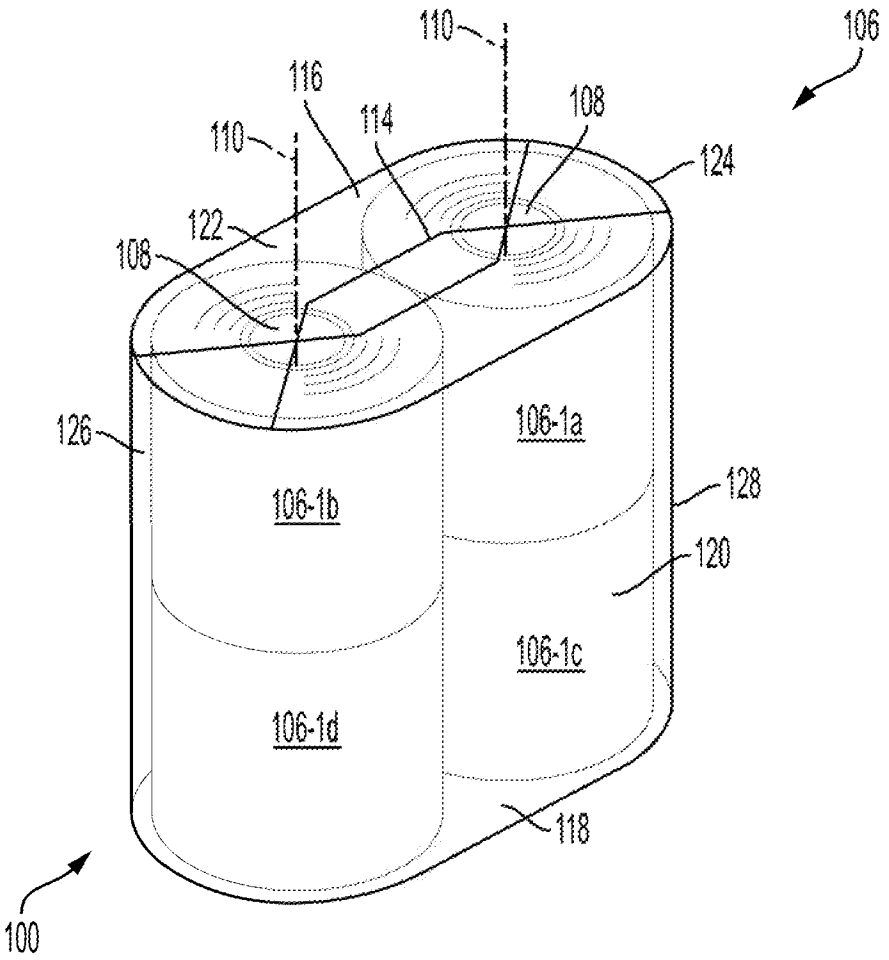
FIG. 1A is a simplified perspective view of a package comprising multiple rolls of sanitary tissue product.

63/456,020, titled "Fibrous Structures Comprising Non-wood Fibers," and filed on Mar. 31, 2023.

FIG. 25D is a table that details multiple inventive and comparative sanitary tissue product embodiments comprising non-wood fibers, specifically detailing multiple properties (note: common numbers between the tables indicate the same sample). FIG. 25D of the present case illustrates a portion of Table 3a from U.S. Patent Application Ser. No. 63/456,020, titled "Fibrous Structures Comprising Non-wood Fibers," and filed on Mar. 31, 2023.

FIG. 25E is a table that details multiple inventive and comparative sanitary tissue product embodiments comprising non-wood fibers, specifically detailing multiple properties (note: common numbers between the tables indicate the same sample). FIG. 25E of the present case illustrates a portion of Table 3a from U.S. Patent Application Ser. No. 63/456,020, titled "Fibrous Structures Comprising Non-wood Fibers," and filed on Mar. 31, 2023.

FIG. 25F is a table that details multiple inventive and comparative sanitary tissue product embodiments comprising non-wood fibers, specifically detailing multiple properties (note: common numbers between the tables indicate the same sample). FIG. 25F of the present case illustrates a portion of Table 3a from U.S. Patent Application Ser. No. 63/456,020, titled "Fibrous Structures Comprising Non-wood Fibers," and filed on Mar. 31, 2023.

FIG. 26 is a table that details fiber morphology of the fibers used in sanitary tissue products comprising non-wood fibers (note: common numbers between the tables indicate the same sample). In FIG. 26, fiber count (length average, million/g) is calculated from length weighted fiber average and coarseness via the following equation (where L(1) has the units of mm/fiber and coarseness has the units of mg/m):Fiber count=1/(L(1)×coarseness). And, fiber count (number average, million/g) is calculated from length weighted fiber average and coarseness via the following equation (where L(n) has the units of mm/fiber and coarseness has the units of mg/m): Fiber count=1/(L(n)×coarseness). FIG. 26 of the present case illustrates Table 4 from U.S. Patent Application Ser. No. 63/456,020, titled "Fibrous Structures Comprising Non-wood Fibers," and filed on Mar. 31, 2023.

FIGS. 27A-1 and 27A-2 are two segments of a table that details PVD data of sanitary tissue products comprising non-wood fibers (common numbers between the tables indicate the same sample). FIGS. 27A-1 and 27A-2 of the present case illustrate a portion of Table 5 from U.S. Patent Application Ser. No. 63/456,020, titled "Fibrous Structures Comprising Non-wood Fibers," and filed on Mar. 31, 2023.

FIGS. 27B-1 and 27B-2 are two segments of a table that details PVD data of sanitary tissue products of the present disclosure comprising non-wood fibers (common numbers between the tables indicate the same sample). FIGS. 27B-1 and 27B-2 of the present case illustrate a portion of Table 5 from U.S. Patent Application Ser. No. 63/456,020, titled "Fibrous Structures Comprising Non-wood Fibers," and filed on Mar. 31, 2023.

FIGS. 27C-1 and 27C-2 are two segments of a table that details PVD data of sanitary tissue products of the present disclosure comprising non-wood fibers (common numbers between the tables indicate the same sample). FIGS. 27C-1 and 27C-2 of the present case illustrate a portion of Table 5 from U.S. Patent Application Ser. No. 63/456,020, titled "Fibrous Structures Comprising Non-wood Fibers," and filed on Mar. 31, 2023.

FIGS. 27D-1 and 27D-2 are two segments of a table that details PVD data of sanitary tissue products of the present disclosure comprising non-wood fibers (common numbers between the tables indicate the same sample). FIGS. 27D-1 and 27D-2 of the present case illustrate a portion of Table 5 from U.S. Patent Application Ser. No. 63/456,020, titled "Fibrous Structures Comprising Non-wood Fibers," and filed on Mar. 31, 2023.

FIGS. 27E-1 and 27E-2 are two segments of a table that details PVD data of sanitary tissue products of the present disclosure comprising non-wood fibers (common numbers between the tables indicate the same sample). FIGS. 27E-1 and 27E-2 of the present case illustrate a portion of Table 5 from U.S. Patent Application Ser. No. 63/456,020, titled "Fibrous Structures Comprising Non-wood Fibers," and filed on Mar. 31, 2023.

FIGS. 27F-1 and 27F-2 are two segments of a table that details PVD data of sanitary tissue products of the present disclosure comprising non-wood fibers (common numbers between the tables indicate the same sample). FIGS. 27C-1 and 27C-2 of the present case illustrate a portion of Table 5 from U.S. Patent Application Ser. No. 63/456,020, titled "Fibrous Structures Comprising Non-wood Fibers," and filed on Mar. 31, 2023.

FIGS. 27G-1 and 27G-2 are two segments of a table that details PVD data of sanitary tissue products of the present disclosure comprising non-wood fibers (common numbers between the tables indicate the same sample). FIGS. 27G-1 and 27G-2 of the present case illustrate a portion of Table 5 from U.S. Patent Application Ser. No. 63/456,020, titled "Fibrous Structures Comprising Non-wood Fibers," and filed on Mar. 31, 2023.

FIG. 28 is a table that details the fiber characteristic differences between non-wood fibers that are never-dried and that have been once-dried. FIG. 28 of the present case illustrates Table 6 from U.S. Patent Application Ser. No. 63/456,020, titled "Fibrous Structures Comprising Non-wood Fibers," and filed on Mar. 31, 2023.

FIGS. 29A-1 and 29A-2 are two segments of a table that details multiple inventive sanitary tissue product embodiments, specifically detailing fiber type and percent incorporation into specific layers and plies of the sanitary tissue product. FIGS. 29A-1 and 29A-2 of the present case illustrate a portion of Table 1 from U.S. Patent Application Ser. No. 63/456,020, titled "Fibrous Structures Comprising Non-wood Fibers," and filed on Mar. 31, 2023.

FIGS. 29B-1 and 29B-2 are two segments of a table that details multiple inventive sanitary tissue product embodiments, specifically detailing fiber type and percent incorporation into specific layers and plies of the sanitary tissue product. FIGS. 29B-1 and 29B-2 of the present case illustrate a portion of Table 1 from U.S. Patent Application Ser. No. 63/456,020, titled "Fibrous Structures Comprising Non-wood Fibers," and filed on Mar. 31, 2023.

FIG. 30 is a table that details multiple inventive sanitary tissue product embodiments, specifically detailing fiber type and percent incorporation into specific layers and plies of the sanitary tissue product. FIG. 30 of the present case illustrate Table 1a from U.S. Patent Application Ser. No. 63/456,020, titled "Fibrous Structures Comprising Non-wood Fibers," and filed on Mar. 31, 2023.

Each of the tables and figures from U.S. Patent Application Ser. No. 63/456,020, titled "Fibrous Structures Comprising Non-wood Fibers," and filed on Mar. 31, 2023, each of the tables and figures from Ser. No. 63/375,858, titled "Sanitary Tissue Products and Arrays Comprising Non-wood Fibers," and filed on Sep. 16, 2022, and each of the tables and figures from Ser. No. 63/472,379, titled "Sanitary Tissue Products and Arrays Comprising Non-wood Fibers," and filed on Jun. 12, 2023 are incorporated herein, in their entirety, by reference.

Inventive sanitary tissue product embodiments illustrated in the figures above, specifically including the inventive sanitary tissue products illustrated in FIGS. 21A-30, may be, but are not required to be, used in the inventive arrays of the present disclosure.

DETAILED DESCRIPTION OF THE INVENTION

The following term explanations may be useful in understanding the present disclosure: "Fiber" as used herein means an elongate particulate having an apparent length greatly exceeding its apparent diameter, i.e., a length to diameter ratio of at least about 10. Fibers having a non-circular cross-section are common; the "diameter" in this case may be considered to be the diameter of a circle having cross-sectional area equal to the cross-sectional area of the fiber. More specifically, as used herein, "fiber" refers to fibrous structure-making fibers. The present disclosure contemplates the use of a variety of fibrous structure-making fibers, such as, for example, natural fibers, including wood fibers, or synthetic fibers made from natural polymers and/or synthetic fibers, or any other suitable fibers, and any combination thereof.

"Fibrous structure" as used herein means a structure (web) that comprises one or more fibers. Non-limiting examples of processes for making fibrous structures include known wet-laid fibrous structure making processes, air-laid fibrous structure making processes, meltblowing fibrous structure making processes, co-forming fibrous structure making processes, and spunbond fibrous structure making processes. Such processes typically include steps of preparing a fiber composition, oftentimes referred to as a fiber slurry in wet-laid processes, either wet or dry, and then depositing a plurality of fibers onto a forming wire or belt such that an embryonic fibrous structure is formed, drying and/or bonding the fibers together such that a fibrous structure is formed, and/or further processing the fibrous structure such that a finished fibrous structure is formed. The fibrous structure may be a through-air-dried fibrous structure and/or conventionally dried fibrous structure. The fibrous structure may be creped or uncreped. The fibrous structure may exhibit differential density regions or may be substantially uniform in density. The fibrous structure may be pattern densified, conventionally felt-pressed and/or high-bulk, uncompacted. The fibrous structures may be homogenous or multilayered in construction.

After and/or concurrently with the forming of the fibrous structure, the fibrous structure may be subjected to physical transformation operations such as embossing, calendaring, selfing, printing, folding, softening, ring-rolling, applying additives, such as latex, lotion and softening agents, combining with one or more other plies of fibrous structures, and the like to produce a finished fibrous structure that forms and/or is incorporated into a sanitary tissue product.

"Non-wood fiber(s)" or "non-wood content" means naturally-occurring fibers derived from non-wood plants, including mineral fibers, plant fibers and mixtures thereof, and specifically excluding non-naturally-occurring fibers (e.g., synthetic fibers). Animal fibers may, for example, be selected from the group consisting of: wool, silk and other naturally-occurring protein fibers and mixtures thereof. The plant fibers may, for example, be obtained directly from a plant. Nonlimiting examples of suitable plants include cotton, cotton linters, flax, sisal, abaca, hemp, Hesper aloe, jute, bamboo, bagasse, kudzu, corn, sorghum, gourd, agave, loofah, trichomes, seed-hairs, wheat, and mixtures thereof.

Further, non-wood fibers of the present disclosure may be derived from one or more non-wood plants of the family Asparagaceae. Suitable non-wood plants may include, but are limited to, one or more plants of the genus *Agave* such as *A. tequilana, A. sisalana* and *A. fourcroyde*, and one or more plants of the genus *Hesperaloe* such as *H. funifera, H. parviflora, H. nocturna, H. chiangii, H. tenuifolia, H. engelmannii*, and *H. malacophylla*. Further, the non-wood fibers of the present disclosure may be prepared from one or more plants of the of the genus *Hesperaloe* such as *H. funifera, H. parviflora, H. nocturna, H. chiangii, H. tenuifolia, H. engelmannii*, and *H. malacophylla*.

"Wood fiber(s)" or "wood content" means fibers derived from both deciduous trees (hereinafter, also referred to as "hardwood") and coniferous trees (hereinafter, also referred to as "softwood") may be utilized. Wood fibers may be short (typical of hardwood fibers) or long (typical of softwood fibers). Nonlimiting examples of short fibers include fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia. Nonlimiting examples of long fibers include fibers derived from Pine, Spruce, Fir, Tamarack, Hemlock, Cypress, and Cedar.

"Synthetic fiber(s)" or "synthetic content" means fibers human-made fibers, and specifically excludes "wood fibers" and "non-wood fibers." Synthetic fibers can be used, in combination with wood and/or non-wood fibers (e.g., bamboo) in the fibrous structures of the present disclosure. Synthetic fibers may be polymeric fibers. Synthetic fibers may comprise elastomeric polymers, polypropylene, polyethylene, polyester, polyolefin, polyvinyl alcohol and nylon, which are obtained from petroleum sources. Additionally, synthetic fibers may be polymeric fibers comprising natural polymers, which are obtained from natural sources, such as starch sources, protein sources and/or cellulose sources may be used in the fibrous structures of the present disclosure. The synthetic fibers may be produced by any suitable methods known in the art.

"Sanitary tissue product" as used herein means a wiping implement for post-urinary and/or post-bowel movement cleaning (referred to as "toilet paper," "toilet tissue," or "toilet tissue product"), for otorhinolaryngological discharges (referred to as "facial tissue" or "facial tissue product") and/or multi-functional absorbent and cleaning uses (referred to as "paper towels," "paper towel products," "absorbent towels," "absorbent towel products," such as paper towel or "wipe products," and including "napkins").

"Ply" or "plies" as used herein means an individual finished fibrous structure optionally to be disposed in a substantially contiguous, face-to-face relationship with other plies, forming a multiple ply ("multi-ply") sanitary tissue product. It is also contemplated that a single-ply sanitary tissue product can effectively form two "plies" or multiple "plies", for example, by being folded on itself.

"Machine Direction" or "MD" as used herein means the direction parallel to the flow of the fibrous structure through the papermaking machine and/or product manufacturing equipment. In one example, once incorporated into a sanitary tissue product, the MD of the fibrous structure may be the MD of the sanitary tissue product.

"Cross Machine Direction" or "CD" as used herein means the direction perpendicular to the machine direction in the same plane of the fibrous structure. In one example, once incorporated into a sanitary tissue product, the CD of the fibrous structure may be the CD of the sanitary tissue product.

"Basis Weight" or "BW" as used herein is the weight per unit area of a sample reported in lbs/3000 $ft^2$ or $g/m^2$. The basis weight is measured herein by the basis weight test method described in the Test Methods section herein.

"Dry Tensile Strength" (or "tensile strength" or "total dry tensile" or "TDT") of a fibrous structure of the present disclosure and/or a sanitary tissue product comprising such fibrous structure is measured according to the Tensile Strength Test Method described herein. Higher TDT values are associated with stronger products and this is true for other tensile values, such as tensile ratio.

"Softness" of a fibrous structure or a sanitary tissue product as used herein may be determined according to the Softness Test Method described in the Test Methods section, which utilizes a human panel evaluation wherein the softness of a test product is measured versus the softness of a control or standard product; the resulting number being a relative measure of softness between the two fibrous structures and/or sanitary tissue products. Softness of a fibrous structure or a sanitary tissue product may also or alternatively be measured using TS7 according to the Emtec Test Method described in the Test Methods section.

"Absorbency" of a fibrous structure or a sanitary tissue as used herein means the characteristic to take up and retain fluids, particularly water and aqueous solutions and suspensions. In evaluating absorbency, not only is the absolute quantity of fluid a fibrous structure or a sanitary tissue product will hold significant, but the rate at which the fluid is absorbed can also be important. Absorbency may be measured herein as HFS (g/g) as capacity, CRT (g/sec) rate, SST (/sec^0.5) rate, VFS (g/g) as capacity, PVD (mg), residual water (%), and/or CRT (g/g or g/in^2) as capacity. More positive values for HFS, CRT (rate and capacity), SST, VFS, PVD, and residual water are associated with a more absorbent product.

"Lint" as used herein means any material that originated from a fibrous structure according to the present disclosure and/or sanitary tissue product comprising such fibrous structure that remains on a surface after which the fibrous structure and/or sanitary tissue product has come into contact. The lint value of a fibrous structure and/or sanitary tissue product comprising such fibrous structure is determined according to the Lint Test Method described herein.

"Texture" as used herein means any pattern present in the fibrous structure. For example, a pattern may be imparted to the fibrous structure during the fibrous structure-making process, such as during, for example, a TAD, UCTAD, fabric crepe, NTT, and/or QRT transfer step. A pattern may also be imparted to the fibrous structure by embossing the finished fibrous structure during the converting process and/or by any other suitable process known in the art.

"Color" as used herein, means a visual effect resulting from a human eye's ability to distinguish the different wavelengths or frequencies of light. The apparent color of an object depends on the wavelength of the light that it reflects. While a wide palette of colors can be employed herein, it is preferred to use a member selected from the group consisting of orange, purple, lavender, red, green, blue, yellow, and violet. The method for measuring color is described in the Color Test Method described herein.

"Rolled product(s)" as used herein include fibrous structures, paper, and sanitary tissue products that are in the form of a web and can be wound about a core. For example, rolled sanitary tissue products can be convolutedly wound upon itself about a core or without a core to form a sanitary tissue product roll and can be perforated into the form of discrete sheets, as is commonly known for toilet tissue and paper towels.

"Stacked product(s)" as used herein include fibrous structures, paper, and sanitary tissue products that are in the form of a web and cut into distinct separate sheets, where the sheets are folded (e.g., z-folded or c-folded) and may be interleaved with each other, such that a trailing edge of one is connected with a leading edge of another. Common examples of stacks of folded and/or interleaved sheets include facial tissues and napkins.

"Percent (%) difference," "X % difference," or "X % different" is calculated by: subtracting the lower value (e.g., common intensive property value) from the higher value (e.g., common intensive property value) and then dividing that value by the average of the lower and higher values, and then multiplying the result by 100.

"Within X %" or "within X percent" is calculated by the following non-limiting example: If first and second sanitary tissue products have a common intensive property (e.g., lint), and if a second lint value of the second sanitary tissue product is 10, then "within 25%" of the second lint value is calculated as follows for this example: multiplying 10 (the second lint value) by 25%, which equals 2.5, and then adding 2.5 to 10 (the second lint value) and subtracting 2.5 from 10 (the second lint value) to get a range, so that "within 25%" of the second lint value for this example means a lint value of or between 12.5 and 7.5). The absolute value of "X % change" can be used to determine if "within X %" is satisfied; for example can also be determined by using the absolute For example, if "X % change" is −25%, then a "within 25%" is satisfied, but if "X % change" is −25%, a "within 20%" is not satisfied.

"Percent (%) change," "X % change," or "X % change" is calculated by: subtracting the reference value (e.g., common intensive property value of a sustainable sanitary tissue product) from the comparative value (e.g., common intensive property value of a sanitary tissue product) and then dividing by the reference value, and then multiplying the result by 100. For example, if a reference value is 18 (e.g., a basis weight of a sustainable sanitary tissue product) and the comparative value is 31 (e.g., a basis weight of a soft sanitary tissue product), then 18 should be subtracted from 31, which equals 13, which should be divided by 18, which equals 0.722, which should be multiplied by 100, which equals 72.2% change.

Generally, the "bamboo," "bamboo fibers," "bamboo content," or "bamboo fiber content" incorporated into fibrous structure(s) of the present disclosure are fibrous materials derived from any bamboo species. More particularly, the bamboo fiber species may be selected from the group consisting of *Acidosasa* sp., *Ampleocalamus* sp., *Arundinaria* sp., *Bambusa* sp., *Bashania* sp., *Borinda* sp., *Brachystachyum* sp., *Cephalostachyum* sp., *Chimonobambusa* sp., *Chusquea* sp., *Dendrocalamus* sp., *Dinochloa* sp., *Drepanostachyum* sp., *Eremitis* sp., *Fargesia* sp., *Gaoligongshania* sp., *Gelidocalamus* sp., *Gigantocloa* sp., *Guadua* sp., *Hibanobambusa* sp., *Himalayacalamus* sp., *Indocalamus* sp., *Indosasa* sp., *Lithachne* sp., *Melocanna* sp., *Menstruocalamus* sp., *Nastus* sp., *Neohouzeaua* sp., *Neomicrocalamus* sp., *Ochlandra* sp., *Oligostachyum* sp., *Olmeca* sp., *Otatea* sp., *Oxytenanthera* sp., *Phyllostachys* sp., *Pleioblastus* sp., *Pseudosasa* sp., *Raddia* sp., *Rhipidocladum* sp., *Sasa* sp., *Sasaella* sp., *Sasamorpha* sp., *Schizostachyum* sp.,

*Semiarundinaria* sp., *Shibatea* sp., *Sinobambusa* sp., *Thamnocalamus* sp., *Thyrsostachys* sp., *Yushania* sp. and mixtures thereof.

The bamboo fibers may be from temperate bamboos of the *Phyllostachys* species, for example *Phyllostachys heterocycla pubescens*, also known as Moso Bamboo. However, it is to be understood that the compositions disclosed herein, unless otherwise stated, are not limited to containing any one bamboo fiber and may comprise a plurality of fibers of different species. For example, the composition may comprise a bamboo from a *Phyllostachys heterocycla pubescens* and a bamboo from a different species such as, for example, *Phyllostachys bambusoides*.

Bamboo fibers for use in the webs, fibrous structures, and products of the present disclosure may be produced by any appropriate methods known in the art. The bamboo fibers may be pulped bamboo fibers, produced by chemical processing of crushed bamboo stalk. The chemical processing may comprise treating the crushed bamboo stalk with an appropriate alkaline solution. The skilled artisan will be capable of selecting an appropriate alkaline solution. Bamboo fiber may also be produced by mechanical processing of crushed bamboo stalk, which may involve enzymatic digestion of the crushed bamboo stalk. Although bamboo fiber may be produced by any appropriate methods known in the art, a desirable method for manufacturing the bamboo pulp may be as a chemical pulping method such as, but not limited to, kraft, sulfite or soda/AQ pulping techniques.

Bamboo fibers of the present disclosure may be bamboo pulp fibers and may have an average fiber length of at least about 0.8 mm. When blends of fibers from various bamboo species are employed, it is noted that blends may comprise two or more species of bamboo, or may comprise three or more species of bamboo, such that the average fiber length is at least about 1.1 mm, at least about 1.5 mm, or from about 1.1 to about 2 mm. Fibrous structure(s) (including sanitary tissue products), web(s) that form the fibrous structure(s), layer(s) of a fibrous structure(s), and/or sheet(s) of a fibrous structure may comprise at least about 5%, about 10%, about 15%, about 20%, about 30%. about 40%, about 50%, about 75%, about 80%, or about 100% bamboo content, or from about 5% to about 15%, from about 10% to about 30%, from about 20% to about 40%, from about 30% to about 50%, from about 40% to about 60%, from about 50% to about 70%, from about 60% to about 80%, from about 70% to about 90%, from about 80% to about 100%, from about 90% to about 100%, from about 95% to about 100%, or from about 97.5% to about 100% bamboo content, specifically reciting all 0.1% increments within the above-recited ranges of this paragraph and all ranges formed therein or thereby.

Generally, the "abaca," "abaca fibers," "abaca content," or "abaca fiber content" incorporated into fibrous structure(s) of the present disclosure are fibrous materials derived from *Musa textilis* (a species of banana native to the Philippines). Abaca may also be referred to as Manilla hemp, Cebu hemp, Davao hemp, Banana hemp or Musa hemp and can be used to derive abaca cellulose fibers.

Abaca may have a fiber coarseness of greater than 16 mg/100 m (or less than 20 mg/100 m) and a fiber length of 2.5 mm, 2.6 mm, 2.7 mm, 2.8 mm or more. Beyond abaca, sunn hemp, kenaf, and sisal hemp may have these characteristics.

Abaca comprises characteristics that can make it challenging (especially at higher incorporation levels) for incorporating into sanitary tissue products of the present invention as it is better known for being used to produce thin, strong, and porous paper capable of withstanding hard use.

Fibrous structure(s) (including sanitary tissue products), web(s) that form the fibrous structure(s), layer(s) of a fibrous structure(s), and/or sheet(s) of a fibrous structure may comprise at least about 5%, about 10%, about 15%, about 20%, about 30%. about 40%, about 50%, about 75%, about 80%, or about 100% abaca content, or from about 5% to about 15%, from about 10% to about 30%, from about 20% to about 40%, from about 30% to about 50%, from about 40% to about 60%, from about 50% to about 70%, from about 60% to about 80%, from about 70% to about 90%, from about 80% to about 100%, from about 90% to about 100%, from about 95% to about 100%, or from about 97.5% to about 100% abaca content, specifically reciting all 0.1% increments within the above-recited ranges of this paragraph and all ranges formed therein or thereby.

Generally, the "hemp," "hemp fibers," "hemp content," or "hemp fiber content" incorporated into fibrous structure(s) of the present disclosure may be made up of hemp cellulose fibers derived from the plants *Cannabis sativa* or *Cannabis sativa indica*. The hemp cellulose fibers may be processed to a particulate fiber pulp.

Hemp cellulose fibers may be derived from one or more of the plant sources cannabis, *Cannabis sativa, Cannabis sativa indica*, Agava Sisalana (i.e., Sisal hemp).

*Cannabis* is a genus of flowering plants that includes three different species, *Cannabis sativa, Cannabis indica*, and *Cannabis ruderalis*. The cannabis stalk (or stem) consists of an open cavity surrounded by an inner layer of core fiber, often referred to as hurd, and an outer layer referred to as the bast. Bast fibers are roughly 20% of the stalk mass and the hurd 80% of the mass. Cannabis bast fibers have a large range in length and diameter, but on average are very long with medium coarseness; suitable for making textiles, paper, and nonwovens. The hurd consists of very short, bulky fibers, typically 0.2-0.65 mm in length.

Fibrous structure(s) (including sanitary tissue products), web(s) that form the fibrous structure(s), layer(s) of a fibrous structure(s), and/or sheet(s) of a fibrous structure may comprise at least about 5%, about 10%, about 15%, about 20%, about 30%. about 40%, about 50%, about 75%, about 80%, or about 100% abaca content, or from about 5% to about 15%, from about 10% to about 30%, from about 20% to about 40%, from about 30% to about 50%, from about 40% to about 60%, from about 50% to about 70%, from about 60% to about 80%, from about 70% to about 90%, from about 80% to about 100%, from about 90% to about 100%, from about 95% to about 100%, or from about 97.5% to about 100% hemp content, specifically reciting all 0.1% increments within the above-recited ranges of this paragraph and all ranges formed therein or thereby.

Generally, the "bagasse," "bagasse fibers," "bagasse content," or "bagasse fiber content" incorporated into fibrous structure(s) of the present disclosure may be made up of "sugar cane bagasse"—the dry pulpy residue left after the extraction of juice from sugar cane or sorghum stalks to extract their juice. Agave bagasse is similar, but is the material remnants after extracting blue agave sap.

Fibrous structure(s) (including sanitary tissue products), web(s) that form the fibrous structure(s), layer(s) of a fibrous structure(s), and/or sheet(s) of a fibrous structure may comprise at least about 5%, about 10%, about 15%, about 20%, about 30%. about 40%, about 50%, about 75%, about 80%, or about 100% abaca content, or from about 5% to about 15%, from about 10% to about 30%, from about 20% to about 40%, from about 30% to about 50%, from about 40% to about 60%, from about 50% to about 70%, from about 60% to about 80%, from about 70% to about 90%, from about 80% to about 100%, from about 90% to about 100%, from about 95% to about 100%, or from about 97.5% to about 100% bagasse content, specifically reciting all 0.1% increments within the above-recited ranges of this paragraph and all ranges formed therein or thereby.

Generally, the "flax," "flax fibers," "flax content," or "flax fiber content" incorporated into fibrous structure(s) of the present disclosure may be made up of *Linum usitatissimum*, in the family Linaceae. Flax fiber is extracted from the bast beneath the surface of the stem of the flax plant.

Fibrous structure(s) (including sanitary tissue products), web(s) that form the fibrous structure(s), layer(s) of a fibrous structure(s), and/or sheet(s) of a fibrous structure may comprise at least about 5%, about 10%, about 15%, about 20%, about 30%. about 40%, about 50%, about 75%, about 80%, or about 100% abaca content, or from about 5% to about 15%, from about 10% to about 30%, from about 20% to about 40%, from about 30% to about 50%, from about 40% to about 60%, from about 50% to about 70%, from about 60% to about 80%, from about 70% to about 90%, from about 80% to about 100%, from about 90% to about 100%, from about 95% to about 100%, or from about 97.5% to about 100% flax content, specifically reciting all 0.1% increments within the above-recited ranges of this paragraph and all ranges formed therein or thereby.

Generally, the "cotton," "cotton fibers," "cotton content," or "cotton fiber content" incorporated into fibrous structure(s) of the present disclosure may be made up of cotton linters, which are fine, silky fibers that adhere to the seeds of the cotton plant after ginning. These curly fibers typically are less than ⅛ inch (3.2 mm) long. The term also may apply to the longer textile fiber staple lint, as well as the shorter fuzzy fibers from some upland species.

Fibrous structure(s) (including sanitary tissue products), web(s) that form the fibrous structure(s), layer(s) of a fibrous structure(s), and/or sheet(s) of a fibrous structure may comprise at least about 5%, about 10%, about 15%, about 20%, about 30%. about 40%, about 50%, about 75%, about 80%, or about 100% abaca content, or from about 5% to about 15%, from about 10% to about 30%, from about 20% to about 40%, from about 30% to about 50%, from about 40% to about 60%, from about 50% to about 70%, from about 60% to about 80%, from about 70% to about 90%, from about 80% to about 100%, from about 90% to about 100%, from about 95% to about 100%, or from about 97.5% to about 100% cotton content, specifically reciting all 0.1% increments within the above-recited ranges of this paragraph and all ranges formed therein or thereby.

"Array" means a display of packages, often in a retail setting on the same side of an aisle or generally across an aisle from each other, the packages often comprising disposable, fibrous, sanitary tissue products of different constructions (such that the products are compositionally and/or structurally different e.g., different fibers or different fiber blends, different chemistries, different embossments, different properties and/or characteristics, etc.). The packages may have the same brand and/or sub-brand (or at least common sub-brand portions) and/or the same trademark registration and/or may have been manufactured by or for a common company. The packages may be available at a common point of sale. An array is marketed as a line-up of products normally having like packaging elements (e.g., packaging material type, film, paper, dominant color, design theme, same color pallet, design architecture, etc.) that convey to consumers that the different individual packages are part of a larger line-up. Arrays often have the same brand name, for example, "Bounty," and same sub-brand (or portion of the sub-brand), for example, a plurality of packages may have "Essentials," or a plurality of packages may have "Ultra." A different product in the array may have the same brand "Bounty" and the sub-brand, or portion of the sub-brand name (these may also be referred to as identifiers or additional information indicia), may be different: a first package may display "Bounty" and may also display "Ultra Strong," and a second package may display "Bounty" and may also display "Ultra Soft." The differences between "Charmin Ultra Soft" and "Charmin Ultra Strong" or the differences between "Bounty" and "Bounty Essentials" may include product form, application style, or other structural and/or functional elements intended to address the differences in consumer needs or preferences for such products. Furthermore, the packaging is distinctly different in that "Charmin Ultra Strong" is packaged in a predominately red packaging (or with dominant red signals) and "Charmin Ultra Soft" is packaged in a predominately blue packaging (or with dominant blue signals).

More broadly speaking, part of an array may be located in a physical store, while another part of the array is offered on-line. For instance, an array may include "Charmin Ultra Soft," Charmin Ultra Strong," and "Charmin Ultra Eco." "Charmin Ultra Soft" and "Charmin Ultra Strong" may be available physically in stores on shelf displays in near proximity to one another, while "Charmin Ultra Eco" is only available on-line, but each could be considered part of an array. In this example, each product is branded as "Charmin," each has the same sub-brand or sub-brand portion "Ultra" to indicate that it is a premium version of the product. And, all three products are manufactured by or on behalf of The Procter & Gamble Company. In a like example, three different product types having different brand names, but the same sub-brand or additional information, and manufactured by or on behalf of the same company may be part of an array. For example, "Bounty Ultra Eco," Charmin Ultra Eco," and "Puffs Ultra Eco," each manufactured by The Procter & Gamble Company may be considered part of the same array.

"Intensive property" as used herein means a property of a fibrous structure and/or sanitary tissue product, wherein the property is selected from the group including: lint, softness, basis weight, texture, tensile strength, absorbency, etc.

"Common intensive property" as used herein means an intensive property (e.g., lint) that is present in two or more fibrous structures and/or sanitary tissue products.

"Value of a common intensive property" as used herein means a measured value of a common intensive property present in each of two or more fibrous structures and/or sanitary tissue products.

"Dominant common intensive property" as used herein means the more desirable of two or more values of a common intensive property. For example, if one sanitary tissue product exhibits a total dry tensile strength of about 650 g/in and another sanitary tissue product exhibits a total dry tensile strength of about 500 g/in, then the dominant common intensive property is the 650 g/in and the sanitary tissue product that exhibits a total dry tensile strength of about 650 g/in exhibits the dominant common intensive property because it is more desirable to have a stronger towel. In other words, one of the sanitary tissue products exhibits greater total dry tensile strength than the other sanitary tissue product. In one example, in order for a common intensive property of one sanitary tissue product to be a dominant common intensive property compared to another sanitary tissue product, the difference in the values of the common intensive properties of the sanitary tissue products has to be greater than about 5% and/or greater than about 10% and/or greater than about 15% and/or greater than about 20% and/or greater than about 25% and/or greater than about 30% and/or greater than about 50% (note: "greater than about" used interchangeably with "at least about" herein).

In another example, if one sanitary tissue product exhibits a TS7 of about 14 dB $V^2$ rms and another sanitary tissue product exhibits a softness of 12 dB $V^2$ rms, then the sanitary tissue product that exhibits a softness of 12 dB $V^2$ rms exhibits the dominant common intensive property; namely softness, because lower (less positive) TS7 values are associated with more soft products (the same is true for TS750 and slip stick—where less positive values are associated with softer products, while more positive values of lint are associated with softer products), which is desirable. In other words, one of the sanitary tissue products is softer than the other sanitary tissue product. Relative values between sanitary tissue products, such as one sanitary tissue product is softer than another sanitary tissue product may be used to identify the dominant common intensive property in addition to the absolute values of common intensive properties.

"Dominant sustainable sanitary tissue product" as used herein means in an array, the sanitary tissue product that conveys sustainability in a more dominant manner than the other sanitary tissue product(s) in the array. For example, the greater use of words, objects, and/or colors of nature. As further example, while multiple sanitary tissue products in an array might mention the use of non-wood fibers (e.g., bamboo), one sanitary tissue product in the array may print it larger or place it on a front face of the package (versus a side or back face of the package). As another example, while multiple sanitary tissue products in an array might mention the use of non-wood fibers (e.g., bamboo), one sanitary tissue product in the array may have a sustainable packaging material (paper-based, recycled plastic (including post-use), plant-based plastic, biodegradable, etc.), whereas the other packages in the array have conventional film (e.g., non-recycled plastic, non-plant-based plastic, etc.) packaging.

"Dominant strong sanitary tissue product" as used herein means in an array, the sanitary tissue product that conveys strength in a more dominant manner than the other sanitary tissue product(s) in the array.

"Dominant soft sanitary tissue product" as used herein means in an array, the sanitary tissue product that conveys softness in a more dominant manner than the other sanitary tissue product(s) in the array.

"Relative value of a common intensive property" as used herein means the value of a common intensive property of one fibrous structure and/or sanitary tissue product compared to the value of the common intensive property in another fibrous structure and/or sanitary tissue product. For example, the value of a common intensive property of one fibrous structure and/or sanitary tissue product may be greater or less than the value of the common intensive property of another fibrous structure and/or sanitary tissue product.

"Communicated" as used herein means a package, for example a sanitary tissue product package, comprising a non-textual indicia, and/or a sanitary tissue product, itself, conveys information to a consumer about a product housed within the package. In one example, the information about the product may be conveyed intuitively to a consumer by a non-textual indicia.

"Intuitively communicated" as used herein means a package and/or sanitary tissue product, itself, comprising a non-textual indicia, conveys information by the non-textual indicia that a consumer interprets based on the consumer's previous life experiences and/or knowledge.

"Indicia" as used herein means an identifier and/or indicator and/or hint and/or suggestion, of the nature of a property of something, such as an intensive property of a sanitary tissue product.

"Textual indicia" as used herein means a text indicia, such as a word and/or phrase that communicates to a consumer a property about the sanitary tissue product it is associated with. In one example, a sanitary tissue product, such as a toilet tissue product, is housed in a package comprising a textual indicia; namely, the word "Strong."

"Brand name" as used herein means a single source identifier, in other words, a brand name identifies a product and/or service as exclusively coming from a single commercial source (i.e., company). An example of a brand name is Charmin®, which is also a trademark. Brand names are nonlimiting examples of textual indicia. The sanitary tissue products of the present disclosure may be marketed and/or packaged under a common brand name (i.e., the same brand name, such as Charmin®). In addition to the brand name, a product descriptor may also be associated with the sanitary tissue products, such as "Ultra Strong" and/or "Ultra Soft" for example).

"Non-textual indicia" as used herein means a non-text indicia that communicates to a consumer through a consumer's senses. In one example, a non-textual indicia may communicate, even intuitively communicate, to a consumer through sight (visual indicia), through touch (texture indicia), sound (audio indicia) and/or through smell (scent indicia).

Nonlimiting examples of non-textual indicia include colors, textures, patterns, such as emboss patterns and/or emboss pattern images or images of patterns, character representations, for example character representations exhibiting an active pose, and mixture thereof.

"Character representation" as used herein means an image of a person, animal, deity, angel or one or more parts thereof. Non-limiting examples of character representations include babies, children, females, queens, elderly ladies, officer workers, males, burly men, lumberjacks, mechanics, bears, dogs, puppies, cats, kittens, rabbits, pigs, sheep, horses, fish, cows, elephants, ducks, monkeys, lions, parts thereof such as hands, paws, teeth, hoofs, claws and mixtures thereof. In addition, the character representations may include inanimate objects such as clouds, flowers, toilets, sinks, dishes, bubbles, windows, countertops, floors and mixtures thereof.

"Active pose" as used herein means that the character representation communicates action or motion to a consumer. Non-limiting examples of active poses include stretching a sanitary tissue product between two hands of the character, wringing a sanitary tissue product by two hands, a character squeezing a sanitary tissue product and a character contacting the character's skin with a sanitary tissue product. Character representations that do not exhibit an active pose, such as a character simply standing, are not within the scope of the present disclosure. However, they can be present on a package so long as a character representation exhibiting an active pose is also present on the package. In one example, a character representation or part(s) thereof, such as hands, squeeze a sanitary tissue product and/or stretch a sanitary tissue product and/or hold a sanitary tissue product up to the character representation's skin. For purposes of the character representation discussion herein, the sanitary tissue product is a representation of a sanitary tissue product.

"Psychologically matched" as used herein means that a non-textual indicia on a package housing a sanitary tissue product of the present disclosure and/or on the sanitary tissue product, itself, denotes (i.e., serves as a symbol for; signifies; represents something) an intensive property of the sanitary tissue product. For example, the color red typically denotes strength, the color blue typically denotes softness, the color pink typically denotes softness and the color green may have historically been associated with absorbency, however, green may now be more associated with ecologically friendly/sustainable products. Therefore, a consumer of sanitary tissue products can identify and/or select a package of sanitary tissue product that exhibits a dominant common intensive property of strength, wherein the package comprises a non-textual indicia psychologically matched (such as the color red) to communicate to the consumer that the sanitary tissue products exhibits strength as its dominant common intensive property. The psychologically matched non-textual indicia aids in mitigating any confusion that the consumer may have when trying to identify and/or select a desired sanitary tissue product among an array of sanitary tissue products. The consumer is able to interpret the intuitive communication from the non-textual indicia to be consistent with the actual dominant intensive property of the sanitary tissue product.

"Psychologically different" as used herein means that two or more different non-textual indicia, such as the color blue and the color red, denote different intensive properties. For example, the color blue denotes softness whereas the color red denotes strength. In one example, in order to be psychologically different, the non-textual indicia cannot denote the same intensive property. For example, the color blue, which denotes softness, and the color pink, which denotes softness, are not psychologically different for the purposes of the present disclosure. Likewise, the color blue, which denotes softness, and the color purple, which typically denotes softness, are not psychologically different for the purposes of the present disclosure.

"Sustainable" or "sustainability" as used herein means that the product is somehow better for the environment. For example, by conveying that the product or contents making up the product are more renewable. More specifically, sanitary tissue products may convey sustainability by indicating that the product comprises non-wood fibers, such as, for example, bamboo, *abaca*, hemp, bagasse, trichomes, etc. Further, products may communicate sustainability by using imagery of nature, such as blue skies and water, green and brown trees and plants (and plant parts), and various animals, such as pandas, caribou, moose, reindeer, rabbits, chipmunks, squirrels, and other such forest, woodland, rainforest, lake, river, ocean etc. creatures. Sustainability may be communicated with terms like "eco," "eco-friendly," "recycled," "recycled-fibers," "renewable," "green," "good for the planet," "sustainable," "guilt-free," "guilt-free use," "recycle me," "give this package a second life," "earth friendly," "100% recyclable," "smart plastic," and the like. Sustainability may also be communicated by what is being avoided, like communicating that less or no trees are being used to make the product. For example, a product may communicate that no "old-growth forests" are used to make the product or that no "Boreal" forest is used to make the product or that no "rainforest" was used to make the product. Sustainability may also be communicated by an indication that a certain number of trees are planted to replace the trees that are used to make the product. Sustainability may also be associated with products that are free of dyes and/or plastics. Still further, sustainability may be associated with low/no waste manufacturing (e.g., zero landfill production), as well as low/no carbon-footprint to manufacturing. Of course, combinations of each of these may be used to communicate sustainability.

"High tier," "highest tier," "higher tier," as used herein means products and/or offerings comprising more of the consumer-desirable properties or characteristics versus like offerings. For example, Charmin Ultra Strong may be considered "high tier" or "higher tier" as compared to Charmin Essential Strong because Charmin Ultra Strong may be stronger and/or may have a higher level of softness and/or absorbency versus Charmin Essential Strong—even though both are "Charmin" and "Strong," one is "Ultra," while the other is "Essential." Likewise, Charmin Ultra Soft may be softer and/or may have a higher level of strength and/or absorbency versus Charmin Essential Soft.

Sanitary Tissue Products of the Present Disclosure

Figure 1B:
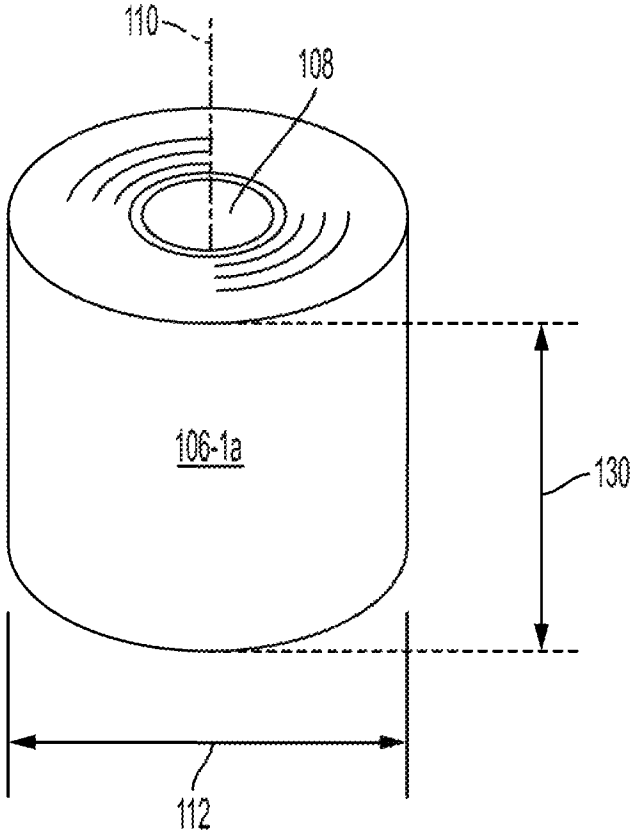
FIG. 1B is a simplified perspective view of a rolled sanitary tissue product.
Figure 1C:
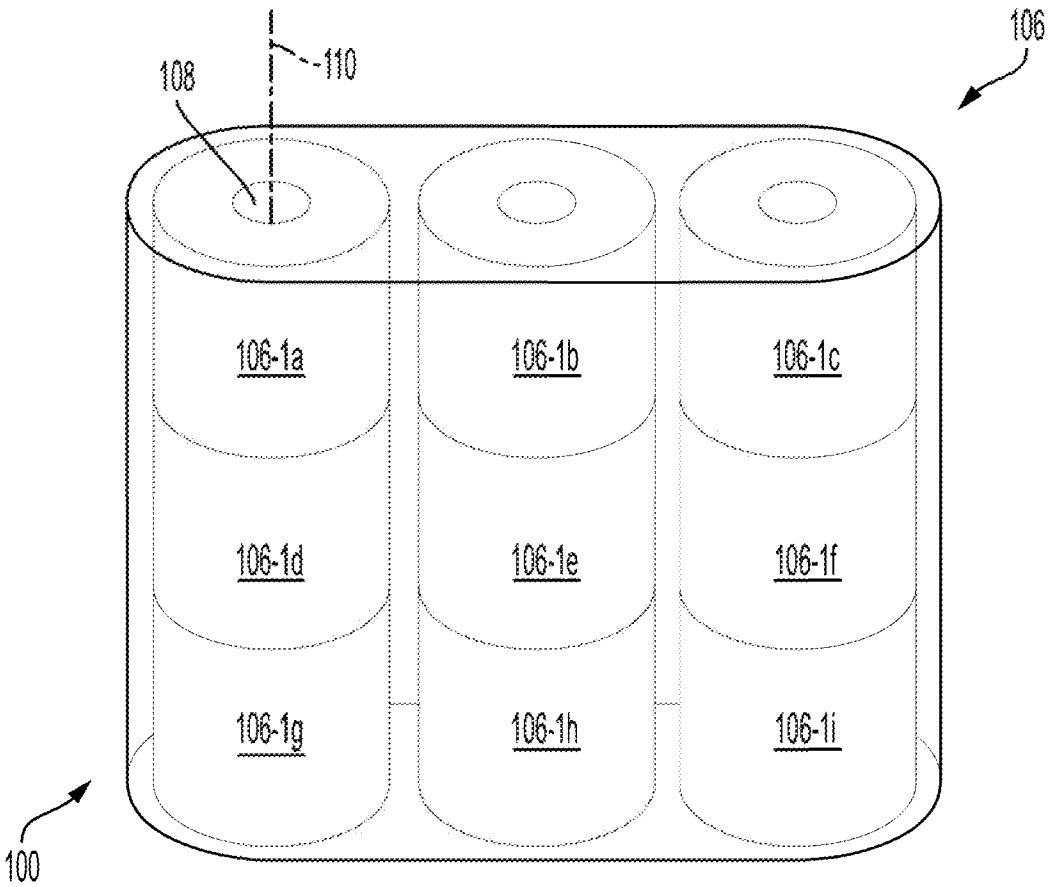
FIG. 1C is a simplified perspective view of a package comprising multiple rolls of sanitary tissue product.

FIG. 1A shows a simplified perspective illustration of a package 100 of sanitary tissue product 106. As shown in FIG. 1B, the sanitary tissue product 106 may be configured as rolled paper product. "Rolled products" or "rolled paper products" or "rolls of product" or "rolls" within the present disclosure may include products made from cellulose fibers, non-wood fibers, synthetic fibers, non-woven fibers, other suitable fibers, and combinations thereof. In some configurations, rolled products can be made of, or partially made of recycled fibers. Disposable rolled products or disposable rolled absorbent products or disposable rolled sanitary tissue products may comprise paper towels, facial tissues, toilet tissues, shop towels, wipes, and the like, which may be made from one or more webs of fibers, such as cellulose fibers, non-wood fibers, and/or synthetic fibers, for example. Rolled sanitary tissue products may comprises an absorbent towel substrate, a sanitary tissue substrate, or a cellulosic fiber containing substrate. With continued reference to FIG. 1B, each roll 106*a* of rolled sanitary tissue product 106 may be wound about a paper, cardboard, paperboard, or corrugate tube to form a core 108 through each roll 106*a*. Each core 108 may define a longitudinal axis 110 extending therethrough. In some configurations, the rolls 106*a* of rolled sanitary tissue product 106 may not include the paper, cardboard, paperboard, or corrugate tube, but instead, the rolls of product may be wound about itself to form a roll while still forming a core defined through each roll. The void area in the center of each roll where the product winds about itself can be considered a "core" for purposes of this disclosure, although such rolls may be referred to as "coreless" rolls.

Rolled sanitary tissue products 106 may have a "Roll Height" 130 (see FIG. 1B) and a "Roll Diameter" 112 (see FIG. 1B). It is to be appreciated that rolled sanitary tissue products 106 herein may be provided in various different sizes, and may comprise various different roll diameters 112. For example, in some configurations, the roll diameter 112 of the rolled sanitary tissue product 106 may be from about 4 inches to about 8 inches, specifically reciting all 0.05 inch increments within the above-recited ranges and all ranges formed therein or thereby. In some configurations, the roll diameter 112 of the rolled sanitary tissue product 106 may be from about 6 inches to about 22 inches, specifically reciting all 0.05 inch increments within the above-recited ranges and all ranges formed therein or thereby.

Figure 3:
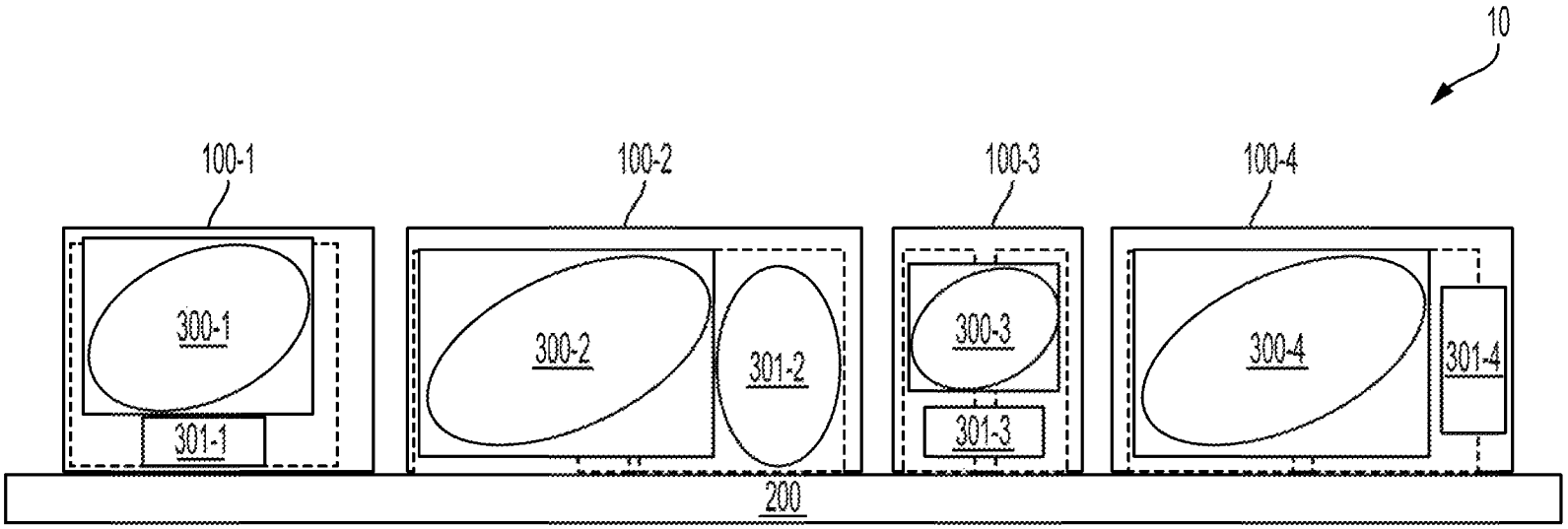
FIG. 3 is a simplified front view of an array of packages comprising sanitary tissue products on a retail store shelf.

Referring to FIG. 3, each of the first package 100-1, second package 100-2, third package 100-3, and fourth package 100-4 may comprise common brand name indicia 300, but comprise different sub-brand names or different sub-brand name portions and/or additional information indicia 301-1, 301-2, 301-3, and 301-4. The brand names may be indicia on the viewable surface of the package or, alternatively, may be embossed as part of the texture of the fibrous substrate. Each of the first package 100-1, second package 100-2, third package 100-3, and fourth package 100-4 may be manufactured and/or marketed by the same company (e.g., The Procter & Gamble Company) under the same brand name (e.g., Bounty, Charmin, etc.) 300.

Figure 1D:
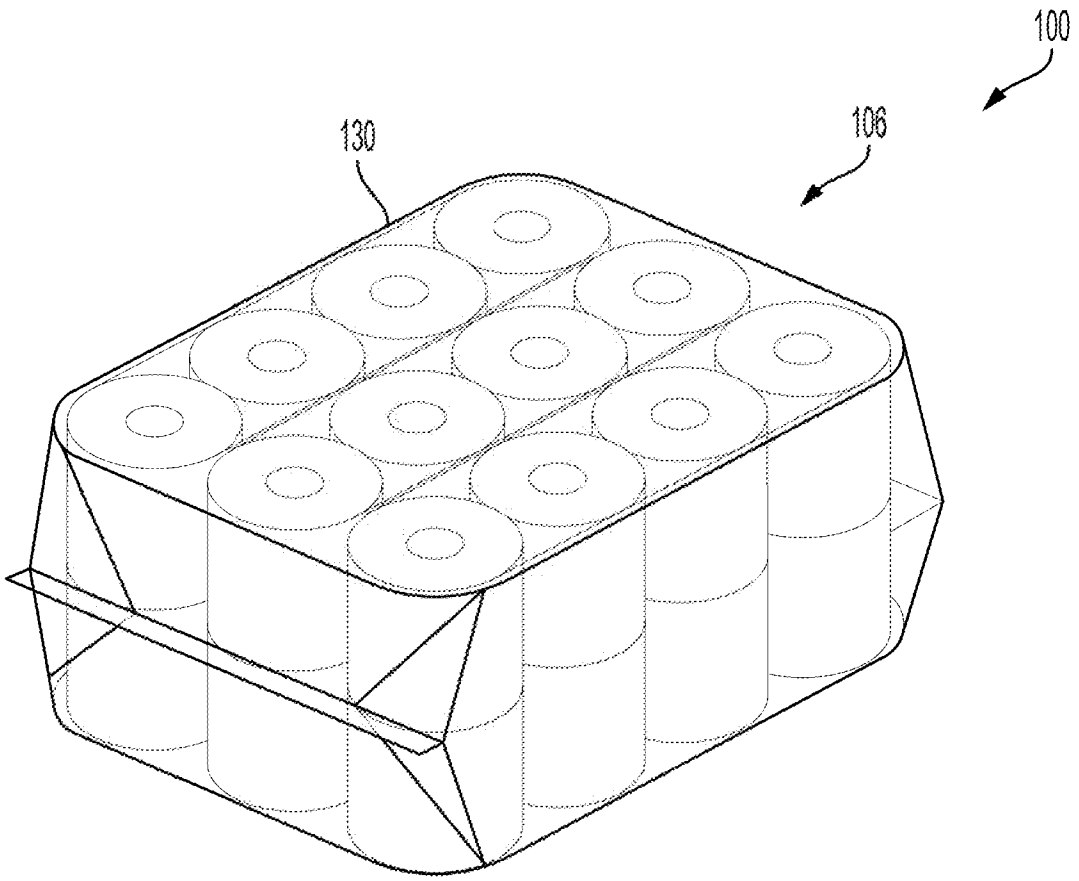
FIG. 1D is a simplified perspective view of a package including individually wrapped inner packages of sanitary tissue product.

It is to be appreciated that the packages 100 may include various quantities of sanitary tissue products 106 that may be arranged in various orientations within the package 100. For example, as shown in FIG. 1A, an individually wrapped package 100 may include four rolls of rolled sanitary tissue product 106 inside a package 100, wherein two rolls **106*a*-1 and 106*a*-2 are stacked on another two rolls 106*a*-3 and 106*a*-4. The longitudinal axis 110 of each of the cores 108 of each stack of at least two rolls may be generally parallel and aligned with each other and adjacent stack(s) of at least two rolls can lie in generally the same plane as the other stack(s) of at least two rolled sanitary tissue products 106. In another example, shown in FIG. 1C, an individually wrapped package 100 may include nine rolls 106*a*-1, 2, 3, 4, 5, 6, 7, 8, and 9 of rolled sanitary tissue product 106 arranged in stacks inside the package 100. It is to be appreciated that multiple rolls of rolled sanitary tissue product 106 can be enclosed in a package 100 constructed from a polymer film or other suitable material that may be sealed to form individually wrapped packages 100. In some configurations, individually wrapped packages 100 of the two or more rolls, or stacks of rolls, may be bundled and/or bound together within an overwrap 130 forming a package 100 to define a large count package 100, such as shown in FIG. 1D. In some configurations, large count packages 100 may contain a plurality of "naked," (i.e., unwrapped) rolls of rolled sanitary tissue product 106. In some configurations, the individually wrapped packages or naked rolls may be stacked or positioned together into a generally cuboid-shaped package 100, such as disclosed in U.S. Patent Publication No. 2012/0205272 A1. It is to be appreciated that packages 100 can each comprise one or more rolls of rolled sanitary tissue product 106**, such as for example, two, three, four, six, eight, nine, ten, twelve, or fifteen rolls of rolled sanitary tissue product.

Sanitary tissue products of the present disclosure may comprise one or more fibrous structures and/or finished fibrous structures, and may be single ply or may be multiple plies (i.e., "multi-ply"). Sanitary tissue products of the present disclosure may be in any suitable form, such as in a roll, in individual sheets, in connected, but perforated sheets, in a folded format or even in an unfolded format.

The sanitary tissue products of the present disclosure may comprise additives such as softening agents, temporary wet strength agents, permanent wet strength agents, bulk softening agents, surface softening agents, lotions, silicones, and other types of additives suitable for inclusion in and/or on sanitary tissue products. In one example, the sanitary tissue product, for example a toilet tissue product, comprises a temporary wet strength resin. In another example, the sanitary tissue product, for example an absorbent towel product, comprises a permanent wet strength resin.

Non-Wood Sanitary Tissue Products of the Present Disclosure

Sanitary tissue products of the present disclosure may be non-wood sanitary tissue products that may comprise non-wood fibers and that may have compositions, properties, and characteristics of sanitary tissue products comprising non-wood(s) as disclosed and defined in U.S. Ser. No. 63/456,020, titled "Fibrous Structures Comprising Non-wood Fibers," filed on Mar. 31, 2023, Young as the first-named inventor, ("Young"), particularly including the compositions, properties, characteristics of inventive sanitary tissue products as disclosed in the graphs and tables of Young and as illustrated in the tables and graphs of FIGS. 21A-K and 23A-30 of the present application. Said sanitary tissue products of the present disclosure may be packaged in a way that conveys sustainability, as described in greater detail herein. Said sanitary tissue products of the present disclosure contained within their packages may be offered and/or displayed physically and/or digitally with other sanitary tissue products, which may or may not comprise non-wood fibers, and which may or may not convey sustainability, strength, and/or softness; said offering and/or display of said first and second sanitary tissue products may form arrays of the present disclosure, as disclosed in greater detail herein.

Non-Wood Fibers

As used herein the term "non-wood fiber(s)" or "non-wood content" means naturally-occurring fibers derived from non-wood plants, including animal fibers, mineral fibers, plant fibers and mixtures thereof, and specifically excluding non-naturally-occurring fibers (e.g., synthetic fibers). Animal fibers may, for example, be selected from the group consisting of: wool, silk and other naturally-occurring protein fibers and mixtures thereof. The plant fibers may, for example, be obtained directly from a plant. Nonlimiting examples of suitable plants include cotton, cotton linters, flax, sisal, abaca, hemp, hesperaloe, jute, bamboo, bagasse, kudzu, corn, sorghum, gourd, agave, loofah, trichomes, seed-hairs, wheat, and mixtures thereof.

Non-wood fibers of the present disclosure may be derived from one or more non-wood plants of the family Asparagaceae. Suitable non-wood plants may include, but are limited to, one or more plants of the genus *Agave* such as *A. tequilana, A. sisalana* and *A. fourcroyde*, and one or more plants of the genus *Hesperaloe* such as *H. funifera, H. parviflora, H. nocturna, H.* Changi, *H. tenuifolia, H. engelmannii*, and *H. malacophylla*. Further, the non-wood fibers of the present disclosure may be prepared from one or more plants of the of the genus *Hesperaloe* such as *H. funifera, H. parviflora, H. nocturna, H. chiangii, H. tenuifolia, H. engelmannii*, and *H. malacophylla.*

As used herein the term "wood fiber(s)" or "wood content" means fibers derived from both deciduous trees (hereinafter, also referred to as "hardwood") and coniferous trees (hereinafter, also referred to as "softwood") may be utilized. Wood fibers may be short (typical of hardwood fibers) or long (typical of softwood fibers). Nonlimiting examples of short fibers include fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia. Nonlimiting examples of long fibers include fibers derived from Pine, Spruce, Fir, Tamarack, Hemlock, Cypress, and Cedar.

As used herein the term "synthetic fiber(s)" or "synthetic content" means fibers human-made fibers, and specifically excludes "wood fibers" and "non-wood fibers." Synthetic fibers can be used, in combination with non-wood fibers (e.g., bamboo) in the fibrous structures of the present disclosure. Synthetic fibers may be polymeric fibers. Synthetic fibers may comprise elastomeric polymers, polypropylene, polyethylene, polyester, polyolefin, polyvinyl alcohol and nylon, which are obtained from petroleum sources. Additionally, synthetic fibers may be polymeric fibers comprising natural polymers, which are obtained from natural sources, such as starch sources, protein sources and/or cellulose sources may be used in the fibrous structures of the present disclosure. The synthetic fibers may be produced by any suitable methods known in the art.

Fibrous structure(s) (including sanitary tissue products), web(s) that form the fibrous structure(s) (including sanitary tissue products), layer(s) of a fibrous structure(s) (including at least one of or each of a first and a second layer of a ply), and/or sheet(s) of a fibrous structure may comprise at least about 5%, about 10%, about 15%, about 20%, about 30%, about 35% about 40%, about 50%, about 75%, about 80%, or about 100% non-wood content, or from about 5% to about 15%, from about 10% to about 30%, from about 20% to about 40%, from about 30% to about 50%, from about 40% to about 60%, from about 50% to about 70%, from about 55% to about 95%, from about 65% to about 85%, from about 60% to about 80%, from about 70% to about 90%, from about 80% to about 100%, from about 90% to about 100%, from about 95% to about 100%, or from about 97.5% to about 100% non-wood content (e.g., bamboo, *abaca*, hemp, etc.), specifically reciting all 0.1% increments within the above-recited ranges of this paragraph and all ranges formed therein or thereby.

Bamboo

Generally, the "bamboo," "bamboo fibers," "bamboo content," or "bamboo fiber content" incorporated into fibrous structure(s) of the present disclosure are fibrous materials derived from any bamboo species. More particularly, the bamboo fiber species may be selected from the group consisting of: *Acidosasa* sp., *Ampleocalamus* sp., *Arundinaria* sp., *Bambusa* sp., *Bashania* sp., *Borinda* sp., *Brachystachyum* sp., *Cephalostachyum* sp., *Chimonobambusa* sp., *Chusquea* sp., *Dendrocalamus* sp., *Dinochloa* sp., *Drepanostachyum* sp., *Eremitis* sp., *Fargesia* sp., *Gaoligongshania* sp., *Gelidocalamus* sp., *Gigantocloa* sp., *Guadua* sp., *Hibanobambusa* sp., *Himalayacalamus* sp., *Indocalamus* sp., *Indosasa* sp., *Lithachne* sp., *Melocanna* sp., *Menstruocalamus* sp., *Nastus* sp., *Neohouzeaua* sp., *Neomicrocalamus* sp., *Ochlandra* sp., *Oligostachyum* sp., *Olmeca* sp., *Otatea* sp., *Oxytenanthera* sp., *Phyllostachys* sp., *Pleioblastus* sp., *Pseudosasa* sp., *Raddia* sp., *Rhipidocladum* sp., *Sasa* sp., *Sasaella* sp., *Sasamorpha* sp., *Schizostachyum* sp., *Semiarundinaria* sp., *Shibatea* sp., *Sinobambusa* sp., *Thamnocalamus* sp., *Thyrsostachys* sp., *Yushania* sp. and mixtures thereof.

The bamboo fibers may be from temperate bamboos of the *Phyllostachys* species, for example *Phyllostachys heterocycla pubescens*, also known as Moso Bamboo. However, it is to be understood that the compositions disclosed herein, unless otherwise stated, are not limited to containing any one bamboo fiber and may comprise a plurality of fibers of different species. For example, the composition may comprise a bamboo from a *Phyllostachys heterocycla pubescens* and a bamboo from a different species such as, for example, *Phyllostachys bambusoides*.

Bamboo fibers for use in the webs, fibrous structures, and products of the present disclosure may be produced by any appropriate methods known in the art. The bamboo fibers may be pulped bamboo fibers, produced by chemical processing of crushed bamboo stalk. The chemical processing may comprise treating the crushed bamboo stalk with an appropriate alkaline solution. The skilled artisan will be capable of selecting an appropriate alkaline solution. Bamboo fiber may also be produced by mechanical processing of crushed bamboo stalk, which may involve enzymatic digestion of the crushed bamboo stalk. Although bamboo fiber may be produced by any appropriate methods known in the art, a desirable method for manufacturing the bamboo pulp may be as a chemical pulping method such as, but not limited to, kraft, sulfite or soda/AQ pulping techniques.

Bamboo fibers of the present disclosure may be bamboo pulp fibers and may have an average fiber length of at least about 0.8 mm. When blends of fibers from various bamboo species are employed, it is noted that blends may comprise two or more species of bamboo, or may comprise three or more species of bamboo, such that the average fiber length is at least about 1.1 mm, at least about 1.5 mm, or from about 1.1 to about 2 mm. Fibrous structure(s) (including sanitary tissue products), web(s) that form the fibrous structure(s), layer(s) of a fibrous structure(s) (including at least one of or each of a first and a second layer of a ply), and/or sheet(s) of a fibrous structure may comprise at least about 5%, about 10%, about 15%, about 20%, about 30%, about 35%, about 40%, about 50%, about 75%, about 80%, or about 100% bamboo content, or from about 5% to about 15%, from about 10% to about 30%, from about 20% to about 40%, from about 30% to about 50%, from about 40% to about 60%, from about 50% to about 70%, from about 60% to about 80%, from about 70% to about 90%, from about 80% to about 100%, from about 90% to about 100%, from about 95% to about 100%, or from about 97.5% to about 100% bamboo content, specifically reciting all 0.1% increments within the above-recited ranges of this paragraph and all ranges formed therein or thereby.

Bamboo fibers may be more desirable to use than other non-wood fibers, such as various straws (e.g., wheat straw) for multiple reasons, one being that bamboo fibers are generally longer than straw fibers, which results in fibrous structures comprising bamboo fibers being stronger (without using strength enhancing chemistry or process manipulations) than like fibrous structures comprising shorter straw fibers.

Abaca

Generally, the "abaca," "abaca fibers," "abaca content," or "abaca fiber content" incorporated into fibrous structure(s) of the present disclosure are fibrous materials derived from *Musa textilis* (a species of banana native to the Philippines). Abaca may also be referred to as Manilla hemp, Cebu hemp, Davao hemp, Banana hemp or Musa hemp and can be used to derive abaca cellulose fibers.

Abaca may have a fiber coarseness of greater than 16 mg/100 m (or less than 20 mg/100 m) and a fiber length of 2.5 mm, 2.6 mm, 2.7 mm, 2.8 mm or more. Beyond abaca, sunn hemp, kenaf, and sisal hemp may have these characteristics.

Abaca comprises characteristics that can make it challenging (especially at higher incorporation levels) for incorporating into sanitary tissue products of the present invention as it is better known for being used to produce thin, strong, and porous paper capable of withstanding hard use.

Fibrous structure(s) (including sanitary tissue products), web(s) that form the fibrous structure(s), layer(s) of a fibrous structure(s) (including at least one of or each of a first and a second layer of a ply), and/or sheet(s) of a fibrous structure may comprise at least about 5%, about 10%, about 15%, about 20%, about 30%. about 40%, about 50%, about 75%, about 80%, or about 100% abaca content, or from about 5% to about 15%, from about 10% to about 30%, from about 20% to about 40%, from about 30% to about 50%, from about 40% to about 60%, from about 50% to about 70%, from about 60% to about 80%, from about 70% to about 90%, from about 80% to about 100%, from about 90% to about 100%, from about 95% to about 100%, or from about 97.5% to about 100% abaca content, specifically reciting all 0.1% increments within the above-recited ranges of this paragraph and all ranges formed therein or thereby.

Abaca fibers may be more desirable to use than other non-wood fibers, such as various straws (e.g., wheat straw) for multiple reasons, one being that abaca fibers are generally longer than straw fibers, which results in fibrous structures comprising abaca fibers being stronger (without using strength enhancing chemistry or process manipulations) than like fibrous structures comprising shorter straw fibers. Further, abaca's length, width, and coarseness make it a more suitable softwood replacement, its higher fibrillation increases specific surface area of the fiber and its carboxyl groups make it better for attaching strength chemistries.

Once-Dried Non-Wood Fibers

The challenges associated with non-wood fiber morphology are further complicated by using once-dried (versus never-dried, which comprise greater than about 45% water content) fibers in the paper-making process. Although never-dried and once-dried fibers are chemically similar, they differ greatly in their physical properties. Never-dried fiber walls contain much more water per unit dry mass than those of dried fibers after reslushing. Being more swollen, the never-dried walls are more flexible or conformable. In contrast, the walls of once-dried (and rewetted or reslushed or repulped) fibers are stiff (compared to never-dried fibers). Significant changes in the papermaking properties of fibers occur with water removal as the walls become progressively more rigid and less conformable. The table of FIG. 28 shows the fiber characteristic differences between non-wood fibers that are never-dried and that have been once-dried; see also, for example: A. M. Scallan and G. V. Laivins, The mechanism of hornification of wood pulps in Products of Papermaking, Trans. of the Xth Fund. Res. Symp. Oxford, 1993, (C. F. Baker, ed.), pp 1235-1260, FRC, Manchester, 2018. DOI: 10.15376/frc.1993.2.1235, at page 1242 (Effect of Temperature) states: "Drying-and-reslushing at 25 C dropped the breaking length from 7.3 km for the virgin sheet down to 2.7 km. Raising the drying temperature to 105° and to 150° C. further lowered the breaking length to 1.6 and 0.6 km. From this study it is apparent that the major reduction in sheet strength is due to water removal and that heat causes an additional reduction which is much smaller in magnitude." The same article further states: "Only a few investigations have been carried out, designed to separate the effects of temperature and water removal during drying. Lyne and Gallay avoided this problem by heating without drying; in their experiments wet handsheets were heated to 95° C. for three minutes in an atmosphere saturated with water vapour before air drying (19). The tensile strength of the sheet was lowered by 14% when compared to that of an unheated control. The result shows that the heat treatment led to a reduction in the extent of interfibre bonding which they attributed to a loss of swelling of the pulp upon heating." The table of FIG. 28 also illustrates that never-dried fibers bond to each other better than once-dried fibers. To overcome the effects of temperature and water removal, strength in the web (e.g., sanitary tissue product) may be achieved by temporary and/or permanent wet strength, dry strength additives, furnish blend ratios (e.g., softwood-to-hardwood ratios), process manipulations (refining, formation, calendaring, creping, etc.), etc.

While it may be desirable to use never-dried fibers (see, for example, the following publications assigned to Essity Hygiene and Health Aktiebolag: WO2023282811A1, WO2023282812A1, WO2023282813A1, WO2023282818A1), such requires the pulping facility to be close to the paper-making facility as wet fibers are too expensive to ship. Because this proximity is often impractical, the inventors of the present application used non-wood fibers that were at least once-dried and overcame not only the challenges associated with non-wood fibers, but also overcame the challenges of the non-wood fibers having been at least once-dried at the pulping facility and then shipped as dried sheets before incorporating the fibers into the paper-making process. That is, the non-wood fibers disclosed herein were reslushed from dried sheets before they were sent to a headbox in the paper-making process. Further, on a single fiber basis, the fiber length of once-dried non-wood fibers in the finished product (e.g., sanitary tissue product) will normally be shorter than never-dried non-wood fibers due to the extra processing necessary to rewet once-dried non-wood fibers. These shorter fibers have a materially different characteristics, which, among other things, will impact the strength of the final product.

When using once-dried non-wood pulp, the unit of pulp is typically in a bale, a sheet, or a block, which comprises less than about 45%, 40%, 35%, 25%, 15%, 10%, 5%, or 2% of water (water content). The unit of once-fired non-wood pulp may then be placed into a repulping unit to be repulped (also called reslushed or rewetted). The repulped non-wood fibers may then be further refined or may be sent directly to a headbox. As referenced above, the reslushed non-wood fibers will likely be stiffer (versus like fibers that were never-dried) due to hornification.

Another benefit of using once-dried fibers instead of never-dried fibers is that once-dried fibers bond less during the paper-making process and are thus less connected, which results in a softer sanitary tissue product, which allows the sanitary tissue product to be more cloth-like and more desirable. For instance, once-dried fibers of the present disclosure may have a breaking length of less than about 3.25 m/micron, less than about 2.7 m/micron, less than about 2.5 m/micron, less than about 2.0 m/micron, less than about 1.8 m/micron, less than about 1.6 m/micron, less than about 1.5 m/micron, less than about 1.0 m/micron, less than about 0.6 m/micron, or less than about 0.5 m/micron, while never-dried fibers tend to have higher breaking lengths, such as greater than about 3.0 m/micron, greater than about 3.5 m/micron, greater than about 4.0 m/micron, greater than about 5.0 m/micron, or greater than about 6.0 m/micron, specifically reciting all 0.1 m/micron increments within the above-recited ranges of this paragraph and all ranges formed therein or thereby.

In light of the paragraphs of this Section (Once-dried Non-wood Fibers), a desirable process for making sanitary tissue products of the present disclosure may comprise: re-slushing pulp comprising non-wood fibers prior to sending the pulp to a headbox; forming a web comprising the non-wood fibers; creating zones of differential densities in the web; and creping the web. The once-dried non-wood pulp may be introduced into a repulping unit prior to the step of re-slushing the pulp. The once-dried non-wood pulp comprises non-wood fibers having a water content of less than about 10%, 20%, or 40%. The once-dried non-wood pulp may be in the form of a bale, a sheet, or a block. The non-wood fibers may be selected from the group consisting of bamboo, *abaca*, and mixtures thereof. The web may be treated with permanent or temporary wet strength. This process of making sanitary tissue products of the present disclosure may further include harvesting non-wood fibers and pulping the non-wood fibers and drying the non-wood fibers. The non-wood fibers may be dried (using, for example a pulp drier (e.g., from Andritz, Valmet, etc.)) at a facility other than a destination paper-making facility (i.e., where the pulp will be used to make the sanitary tissue products, including paper towels, toilet tissue, and/or facial tissue. The dried non-wood fibers may then be shipped to a destination paper-making facility. The shipping distance may be greater than: about 25, about 50, about 75, about 100, about 200, about 500, about 1,000 miles to reach the destination paper-making facility. In some instances, the dried non-wood fibers may be shipped as far as from Asia (e.g., China) to North America (e.g., US).

Figure 6A:
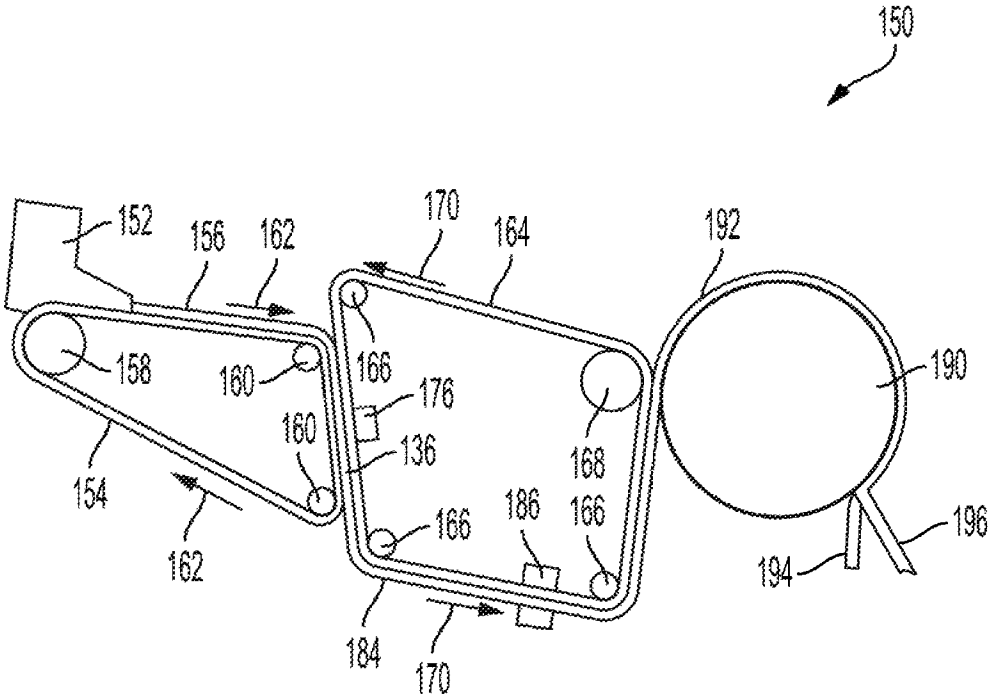
FIG. 6A is a schematic representation of one method for making the fibrous structures (including sanitary tissue products) detailed herein. Specific details of the process and equipment represented by FIG. 6A can be found in U.S. Pat. Nos. 5,714,041; 9,217,226; 9,435,081; 9,631,323; 9,752,281; 10,240,296; and U.S. Publication Nos. 2013-0048239; 2022-0010497.
Figure 6B:
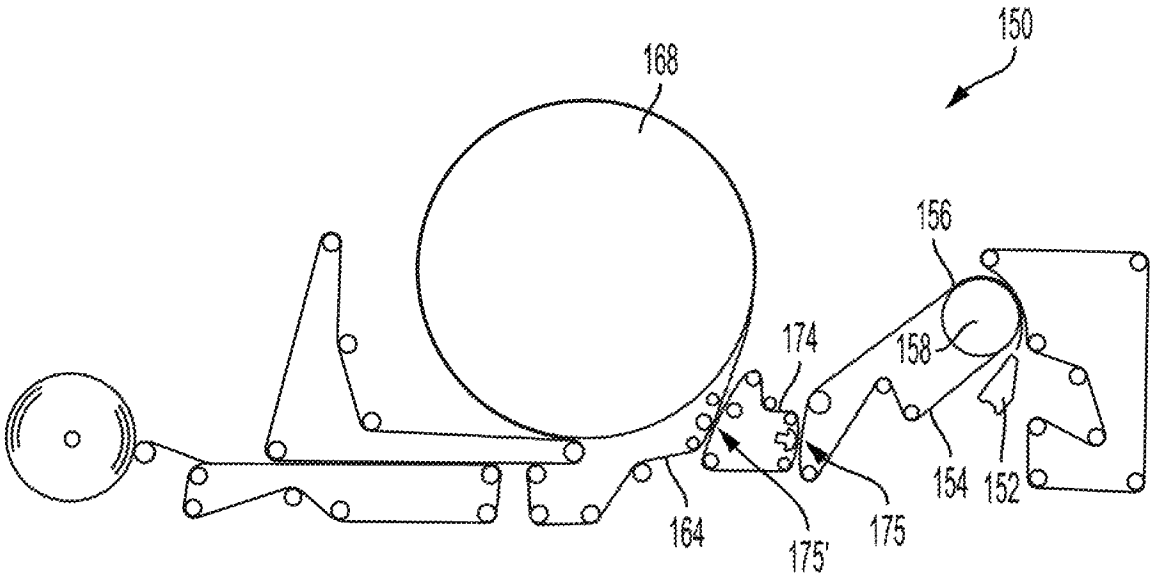
FIG. 6B is a schematic representation of one method for making the fibrous structures (including sanitary tissue products) detailed herein. Specific details of the process and equipment represented by FIG. 6B can be found in U.S. Pat. No. 7,972,474.
Figure 6C:
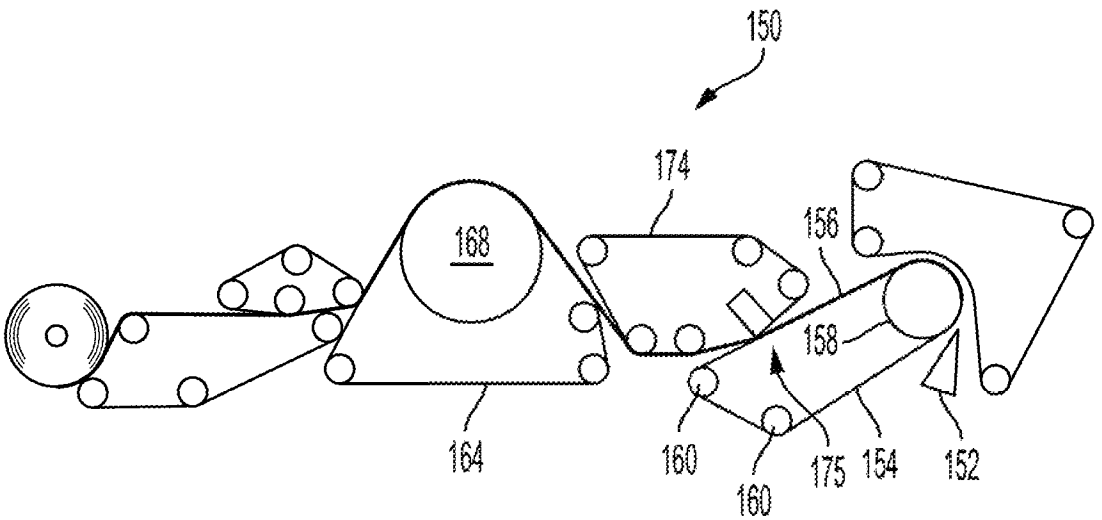
FIG. 6C is a schematic representation of one method for making the fibrous structures (including sanitary tissue products) detailed herein.

Arrays of the present disclosure may comprise a first package of sanitary tissue products that are formed using never-dried, non-wood fibers, such that the sanitary tissue products of the first package comprise or consist of fibers that had not been dried until the paper-making process (such as the processes of FIGS. 6A-C); and the array may also comprise a second package of sanitary tissue products that are formed using at least once-dried, non-wood fibers, such that the sanitary tissue products of the second package comprise or consist of fibers that had been dried prior to the paper-making process (such as the processes of FIGS. 6A-C). The claims and supporting disclosure of U.S. patent application Ser. No. 18/131,388, titled "Sanitary tissue Products Comprising Once-dried Fibers," and filed on Apr. 6, 2023, are incorporated herein by reference.

Properties of Fibrous Structure(s)

Fibrous structure(s) (including sanitary tissue product(s)), web(s) that form the fibrous structure(s), layer(s) of a fibrous structure(s) (including at least one of or each of a first and a second layer of a ply), and/or sheet(s) of a fibrous structure(s) as disclosed herein, particularly including various inventive non-wood inclusions, even including greater than 80% non-woods by weight of the fibrous structure, and even including 100% non-woods by weight of the fibrous structure, may have one or a combination of the following properties:

- a VFS of greater than about 5.5 g/g, greater than about 6.0 g/g, greater than about 7.0 g/g, from about 3 g/g to about 20 g/g, from about 4 g/g to about 18 g/g, from about 5 g/g to about 16 g/g, from about 6 g/g to about 14 g/g, from about 8 g/g to about 12 g/g, or from about 5 g/g to about 6 g/g, specifically reciting all increments of 0.01 g/g within the above-recited ranges and all ranges formed therein or thereby;
- an HFS of greater than about 13 g/g, or greater than about 14 g/g, or greater than about 15 g/g, or greater than about 16 g/g, or greater than about 16.5 g/g, or greater than about 17 g/g, or greater than about 17.5 g/g, or greater than about 18 g/g, or greater than about 18.5, g/g or greater than about 19 g/g, or greater than about 20 g/g, or greater than about 21 g/g, or from about 4 g/g to about 30 g/g, from about 6 g/g to about 28 g/g, from about 8 g/g to about 26 g/g, from about 10 g/g to about 24 g/g, from about 12 g/g to about 22 g/g, from about 13 g/g to about 20, from about 14 g/g to about 18 g/g, from about 13 g/g to about 15 g/g, or from about 13 g/g to about 14 g/g, specifically reciting all increments of 0.1 g/g within the above-recited ranges and all ranges formed therein or thereby;
- a stack compressibility of greater than about 40 mils/(log ($g/in^2$)), greater than about 41 mils/(log($g/in^2$)), greater than about 45 mils/(log($g/in^2$)), greater than about 50 mils/(log($g/in^2$)), from about 25 mils/(log($g/in^2$)) to about 100 mils/(log($g/in^2$)), from about 30 mils/(log($g/in^2$)) to about 75 mils/(log($g/in^2$)), from about 40 mils/(log($g/in^2$)) to about 50 mils/(log($g/in^2$)), from about 41 mils/(log($g/in^2$)) to about 48, or from about mils/(log ($g/in^2$)) to about 48 mils/(log($g/in^2$)), specifically reciting all increments of 0.1 mils/(log($g/in^2$)) within the above-recited ranges and all ranges formed therein or thereby;
- an MD wet peak elongation of greater than about 18%, greater than about 20%, from about 10% to about 30%, from about 14% to about 25%, from about 18% to about 22%, or from about 18% to about 20%, specifically reciting all increments of 0.1% within the above-recited ranges and all ranges formed therein or thereby;
- a CD wet peak elongation of greater than about 12%, from about 5% to about 30%, from about 10% to about 25%, from about 12% to about 20%, or from about 12% to about 15%, specifically reciting all increments of 0.1% within the above-recited ranges and all ranges formed therein or thereby;
- an MD wet peak TEA of greater than about 21 $g*in/in^2$, greater than about 22 $g*in/in^2$, from about 15 $g*in/in^2$ to about 50 $g*in/in^2$, from about 20 $g*in/in^2$ to about 40 $g*in/in^2$, from about 21 $g*in/in^2$ to about 30 $g*in/in^2$, or from about 21 $g*in/in^2$ to about 25 $g*in/in^2$, specifically reciting all increments of 1 $g*in/in^2$ within the above-recited ranges and all ranges formed therein or thereby;
- a CD wet peak TEA of greater than about 7 $g*in/in^2$, from about 6 $g*in/in^2$ to about 40 $g*in/in^2$, from about 6.5 $g*in/in^2$ to about 30 $g*in/in^2$, from about 7 $g*in/in^2$ to about 20 $g*in/in^2$, or from about 7.5 $g*in/in^2$ to about 15 $g*in/in^2$, or from about 8 $g*in/in^2$ to about 12 $g*in/in^2$, specifically reciting all increments of 0.5 $g*in/in^2$ within the above-recited ranges and all ranges formed therein or thereby;
- a CD elongation (dry) of greater than about 5%, of greater than about 8%, of greater than about 12%, of greater than about 13.5%, or from about 5% to about 25%, from about 10% to about 20%, from about 12% to about 18%, from about 13% to about 17%, or from about 14% to about 16%, specifically reciting all increments of 0.5% within the above-recited ranges and all ranges formed therein or thereby;
- a CD TEA of greater than about 35 in-$g/in^2$, of greater than about 32 in-$g/in^2$, or from about 5 in-$g/in^2$ to about 100 in-$g/in^2$, from about 15 in-$g/in^2$ to about 75 in-$g/in^2$, from about 25 in-$g/in^2$ to about 50 in-$g/in^2$, from about 32 in-$g/in^2$ to about 45 in-$g/in^2$, from about 33 in-$g/in^2$ to about 40 in-$g/in^2$, from about 34 in-$g/in^2$ to about 38 in-$g/in^2$, specifically reciting all increments of 1 in-$g/in^2$ within the above-recited ranges and all ranges formed therein or thereby;
- a dry CD tensile modulus/dry CD tensile peak load (derived from the appropriate of: 1) Dry Elongation, Tensile Strength, TEA and Modulus Test Methods for Toilet Paper, 2) Dry Elongation, Tensile Strength, TEA and Modulus Test Methods for Paper Towels, or 3) Dry Elongation, Tensile Strength, TEA and Modulus Test Methods for Facial Tissue) less than about 5.0 g/g, less than about 4.5 g/g, less than about 4.0 g/g, less than about 3.5 g/g, less than about 3.0 g/g, from about 5.0 g/g to about 2.5 g/g, from about 4.0 g/g to about 2.0 g/g, or from about 3.5 g/g to about 1.5 g/g, specifically reciting all increments of 0.1 g/g within the above-recited ranges and all ranges formed therein or thereby;
- a wet CD tensile modulus/wet CD tensile peak load less than about 5.0 g/g, less than about 4.5 g/g, less than about 4.25 g/g, less than about 4.0 g/g, less than about 3.75 g/g, less than about 3.5 g/g, less than about 3.25 g/g, less than about 3.0 g/g, less than about 2.5 g/g, less than about 2 g/g, from about 5.0 g/g to about 2.5 g/g, from about 4.0 g/g to about 2.0 g/g, or from about 3.5 g/g to about 1.5 g/g, specifically reciting all increments of 0.1 g/g within the above-recited ranges and all ranges formed therein or thereby;

a CD modulus (dry) of less than about 2000 g/cm, of less than about 2400 g/cm, of less than about 2500 g/cm, of less than about 3270 g/cm, or from about 200 g/cm to about 5000 g/cm, or from about 1000 g/cm to about 4500 g/cm, or from about 2000 g/cm to about 4000 g/cm, or from about 3000 g/cm to about 4000 g/cm, or from about 3270 g/cm to about 3800 g/cm, or from about 3300 g/cm to about 3700 g/cm, or from about 3350 g/cm to about 3600 g/cm, or from about 3400 g/cm to about 3500 g/cm, specifically reciting all increments of 1 g/cm within the above-recited ranges and all ranges formed therein or thereby;

an MD modulus (dry) of less than about 3360 g/cm, or less than about 1750 g/cm or from about 500 g/cm to about 6000 g/cm, or from about 1000 g/cm to about 5000 g/cm, or from about 2000 g/cm to about 4000 g/cm, or from about 3000 g/cm to about 4000 g/cm, or from about 3360 g/cm to about 3800 g/cm, or from about 3400 g/cm to about 3700 g/cm, or from about 3450 g/cm to about 3600 g/cm, or from about 3500 g/cm to about 3600 g/cm, specifically reciting all increments of 1 g/cm within the above-recited ranges and all ranges formed therein or thereby;

a TS7 of less than about 40.00 dB $V^2$ rms, or less than about 30.00 dB $V^2$ rms, or less than about 22.00 dB $V^2$ rms, or less than about 20.00 dB $V^2$ rms, or less than about 24.00 dB $V^2$ rms, or less than about 15.00 dB $V^2$ rms, or less than about 14.00 dB $V^2$ rms, or less than about 10.00 dB $V^2$ rms, or less than about 8.00 dB $V^2$ rms, or greater than about 5.00 dB $V^2$ rms, or between about 3.00 dB $V^2$ rms and about 40.00 dB $V^2$ rms ("between about 'X' and about 'X'" is used interchangeably with "from about 'X' to about 'X'"), or between about 3.00 dB $V^2$ rms and about 20.00 dB $V^2$ rms, or between about 4.00 dB $V^2$ rms and about 30 dB $V^2$ rms, or between about 15.00 dB $V^2$ rms and about 30.00 dB $V^2$ rms, or between about 5.00 dB $V^2$ rms and about 20.00 dB $V^2$ rms, or between about 6.00 dB $V^2$ rms and about 14 dB $V^2$ rms, or between about 7.00 dB $V^2$ rms and about 12.00 dB $V^2$ rms, or between about 8.00 dB $V^2$ rms and about 11.50 dB $V^2$ rms, or between about 9.0 dB $V^2$ rms and about 11.00 dB $V^2$ rms, or between about 9.50 dB $V^2$ rms and about 10.50 dB $V^2$ rms, between about 9.50 dB $V^2$ rms and about 10.00 dB $V^2$ rms, between about 15 dB $V^2$ rms and about 17 dB $V^2$ rms, or between about 15 dB $V^2$ rms and about 16 dB $V^2$ rms, specifically reciting all increments of 0.01 dB $V^2$ rms within the above-recited ranges and all ranges formed therein or thereby;

a compressive slope of less than about 14.0 mil/g, or less than about 3.0 mil/g, or less than about 4.0 mil/g, or less than about 5.0 mil/g, or less than about 6.0 mil/g, or less than about 7.0 mil/g, or less than about 8.0 mil/g, or less than about 9.0 mil/g, or greater than about 12.0 mil/g 8, or greater than about 11.0 mil/g, or greater than about 12.0 mil/g, or between about 4.0 mil/g and about 10.0 mil/g, or between about 8.0 mil/g and about 12.0 mil/g, or between about 6 mil/g and about 14.0 mil/g, or between about 8.0 mil/g and about 14 mil/g, or between about 7.5 mil/g and about 11 mil/g, or between about 12.0 mil/g and about 3.0 mil/g, or between about 11.0 mil/g and about 5.0 mil/g, or between about 10.0 mil/g and about 4.0 mil/g, or between about 8.0 mil/g and about 5.0 mil/g, specifically reciting all increments of 0.01 mil/g within the above-recited ranges and all ranges formed therein or thereby;

a formation index of less than about 170, or less than about 90, or less than about 65, or greater than about 30, or greater than about 50, or between about 55 and about 165, or between about 55 and about 85, or between about 60 and about 80, or between about 65 and about 75, specifically reciting all increments of 0.1 within the above-recited ranges and all ranges formed therein or thereby;

a coverage of less than about 10 fiber layers (making up a layer 55 of a ply 53), or less than about 9 fiber layers, or less than about 8 fiber layers, or less than about 7 fiber layers, or less than about 6 fiber layers, or less than about 5 fiber layers, or less than about 4 fiber layers, or greater than about 2 fiber layers, or greater than about 4.75 fiber layers, or greater than about 5 fiber layers, or greater than about 5.25 fiber layers, or greater than about 5.5 fiber layers, or greater than about 5.75 fiber layers, or greater than about 6 fiber layers, or greater than about 6.25 fiber layers, or greater than about 6.5 fiber layers, or greater than about 7 fiber layers, or greater than about 7.25 fiber layers, or greater than about 7.5 fiber layers, or greater than about 7.75 fiber layers, or greater than about 8 fiber layers, or greater than about 8.25 fiber layers, or greater than about 8.5 fiber layers, or greater than about 9 fiber layers, or between about 2 and about 10 fiber layers, or between about 4 and about fiber 9 fiber layers, or between about 5 and about fiber 8 fiber layers, or between about 4 and about fiber 7 fiber layers, specifically reciting all increments of 1 fiber layer within the above-recited ranges and all ranges formed therein or thereby;

a coarseness (according to the Coverage and Fiber Count Test Method) of less than about 0.35 mg/m, or less than about 0.30 mg/m, or less than about 0.25 mg/m, or less than about 0.20 mg/m, or greater than about 0.13 mg/m, or greater than about 0.14 mg/m, or greater than about 0.15 mg/m, or greater than about 0.16 mg/m, or greater than about 0.17 mg/m, or between about 0.15 mg/m and about 0.35 mg/m, or between about 0.15 mg/m and about 0.30 mg/m, or between about 0.16 mg/m and about 1.7 mg/m, or between about 0.15 mg/m and about 0.17 mg/m, or between about 0.15 mg/m and about 0.20 mg/m, or between about 0.25 mg/m and about 0.26 mg/m, or between about 0.22 mg/m and about 0.3 mg/m, or between about 0.19 mg/m and about 0.32 mg/m, specifically reciting all increments of 0.01 mg/m within the above-recited ranges and all ranges formed therein or thereby;

a lint value of less than about 11, or less than about 10, or less than about 9, or less than about 8, or less than about 7, or less than about 6, or less than about 5, or greater than about 0.5, greater than about 4.1, greater than about 6, or between about 0.5 and about 11, or between about 0.7 and about 11, or between about 7.5 and about 10.5, or between about 4 and about 5.5, or between about 6.3 and about 7.7, or between about 3 and about 10, or between about 4 and about 9, or between about 5 and about 8, or between about 6 and about 8, specifically reciting all increments of 0.01 (Hunter L value) within the above-recited ranges and all ranges formed therein or thereby;

a fiber length of less than about 4 mm, of less than about 3 mm, of less than about 2.3 mm, or less than about 2.2 mm, or less than about 2.1 mm, or less than about 2.0 mm, or less than about 1.9 mm, or less than about 1.5 mm, or less than about 1.4, or greater than about 0.7, or greater than about 1, or greater than about 2 mm or between about 0.6 mm and about 2.4 mm, or between about 0.7 mm and about 2.2 mm, or between about 0.8 mm and about 2 mm, or between 2.5 mm and 3.7 mm, or between about 0.9 mm and about 1.8 mm, or between about 1 mm and about 1.6 mm, or between about 1.1 mm and about 1.5 mm, or between about 1.1 mm and about 1.4 mm, or between about 1.1 mm and about 1.3 mm, specifically reciting all increments of 0.01 mm within the above-recited ranges and all ranges formed therein or thereby;

a fiber width of less than about 31 um, or less than about 28 um, or less than about 25 um, or less than about 22 um, or less than about 20 um, or greater than about 8 um, or between about 7 um and about 32 um, or between about 8 um and about 31 um, or between about 10 um and about 28 um, or between about 12 um and about 26 um, or between about 14 um and about 24 um, or between about 16 um and about 22 um, or between about 22 um and about 27 um, or between about 25 um and about 31 um, or between about 15 um and about 19 um, or between about 18 um and about 20 um, or between about 7.5 um and about 9.5 um, specifically reciting all increments of 0.1 um within the above-recited ranges and all ranges formed therein or thereby;

a fiber length/width ratio (according to the Fiber Length, Width, Coarseness, and Fiber Count Test Method) of less than about 190, or less than about 180, or less than about 170, or less than about 160, or less than about 150, or less than about 140, or less than about 130, or less than about 120, or less than about 110, or less than about 106, or less than about 100, or less than about 75, or less than about 50, or greater than about 40, or between about 190 and about 35, or between about 185 and about 40, or between about 175 and about 50, or between about 150 and about 75, or between about 125 and about 100, specifically reciting all increments of 1 within the above-recited ranges and all ranges formed therein or thereby;

a fiber count (length average) of less than about 30 fibers/g, or less than about 25 fibers/g, or less than about 20 fibers/g, or less than about 16 fibers/g, or less than about 15 fibers/g, or less than about 14 fibers/g, or less than about 13 fibers/g, or less than about 10 fibers/g, or greater than about 3 fibers/g, or between about 2.75 fibers/g and about 5 fibers/g, or between about 3 fibers/g and about 35 fibers/g, or between about 3.5 fibers/g and about 30 fibers/g, or between about 5 fibers/g and about 25 fibers/g, or between about 10 fibers/g and about 20 fibers/g, or between about 10 fibers/g and about 15 fibers/g, specifically reciting all increments of 0.1 fibers/g within the above-recited ranges and all ranges formed therein or thereby;

a fiber count (number average) of less than about 30 fibers/g, or less than about 25 fibers/g, or less than about 20 fibers/g, or less than about 16 fibers/g, or less than about 15 fibers/g, or less than about 14 fibers/g, or less than about 13 fibers/g, or less than about 10 fibers/g, or greater than about 3 fibers/g, or greater than about 8.9 fibers/g, or between about 3 fibers/g and about 35 fibers/g, or between about 3.5 fibers/g and about 30 fibers/g, or between about 5 fibers/g and about 25 fibers/g, or between about 10 fibers/g and about 20 fibers/g, or between about 10 fibers/g and about 15 fibers/g, specifically reciting all increments of 0.1 fibers/g within the above-recited ranges and all ranges formed therein or thereby;

fiber count-area (C(n)) of greater than about 800 million/m^2, greater than about 830 million/m^2, greater than about 850 million/m^2, greater than about 900 million/m^2, greater than about 950 million/m^2, greater than about 1,000 million/m^2, or less than about 1,050 million/m^2, less than about 950 million/m^2, or from about 800 million/m^2 to about 1,000 million/m^2, from about 850 million/m^2 to about 975 million/m^2, specifically reciting all increments of 1 million/m^2 within the above-recited ranges and all ranges formed therein or thereby;

fiber count-area (C(1)) of greater than about 260 million/m^2, greater than about 280 million/m^2, greater than about 300 million/m^2, greater than about 350 million/m^2, greater than about 400 million/m^2, greater than about 450 million/m^2, greater than about 500 million/m^2, greater than about 525 million/m^2, or less than about 530 million/m^2, less than about 500 million/m^2, less than about 400 million/m^2, or from about 260 million/m^2 to about 530 million/m^2, from about 260 million/m^2 to about 400 million/m^2, from about 260 million/m^2 to about 400 million/m^2, specifically reciting all increments of 1 million/m^2 within the above-recited ranges and all ranges formed therein or thereby;

a tensile ratio (also called "dry tensile ratio," see the Dry Elongation, Tensile Strength, TEA and Modulus Test Methods below) of less than about 4.5, or less than about 4, or less than about 3.5, or less than about 3, or less than about 2.5, or less than about 2.1, or less than about 2, or less than about 1.9, or less than about 1.7, or greater than about 0.5, or greater than about 1.3, or greater than about 1.6, or greater than about 2, or greater than about 2.5, or between about 0.4 and about 0.5, or between about 0.5 and about 4.5, or between about 1.1 and about 1.6, or between about 1.25 and about 3, or between about 1.8 and about 2.4, or between about 1 and about 3, or between about 1.2 and about 2.1, or between about 1.5 and about 2, or between about 1.7 and about 2, specifically reciting all increments of 0.01 within the above-recited ranges and all ranges formed therein or thereby;

an Emtec TS750 of greater than about 10 dB $V^2$ rms, or greater than about 20 dB $V^2$ rms, or greater than about 40 dB $V^2$ rms, or greater than about 47.7 dB $V^2$ rms, or greater than about 50 dB $V^2$ rms, or greater than about 75 dB $V^2$ rms, or less than about 115 dB $V^2$ rms, or less than about 20 dB $V^2$ rms, or less than about 40 dB $V^2$ rms, or less than about 45 dB $V^2$ rms, or less than about 60 dB $V^2$ rms, or less than about 80 dB $V^2$ rms, or between about 10 dB $V^2$ rms and about 120 dB $V^2$ rms, or between about 14 dB $V^2$ rms and about 113 dB $V^2$ rms, or between about 14 dB $V^2$ rms and about 75 dB $V^2$ rms, or between about 50 dB $V^2$ rms and about 112 dB $V^2$ rms, or between about 15 dB $V^2$ rms and about 50 dB $V^2$, or between about 16 dB $V^2$ rms and about 40 dB $V^2$, or between about 20 dB $V^2$ rms and about 30 dB $V^2$, or between about 25 dB $V^2$ rms and about 35 dB $V^2$, or between about 40 dB $V^2$ rms and about 55 dB $V^2$, specifically reciting all increments of 1 dB $V^2$ rms within the above-recited ranges and all ranges formed therein or thereby;

a slip stick of greater than about 235, or greater than about 270 greater than about 300, or greater than about 350, or greater than about 400, or greater than about 500, or greater than about 600, or greater than about 700, greater than about 800, or greater than about 900, or less than about 435, or less than about 605, or less than about 1000, or between about 230 and about 1400, or between about 235 and about 435, or between about 235 and about 605, or between about 280 and about 965, or between about 300 and about 800, or between about 350 and about 500, or between about 400 and about 600, specifically reciting all increments of 10 within the above-recited ranges and all ranges formed therein or thereby;

a density of a first zone (a first region) or a pillow zone may be different than a density of a second zone (a second region or a knuckle zone), which is adjacent to the first zone, such that the density of a second zone (a second region or a knuckle zone) may be 5%, 10%, 15%, 20%, 30%, 40%, 50%, 75%, 100%, 125%, 150%, 175%, or 200% greater than the first zone (first region or pillow zone), specifically reciting all increments of 0.01% within the above-recited ranges and all ranges formed therein or thereby (the Micro-CT Intensive Property Measurement Method can be used to determine density of an area of interest);

a Runkel Ratio of greater than about 1, or greater than about 2, or greater than about 3, or greater than about 5, or greater than about 6, or greater than about 7, or less than about 10, between about 0.5 and about 10, or between about 1 and about 8, or between about 1.5 and about 6.5, specifically reciting all increments of 0.1 within the above-recited ranges and all ranges formed therein or thereby;

a 2.5-160 micron PVD desorption of less than about 1600 mg, or less than about 1550 mg, or less than about 1500 mg, or less than about 1400 mg, or less than about 1300 mg, or less than about 1200 mg, or less than about 1100 mg, or less than about 1000 mg, or less than about 900 mg, or less than about 800 mg, or less than about 700 mg, or less than about 600 mg, or greater than about 550 mg, or between about 550 mg and about 1600 mg, or between about 600 mg and about 1550 mg, or between about 700 mg and about 1550 mg, or between about 825 mg and about 1550 mg, or between about 850 mg and about 1500 mg, or between about 900 mg and about 1400 mg, or between about 1000 mg and about 1200 mg, specifically reciting all increments of 1 mg within the above-recited ranges and all ranges formed therein or thereby;

a 2.5-160 micron PVD absorption of less than about 1200 mg, or less than about 1100 mg, or less than about 1000 mg, or less than about 900 mg, or greater than about 400 mg, or greater than about 800 mg, or greater than about 825 mg, or between about 400 mg and about 1200 mg, or between about 500 mg and about 1200 mg, or between about 600 mg and about 1200 mg, or between about 700 mg and about 1200 mg, or between about 800 mg and about 1200 mg, or between about 900 mg and about 1100 mg, specifically reciting all increments of 1 mg within the above-recited ranges and all ranges formed therein or thereby;

a VFS of greater than about 4 g/g, or greater than about 5.5 g/g, or greater than about 6.0 g/g, or greater than about 7.0 g/g, or greater than about 7.3 g/g, or greater than about 7.5 g/g, or greater than about 8 mg, or greater than about 8.5 g/g, or greater than about 9 g/g, or greater than about 9.5 g/g, or greater than about 10 g/g, or greater than about 10.5 g/g, or greater than about 11 g/g, or greater than about 11.5 g/g, or greater than about 12 g/g, or greater than about 12.5 g/g, or less than about 13 g/g, or between about 4 g/g and about 15 g/g, or between about 5 g/g and about 11 g/g, or between about 10 g/g and about 15 g/g, or between about 7 g/g and about 13 g/g, or between about 7.5 g/g and about 13 g/g, or between about 8 g/g and about 13 g/g, or between about 9 g/g and about 13 g/g, or between about 10 g/g and about 13 g/g, or between about 10.5 g/g and about 12.5 g/g, or between about 10 g/g and about 12 g/g, or between about 10.5 g/g and about 11.5 g/g, reciting all increments of 0.1 g/g within the above-recited ranges and all ranges formed therein or thereby;

a residual water of less than about 10%, less than about 9%, less than about 7%, less than about 5%, less than about 4%, less than about 3.5%, from about 1% to about 20%, from about 2% to about 18%, from about 3% to about 16%, from about 4% to about 14%, from about 5% to about 12%, from about 6% to about 10%, from about 1% to about 3%, or from about 1% to about 2%, specifically reciting all increments of 0.1% within the above-recited ranges and all ranges formed therein or thereby;

a basis weight of at least about 48 $g/m^2$ (i.e., gsm), of between about 10 $g/m^2$ and about 100 $g/m^2$, or between about 10 $g/m^2$ and about 45 $g/m^2$, between about 20 $g/m^2$ and about 40 $g/m^2$, or between about 24 $g/m^2$ and about 40 $g/m^2$, or between about 30 $g/m^2$ and about 32 $g/m^2$, or between about 40 $g/m^2$ and about 65 $g/m^2$, or between about 45 $g/m^2$ and about 60 $g/m^2$, or between about 50 $g/m^2$ and about 58 $g/m^2$, or between about 50 $g/m^2$ and about 55 $g/m^2$, or between about 50 $g/m^2$ and about 75 $g/m^2$, specifically reciting all increments of 0.1 $g/m^2$ within the above-recited ranges and all ranges formed therein or thereby;

a density (based on measuring caliper at 95 g/in^2) of less than about 0.60 g/cm^3 and/or less than about 0.30 g/cm^3 and/or less than about 0.20 g/cm^3 and/or less than about 0.10 g/cm^3 and/or less than about 0.07 g/cm^3 and/or less than about 0.05 g/cm^3 and/or from about 0.01 g/cm^3 to about 0.20 g/cm^3 and/or from about 0.02 g/cm^3 to about 0.10 g/cm^3, specifically reciting all increments of 0.001 g/cm^3 within the above-recited ranges and all ranges formed therein or thereby;

a bulk (also called "dry bulk," based on measuring caliper at 95 g/in^2) of greater than about 1.67 cm^3/g and/or greater than about 3.33 cm^3/g and/or greater than about 5.00 cm^3/g and/or greater than about 10.00 cm^3/g and/or greater than about 14.29 cm^3/g and/or greater than about 15.0 cm^3/g and/or greater than about 18.0 cm^3/g and/or greater than about 20.00 cm^3/g and/or from about 100.00 cm^3/g to about 5.00 cm^3/g and/or from about 50.00 cm^3/g to about 10.00 cm^3/g, specifically reciting all increments of 0.01 cm^3/g within the above-recited ranges and all ranges formed therein or thereby (Note: This is distinct from "Dry Bulk Ratio" and "Resilient Bulk.");

an SST (absorbency rate) of greater than about 0.3 $g/sec^{0.5}$, or greater than about 0.4 $g/sec^{0.5}$, or greater than about 0.45 $g/sec^{0.5}$, or greater than about 0.5 $g/sec^{0.5}$, or greater than about 0.75 $g/sec^{0.5}$, or greater than about 1.0 $g/sec^{0.5}$, or greater than about 1.60 $g/sec^{0.5}$, or greater than about 1.65 $g/sec^{0.5}$, or greater than about 1.70 $g/sec^{0.5}$, or greater than about 1.75 $g/sec^{0.5}$, or greater than about 1.80 $g/sec^{0.5}$, or greater than about 1.82 $g/sec^{0.5}$, or greater than about 1.85 g/sec$^{0.5}$, or greater than about 1.88 g/sec$^{0.5}$, or greater than about 1.90 g/sec$^{0.5}$, or greater than about 1.95 g/sec$^{0.5}$, or greater than about 2.00 g/sec$^{0.5}$, or between about 1.60 g/sec$^{0.5}$ and about 2.50 g/sec$^{0.5}$, between about 1.0 g/sec$^{0.5}$ and about 2.0 g/sec$^{0.5}$, or between about 2.0 g/sec$^{0.5}$ and about 2.50 g/sec$^{0.5}$, or between about 0.3 g/sec$^{0.5}$ and about 0.7 g/sec$^{0.5}$, or between about 1.0 g/sec$^{0.5}$ and about 1.50 g/sec$^{0.5}$, or between about 0.3 g/sec$^{0.5}$, and about 0.9 g/sec$^{0.5}$ or between about 1.65 g/sec$^{0.5}$ and about 2.50 g/sec$^{0.5}$, or between about 1.70 g/sec$^{0.5}$ and about 2.40 g/sec$^{0.5}$, or between about 1.75 g/sec$^{0.5}$ and about 2.30 g/sec$^{0.5}$, or between about 1.80 g/sec$^{0.5}$ and about 2.20 g/sec$^{0.5}$, or between about 1.82 g/sec$^{0.5}$ and about 2.10 g/sec$^{0.5}$, or between about 1.85 g/sec$^{0.5}$ and about 2.00 g/sec$^{0.5}$, specifically reciting all increments of 0.1 g/sec$^{0.5}$ within the above-recited ranges and all ranges formed therein or thereby;

a plate stiffness of greater than about 0.3 N*mm, or greater than about 0.5 N*mm, or greater than about 1.0 N*mm, or greater than about 2.0 N*mm, or greater than about 4.0 N*mm, or greater than about 6.0 N*mm, or greater than about 8.0 N*mm, or greater than about 12.0 N*mm, or greater than about 12.5 N*mm, or greater than about 13.0 N*mm, or greater than about 13.5 N*mm, or greater than about 14 N*mm, or greater than about 14.5 N*mm, or greater than about 15 N*mm, or greater than about 15.5 N*mm, or greater than about 16 N*mm, or greater than about 16.5 N*mm, or greater than about 17 N*mm, or between about 0.3 N*mm and about 20 N*mm, or between about 1 N*mm and about 20 N*mm, or between about 2 N*mm and about 20 N*mm, or between about 4 N*mm and about 20 N*mm, or between about 6 N*mm and about 20 N*mm, or between about 8 N*mm and about 20 N*mm, or between about 10 N*mm and about 20 N*mm, or between about 12 N*mm and about 20 N*mm, or between about 12.5 N*mm and about 20 N*mm, or between about 13 N*mm and about 20 N*mm, or between about 13.5 N*mm and about 20 N*mm, or between about 14 N*mm between about 20 N*mm, or between about 14.5 N*mm and about 20 N*mm, or between about 15 N*mm and about 20 N*mm, or between about 15.5 N*mm and about 20 N*mm, or between about 16 N*mm and about 20 N*mm, or between about 16.5 N*mm and about 20 N*mm, or between about 17 N*mm and about 20 N*mm, specifically reciting all increments of 0.1 N*mm within the above-recited ranges and all ranges formed therein or thereby;

a resilient bulk of greater than about 25 cm$^3$/g, or greater than about 29 cm$^3$/g, or greater than about 40 cm$^3$/g, or greater than about 50 cm$^3$/g, or greater than about 60 cm$^3$/g, or greater than about 62 cm$^3$/g, or greater than about 75 cm$^3$/g, or greater than about 85 cm$^3$/g, or greater than about 90 cm$^3$/g, or greater than about 95 cm$^3$/g, or greater than about 100 cm$^3$/g, or greater than about 102 cm$^3$/g, or greater than about 105 cm$^3$/g, or between about 29 cm$^3$/g and about 112 cm$^3$/g, or between about 29 cm$^3$/g and about 103 cm$^3$/g, or between about 40 cm$^3$/g and about 100 cm$^3$/g, or between about 50 cm$^3$/g and about 75 cm$^3$/g, or between about 55 cm$^3$/g and 70 cm$^3$/g, or between about 85 cm$^3$/g and about 110 cm$^3$/g, or between about 90 cm$^3$/g and about 110 cm$^3$/g, or between about 95 cm$^3$/g and about 110 cm$^3$/g, or between about 100 cm$^3$/g and about 110 cm$^3$/g, specifically reciting all increments of 1 cm$^3$/g within the above-recited ranges and all ranges formed therein or thereby;

a total wet tensile of greater than about 50 g/in, or greater than about 75 g/in, or greater than about 100 g/in, or greater than about 200 g/in, or greater than about 300 g/in, or greater than about 400 g/in, or greater than about 450 g/in, or greater than about 470 g/in, or greater than about 500 g/in, or greater than about 550 g/in, or greater than about 600 g/in, or greater than about 650 g/in, or greater than about 700 g/in, or greater than about 750 g/in, or greater than about 758 g/in, or greater than about 800 g/in, or greater than about 850 g/in, or greater than about 900 g/in, or greater than about 2278. or between about 350 g/in and about 475 g/in, or between about 420 g/in and about 440 g/in, or between about 100 g/in and about 640 g/in, or between about 300 g/in and about 1000 g/in, or between about 400 g/in and about 900 g/in, or between about 500 g/in and about 900 g/in, or between about 550 g/in and about 900 g/in, or between about 600 g/in and about 900 g/in, or between about 650 g/in and about 900 g/in, or between about 700 g/in and about 900 g/in, specifically reciting all increments of 10 g/in within the above-recited ranges and all ranges formed therein or thereby;

a total wet tensile (Finch) of greater than about between about 10 g/in and about 125 g/in, or between about 20 g/in and about 55 g/in, or between about 30 g/in and about 100 g/in, or between about 10 g/in and about 65 g/in, specifically reciting all increments of 1 g/in within the above-recited ranges and all ranges formed therein or thereby;

a dry burst (peak load) strength of greater than about 250 g, or greater than about 400 g, or greater than about 600 g, or greater than about 800 g, or greater than about 1000 g, or greater than about 1200 g, or greater than about 1300 g, or greater than about 1400 g, or between about 250 g and about 1500 g, or between about 400 g and about 1500 g, or between about 600 g and about 1500 g, or between about 800 g and about 1450 g, or between about 1000 g and about 1400 g;

a wet burst (peak load) strength of greater than about 3 g, greater than about 5 g, or greater than about 10 g, or greater than about 20 g, or greater than about 50 g, or greater than about 55 g, or greater than about 75 g, or greater than about 100 g, or greater than about 115 g, or greater than about 150 g, or greater than about 177 g, or greater than about 200 g, or greater than about 300 g, or greater than about 350 g, or greater than about 400 g, or greater than about 450 g, or greater than about 478 g, or greater than about 500 g, or greater than about 550 g, or greater than about 600 g, or between about 20 g and about 530 g, or between about 3 g and about 22 g, or between about 25 g and about 52 g, or between about 230 g and about 525 g, or between about 180 g and about 525 g, or between about 200 g and about 700 g, or between about 350 g and about 600 g, or between about 350 g and about 550 g, or between about 400 g and about 550 g, or between about 400 g and about 525 g, or between about 50 g and about 220 g, or between about 50 g and about 60 g, or between about 50 g and 55 g, specifically reciting all increments of 10 g within the above-recited ranges and all ranges formed therein or thereby;

a flexural rigidity of greater than about 175 mg-cm, or greater than about 700 mg-cm, or greater than about 800 mg-cm, or greater than about 900 mg-cm, or greater than about 1000 mg-cm, or greater than about 1100 mg-cm, or greater than about 1200 mg-cm, or greater than about 1300 mg-cm, or greater than about 1400 mg-cm, or greater than about 1500 mg-cm, or greater than about 1600 mg-cm, or greater than about 1700 mg-cm, or between about 700 mg-cm and about 1800 mg-cm, or between about 800 mg-cm and about 1600 mg-cm, or between about 900 mg-cm and about 1400 mg-cm, or between about 1000 mg-cm and about 1350 mg-cm, or between about 1050 mg-cm and about 1350 mg-cm, or between about 1100 mg-cm and about 1350 mg-cm, or between about 1100 mg-cm and about 1300 mg-cm, specifically reciting all increments of 10 mg-cm within the above-recited ranges and all ranges formed therein or thereby;

a dry caliper of greater than about 4.0 mils, or greater than about 10.0 mils, or greater than about 15.0 mils, or greater than about 20.0 mils, or than about 26.0 mils, or than about 28.0 mils, or greater than about 40 mils, or greater than about 55 mils, or between about 4.0 mils and about 27.0 mils, or between about 18.0 mils and about 24.0 mils, or between about 45.0 mils and about 51.0 mils, or between about 29 mils and about 33.0 mils, or between about 19.0 mils and about 43.0 mils, or about 26.0 mils and about 80.0 mils, or between 40.0 mils and 60.0 mils, or between about 50 and about 60 mils, specifically reciting all increments of 0.10 mils within the above-recited ranges and all ranges formed therein or thereby;

a wet caliper of greater than about 8.0 mils, or greater than about 10.0 mils, or greater than about 15.0 mils, or greater than about 17.0 mils, or greater than about 26 mils, or between about 10.0 mils and about 33.0 mils, or between about 15.0 mils and about 25.0 mils, or between about 8.0 mils and about 20.0 mils, or between about 26.0 mils and about 70.0 mils, or between about 26.0 mils and about 40.0 mils, specifically reciting all increments of 0.10 mils within the above-recited ranges and all ranges formed therein or thereby;

a total dry tensile (total tensile) of greater than about 250 g/in, or greater than about 400 g/in, or greater than about 500 g/in, or greater than about 700 g/in, or greater than about 800 g/in, or greater than about 1000 g/in, or greater than about 1200 g/in, or greater than about 1300 g/in, or greater than about 1700 g/in, or greater than about 2278 g/in, or between about 880 g/in and about 2570 g/in, or between about 1800 g/in and about 2485 g/in, or between about 1900 g/in and about 2300 g/in, or between about 250 g/in and about 1000 g/in, or between about 400 g/in and about 580 g/in, or between about 700 g/in and about 800 g/in, or between about 275 g/in and about 1310 g/in, or about 1300 g/in and about 4000 g/in, or between about 1800 g/in and about 2800 g/in, specifically reciting all increments of 10 g/in within the above-recited ranges and all ranges formed therein or thereby;

a geometric mean (GM) dry modulus of greater than about 1000 g/cm, or greater than about 1700 g/cm, or less than about 3320 g/cm, or less than about 2500 g/cm, or less than about 2400 g/cm, or less than about 2300 g/cm, or less than about 2000 g/cm, or less than about 1500 g/cm, or less than about 1000 g/cm, or between about 1800 g/cm and about 4000 g/cm, or between about 1800 g/cm and about 3500 g/cm, or between about 3300 g/cm and about 3350 g/cm, specifically reciting all increments of 10 g/cm within the above-recited ranges and all ranges formed therein or thereby;

a wet tensile geometric mean (GM) modulus of greater than about 250 g/cm, or greater than about 375 g/cm, or between about 250 g/cm and about 700 g/cm, or between about 250 g/cm and about 525 g/cm, or between about 375 g/cm and 525 g/cm, specifically reciting all increments of 10 g/cm within the above-recited ranges and all ranges formed therein or thereby;

a CRT rate of greater than about 0.30 g/sec, or greater than about 0.5 g/sec, or greater than about 0.55 g/sec, or greater than about 0.6 g/sec, or greater than about 0.61 g/sec, or greater than about 0.65 g/sec, or greater than about 0.7 g/sec, or greater than about 0.75 g/sec, or greater than about 0.8 g/sec, or between about 0.30 g/sec and about 1.00 g/sec, or between about 0.61 g/sec and about 0.85 g/sec, specifically reciting all increments of 0.05 g/sec within the above-recited ranges and all ranges formed therein or thereby;

a CRT capacity of greater than about 10.0 g/g, or greater than about 12.5 g/g, or between about 12.5 g/g and about 23.0 g/g, or between about 16.5 g/g and about 21.5 g/g, specifically reciting all increments of 0.1 g/g within the above-recited ranges and all ranges formed therein or thereby; a kinetic CoF of greater than about 0.75, or greater than about 0.85, or between about 0.85 and about 1.30, or between about 0.77 and about 1.7, or between about 0.85 and about 1.20, specifically reciting all increments of 0.05 within the above-recited ranges and all ranges formed therein or thereby;

a dry depth of more negative than −240 um, or more negative than −255 um, or more negative than −265 um, or more negative than −275 um, or more negative than −285 um, or more negative than −295 um, or more negative than −300 um, or between about −240 um and about −310 um, or between about −245 um and about −305 um, or between about −255 um and about −303 um, or between about −265 um and about −302 um, or between about −275 um and about −300 um, specifically reciting all increments of 20 um within the above-recited ranges and all ranges formed therein or thereby;

a moist depth of more negative than −275 um, or more negative than −285 um, or more negative than −295 um, or more negative than −300 um, or more negative than −310 um, or more negative than −320 um, or more negative than −330 um, or between about −275 um and about −340 um, or between about −285 um and about −335 um, or between about −295 um and about −332 um, or between about −300 um and about −330 um, or between about −305 um and about −328 um, specifically reciting all increments of 20 um within the above-recited ranges and all ranges formed therein or thereby;

a moist contact area of greater than 25%, or greater than 27%, or greater than 29%, or greater than 31%, or greater than 32%, or greater than 34%, or greater than 36%, or between about 25% and about 38%, or between about 27% and about 37%, or between about 29% and about 36%, or between about 30% and about 35%, or between about 31% and about 34%, specifically reciting all increments of 1% within the above-recited ranges and all ranges formed therein or thereby;

a dry contact area of greater than 17%, or greater than 20%, or greater than 22%, or greater than 24%, or greater than 26%, or greater than 28%, or greater than 30%, or between about 17% and about 33%, or between about 20% and about 31%, or between about 22% and about 30%, or between about 23% and about 30%, or between about 24% and about 29%, specifically reciting all increments of 1% within the above-recited ranges and all ranges formed therein or thereby;

a dry compression (at 10 g force in mils) of greater than about 30 mils, or greater than about 45 mils, or greater than about 50 mils, or greater than about 55 mils, or greater than about 60 mils, or greater than about 65 mils, or greater than about 70, or greater than about 85 mils, or between about 40 mils and about 100 mils, or between about 50 mils and about 80 mils, or between about 50 mils and about 65 mils, or between about 50 mils and about 60 mils, or between about 55 mils and about 60 mils, specifically reciting all increments of 5 mil within the above-recited ranges and all ranges formed therein or thereby;

a wet compression (at 10 g force value) in mils of greater than about 30 mils, or greater than about 20 mils, or greater than about 30 mils, or greater than about 40 mils, or greater than about 50 mils, or greater than about 55, or greater than about 60 mils, or greater than about 70 mils, or between about 30 mils and about 100 mils, or between about 40 mils and about 70 mils, or between about 45 mils and about 60 mils, or between about 47 mils and about 58 mils, or between about 50 mils and about 55 mils, specifically reciting all increments of 5 mils within the above-recited ranges and all ranges formed therein or thereby;

a dry bulk ratio of greater than about 15, or greater than about 18, or greater than about 22, or greater than about 25, or greater than about 27, or greater than about 33, or greater than about 35, or greater than about 40, or greater than about 50, or between about 15 and about 60, or between about 22 and about 50, or between about 25 and about 35, or between about 27 and about 35, or between about 27 and about 33, specifically reciting all increments of 0.5 within the above-recited ranges and all ranges formed therein or thereby;

a wet bulk ratio of greater than about 20, or greater than about 22, or greater than about 25, or greater than about 28, or greater than about 30, or greater than about 34, or greater than about 40, or greater than about 45, or greater than about 50, or greater than about 55, or between about 22 and about 50, or between about 20 and about 50, or between about 25 and about 45, or between about 28 and about 40, or between about 30 and about 34, specifically reciting all increments of 0.5 inches within the above-recited ranges and all ranges formed therein or thereby;

a wet burst strength to dry tensile ratio ("wet burst/dry tensile ratio" which is wet burst strength divided by dry tensile) of greater than about 0.05, greater than about 0.09, greater than about 0.1, greater than about 0.15, greater than about 0.18, greater than about 0.20, greater than about 0.24, or greater than about 0.26, or between about 0.05 and about 0.27, or between about 0.15 and about 0.26, or between about 0.20 and about 0.26;

a wet burst strength to dry burst strength ratio ("wet/dry burst strength ratio" which is wet burst strength divided by dry burst strength) of greater than about 0.09, or greater than about 0.10, or greater than about 0.18, or greater than about 0.19, or greater than about 0.20, or greater than about 0.30, or greater than about 0.40, or between about 0.10 and about 0.50, or between about 0.20 and about 0.48, or between about 0.30 and about 0.46, or between about 0.40 and about 0.46; a concavity ratio measurement of greater than about 0.1, or greater than about 0.15, or greater than about 0.20, or greater than about 0.25, or greater than about 0.30, or greater than about 0.35, or greater than about 0.40, or greater than about 0.45, or greater than about 0.50, or greater than about 0.55, or greater than about 1.0, or greater than about 1.25, or greater than about 1.5, or between about 0.10 and about 0.95, or between about 0.15 and about 0.90, or between about 0.20 and about 0.85, specifically reciting all increments of 0.01 within the above-recited ranges and all ranges formed therein or thereby; and/or a packing fraction measurement of greater than about 0.05, or greater than about 0.08, or greater than about 0.10, or greater than about 0.12, or greater than about 0.15, or greater than about 0.17, or between about 0.05 and about 0.75, or between about 0.10 and about 0.80, or between about 0.15 and about 0.85, specifically reciting all increments of 0.01 within the above-recited ranges and all ranges formed therein or thereby.

Fibrous structure(s), including sanitary tissue products of the present disclosure comprising non-wood fibers, may have one or a combination of the above properties (disclosed in this Properties of Fibrous Structure(s) Section). Further, different sanitary tissue products of an array (e.g., arrays of 2, 3, 4, 5, 6, 7, 8, 9, 10, or more different products) of the present disclosure may have different combinations of the above properties (disclosed in this Properties of Fibrous Structure(s) Section), including, but not limited to the different combinations disclosed in the Aspects of the present disclosure, including Aspects 1-4.

Beyond the sanitary tissue products disclosed herein, the sanitary tissue products, including the inventive sanitary tissue products, disclosed in U.S. Ser. No. 63/456,020, titled "Fibrous Structures Comprising Non-wood Fibers," filed on Mar. 31, 2023 may be used to form at least a portion of the arrays of the present disclosure.

Making of Sanitary Tissue Products

As shown in FIG. 6A, process and equipment 150 for making suitable sanitary tissue products for use in the arrays of the present disclosure may comprise supplying an aqueous dispersion of fibers (a fibrous furnish) to a headbox 152 which can be of any design known to those of skill in the art. The aqueous dispersion of fibers can include wood and non-wood fibers, northern softwood kraft fibers ("NSK"), eucalyptus fibers, southern softwood kraft (SSK) fibers, Northern Hardwood Kraft (NHK) fibers, acacia, bamboo, straw and bast fibers (wheat, flax, rice, barley, etc.), corn stalks, bagasse, abaca, kenaf, reed, synthetic fibers (PP, PET, PE, bico version of such fibers), regenerated cellulose fibers (viscose, lyocell, etc.), and other fibers known in the papermaking art, including short fibers having an average length less than 1.0 mm (Average Short Fiber Length-ASFL) and including long fibers having an average length greater than 1.0 mm, from about 1.2 mm to about 3.5 mm, or from about 3 mm to about 10 mm (Average Long Fiber Length-ALFL). Depending on the non-wood fibers being used, they may be in the long fiber range of length. For instance, bamboo can have a length from 1.1 to 2.0 mm and sunn hemp is even longer, it can have a length from 2.8 to 3.0 mm and sisal hemp can have a length from 2.5 to 2.7 mm. Kenaf can have a length from 2.7 to 3.0 mm, abaca can have a length from 4.0 to 4.3 mm.

From the headbox 152, the aqueous dispersion of fibers can be delivered to a foraminous member 154, which can be a Fourdrinier wire, to produce an embryonic fibrous web 156. Furnish mixes may be useful in the present disclosure may be from about 20% to about 50% short fibers and from about 40% to about 100% long fibers, specifically including all 1% increments between the recited ranges.

The foraminous member 154 can be supported by a breast roll 158 and a plurality of return rolls 160 of which only two are illustrated. The foraminous member 154 can be propelled in the direction indicated by directional arrow 162 by a drive means, not illustrated, at a predetermined velocity, $V_1$. Optional auxiliary units and/or devices commonly associated with fibrous structure making machines and with the foraminous member 154, but not illustrated, comprise forming boards, hydrofoils, vacuum boxes, tension rolls, support rolls, wire cleaning showers, and other various components known to those of skill in the art.

After the aqueous dispersion of fibers is deposited onto the foraminous member 154, the embryonic fibrous web 156 is formed, typically by the removal of a portion of the aqueous dispersing medium by techniques known to those skilled in the art. Vacuum boxes, forming boards, hydrofoils, and other various equipment known to those of skill in the art are useful in effectuating water removal. The embryonic fibrous web 156 can travel with the foraminous member 154 about return roll 160 and can be brought into contact with a papermaking belt 164 in a transfer zone 136, after which the embryonic fibrous web travels on the papermaking belt 164. While in contact with the papermaking belt 164, the embryonic fibrous web 156 can be deflected, rearranged, and/or further dewatered. Depending on the process, mechanical and fluid pressure differential, alone or in combination, can be utilized to deflect a portion of fibers into the deflection conduits of the papermaking belt. For example, in a through-air drying process a vacuum apparatus 176 can apply a fluid pressure differential to the embryonic web 156 disposed on the papermaking belt 164, thereby deflecting fibers into the deflection conduits of the deflection member. The process of deflection may be continued with additional vacuum pressure 186, if necessary, to even further deflect and dewater the fibers of the web 184 into the deflection conduits of the papermaking belt 164.

The papermaking belt 164 can be in the form of an endless belt. In this simplified representation, the papermaking belt 164 passes around and about papermaking belt return rolls 166 and impression nip roll 168 and can travel in the direction indicated by directional arrow 170, at a papermaking belt velocity $V_2$, which can be less than, equal to, or greater than, the foraminous member velocity $V_1$. In the present disclosure, the papermaking belt velocity $V_2$ is less than foraminous member velocity $V_1$ such that the partially-dried fibrous web is foreshortened in the transfer zone 136 by a percentage determined by the relative velocity differential between the foraminous member and the papermaking belt. Associated with the papermaking belt 164, but not illustrated, can be various support rolls, other return rolls, cleaning means, drive means, and other various equipment known to those of skill in the art that may be commonly used in fibrous structure making machines.

The papermaking belts 164 of the present disclosure can be made, or partially made, according to the process described in U.S. Pat. No. 4,637,859, issued Jan. 20, 1987, to Trokhan, and having the patterns of cells as disclosed herein.

The fibrous web 192 can then be creped with a creping blade 194 to remove the web 192 from the surface of the Yankee dryer 190 resulting in the production of a creped fibrous structure 196 in accordance with the present disclosure. As used herein, creping refers to the reduction in length of a dry (having a consistency of at least about 90% and/or at least about 95%) fibrous web which occurs when energy is applied to the dry fibrous web in such a way that the length of the fibrous web is reduced and the fibers in the fibrous web are rearranged with an accompanying disruption of fiber-fiber bonds. Creping can be accomplished in any of several ways as is well known in the art, as the doctor blades can be set at various angles. The creped fibrous structure 196 is wound on a reel, commonly referred to as a parent roll, and can be subjected to post processing steps such as calendaring, tuft generating operations, embossing, and/or converting. The reel winds the creped fibrous structure at a reel surface velocity, $V_4$.

The papermaking belts of the present disclosure can be utilized to form discrete elements and a continuous/substantially continuous network (i.e., knuckles and pillows) into a fibrous structure during a through-air-drying operation. The discrete elements can be knuckles and can be relatively high density relative to the continuous/substantially continuous network, which can be a continuous/substantially pillow having a relatively lower density. In other examples, the discrete elements can be pillows and can be relatively low density relative to the continuous/substantially continuous network, which can be a continuous/substantially continuous knuckle having a relatively higher density. In the example detailed above, the fibrous structure is a homogenous fibrous structure, but such papermaking process may also be adapted to manufacture layered fibrous structures, as is known in the art. As discussed above, the fibrous structure can be embossed during a converting operating to produce the embossed fibrous structures of the present disclosure.

As illustrated in FIGS. 6B and 6C, beyond creating knuckles and pillows with resinous belts described above, and beyond the various types of creping, paper may be transformed in other ways, such that beneficial properties are created, especially as the speed of a belt or a wire transfers the web to a belt or a wire of a different speed, such as, for example, the upstream belt or wire moving faster than the downstream belt or wire. It may be desirable to have multiple such transfers in the same papermaking process. Further, it may be desirable to have different speed differentials at different transfers in such a process. As a more specific example, referring to FIG. 6B, in a first rush transfer 175, the speed of the forming fabric 154 can be travelling at a first rate, while the transfer fabric 174 travels at a second rate (slower than the first rate, but faster than 2,000 feet per minute (fpm), 2,050 fpm, 2,100 fpm, 2,150 fpm, 2.200 fpm, 2,250 fpm, 2,300 fpm, 2,350 fpm, 2,400 fpm, 2,450 fpm, 2,500 fpm, 2,600 fpm, 2,700 fpm, 2,800 fpm, 2,900 fpm, or greater than 3,000 fpm); further, a second rush transfer 175' may occur where the transfer fabric is travelling at the second rate, while the TAD fabric 164 travels at a third rate, which may be the faster or slower (e.g., about 10%, about 15%, about 20%, about 25%, about 30%, about 40, about 50% faster or slower) than the second rate. While the UCTAD process does not form traditional density differentials (e.g., such as knuckles and pillows), said rush transfers can, depending on the speed differentials of the transfers, create fiber orientations within the web such that performance of the fibrous structure is improved, such as, for example, stretch, tensile ratio, tensile, modulus, caliper, bulk.

Arrays of the present disclosure may optionally be created using a first process (e.g., the process of FIG. 6A) to make a first sanitary tissue product 106-1 and a second process (e.g., the process of FIG. 6B) to make a second sanitary tissue product 106-2.

Packages of Sanitary Tissue Products

The packages 100 that house the sanitary tissue products 106 of the present disclosure may be formed from various types of material and may be configured in various shapes and sizes. In some configurations, the packages 100 may be formed from a poly film material that may comprise polymeric films, polypropylene films, and/or polyethylene films. In some configurations, the packages 100 may be formed from cellulose, such as for example, in the form of paper and/or cardboard. The package 100 may have a preformed shape into which sanitary tissue products 106 are inserted and/or may be formed by wrapping a material around one or more sanitary tissue products 106 to define a shape that conforms with the shapes of individual products and/or arrangements of products. As shown in FIG. 1A, the package 100 may also include a seal 114, such as an envelope seal, for example, formed thereon. As shown in FIG. 1A, the package 100 may include a top side 116 and a bottom side 118. The package 100 may also include a front panel 120 and a rear panel 122, wherein the front and rear panels 120, 122 are connected with and separated by opposing first and second sides 124, 126. The front panel 120, the rear panel 122, the first side 124, and/or the second side 126 may be substantially planar, curved, or convex as shown in FIG. 1A and may also define an outer surface 128 of the package 100. Note, "panel" may alternatively be referred to herein as "face" (e.g., front face). The panel configured to face a customer when she walks down an aisle of a retail store may be referred to as an "aisle facing" face or panel of the package 100. Packages 100 may have a "Package Height" 210 (see FIG. 2A), a "Package Width" 212 (see FIG. 2A), and a "Package Depth" 214 (see FIG. 2B). At least one of the panels or faces of the packages in an array may have an indicia 300 and 301 indicating a brand name, sub-brand name, identifier, additional information and/or manufacturer.

Figure 20:
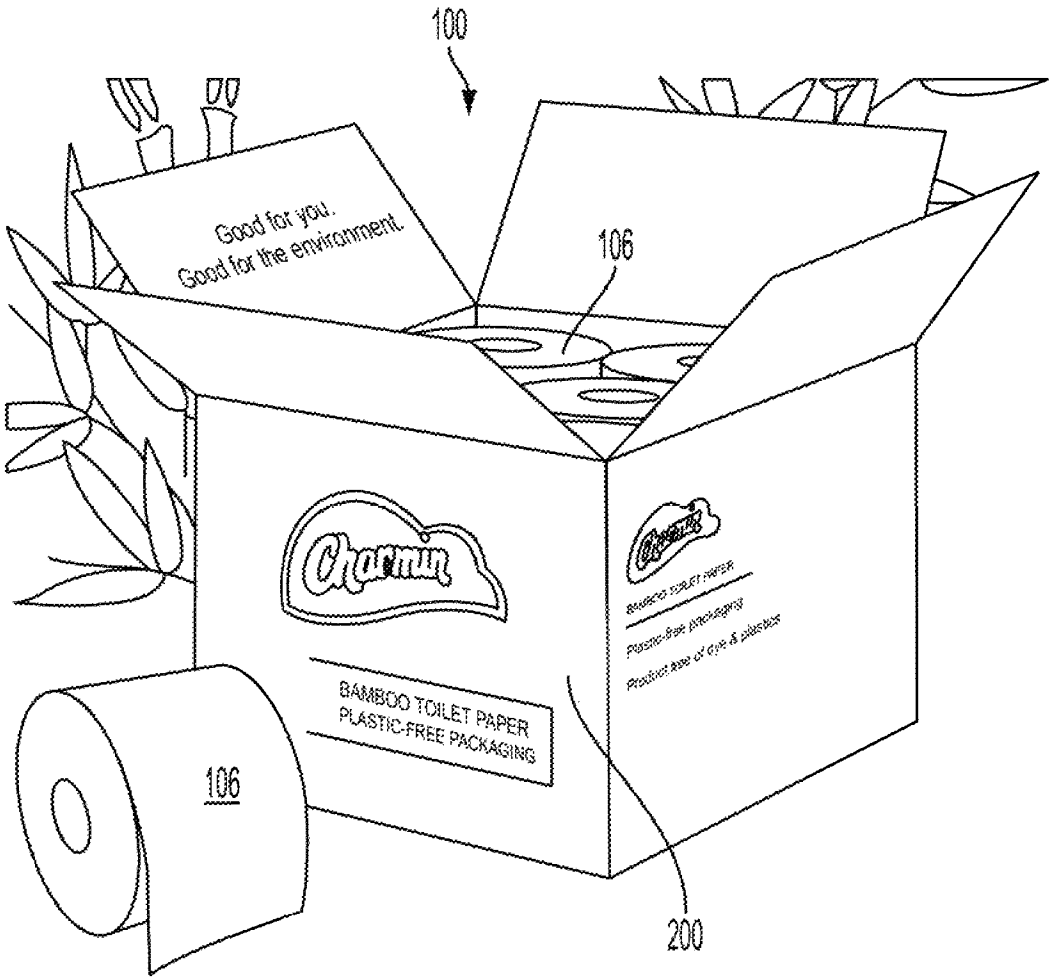
FIG. 20 illustrates a package (corrugated cardboard box) comprising sanitary tissue products, where an interior surface of the package is a contrasting color versus an exterior surface of the package.
Figure 21A:
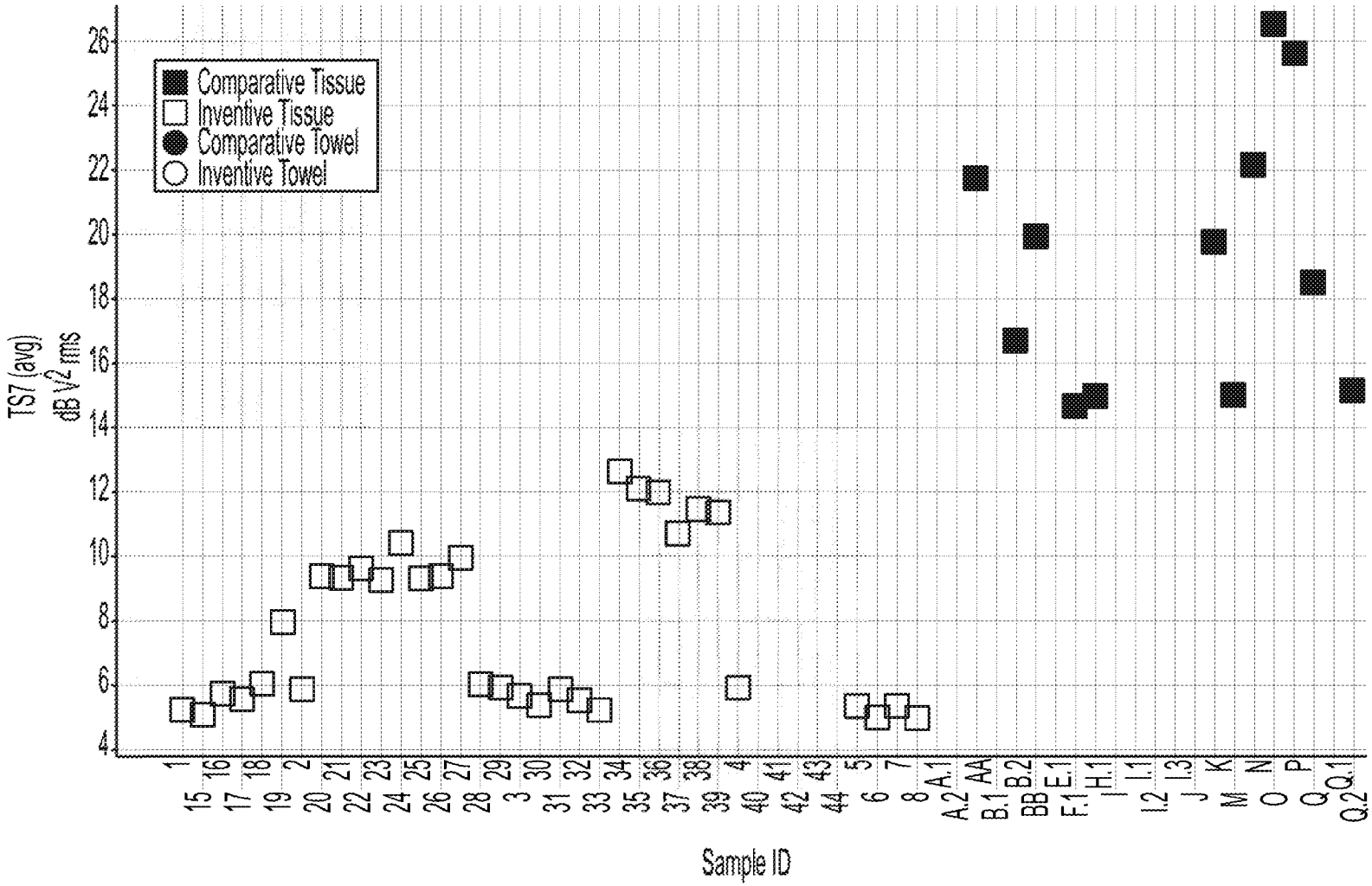
FIG. 21A is a TS7 (y-axis) graph illustrating inventive and comparative non-wood tissue (bath) samples of the tables of FIGS. 24A-J.
Figure 21B:
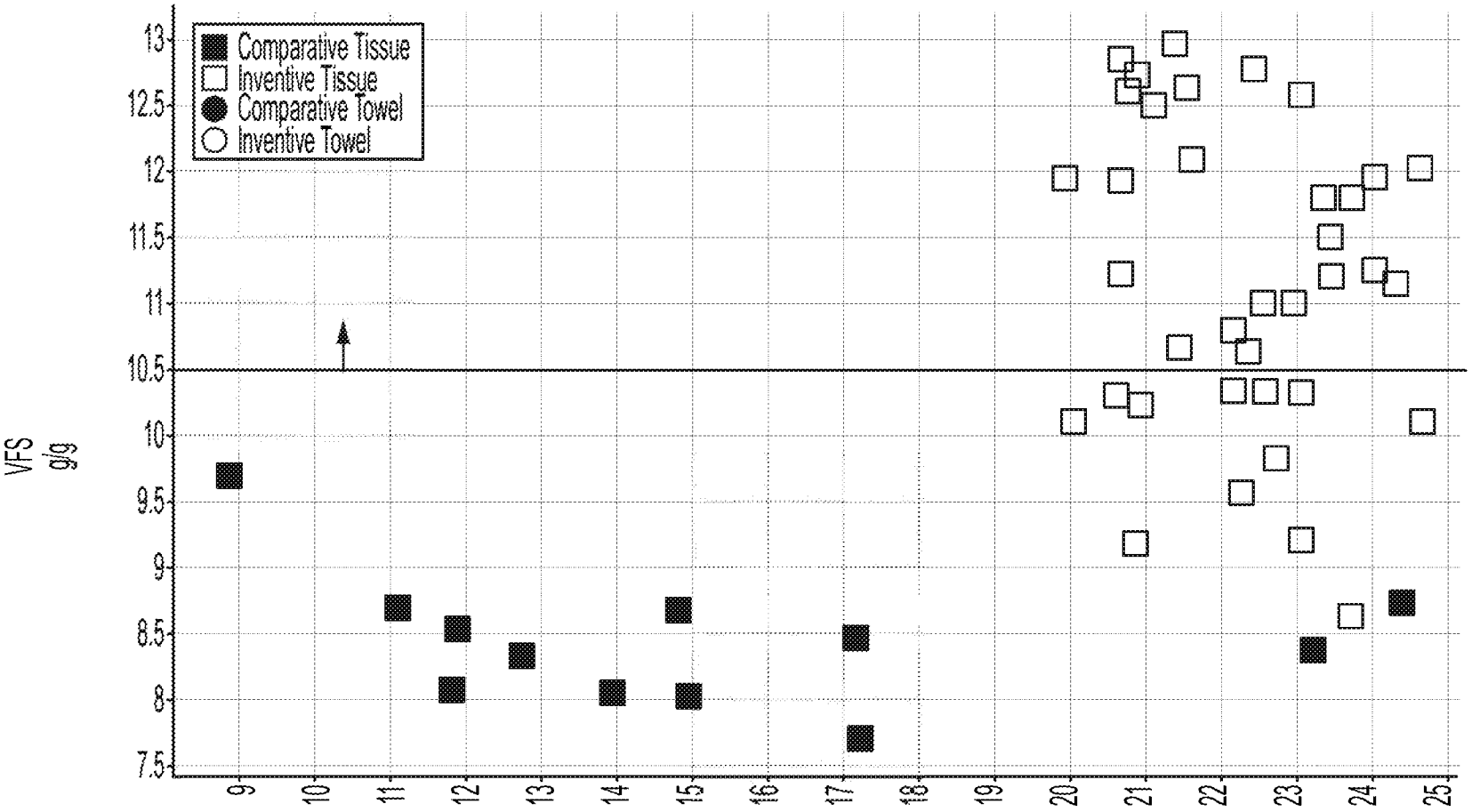
FIG. 21B is a graph illustrating VFS g/g (y-axis) and dry caliper (x-axis) values of inventive and comparative non-wood tissue (bath) samples of the tables of FIGS. 24A-J.
Figure 21C:
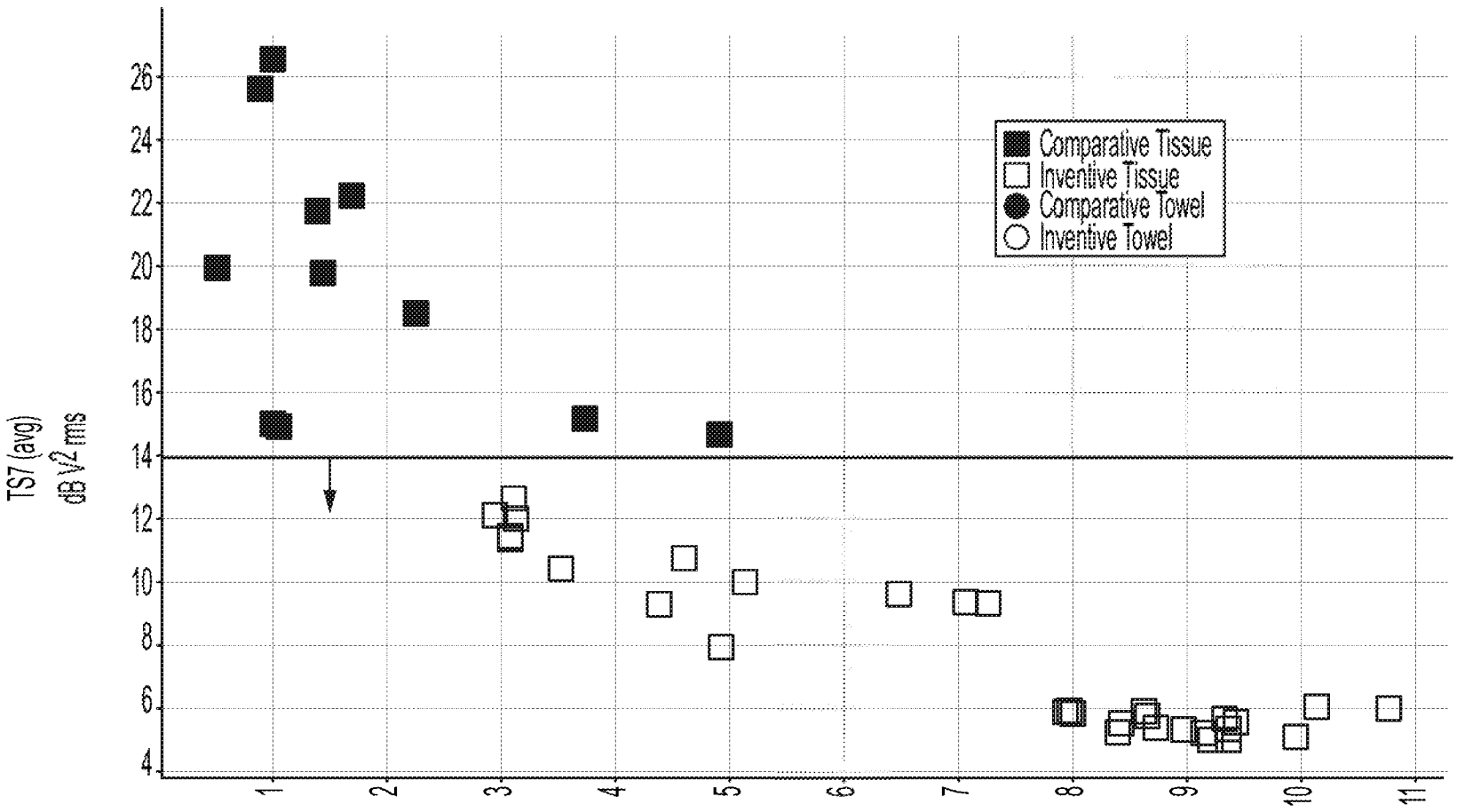
FIG. 21C is a graph illustrating TS7 (y-axis) and lint (x-axis) values of inventive and comparative non-wood tissue (bath) samples of the tables of FIGS. 24A-J.
Figure 21D:
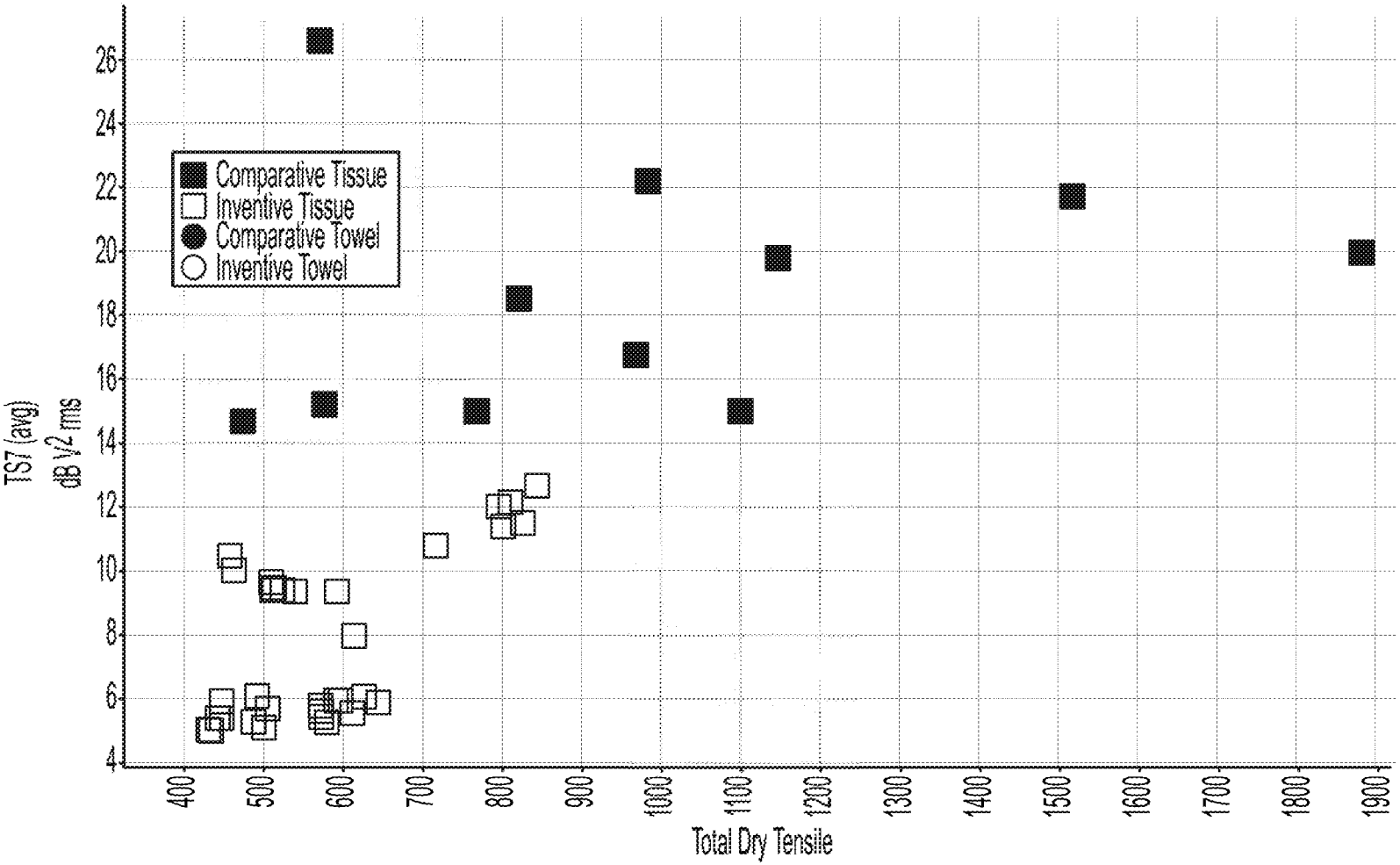
FIG. 21D is a graph illustrating TS7 (y-axis) and total dry tensile (x-axis) values of inventive and comparative non-wood tissue (bath) samples of the tables of FIGS. 24A-J.
Figure 21E:
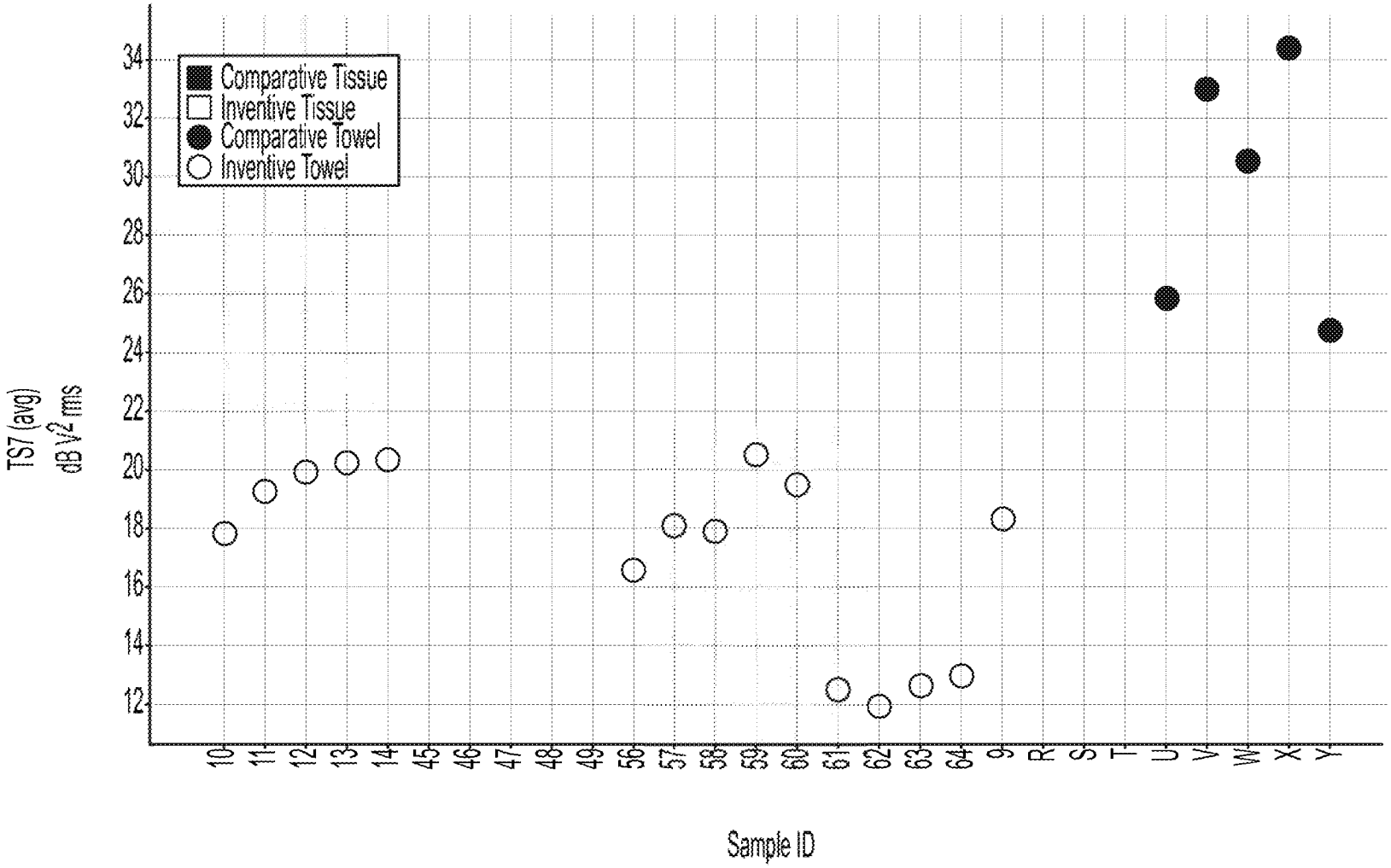
FIG. 21E is a TS7 (y-axis) graph illustrating inventive and comparative non-wood (paper) towel samples of the tables of FIGS. 25A-F.
Figure 21F:
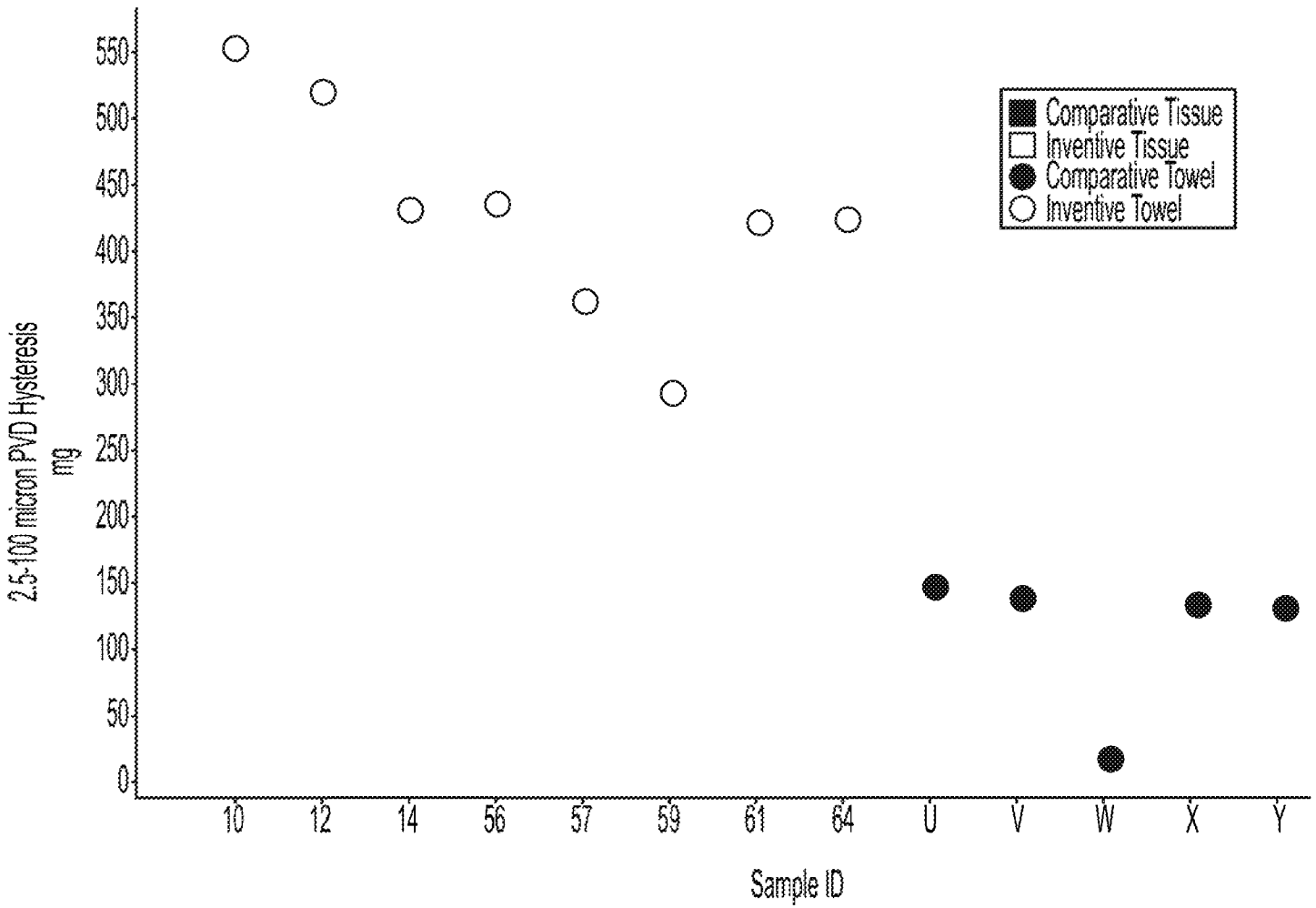
FIG. 21F is a 2.5-100 micron PVD hysteresis (y-axis) graph illustrating inventive and comparative non-wood (paper) towel samples of the tables of FIGS. 23A and B.
Figure 21G:
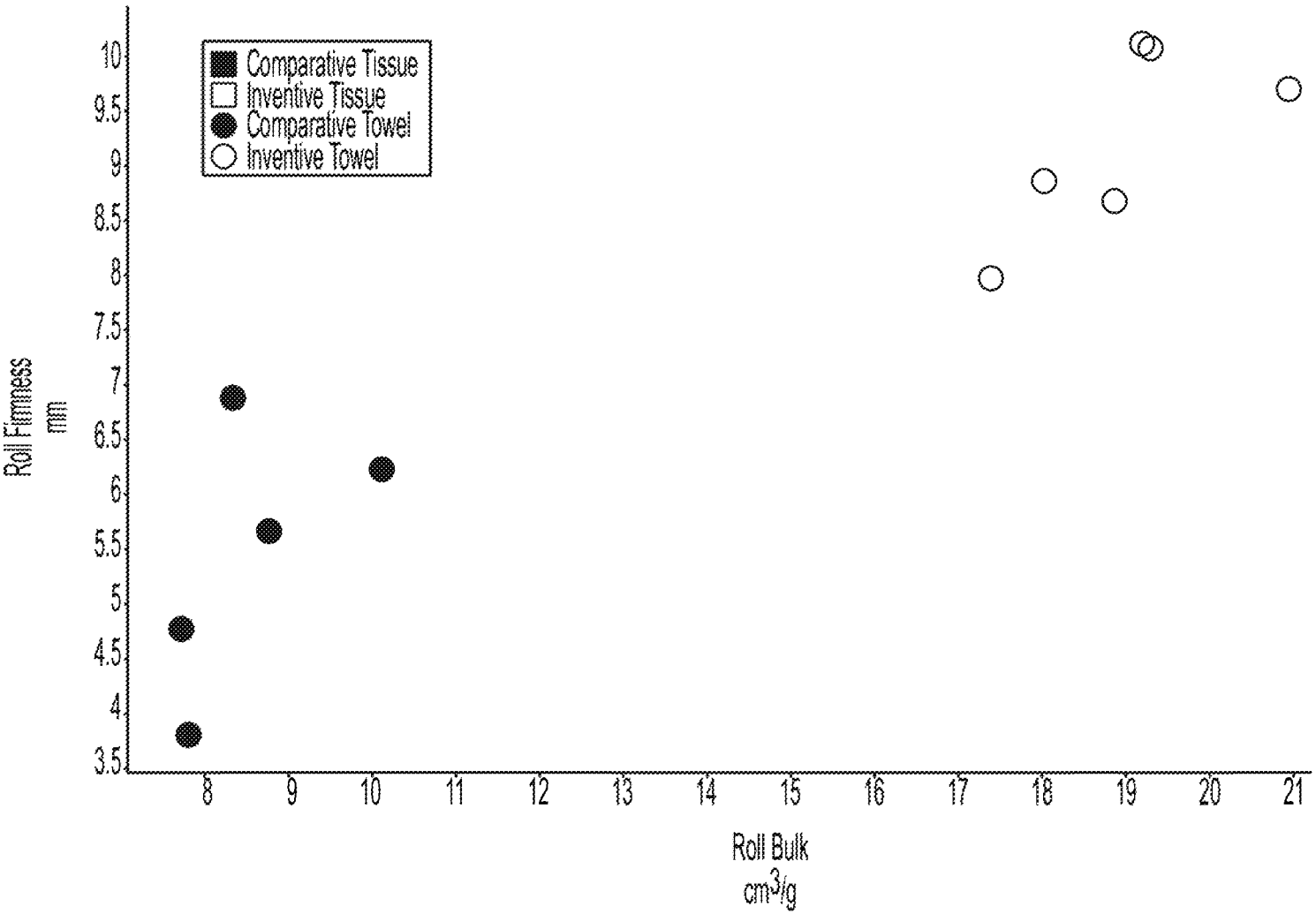
FIG. 21G is a graph illustrating roll firmness (y-axis) and roll bulk (x-axis) values of inventive and comparative non-wood (paper) towel samples of the tables of FIGS. 23A and B.
Figure 21H:
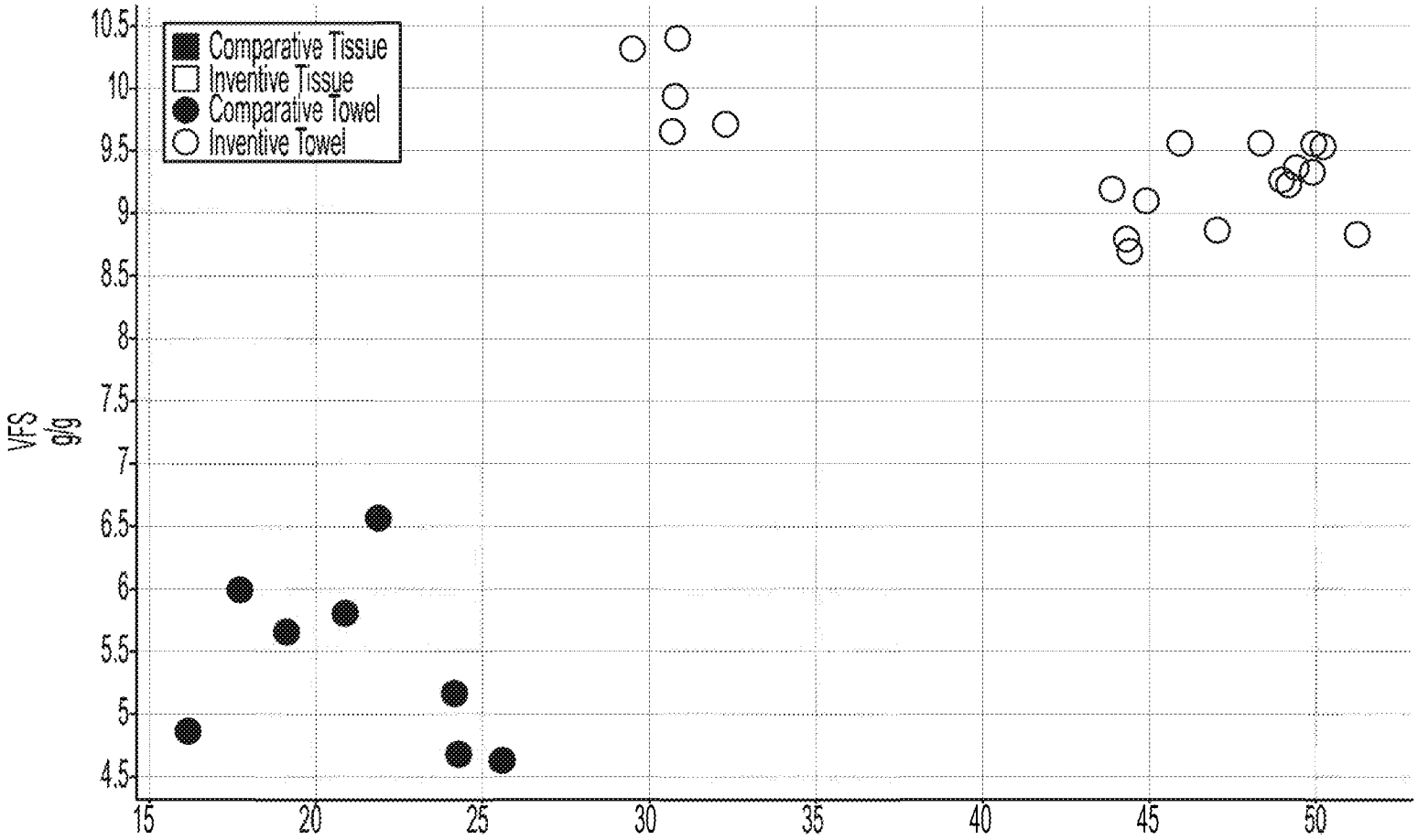
FIG. 21H is a graph illustrating VFS (y-axis) and dry caliper (x-axis) values of inventive and comparative non-wood (paper) towel samples of the tables of FIGS. 25A-F.
Figure 21I:
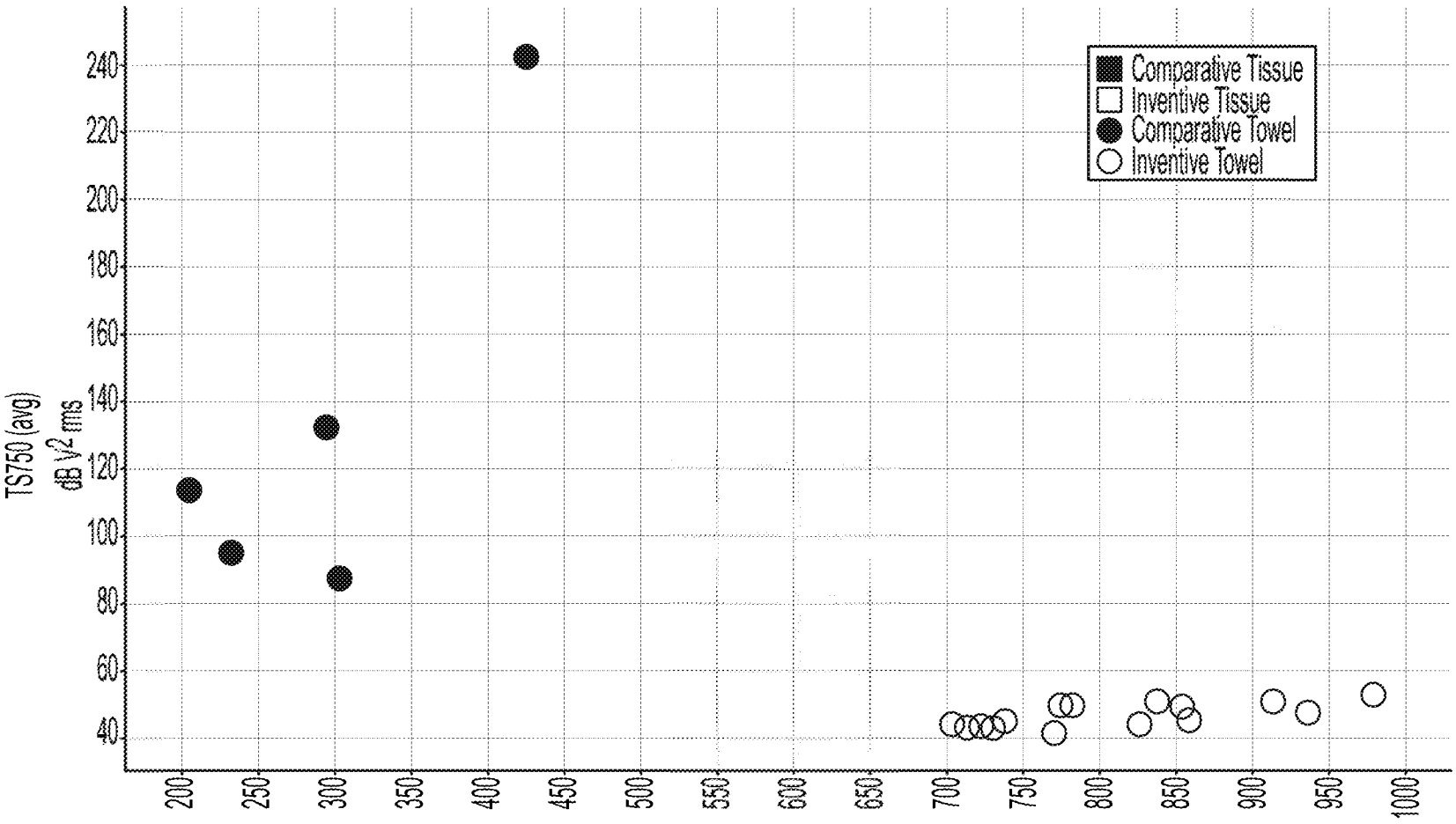
FIG. 21I is a graph illustrating TS750 (y-axis) and total wet tensile (x-axis) values of inventive and comparative non-wood (paper) towel samples of the tables of FIGS. 25A-F.
Figure 21J:
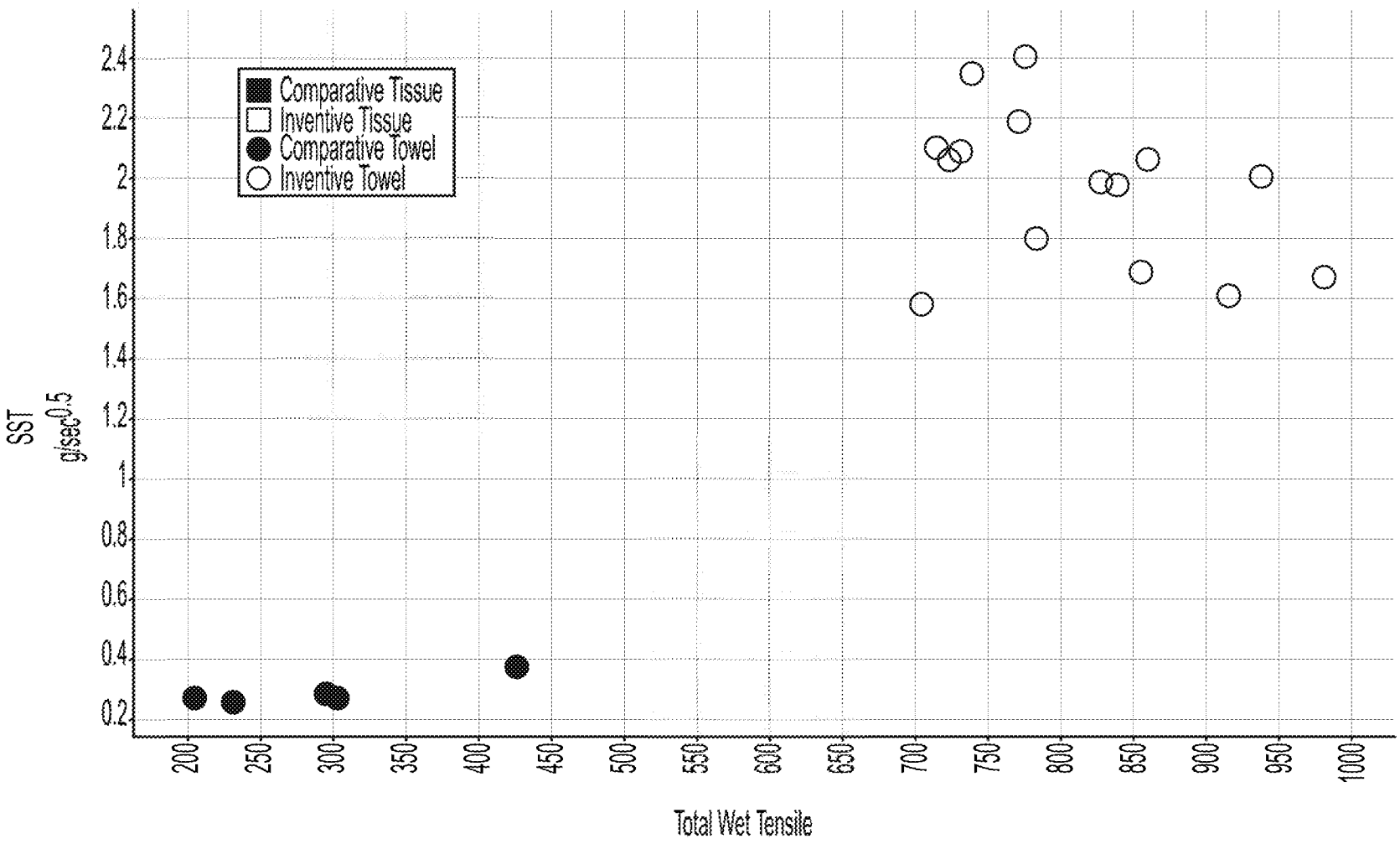
FIG. 21J is a graph illustrating SST (y-axis) and total wet tensile (x-axis) values of inventive and comparative non-wood (paper) towel samples of the tables of FIGS. 25A-F.
Figure 21K:
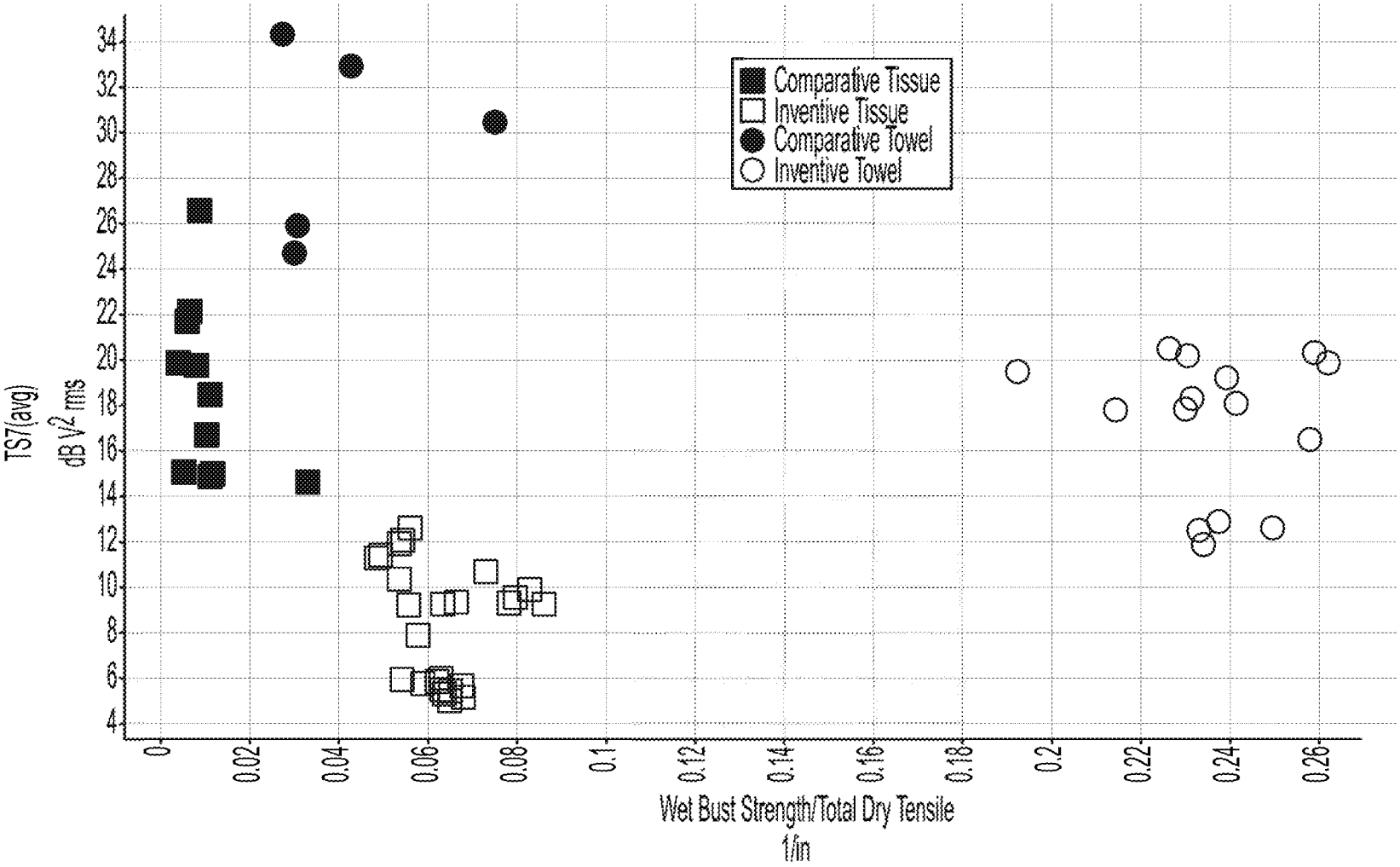
FIG. 21K is a graph illustrating TS7 (y-axis) and Wet Bust Strength/Total Dry Tensile (x-axis) values of inventive and comparative non-wood (paper) towel and tissue (bath) samples of the tables of FIGS. 24A-25F.

The package 100 may be recyclable, such as a corrugated box with paper-based tape. Said package may not comprise any plastic, such that rolls of sanitary tissue product are inserted directly into the corrugated box. Cardboard separators may be use between rows of sanitary tissue product and/or paper wrapping may be used to wrap the sanitary tissue product 106. The box may not have any film or coating on it, inside or outside (however, some protectant (e.g., wax) may be used to protect the outside of the box for shipping and/or storage and/or handling. As shown in FIG. 20, the box may be left brown, or may be colored brown, to convey sustainability (e.g., an un-dyed fiber is commonly believed to be brown). However, in some embodiments, the inside of the box may be white (i.e., dyed) to convey the premium nature of the product, since dying fibers is normally associated with extra cost and, thus, premiumness. In this way, there is a blending of communication: outside the box conveys sustainability, while inside of the box conveys premiumness. Further, text and/or object graphics/indicial may be printed on the inside of the package (e.g., box, film, etc.) so that it is only seen after opening the package as a reminder or as a call out to the consumer of the sustainable nature of the package and/or the sanitary tissue products contained therein. The text and/or objects may be printed in a repeating pattern (such as a grid pattern) and may be printed in a manner to resemble a watermark. Additionally or alternatively, the package may comprise flecks or specks of different color material to signify the recycled or sustainable nature of the packaging material and/or the sanitary tissue products contained therein. Additionally or alternatively, the package may be clear, translucent or slightly opaque, and/or may be tinted with a color (e.g., green) to signify the recycled and/or sustainable nature of the materials.

For example, a packaged sanitary tissue product 106 may comprise a sustainable (e.g., recycled paper, cardboard, plant-based plastic, recycled plastic, etc.) package material 100 comprising a brand name 300 and a sub-brand name 301. The package may convey sustainability. The package may further comprise indicia representative of at least portions of plants and/or trees and may overlap indicia representative of the sanitary tissue product. The sanitary tissue product 106 may be contained within the package 100 and may comprise non-wood fibers. The sanitary tissue product 106 may come in direct contact with the sustainable (e.g., paper-based) package material 100.

As another example, a packaged sanitary tissue product 106 may comprise a sustainable (e.g. paper-based, recycled plastic, plant-based plastic, recycled paper, cardboard, etc.) package material comprising a brand name 300 and a sub-brand name 301. The package 100 may convey sustainability. The package 100 may have an exterior surface of a first color (e.g., brown or tan) and may have an interior surface that contrasts the first color (e.g., white). The sanitary tissue product 106 may be contained within the package 100 and may comprise non-wood fibers. The sanitary tissue product 106 may come in direct contact with the sustainable package material 100.

Figure 4A:
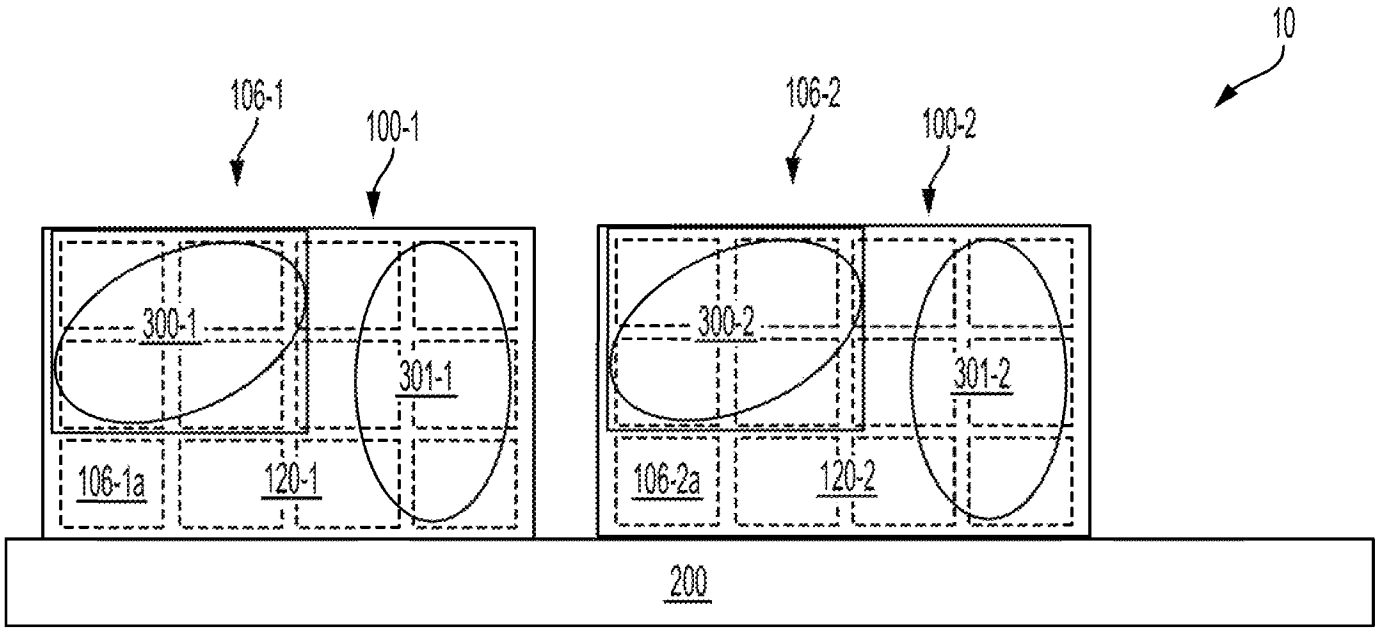
FIG. 4A is a simplified front view of an array of packages comprising sanitary tissue products on a retail store shelf.

For example, as illustrated, in part, in FIG. 4A, an array 10 of sanitary tissue products 106 may comprise first and second sanitary tissue products 106-1 and 106-2. The first sanitary tissue product 106-1 may be in a first package 100-1 that conveys strength and/or softness 301-1 and the first package 100-1 may comprise a plastic film (e.g., 100-1 and 100-2 in FIG. 4E) in contact with the first sanitary tissue product 106-1. The second sanitary tissue product 106-2 may be in a second package 100-2 that conveys sustainability 301-2 and the second package may comprise a sustainable (e.g., paper-based) package (e.g., 100 in FIG. 20) in contact with the second sanitary tissue product 106-2. The second package 100-2 may not comprise a plastic film. The second sanitary tissue product 106-2 may have a greater non-wood fiber content than the first sanitary tissue product 106-1. The first and second sanitary tissue product packages 100-1 and 100-2 may be separate from each other, such that they may be adjacent to each other, including immediately adjacent to each other, such that sides of the first and second packages 100-1 and 100-2 are at least partially touching. The first and second sanitary tissue product packages 100-1 and 100-2 may each comprise a common single source identifier (e.g., brand name indicator 300, such as "Charmin"). The first and second sanitary tissue product packages 100-1 and 100-2 may comprise different sub-brands or different sub-brand name portions or different additional information (e.g., 301-1 and 301-2 such as "soft," "strong," or "eco").

It may be desirable, in an array, to offer multiple sizes of sustainable packages comprising sanitary tissue products comprising non-wood(s). It may also be desirable to offer smaller quantities (e.g., 4 rolls) of sanitary tissue products comprising non-wood(s) in non-corrugated paper-based packaging material (e.g., paper bag grade paper), while offering larger quantities (e.g., 12 rolls) of sanitary tissue products comprising non-wood(s) in corrugated paper-based packaging material (e.g., a cardboard box) or said larger quantities in sustainable plastic packaging material (e.g., plant-based and/or recycled plastic). Further, it may be desirable that the dominant sustainable sanitary tissue product of an array may be a smaller package than the other products in the array as the rolls of the dominant sustainable sanitary tissue products may have fewer sheet per roll and may, thus, be smaller rolls (e.g., a 4 roll package of dominant sustainable sanitary tissue product may be smaller than other 4 roll packages of the array, and may even be the smallest 4 roll package of the array).

Arrays of the Present Disclosure

As shown in FIGS. 2A-4F, a retail store shelf 200 in a retail setting (e.g., Target, Walmart, Meijer, etc.) may comprise an array 10 of sanitary tissue product packages 100 comprising sanitary tissue products 106, such as roll(s) of disposable, fibrous, products (e.g., 106-1*a*, 106-1*b*, etc.) of the present disclosure.

Two or more of the packages illustrated in FIGS. 2A-4L may have the same paper composition and/or the same belt design and/or the same emboss design and/or the same properties/characteristics.

Soft and/or Strong, and Sustainable Arrays

It is often desirable to market packages of sanitary tissue products as an array, where certain properties of the rolls differ. For instance, it may be desirable to offer a first package as strong and/or a second package as soft. It may be desirable to market an array of packages comprising soft, strong, and sustainable offerings. Further, it may be desirable to include, in the array, more non-wood fiber content in the sustainable offering. It may also, however, be desirable to also include non-wood fiber content in the soft and/or the strong offerings. Each of the soft, strong, and sustainable offerings may have the same single source identifier (e.g., Charmin), may have different product designations (e.g., soft, strong, sustainable, etc.), but each of these offerings may communicate that they are the same tier, including each being of a higher tier or even the highest tier. This is surprising because sustainable offering(s) may be seen as a lesser offering because so often their performance is compromised due to the fibers used to make them (e.g., non-wood fibers)—so having a sustainable offering that has many of the properties of the existing soft and/or strong offering is unexpected. The inventors of the present disclosure have achieved new ways of producing and/or offering sanitary tissue structures that out-perform any of the known existing offerings that comprise non-wood fibers, especially existing offerings that comprise a majority of non-wood fibers. For these reasons, even sustainable offerings as disclosed herein may be co-marketed with existing soft and/or strong offerings.

For example, referring to FIG. 4A, an array 10 of sanitary tissue products 106 may comprise a first sanitary tissue product 106-1 (e.g., a disposable, rolled, toilet tissue product) in a first package 100-1 that conveys strength and/or softness 301—land a second sanitary tissue product 106-2 (e.g., a disposable, rolled, toilet tissue product) in a second package 100-2 that conveys sustainability 301-2. At least one, two, three, four, five, or each of corresponding common intensive properties, (e.g., lint, TDT, basis weight, absorbency, softness, TS7, etc.) of the first and second sanitary tissue products 106-1 and 106-2 may have a percent difference (e.g., at least about 5%, about 10%, about 15%, about 20%, about 25%, about 30%, about 35%, about 40%, about 45%, or about 50% different, including all 1% increments therebetween); alternatively, at least one, two, three, four, five, or each of the common intensive properties of the first and second sanitary tissue products may be about the same. The second sanitary tissue products 106-2 may have a higher or greater (e.g., at least about 5%, about 10%, about 15%, about 20%, about 25%, about 30%, about 35%, about 40%, about 45%, or about 50%, about 55%, about 60%, about 65%, about 70%, about 75%, about 80%, about 85%, about 90%, about 95%, or about 100% higher, including all 1% increments therebetween) non-wood fiber content than the first sanitary tissue product 106-1. The first and second sanitary tissue product packages 100-1 and 100-2 may be separate from each other, such that they may be adjacent to each other (such that the front faces of the packages are in the same region or area viewable by the shopper, including on the same shelf display system, including being on different shelves, and including having one or more packages in-between them), including immediately adjacent to each other, such that sides of the first and second packages are at least partially touching. The first and second sanitary tissue product packages 100-1 and 100-2 may each comprise a common single source identifier (e.g., brand name indicator 300, such as "Charmin"). The first and second sanitary tissue product packages 100-1 and 100-2 may comprise a different sub-brand or different sub-brand name portions or different additional information (e.g., 301-1 and 301-2 such as "soft" or "strong").

Figure 2A:
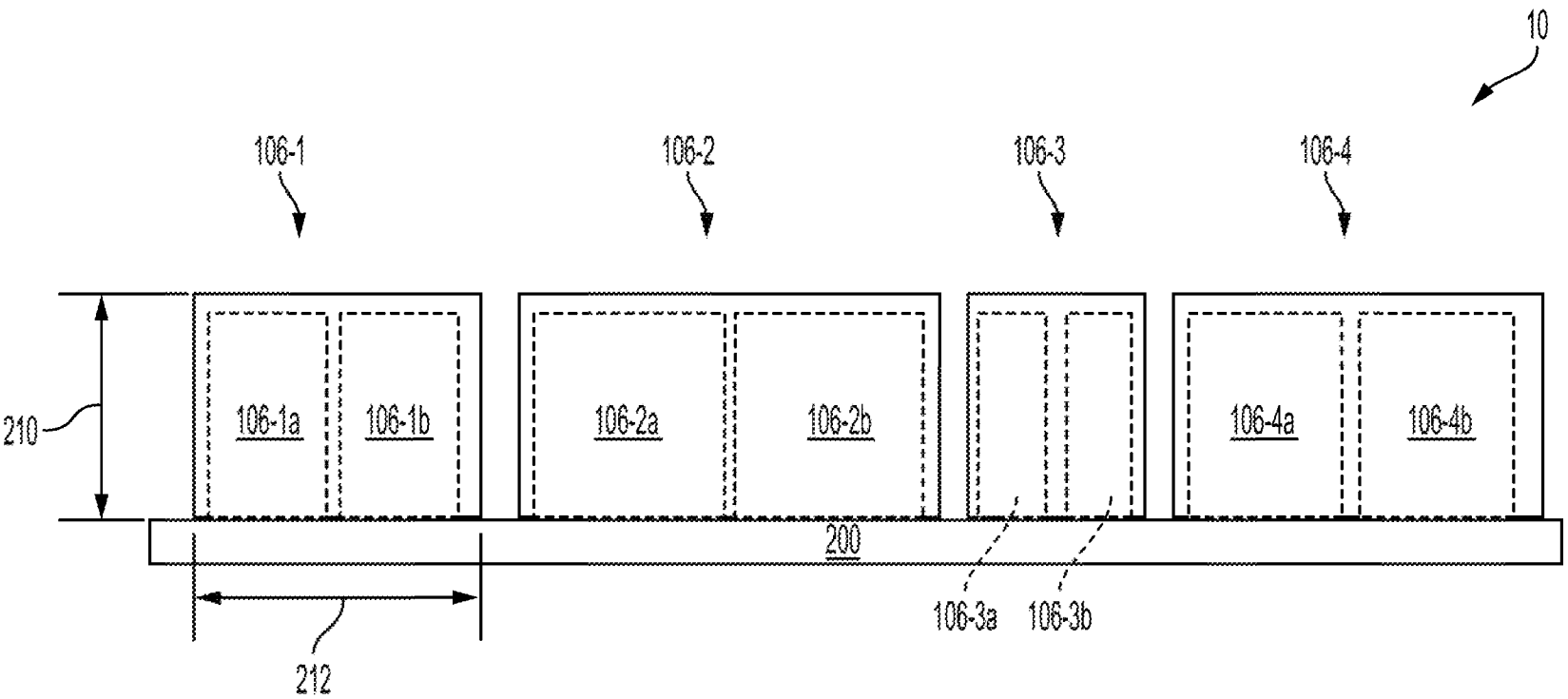
FIG. 2A is a simplified front side view of an array of packages comprising sanitary tissue products on a retail store shelf.
Figure 2B:
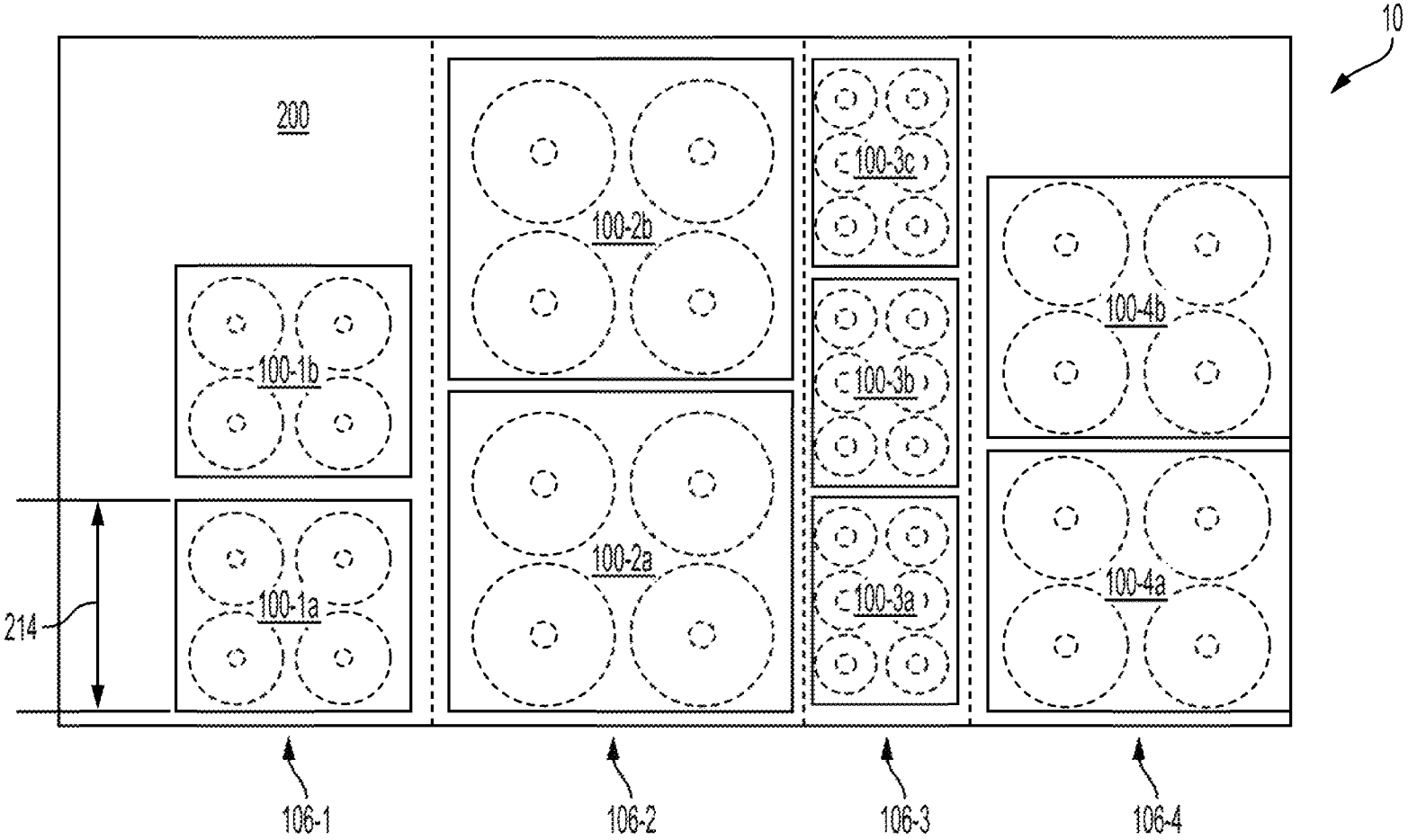
FIG. 2B is a simplified top view of the array of packages of FIG. 2A.
Figure 2C:
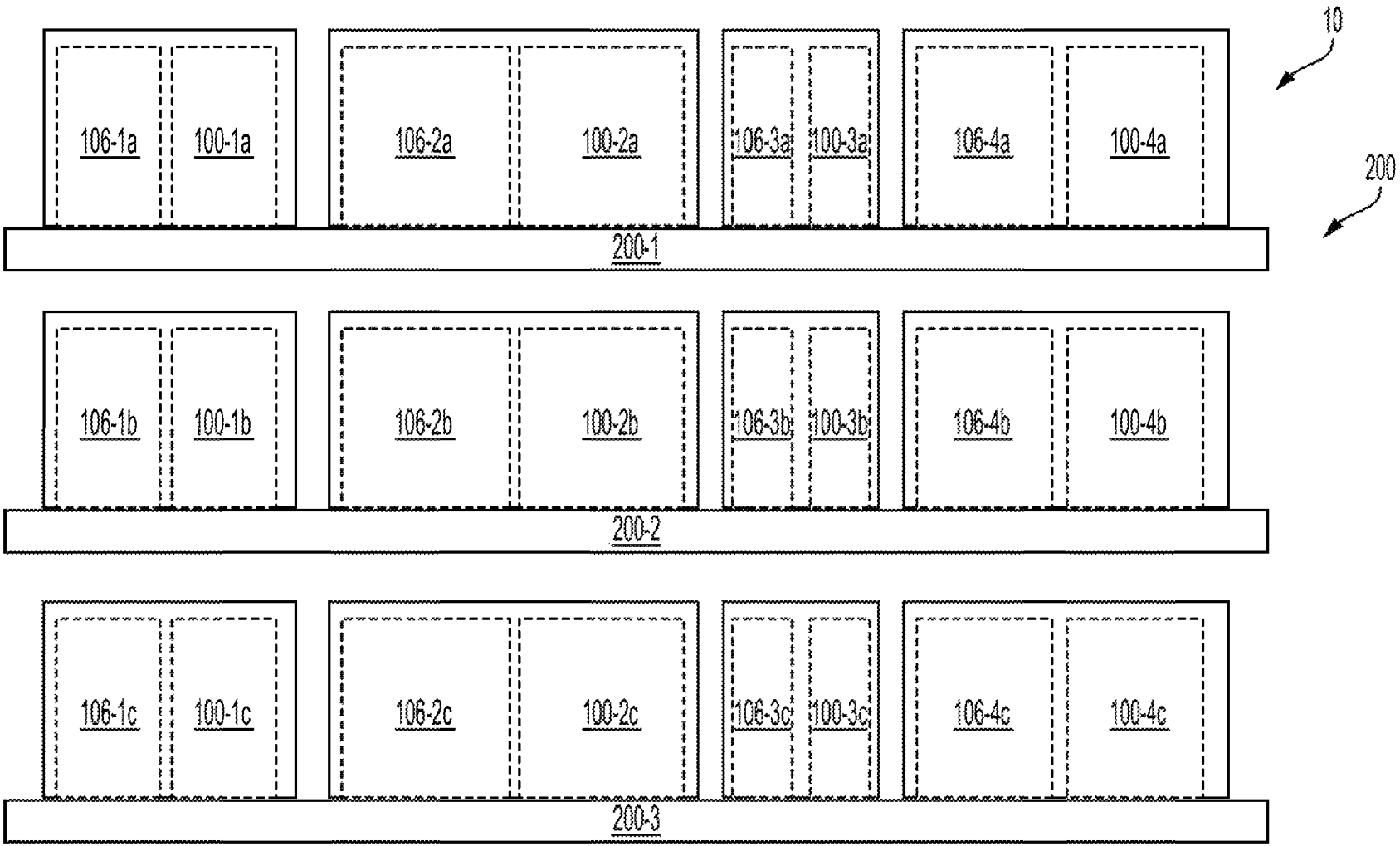
FIG. 2C is a simplified front view of an array of packages comprising sanitary tissue products on multiple retail store shelves.
Figure 2D:
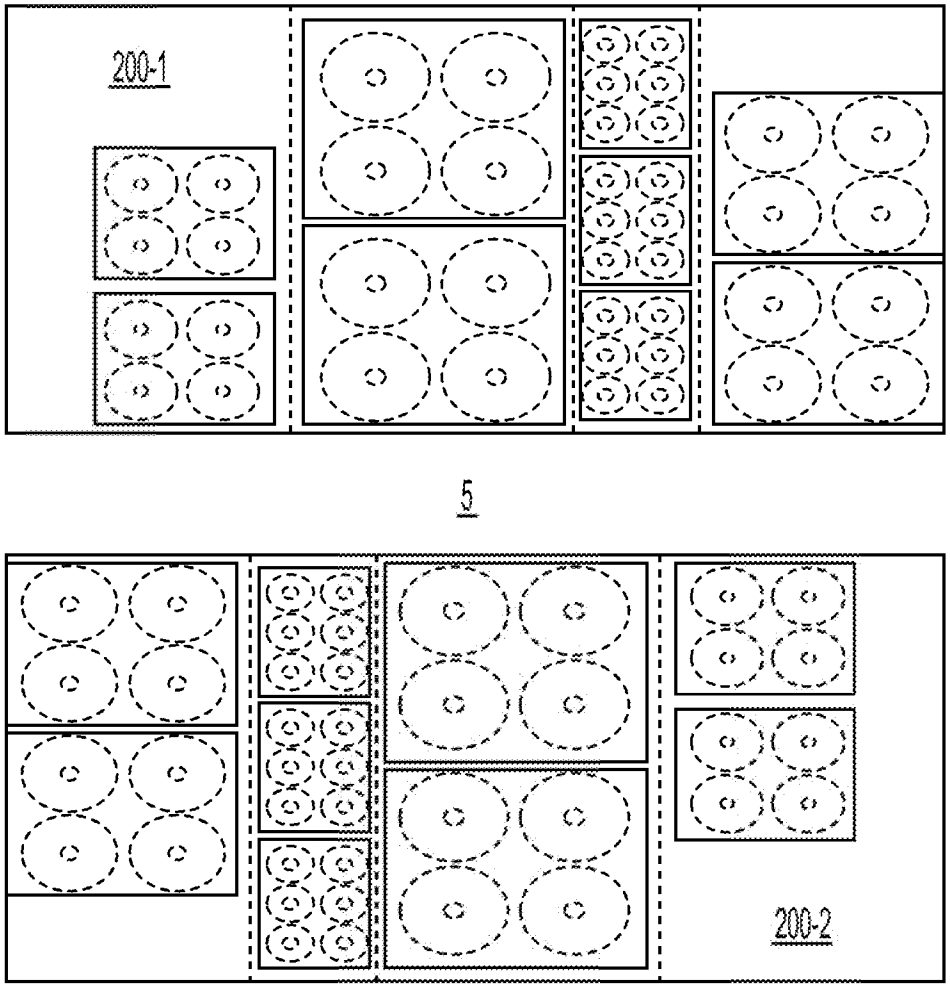
FIG. 2D is a simplified top view of an array of packages comprising sanitary tissue products on retail store shelves forming an aisle 5 therebetween.
Figure 4B:
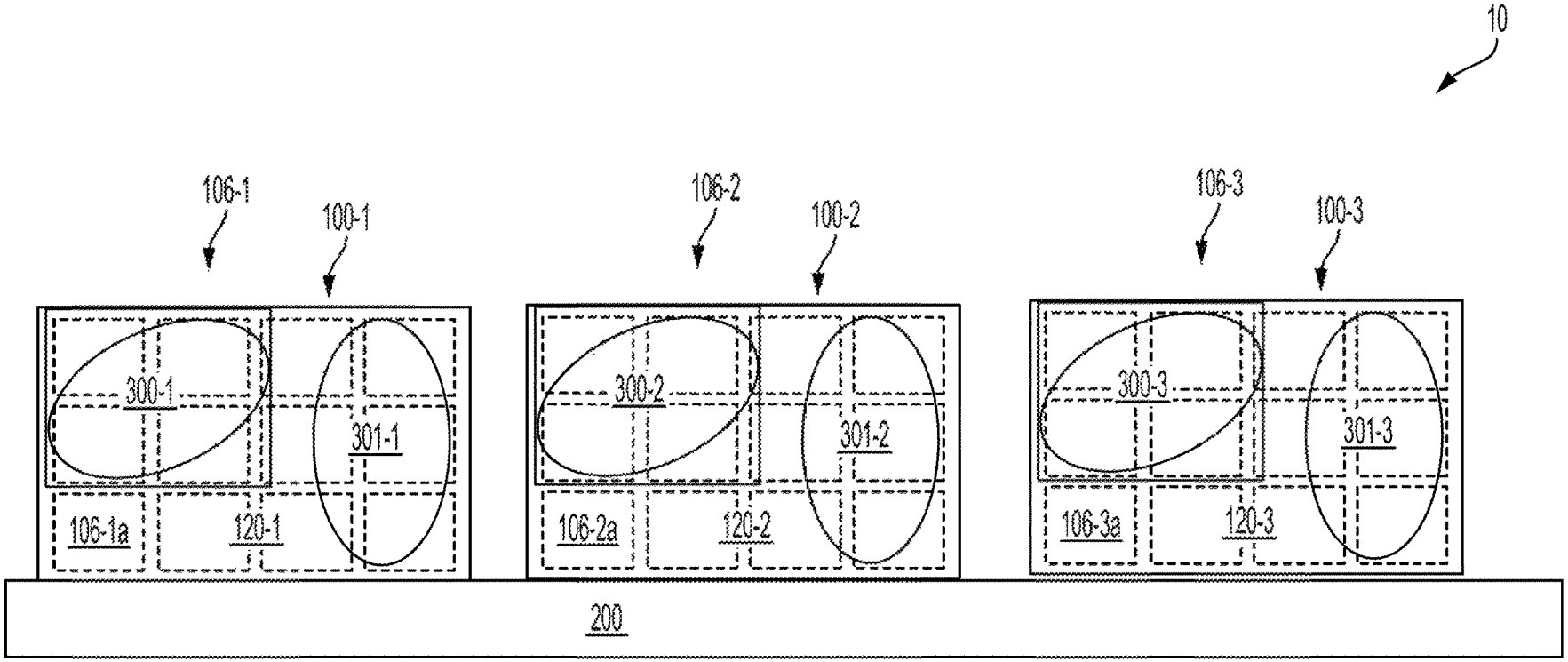
FIG. 4B is a simplified front view of an array of packages comprising sanitary tissue products on a retail store shelf.

For example, referring to FIG. 4B, an array 10 of sanitary tissue products 106 may comprise a first package 100-1 comprising a first front face 120-1 disposed as aisle 5 facing (see FIG. 2D). The first package 100-1 may comprise a first plurality of sanitary tissue products 106-1 (e.g., disposable, rolled, toilet tissue products). The first package 100-1 may convey strength 301-1. A second package 100-2 may comprise a second front face 120-2 disposed as aisle 5 facing. The second package 100-2 may comprise a second plurality of sanitary tissue products 106-2 (e.g., disposable, fibrous, rolled products). The second package 100-2 may convey softness 301-2. A third package 100-3 may comprise a third front face 120-3 disposed as aisle 5 facing. The third package may comprise a third plurality of sanitary tissue products 106-3 (e.g., disposable, rolled toilet tissue products). The third package 100-3 may convey sustainability 301-3. At least one, two, three, four, five, or each of corresponding common intensive properties, (e.g., lint, TDT, basis weight, absorbency, softness, TS7, etc.) of the first and second sanitary tissue products 106-1 and 106-2 may have a percent difference (e.g., at least about 5%, about 10%, about 15%, about 20%, about 25%, about 30%, about 35%, about 40%, about 45%, or about 50% different, including all 1% increments therebetween); at least one, two, three, four, five, or each of corresponding common intensive properties, (e.g., lint, TDT, basis weight, absorbency, softness, TS7, etc.) of the first and third sanitary tissue products 106-1 and 106-3 may have a percent difference (e.g., at least about 5%, about 10%, about 15%, about 20%, about 25%, about 30%, about 35%, about 40%, about 45%, or about 50% different, including all 1% increments therebetween); at least one, two, three, four, five, or each of corresponding common intensive properties, (e.g., lint, TDT, basis weight, absorbency, softness, TS7, etc.) of the second and third sanitary tissue products 106-2 and 106-3 may have a percent difference (e.g., at least about 5%, about 10%, about 15%, about 20%, about 25%, about 30%, about 35%, about 40%, about 45%, or about 50% different, including all 1% increments therebetween); alternatively, at least one, two, three, four, five, or each of the common intensive properties of the first, second, and third sanitary tissue products may be about the same. The third sanitary tissue product may have a higher or greater (e.g., at least about 5%, about 10%, about 15%, about 20%, about 25%, about 30%, about 35%, about 40%, about 45%, or about 50%, about 55%, about 60%, about 65%, about 70%, about 75%, about 80%, about 85%, about 90%, about 95%, or about 100% higher, including all 1% increments therebetween) non-wood fiber content than the first and/or second sanitary tissue products. The first, second, and third sanitary tissue product packages 100-1, 100-2, and 100-3 may be separate from each other, such that they may be adjacent to each other including immediately adjacent to each other, such that sides of the first, second, and third packages are at least partially touching. The first, second, and third sanitary tissue product packages 100-1, 100-2, and 100-3 may each comprise a common single source identifier (e.g., brand name indicator 300, such as "Charmin"). The first, second, and third sanitary tissue product packages 100-1, 100-2, and 100-3 may comprise a different sub-brand or different sub-brand name portions or different additional information (e.g., 301-1, 301-2. 301-3, such as "soft," "strong," or "sustainable").

Multi-Tier Arrays

Packages of sanitary tissue products may be marketed as soft and/or strong offerings. Each of these may be marketed as different tier offerings. As an example, a premium (highest tier) soft package and a premium (highest tier) strong package may be offered, as well as a lesser tier (relative to the high tier) soft package and a lesser tier (relative to the high tier) strong package. Surprisingly, it may be desirable to include a greater percentage of non-wood fibers (e.g., bamboo) in the premium (highest tier) rolls than in the lesser tier rolls. More particularly, it may be desirable to include a greater percentage of non-wood fibers in the high tier soft rolls than in the lesser tier soft rolls, as well as including a greater percentage of non-wood fibers in the high tier strong rolls than the lesser tier strong rolls. This is surprising because non-wood fibers are often considered more sustainable, but are often considered inferior to wood fibers. Such a difference may cause non-wood fibers to be viewed as an inferior substitute when compared to certain conventional hardwood fibers (e.g., eucalyptus) and when compared to certain conventional softwood fibers (e.g., NSK). For these reasons, swapping out more hard and soft wood fibers in high tier products is unexpected—most would expect the larger swap to be made with lesser tier products. There are surprising advantages, however, to incorporating more non-wood fibers into high tier products. Softwoods and hardwoods have a certain morphology (e.g., softwoods tend to be larger and longer relative to hardwoods, which tend to be shorter and smaller) and the non-woods can offer different values of length and coarseness or different combinations of values (as one example, abaca is very long, but has very low coarseness).

Figure 4C:
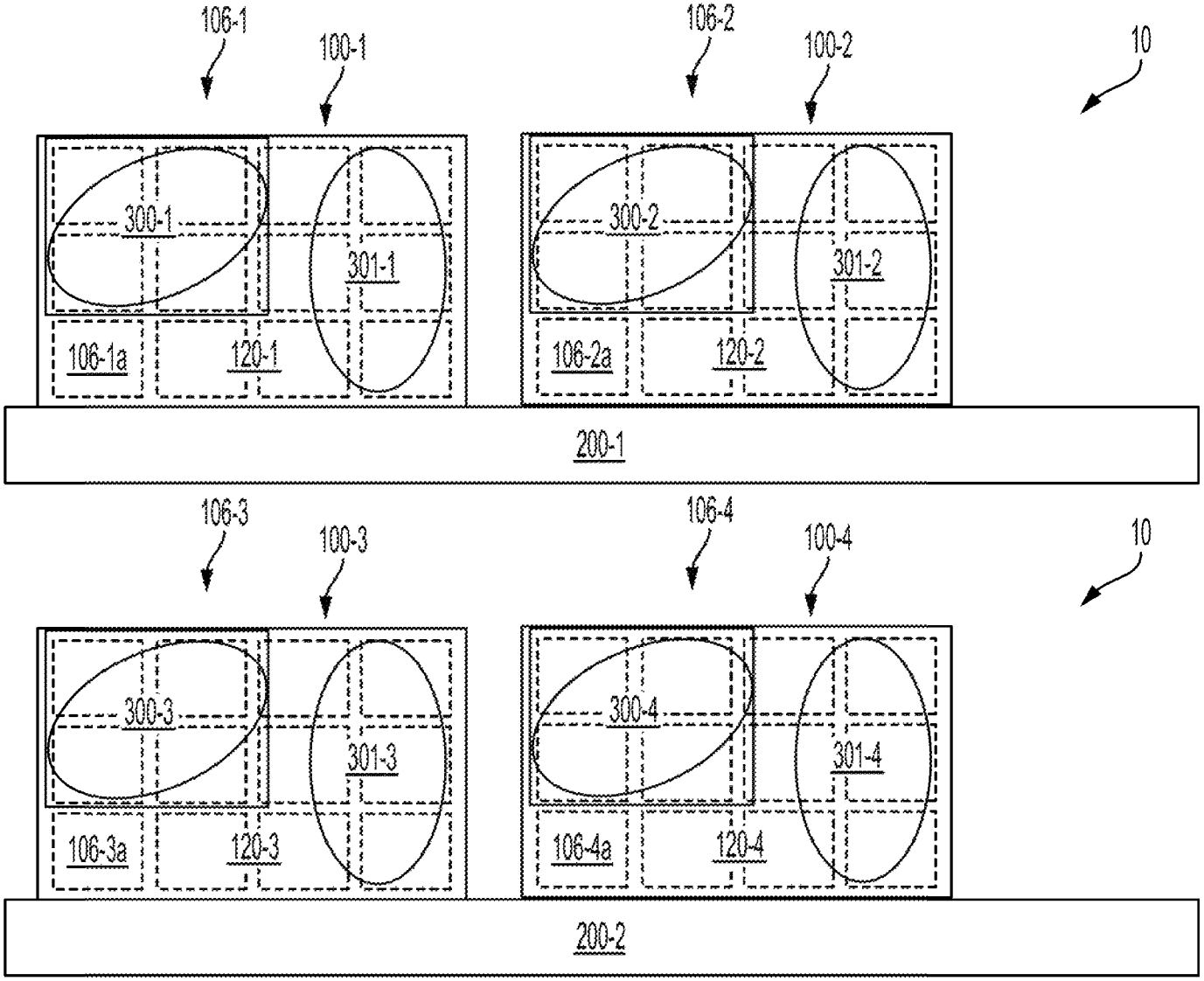
FIG. 4C is a simplified front view of an array of packages comprising sanitary tissue products on a retail store shelf.

For example, referring to FIG. 4C, an array 10 of sanitary tissue products 106 may comprise a first sanitary tissue product—106-1 in a first package 100-1 that conveys strength 301-1, a second sanitary tissue product 106-2 in a second package 100-2 that conveys softness 301-2, a third sanitary tissue product 106-3 in a third package 100-3 that conveys strength 301-3, and a fourth sanitary tissue product 106-4 in a fourth package 100-4 that conveys softness 301-4. At least one, two, three, four, five, or each of corresponding common intensive properties, (e.g., lint, TDT, basis weight, absorbency, softness, TS7, etc.) of the first and third sanitary tissue products 106-1 and 106-3 may have a percent difference (e.g., at least about 5%, about 10%, about 15%, about 20%, about 25%, about 30%, about 35%, about 40%, about 45%, or about 50% different, including all 1% increments therebetween). At least one, two, three, four, five, or each of corresponding common intensive properties, (e.g., lint, TDT, basis weight, absorbency, softness, TS7, etc.) of the second and fourth sanitary tissue products 106-2 and 106-4 may have a percent difference (e.g., at least about 5%, about 10%, about 15%, about 20%, about 25%, about 30%, about 35%, about 40%, about 45%, or about 50% different, including all 1% increments therebetween). The first sanitary tissue product 106-1 may have a greater non-wood fiber content than the third sanitary tissue products 106-3, and/or the second sanitary tissue product 106-2 may have a greater non-wood fiber content than the fourth sanitary tissue product 106-4. The first, second, third, and fourth sanitary tissue product packages 100-1, 100-2, 100-3, and 100-4 may be separate from each other, such that they may be adjacent to each other including on adjacent shelves (e.g., 200-1 and 200-2) and including immediately adjacent to each other, such that sides of the first, second, third, and fourth packages 100-1, 100-2, 100-3, and 100-4 are at least partially touching. The first, second, third, and fourth sanitary tissue product packages 100-1, 100-2, 100-3, and 100-4 may each comprise a common single source identifier (e.g., brand name indicator 300, such as "Charmin" or "Bounty"). The first, second, third, and fourth sanitary tissue product packages 100-1, 100-2, 100-3, and 100-4 may comprise a different sub-brand or different sub-brand name portions or different additional information (e.g., 301-1 may convey "Ultra Strong," 301-2 may convey "Ultra Soft," 301-3 may convey "Essential Strong," and 301-4 may convey "Essential Soft").

Arrays Comprising Large Diameter Rolls

It is often desirable to market packages of these rolled products as an array, where certain properties, including the size (e.g., diameter) of the rolls differ. For instance, it may be desirable to offer a first package comprising traditional diameter rolls and a second package comprising larger diameter rolls. Further, it may be desirable to include, in an array, more non-wood fibers in larger diameter rolls versus traditional diameter rolls. This may be advantageous because consumers may, due to the large scale of larger diameter rolls, more strongly desire that the larger diameter roll offering is more sustainable. Even though the consumer may not actually be using any more sanitary tissue product when they use larger diameter rolls, there may be an increased perception of use and of the impact of the type of fibers being used by the consumer. In this way, larger diameter rolls may make the use of certain fibers more noticeable. For example, a consumer may have guilt over buying a larger diameter roll consisting of wood fibers, but may be okay with a larger diameter roll comprising or consisting of non-wood fibers.

Generally, a first plurality of disposable, fibrous, rolled sanitary tissue products 106 may comprise a first average Roll Diameter 112 of 5.85 inches or less for toilet paper, or 6.60 inches or less for paper towels (referred to herein as "Traditional Diameter Rolls" and the packages containing them as "Traditional Roll Packages"). A second plurality (i.e., 2 or more rolls) of disposable, fibrous, rolled sanitary tissue products may comprise a second average Roll Diameter 112 of 5.90 inches or greater for toilet paper, or 6.70 inches or greater for paper towels (referred to herein as "Larger Diameters Rolls" and the packages containing them as "Larger Roll Packages").

Further, for toilet paper, the second average Roll Diameter (for Larger Diameter Rolls) may be greater than 5.90, 6.00, 6.20, 6.40, or 6.60 inches, and the second average Roll Diameter (for Larger Diameter Rolls) may be 22.00, 20.00, 18.00, 16.00, 14.00, 12.00, 10.00, 8.00, 7.00, or less inches, specifically reciting all 0.1 inch increments within the above-recited ranges and all ranges formed therein or thereby. For toilet paper, the second average Roll Diameter (for Larger Diameter Rolls) may be from 6.00 inches to about 22.00 inches, from about 6.20 inches to about 12.00 inches, from about 6.40 inches to about 12.00 inches, or from about 6.60 inches to about 8.00 inches, specifically reciting all 0.1 inch increments within the above-recited ranges and all ranges formed therein or thereby.

Further, for paper towels, the second average Roll Diameter (for Larger Diameter Rolls) may be greater than 6.60, 6.70, 6.80, 7.00, 7.20, or 7.40 inches, and the second average Roll Diameter (for Larger Diameter Rolls) may be 22.00, 20.00, 18.00, 16.00, 14.00, 12.00, 10.00, 8.00, or less inches, specifically reciting all 0.1 inch increments within the above-recited ranges and all ranges formed therein or thereby. For paper towels, the second average Roll Diameter (for Larger Diameter Rolls) may be from 6.60 inches to about 22.00 inches, from about 6.80 inches to about 18.00 inches, from about 7.00 inches to about 12.00 inches, or from about 7.20 inches to about 8.00 inches, specifically reciting all 0.1 inch increments within the above-recited ranges and all ranges formed therein or thereby.

Traditional Diameter Rolls of toilet paper may have total linear length values per roll of less than about 1590 inches, 1550 inches, 1500 inches, 1400 inches, 1300 inches, 1200 inches, 1000 inches, or 500 inches, and all 1 inch increments therebetween, while Larger Roll Diameter Rolls of toilet paper may have total linear length values per roll of greater than about 1600 inches, 1650 inches, 1700 inches, 1800 inches, 1900 inches, 2000 inches, 3000 inches, 4000 inches, 5000 inches, 6000 inches, 7000 inches, or 8000 inches, and all 1 inch increments therebetween. Likewise, Traditional Diameter Rolls of paper towels may have total linear length values per roll of less than about 700 inches, 650 inches, 600 inches, 550 inches, 500 inches, 400 inches, 300 inches, or 250 inches, and all 1 inch increments therebetween, while Larger Roll Diameter Rolls of paper towels may have total linear length values per roll of greater than about 725 inches, 750 inches, 800 inches, 900 inches, 1000 inches, 1100 inches, 1200 inches, 1300 inches, 1400 inches, 1500 inches, 2000 inches, or 3000 inches, and all 1 inch increments therebetween.

Figure 4D:
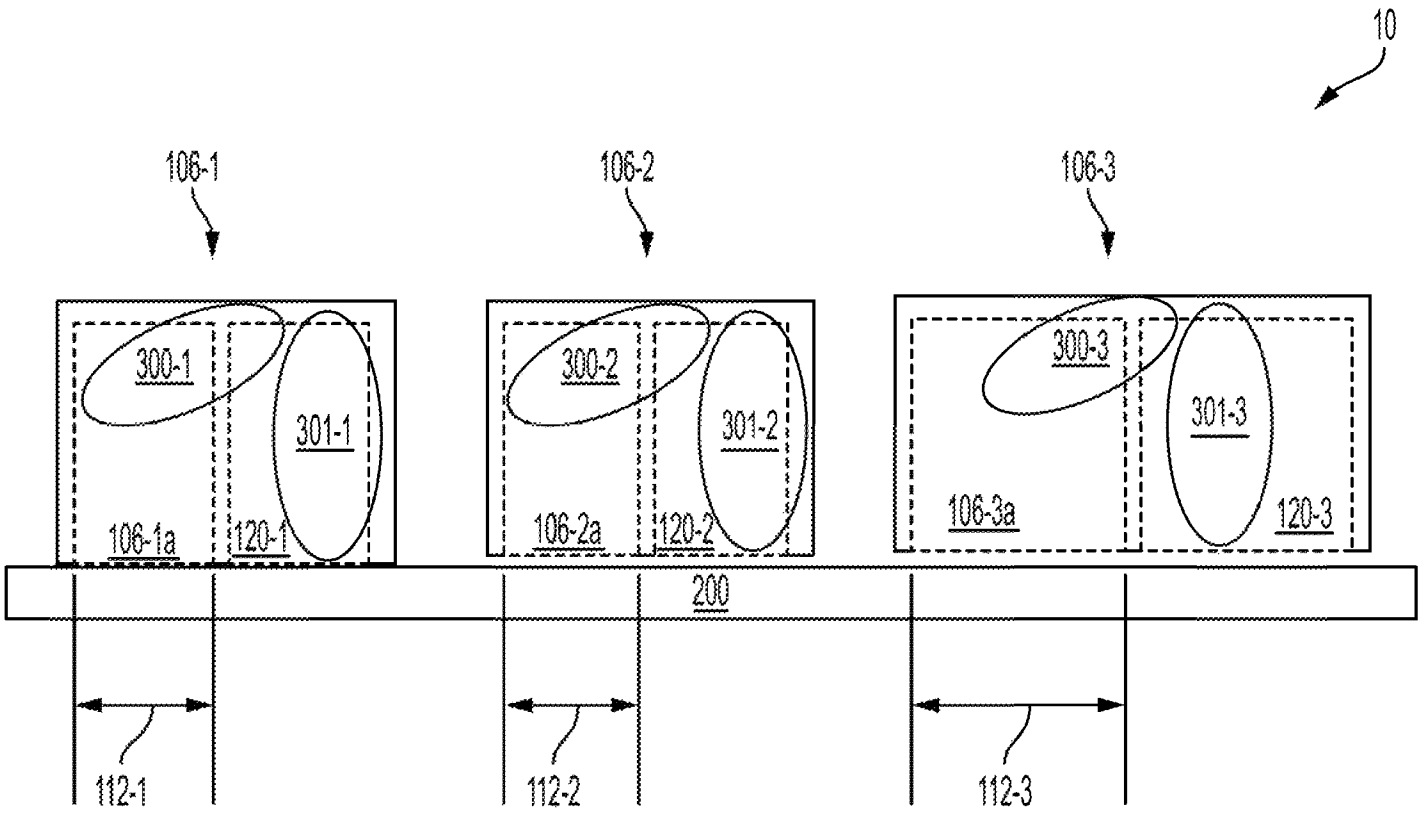
FIG. 4D is a simplified front view of an array of packages comprising sanitary tissue products on a retail store shelf.

For example, referring to FIG. 4D, an array 10 of sanitary tissue products 106 may comprise a first sanitary tissue product 106-1 in a first package 100-1 that conveys strength 301-1, a second sanitary tissue product 106-2 in a second package 100-2 that conveys softness 301-2, and a third sanitary tissue product 106-3 in a third package 100-3 that conveys sustainability 301-3. The first plurality of sanitary tissue products 106-1 may have a first average Roll Diameter of 6.6 inches or less. The second plurality of sanitary tissue products 106-2 may have a second average Roll Diameter of 6.6 inches or less. The third plurality of sanitary tissue products 106-3 may have a third average Roll Diameter of 6.7 inches or greater. The third sanitary tissue product may have a higher or greater (e.g., at least about 5%, about 10%, about 15%, about 20%, about 25%, about 30%, about 35%, about 40%, about 45%, or about 50%, about 55%, about 60%, about 65%, about 70%, about 75%, about 80%, about 85%, about 90%, about 95%, or about 100% higher, including all 1% increments therebetween) non-wood fiber content than the first and/or second sanitary tissue products. The first, second, and third sanitary tissue product packages 100-1, 100-2, and 100-3 may be separate from each other, such that they may be adjacent to each other including immediately adjacent to each other, such that sides of the first, second, and third packages are at least partially touching. The first, second, and third sanitary tissue product packages 100-1, 100-2, and 100-3 may each comprise a common single source identifier (e.g., brand name indicator 300, such as "Charmin"). The first, second, and third sanitary tissue product packages 100-1, 100-2, and 100-3 may comprise a different sub-brand or different sub-brand name portions or different additional information (e.g., 301-1, 301-2, and 301-3 such as "soft," "strong," and "sustainable"). Of course, in other examples, the first and/or second sanitary tissue products may, in addition to the third sanitary tissue product, have average Roll Diameter(s) of 6.7 inches or greater.

Arrays Comprising Different Non-Wood Fibers in Soft and/or Strong Offerings

It is often desirable to market packages of these rolled sanitary tissue products as an array, where certain properties of the rolls differ. For instance, it may be desirable to offer a first package as strong and a second package as soft. As will be described in greater detail below, it may be desirable to incorporate non-wood fibers into each of the soft and strong offerings. In order to combat lack of ready non-wood supply and in order to achieve the different properties expected of a soft offering and a strong offering, it may be desirable to include a first non-wood fiber type in the strong offering and a second non-wood fiber type, which is different from the first non-wood fiber type, in the soft offering. Alternatively, the same non-wood type may be incorporated into each of the strong and soft offerings, but at different percentages into the product and/or web. Each of the soft and strong offerings may have the same single source identifier (e.g., Charmin) and may have different sub-brand portions (e.g., soft, strong, etc.). These are new approaches to offering the performance differences expected by users of soft and strong offerings.

For example, referring to FIG. 4A, an array 10 of sanitary tissue products 106 may comprise a first sanitary tissue product—106-1 in a first package 100-1 that conveys strength 301-1 and a second sanitary tissue product 106-2 in a second package 100-2 that conveys softness 301-2. At least one, two, three, four, five, or each of corresponding common intensive properties, (e.g., lint, TDT, basis weight, absorbency, softness, TS7, etc.) of the first and second sanitary tissue products 106-1 and 106-2 may have a percent difference (e.g., at least about 5%, about 10%, about 15%, about 20%, about 25%, about 30%, about 35%, about 40%, about 45%, or about 50% different, including all 1% increments therebetween); alternatively, at least one, two, three, four, five, or each of the common intensive properties of the first and second sanitary tissue products may be about the same. The second sanitary tissue products 106-2 may have a different (e.g., at least about 5%, about 10%, about 15%, about 20%, about 25%, about 30%, about 35%, about 40%, about 45%, or about 50%, about 55%, about 60%, about 65%, about 70%, about 75%, about 80%, about 85%, about 90%, about 95%, or about 100% different, including all 1% increments therebetween) non-wood fiber content than the first sanitary tissue product 106-1 (e.g., each of the first and second sanitary tissue products may comprise bamboo, where the first sanitary tissue product 106-1 comprises more or less bamboo than the second sanitary tissue product 106-2, or vice versa). Each of the first and second sanitary tissue products may comprise different non-woods (e.g., the first sanitary tissue product 106-1 may comprise abaca and the second sanitary tissue product may comprise bamboo); and/or each of the first and second sanitary tissue products 106-1 and 106-2 may comprise different amount of non-wood content; and/or each of the first and second sanitary tissue products 106-1 and 106-2 may comprise different non-woods in different layers when the sanitary tissue products comprise two or more layers. Each of the first and second sanitary tissue products 106-1 and 106-2 may comprise multiple different non-woods (e.g., each of the first and/or second sanitary tissue product 106-1 and 106-2 may comprise 2, 3, 4, 5, 6, 7, 8, 9, or 10 different non-woods each—more particularly, the first sanitary tissue product 106-1 may comprise bamboo and abaca and the second sanitary tissue product 106-2 may comprise bamboo (or abaca) and trichomes; as another example, the first sanitary tissue product may comprise bamboo, bagasse, abaca, and hemp, and the second sanitary tissue product may comprise bamboo, bagasse, trichomes, and cotton). Each of the first and second sanitary tissue products 106-1 and 106-2 may comprise a common non-wood, but also comprise a different non-wood (e.g., where the first and second sanitary tissue products 106-1 and 106-2 each comprise bamboo, but where only the first sanitary tissue product comprises abaca and only the second sanitary tissue product comprises bagasse). The first and second sanitary tissue product packages and 100-1 and 100-2 may be separate from each other, such that they may be adjacent to each other, including immediately adjacent to each other, such that sides of the first and second packages are at least partially touching. The first and second sanitary tissue product packages 100-1 and 100-2 may each comprise a common single source identifier (e.g., brand name indicator 300, such as "Charmin"). The first and second sanitary tissue product packages 100-1 and 100-2 may comprise a different sub-brand or different sub-brand name portions or different additional information (e.g., 301-1 and 301-2 such as "soft" or "strong").

Arrays Comprising Non-Wood Fibers in the Soft Offering and/or in the Outer Layer It may be desirable to market both soft and strong sanitary tissue products as different offerings. Surprisingly, it may be desirable to include a greater percentage of non-wood fibers into the soft offering (versus the strong offering). This is surprising because non-wood fibers (e.g., bamboo, abaca, etc.) may not be considered as soft as certain conventional hardwood and softwood fibers. For these reasons, including more non-wood content in the soft offering than the strong offering is unexpected. There are surprising advantages, however, to incorporating more non-wood fibers into soft products. For instance, certain non-woods can deliver surprisingly desirable characteristics (e.g., sanitary tissue products that are soft and strong) when incorporated into sanitary tissue products-see for example U.S. Ser. No. 63/329,222 filed on Apr. 8, 2022 by The Procter & Gamble Company; U.S. Ser. No. 63/329,718 filed on Apr. 11, 2022 by The Procter & Gamble Company; U.S. Ser. No. 63/330,077 filed on Apr. 12, 2022 by The Procter & Gamble Company; and U.S. Ser. No. 63/353,183 titled "Fibrous Structures Comprising Non-wood Fiber" filed on Jun. 17, 2022 by The Procter & Gamble Company naming Christopher Michael Young as the first-named inventor.

Just as unexpected, it may be desirable to include more non-wood fibers in a consumer-facing layer of a multi-layered product (soft, strong, sustainable, etc.)—most would expect the larger non-wood content to be in the non-consumer facing layer, thus being more buried or hidden within the final product. There are surprising advantages, however, to incorporating more non-wood fibers into the consumer-facing layer of a multi-layered product. For instance, certain non-woods can deliver surprisingly desirable characteristics (e.g., sanitary tissue products that are soft and strong) when incorporated into sanitary tissue products-see for example U.S. Ser. No. 63/329,222 filed on Apr. 8, 2022 by The Procter & Gamble Company; U.S. Ser. No. 63/329,718 filed on Apr. 11, 2022 by The Procter & Gamble Company; U.S. Ser. No. 63/330,077 filed on Apr. 12, 2022 by The Procter & Gamble Company; and U.S. Ser. No. 63/353,183 titled "Fibrous Structures Comprising Non-wood Fiber" filed on Jun. 17, 2022 by The Procter & Gamble Company naming Christopher Michael Young as the first-named inventor.

Figure 16:
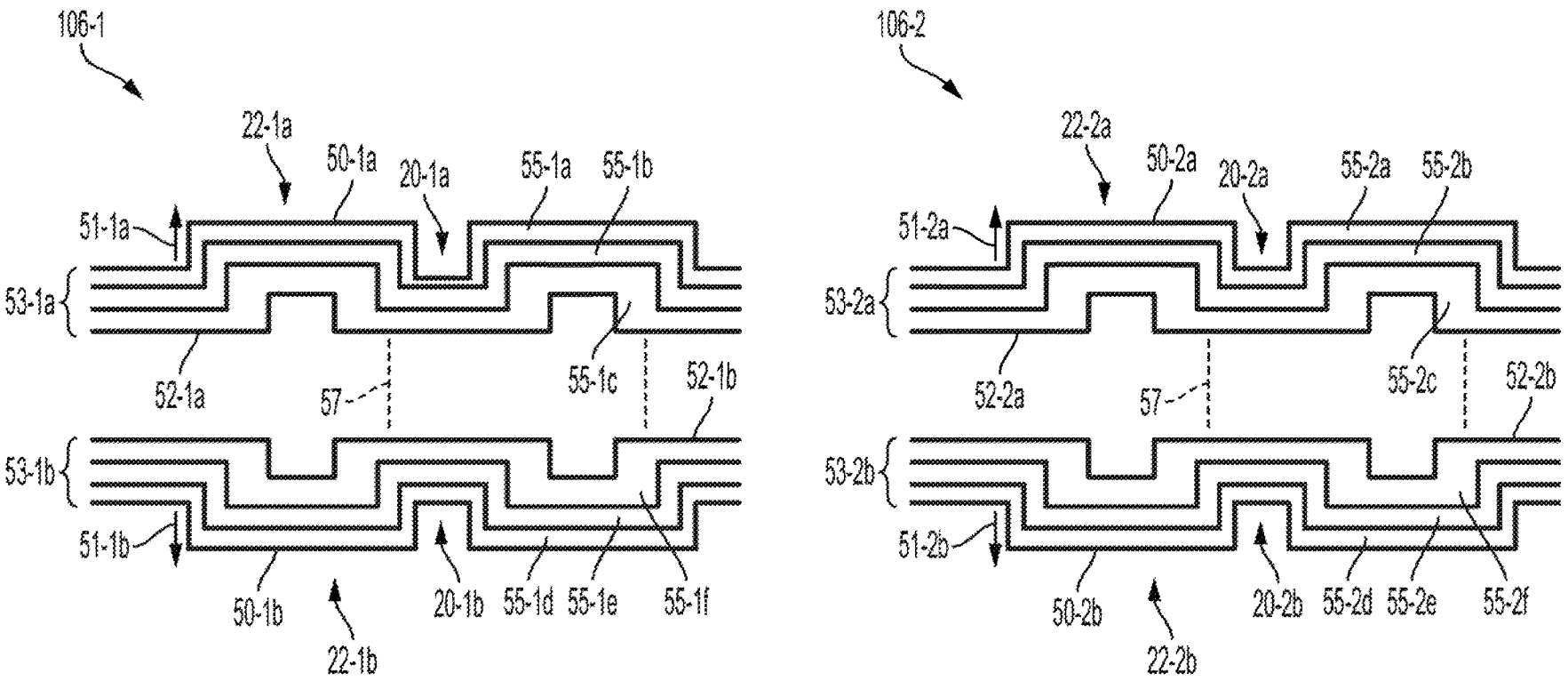
FIG. 16 illustrates two partial representative cross-section views of two sanitary tissue products, each comprising knuckles and pillows and made according to a TAD process such as the one illustrated in FIG. 6 of U.S. Ser. No. 63/330,077 ("Young").

For example, referring to FIG. 4A, an array 10 of sanitary tissue products 106 may comprise a first sanitary tissue product—106-1 in a first package 100-1 that conveys strength 301-1 and a second sanitary tissue product 106-2 in a second package 100-2 that conveys softness 301-2. At least one, two, three, four, five, or each of corresponding common intensive properties (e.g., lint, TDT, basis weight, absorbency, softness, TS7, etc.) of the first and second sanitary tissue products 106-1 and 106-2 may have a percent difference (e.g., at least about 5%, about 10%, about 15%, about 20%, about 25%, about 30%, about 35%, about 40%, about 45%, or about 50% different, including all 1% increments therebetween); alternatively, at least one, two, three, four, five, or each of the common intensive properties of the first and second sanitary tissue products may be about the same. The second sanitary tissue products 106-2 may have a different (e.g., at least about 5%, about 10%, about 15%, about 20%, about 25%, about 30%, about 35%, about 40%, about 45%, or about 50%, about 55%, about 60%, about 65%, about 70%, about 75%, about 80%, about 85%, about 90%, about 95%, or about 100% different, including all 1% increments therebetween) non-wood fiber content than the first sanitary tissue product 106-1 (e.g., each of the first and second sanitary tissue products may comprise bamboo, where the first sanitary tissue product 106-1 comprises more or less bamboo than the second sanitary tissue product 106-2, or vice versa). Each of the first and second sanitary tissue products may comprise different non-woods (e.g., the first sanitary tissue product 106-1 may comprise bamboo and the second sanitary tissue product 106-2 may comprise abaca); and/or each of the first and second sanitary tissue products 106-1 and 106-2 may comprise different amounts of non-wood content; and/or each of the first and second sanitary tissue products 106-1 and 106-2 may comprise non-woods in different layers. For instance, referring to FIG. 16, the first and second sanitary tissue products 106-1 and 106-2 may comprise plies 53-1 and 53-2, and the plies may comprise first layers 55-1*a* and 55-2*a* and second layers 55-1*b* and 55-2*b* (as well as third layers 55-1*c* and 55-2*c*). The first layer 55-1*a* of the first sanitary tissue product 106-1 may have a higher non-wood (e.g., bamboo) content than the first layer 55-2*a* of other of the second sanitary tissue product 106-2, where the first layers 55-1*a* and 55-2*a* are consumer-facing 50 layers; alternatively, the product-facing 52 layers 55-1*c* and 55-2*c* or a middle layer 55-1*b* and 55-2*b* of a multi-layer product may have a greater non-wood content than a consumer-facing 50 layer 55-1*a* and 55-2*a*. Further, a first layer (e.g., 55-1*a*) of the first sanitary tissue product 106-1 may have a different non-wood content and/or non-wood fiber type(s) than a first layer (e.g., 55-2*a*) of the second sanitary tissue product 106-2. For instance, a second layer 55-1*b* may comprise a different percentage (e.g., at least about 5%, about 10%, about 15%, about 20%, about 25%, about 30%, about 35%, about 40%, about 45%, or about 50% different, including all 1% increments therebetween) of non-wood versus a second layer 55-2*b*; and/or a second layer 55-1*b* may comprise different non-wood fiber types versus a second layer 55-2*b* (e.g., where the second layers 55-1*b* and 55-2*b* each comprise bamboo, but where only the second layer 55-1*b* comprises abaca and only the second layer 55-2*b* comprises bagasse). The first and second sanitary tissue product packages 100-1, and 100-2 may be separate from each other, such that they may be adjacent to each other, including immediately adjacent to each other, such that sides of the first and/or second packages are at least partially touching.

Figure 4E:
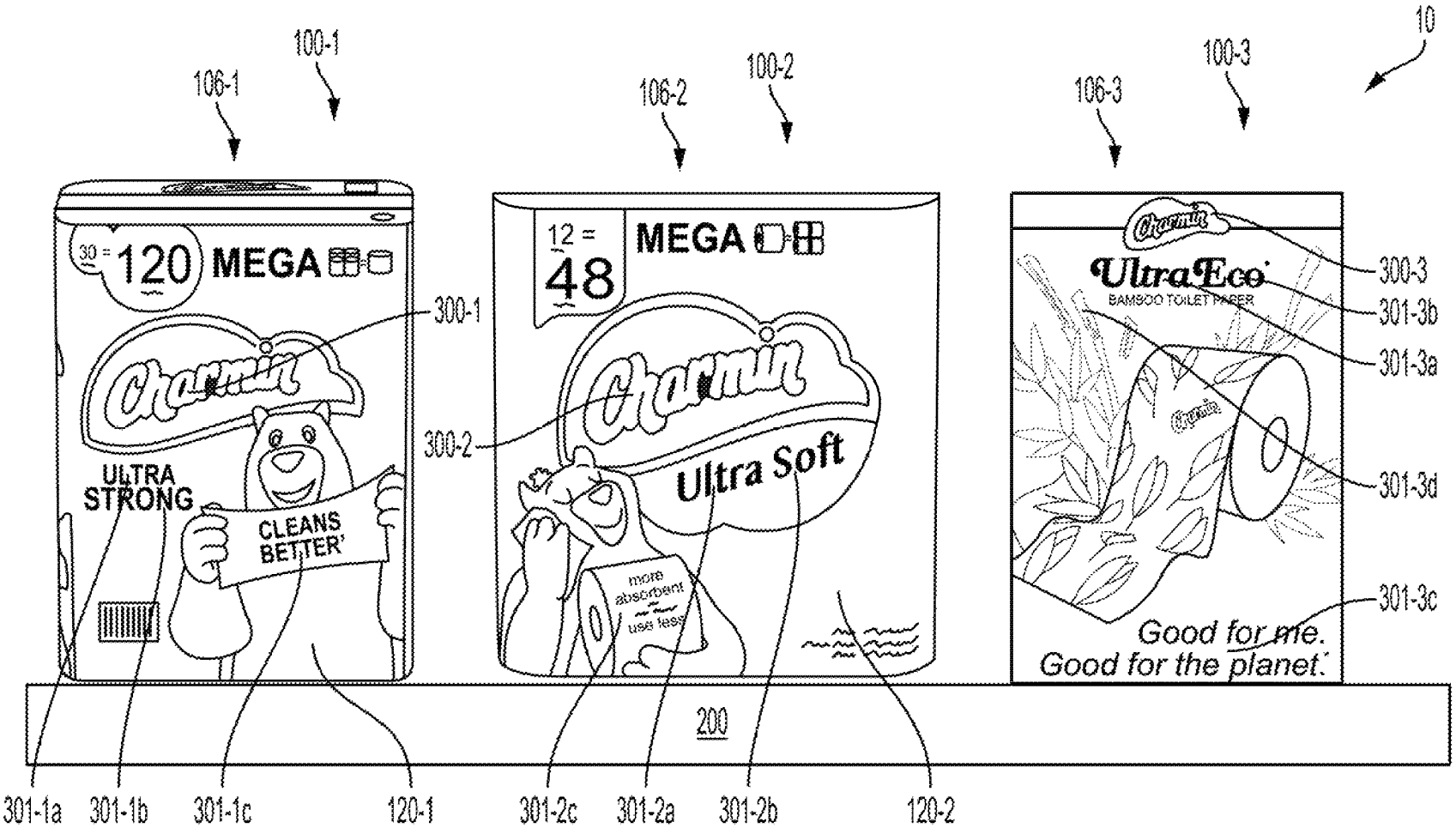
FIG. 4E is a front view of an array of packages comprising sanitary tissue products on a retail store shelf.
Figure 4F:
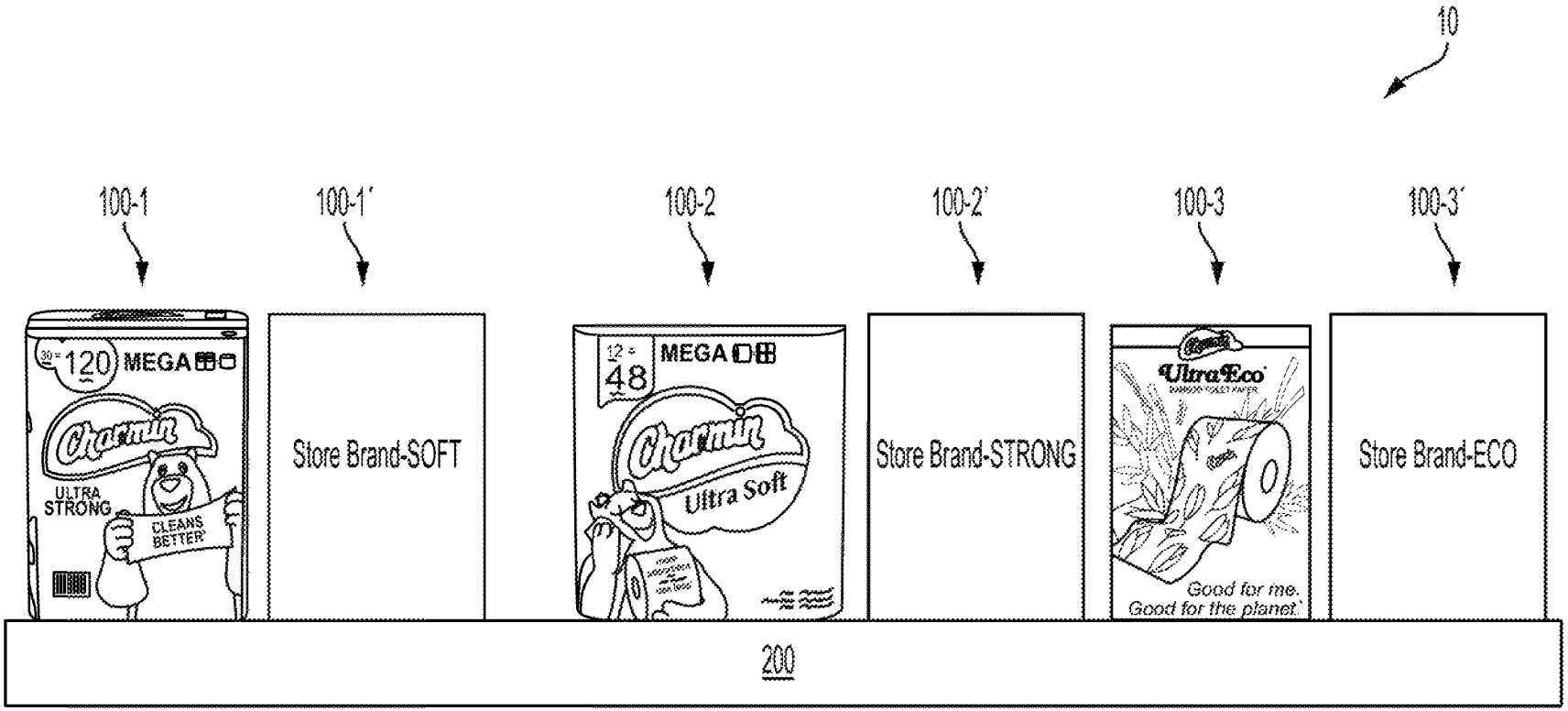
FIG. 4F is a front view of an array of packages comprising sanitary tissue products on a retail store shelf.
Figure 4G:
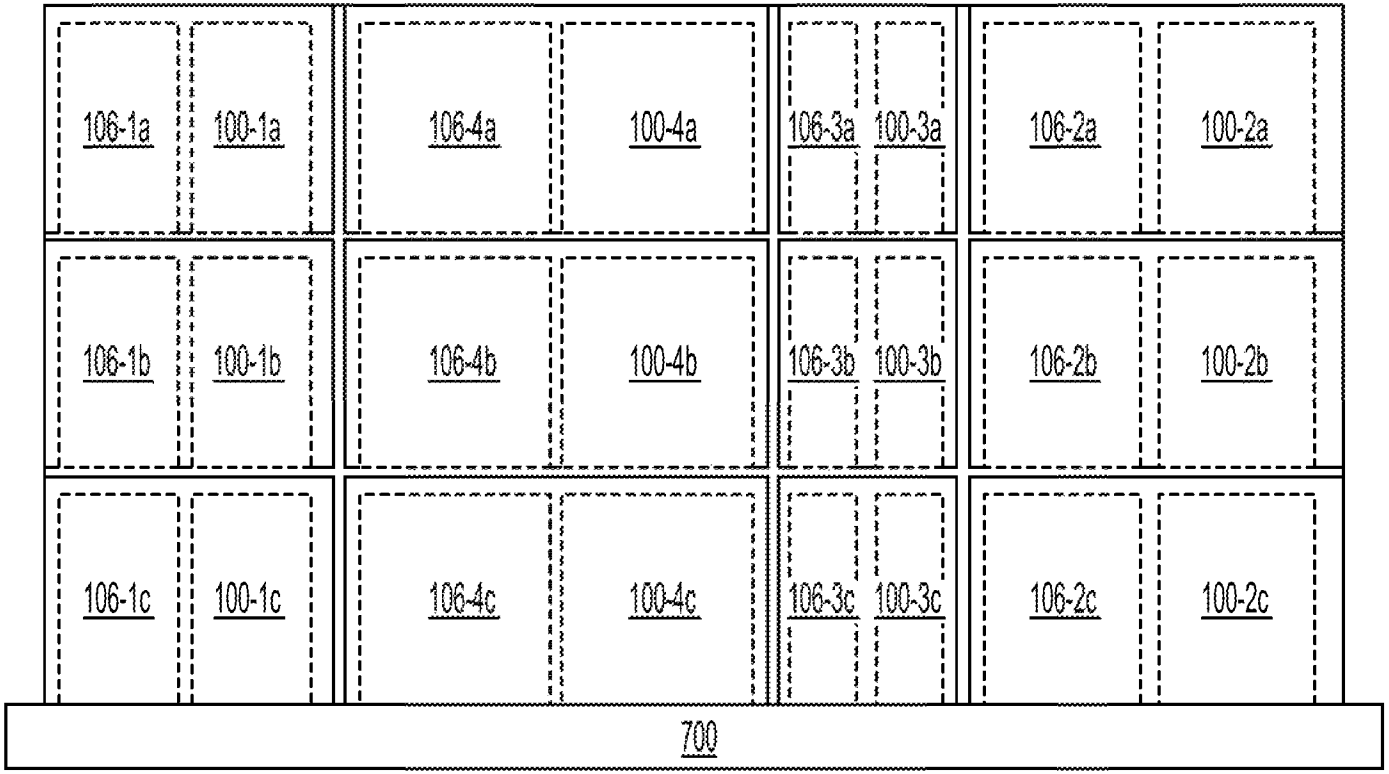
FIG. 4G is a front view of an array of packages comprising sanitary tissue products on a pallet.
Figure 4H:
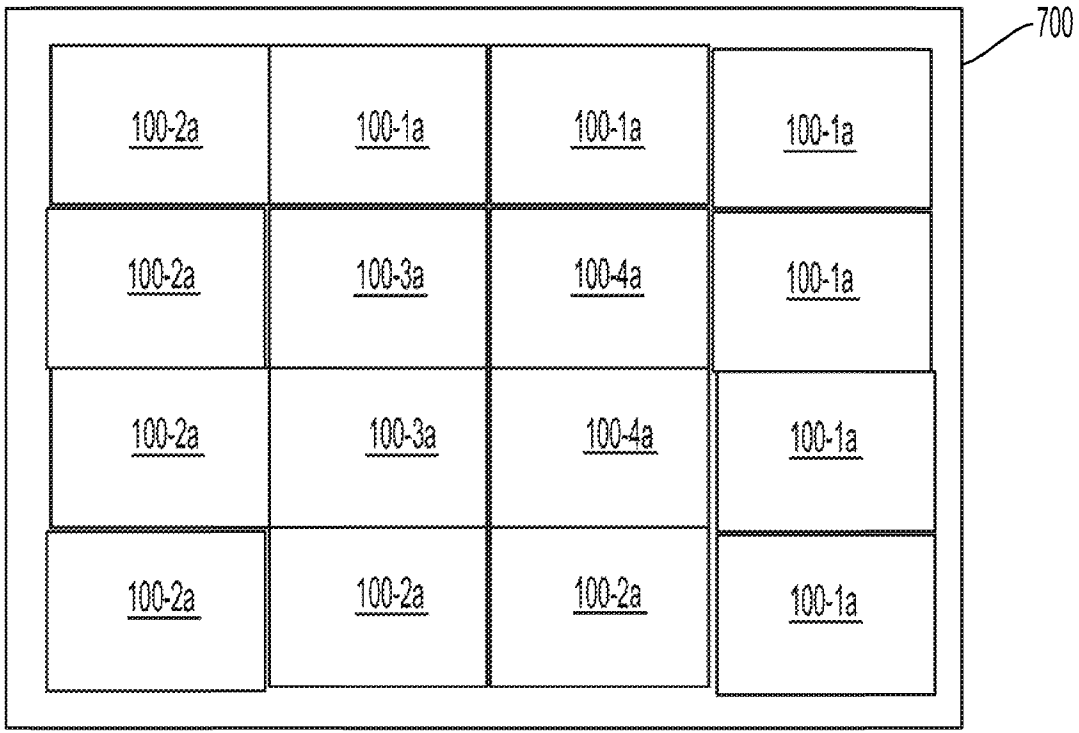
FIG. 4H is a top view of an array of packages comprising sanitary tissue products on a pallet.
Figure 4I:
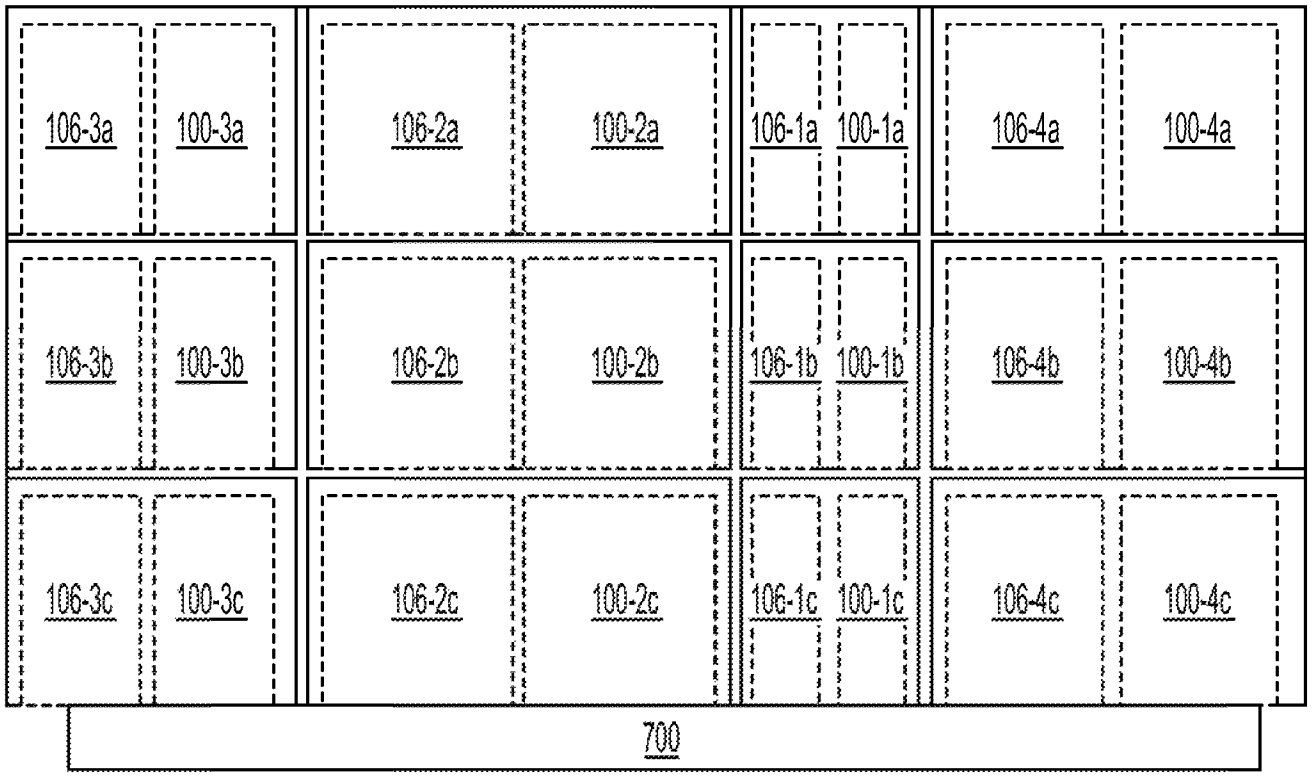
FIG. 4I is a front view of an array of packages comprising sanitary tissue products on a pallet.
Figure 4J:
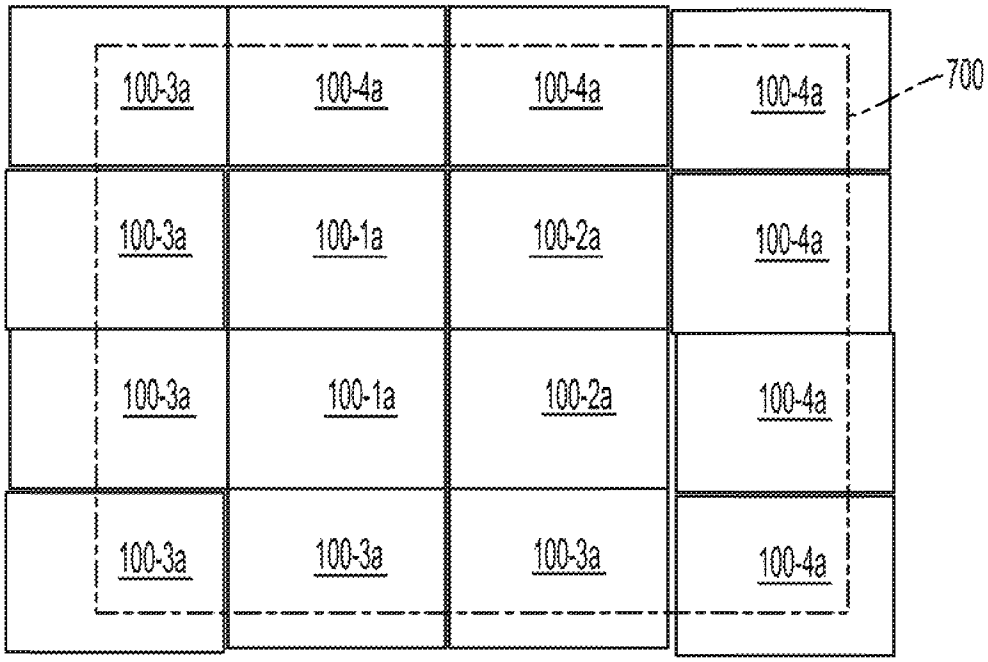
FIG. 4J is a top view of an array of packages comprising sanitary tissue products on a pallet.

Referring to FIG. 4F, an array 10 of commonly branded packages (e.g., 100-1, 100-2, and 100-3) may still be considered an array and considered adjacent to one another even when another product (e.g., private label or store brand 100-1', 100-2', and 100-3') is placed between said products having a common brand name 300—in fact, commonly branded packages may still be considered adjacent to each other when on the same shelf system, but on different shelves or even when across a common aisle 5 from each other. The first, second, and third sanitary tissue product packages 100-1, 100-2, and 100-3 may each comprise a common single source identifier (e.g., brand name indicator 300-1: "Charmin," 300-2: "Charmin," and 300-3: "Charmin"). The first, second, and third sanitary tissue product packages 100-1, 100-2, and 100-3 may comprise different sub-brands or different sub-brand name portions or different additional information (e.g., 301-1: "strong," 301-2: "soft," and 301-3: "eco").

Pallet Arrays

FIGS. 4G-J illustrate an array of packages 100 comprising sanitary tissue products 106. More particularly, first packages 100-1*a, b*, and *c* may convey strength, second packages 100-2*a, b*, and *c* may convey softness, and third packages 100-3*a, b*, and *c* may convey sustainability. Each of the packages 100-1, 2, and 3 may be arranged on a pallet 700 to form a "pallet array." Pallet arrays may be used for sending retail stores the necessary assortment of packages that includes sanitary tissue products comprising non-woods so that inventive arrays such as the ones described and illustrated by FIGS. 2A-4F and 4L may be formed by the retailer. In some instances, due to the composition of the packages conveying sustainability 100-3 and 100-4 (e.g., cardboard), which may be more rigid and more structurally stable than the composition of packages conveying strength and/or softness 100-1 and 100-2 (e.g., film), it may be desirable to dispose packages conveying sustainability 100-3 and 100-4 on an outer perimeter or on an end of the pallet array. Further, there may be a desire to arrange the packages such that an underhung pallet is created (see FIGS. 4G and H) or such that an overhung pallet is created (see FIGS. 4I and J)—see also U.S. Ser. No. 16/811,444 or U.S. Pub. No. US2020/0283208A1, which further discloses over and underhung pallet arrangements that may be used for pallet arrays of the present disclosure. An overhung pallet (or a greater degree of overhang) may be possible due to the stability/rigidity offered by cardboard packages—See FIGS. 4I and J. Alternatively, if the packages conveying sustainability are in a thinner paper package material, they may be less supportive and less stable, and more susceptible to tearing, such that it may be desirable to place said paper packages in a center area of the pallet and/or surrounded by more tear-resistant film packages—See FIGS. 4G and H.

For example, an array of sanitary tissue products may comprise first and second sanitary tissue products 106-1 and 106-2. The first sanitary tissue product 106-1 may be contained in a first package 100-1 that conveys strength and/or softness. The first package may comprise a plastic film (such as non-plant and non-recycled plastic) in contact with the first sanitary tissue product. The second sanitary tissue product 106-2 may be contained in a second package 100-2 that conveys sustainability. The second package 100-2 may comprise sustainable (e.g., paper-based, recycled plastic, plant-based plastic, etc.) packaging material in contact with the second sanitary tissue product 106-2. The second sanitary tissue product 106-2 may have a greater non-wood fiber content than the first sanitary tissue product 106-1. The first and second sanitary tissue product packages 100-1 and 100-2 may be disposed on a same pallet 700. Each of the first and second sanitary tissue product packages 100-1 and 100-2 may each comprise a common single source identifier. The first and second sanitary tissue product packages 100-1 and 100-2 may comprise different sub-brands or different sub-brand name portions.

Further, pallet arrays such as the ones illustrated by FIGS. 4G-J may be especially useful for being placed at the retailer in a locations where customers wanting to purchase such items may pick the package directly from the pallet 700. This eliminates the need for the retailer to unload the pallet to create an array on a shelf 200. Rather, the pallet array may be used in place of a shelf, providing the customers ready access to the arrays comprising sanitary tissue products comprising non-wood fibers. The pallet arrays may be placed such that an aisle (e.g., 5) is formed between the pallet arrays. Still further, not only may the pallets comprise conventional products (that don't comprise non-wood fibers and that may be in film packages) in combination with sustainable products as described herein (which comprise non-wood fibers and may be packaged in sustainable material), but each of these product types on a pallet may be wrapped in plastic film for the purpose of stabilizing the pallet load. It may be desirable to have an entire pallet of sustainable product(s) wrapped by said plastic film. Wrapping sustainable product with such film(s) is not obvious because there is a great interest to dissociate plastic products from sustainable products.

Intermediate Non-Wood Sanitary Tissue Product

While the art has disclosed that low coarseness non-woods (e.g., bamboo) can be used in toilet tissue, the inventors of the present disclosure have, surprisingly, found that adding much higher coarseness non-wood fibers into the sheet, even at high inclusion levels, and even against the consumer (i.e., on a consumer-facing surface), can result in products with good softness and low levels of lint. The non-wood fibers may also be wider (for example, bamboo at 18.9 um) than conventional wood fibers. These coarse and wide non-wood fibers can be used to create substrates with lower fiber coverage at a given basis weight. Further, it has been surprisingly shown that the introduction of coarser, non-wood fibers, which create lower fiber coverage substates, can still create products that can successfully balance the traditional strength-softness contradiction. Thus, sanitary tissue products comprising non-woods may be soft as or nearly as soft as leading soft sanitary tissue products on the market, while at the same time be strong as or nearly as strong as leading strong sanitary tissue products on the market—while having lower lint levels. These improvements may be achieved, at least in part, through different making processes, belt designs, fiber selection, inclusion levels, etc.-see for example U.S. Ser. No. 63/329,222 filed on Apr. 8, 2022 by The Procter & Gamble Company; U.S. Ser. No. 63/329,718 filed on Apr. 11, 2022 by The Procter & Gamble Company; U.S. Ser. No. 63/330,077 filed on Apr. 12, 2022 by The Procter & Gamble Company; and U.S. Ser. No. 63/353,183 titled "Fibrous Structures Comprising Non-wood Fiber" filed on Jun. 17, 2022 by The Procter & Gamble Company naming Christopher Michael Young as the first-named inventor.

For example, an array 10 of sanitary tissue products 106, such as illustrated in FIG. 4A, may comprise first and second sanitary tissue products 106-1 and 106-2. The first sanitary tissue product may be contained in a first package 100-1 that conveys strength and/or softness 301-1. The second sanitary tissue product 106-2 may be contained in a second package 100-2 that conveys sustainability 301-2. The second sanitary tissue product 106-2 may have a greater non-wood fiber content than the first sanitary tissue product 106-1. The second sanitary tissue product 106-2 may have a TS7 less, but within about 5%, 10%, 15%, 20% or 25%, including all 1% increments therebetween, than a TS7 of the first sanitary tissue product 106-1. The second sanitary tissue product 106-2 may have a lint value greater, but within about 5%, 10%, 15%, 20% or 25%, including all 1% increments therebetween, than a lint value of the first sanitary tissue product 106-1. A total dry tensile of the second sanitary tissue product 106-2 may be less, but within about 5%, 10%, 15%, 20% or 25%, including all 1% increments therebetween, than a total dry tensile of the first sanitary tissue product 106-1. Each of lint, basis weight, total dry tensile, absorbency, softness, TS7, etc. may be common intensive properties of the first and second sanitary tissue products 106-1 and 106-2. The first and second sanitary tissue product packages 100-1 and 100-2 may be separate from each other, such that they may be adjacent to each other, including immediately adjacent to each other, such that sides of the first and second packages 100-1 and 100-2 are at least partially touching. The first and second sanitary tissue product packages 100-1 and 100-2 may each comprise a common single source identifier (e.g., brand name indicator 300, such as "Charmin"). The first and second sanitary tissue product packages 100-1 and 100-2 may comprise different sub-brands or different sub-brand name portions or different additional information (e.g., "soft," "strong," or "eco").

As another example, an array 10 of sanitary tissue products 106, such as the one illustrated in FIG. 4B, may comprise first, second, and third sanitary tissue products 106-1, 106-2, and 106-3. The first sanitary tissue product 106-1 may be contained in a first package 100-1 that conveys strength 301-1. The second sanitary tissue product 106-2 may be contained in a second package 100-2 that conveys softness 301-2. The third sanitary tissue product 106-3 may be contained in a third package 100-3 that conveys sustainability 301-3. The third sanitary tissue product 106-3 may have a greater non-wood fiber content than the first and/or second sanitary tissue products 106-1 and 106-2. The third sanitary tissue product 106-3 may have a TS7 greater, but within about 5%, 10%, 15%, 20% or 25%, including all 1% increments therebetween, than a TS7 of the first sanitary tissue product 106-1, and a TS7 of the second sanitary tissue product 106-2 may be greater, but within about 5%, 10%, 15%, 20% or 25%, including all 1% increments therebetween, of the TS7 of the first and/or third sanitary tissue product 106-1 and 106-3. The third sanitary tissue product 106-3 may have a lint value greater, but within about 5%, 10%, 15%, 20% or 25%, including all 1% increments therebetween, than a lint value of the first sanitary tissue product 106-1, and the lint value of the third sanitary tissue product 106-3 may be less, but within about 5%, 10%, 15%, 20% or 25%, including all 1% increments therebetween, of the lint value of the second sanitary tissue product 106-2. A total dry tensile of the third sanitary tissue product 106-3 may be less, but within about 5%, 10%, 15%, 20% or 25%, including all 1% increments therebetween, than a total dry tensile of the first sanitary tissue product 106-1. A total dry tensile of the third sanitary tissue product 106-3 may be greater, but within about 5%, 10%, 15%, 20% or 25%, including all 1% increments therebetween, than a total dry tensile of the second sanitary tissue product 106-2. The first, second, and third sanitary tissue product packages 100-1, 100-2, and 100-3 and may be separate from each other, such that they may be adjacent to each other, including immediately adjacent to each other, such that sides of the first, second, and third packages 100-1, 100-2, and 100-3 are at least partially touching. The first and second sanitary tissue product packages 100-1 and 100-2 may each comprise a common single source identifier (e.g., brand name indicator 300-1, 2, and 3, such as "Charmin"). The first, second, and third sanitary tissue product packages 100-1, 100-2, and 100-3 may comprise different sub-brands or different sub-brand name portions or different additional information (e.g., "soft," "strong," or "eco").

Fibrous Structure Texture and/or Emboss Arrays

Figure 5A:
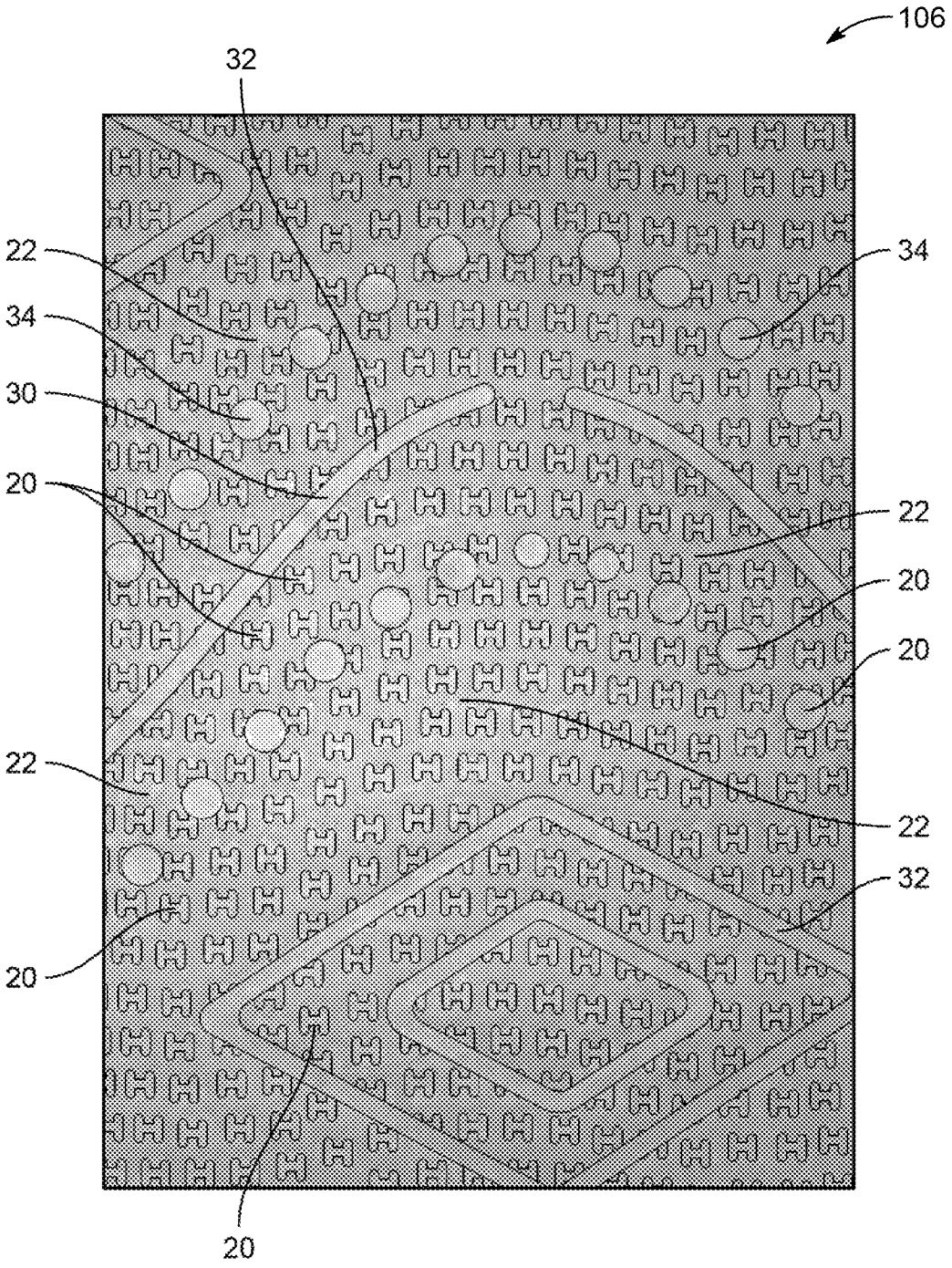
FIG. 5A is a photograph of a portion of a sanitary tissue product, particularly a paper towel, comprising knuckles 20, pillows 22, embossments 32 (including line embossments 30 and dot embossments 34).
Figure 5B:
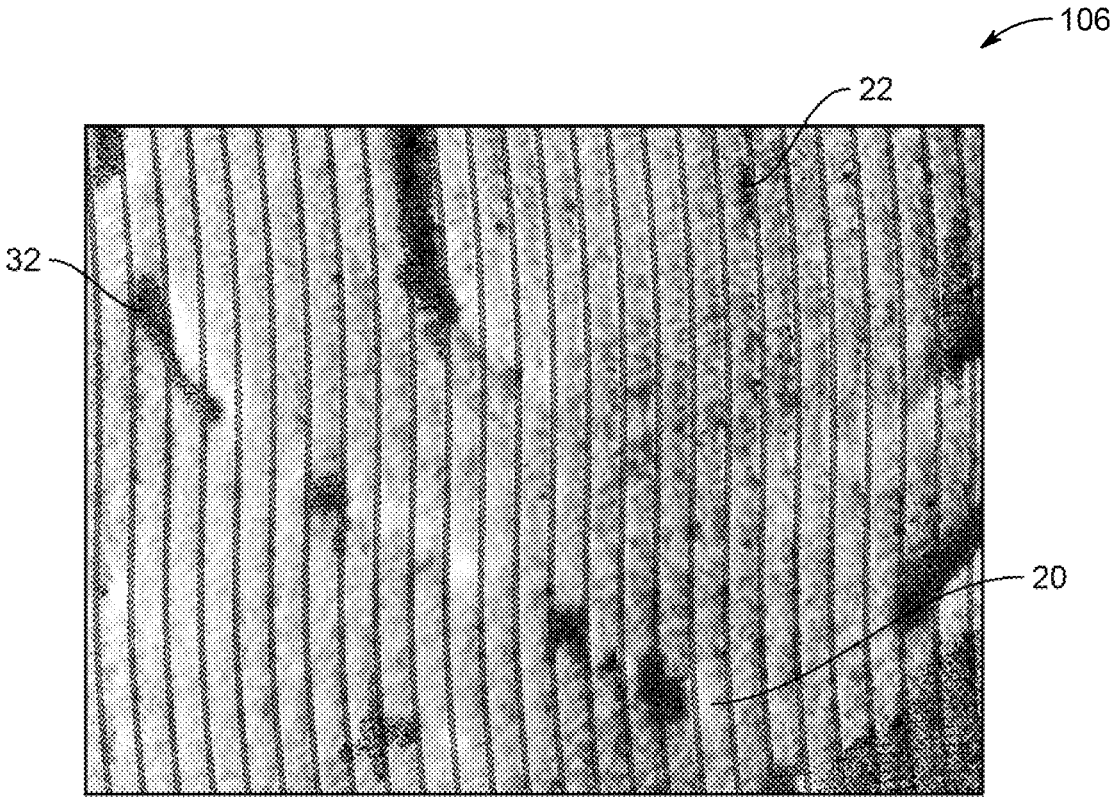
FIG. 5B is a photograph of a portion of a sanitary tissue product, particularly a wire-side-out (WSO) bath tissue, comprising knuckles 20 and pillows 22.
Figure 5C:
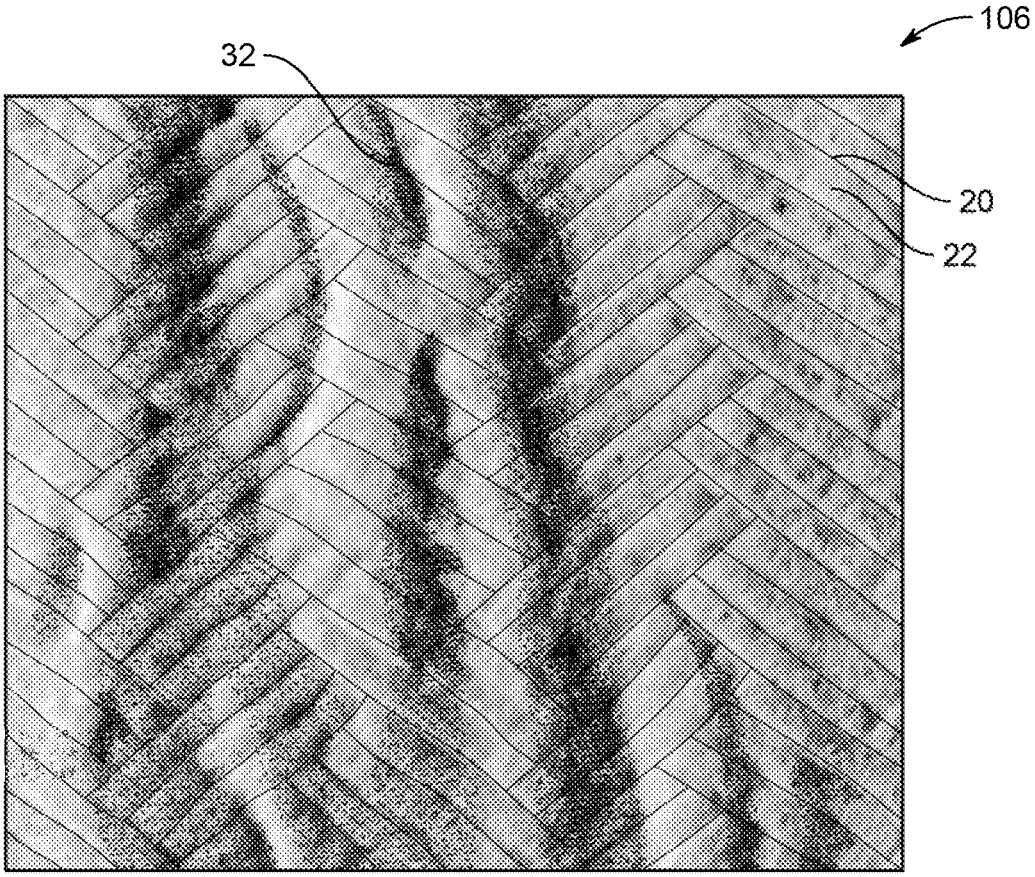
FIG. 5C is a photograph of a portion of a sanitary tissue product, particularly a fabric-side-out (FSO) bath tissue, comprising knuckles 20 and pillows 22.
Figure 17A:
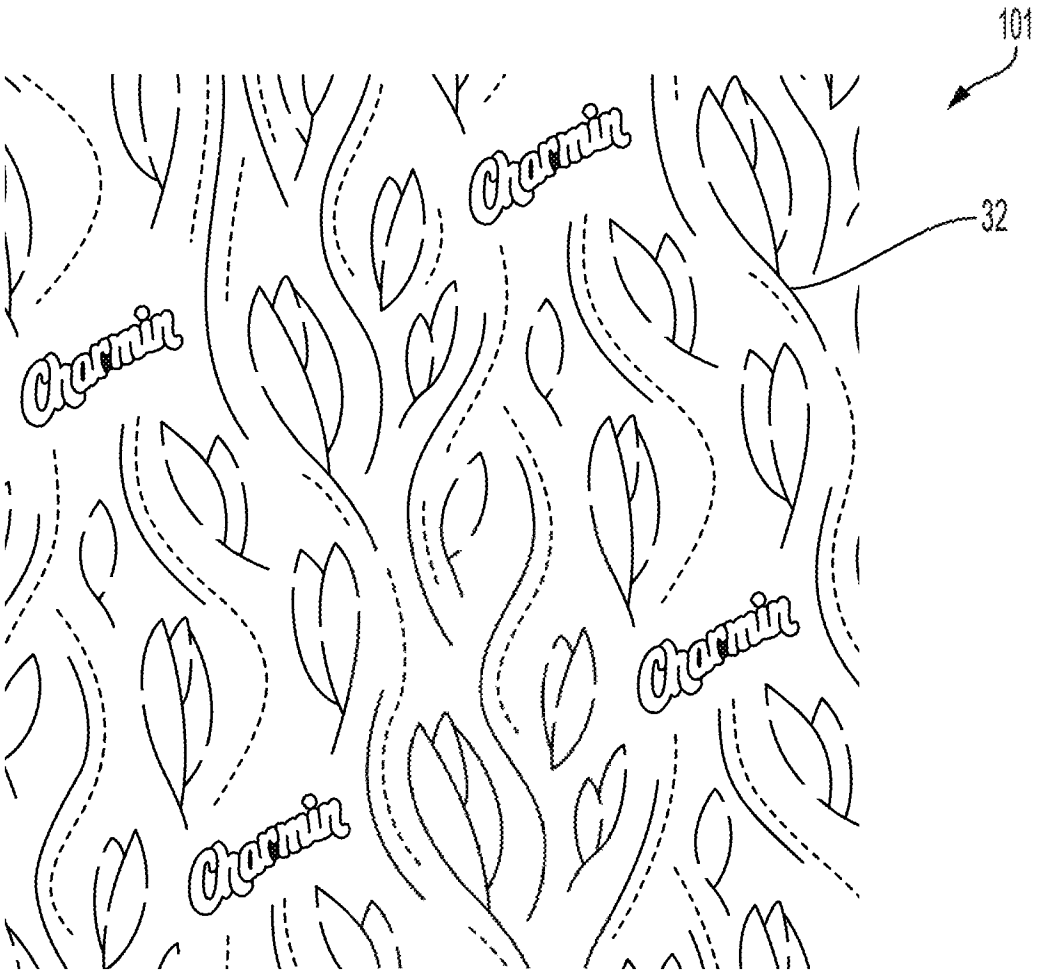
FIG. 17A is a portion of a fibrous structure of the present disclosure comprising an emboss pattern.
Figure 17B:
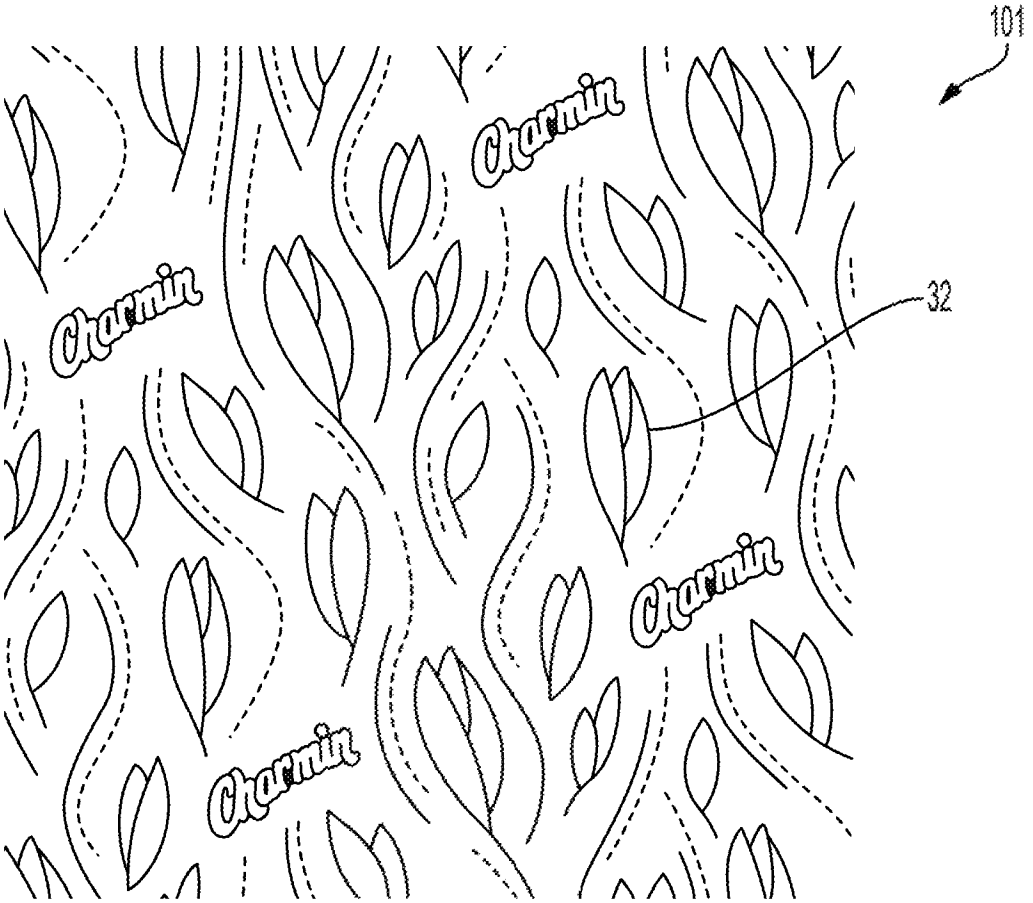
FIG. 17B is a portion of a fibrous structure of the present disclosure comprising an emboss pattern.
Figure 19A:
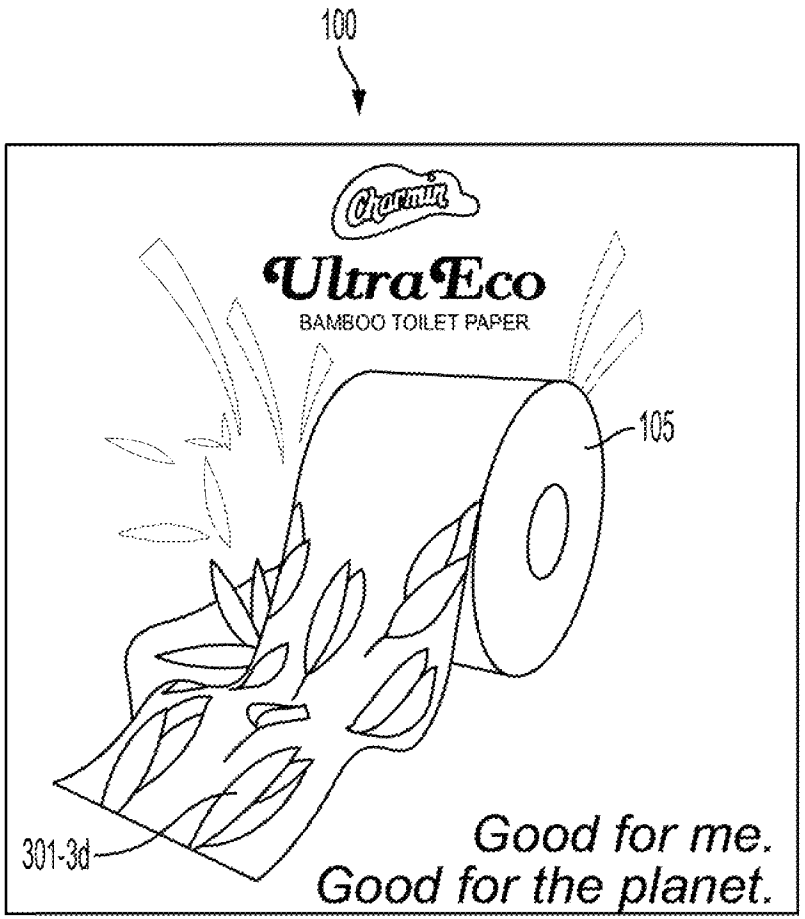
FIG. 19A illustrates a package conveying sustainability using an illustration of a rolled sanitary tissue product overlapped with illustrations of plant/tree parts.

Sanitary tissue products (e.g., 106-1, 106-2, and 106-3) of the present disclosure may have texture created by knuckles 20 and pillows 22 (see, for example, FIGS. 5A-C), and/or embossments 32—see, for example, FIGS. 17A and 17B illustrate fibrous structures 101 that comprise a pattern of emboss 32 elements—each black line, dash, object, etc. illustrated in FIGS. 17A and 17B are embossments 32. As shown in FIGS. 17A and 17B, the embossments may imply or symbolize stems, leaves, flowers, which may be useful for conveying sustainability for a fibrous structure 101 that comprises non-wood fibers and/or a fibrous structure 101 that is marketed as an "eco" product. Additionally or alternatively, texture, embossments and/or print may imply or symbolize the earth, as well as the combination of the earth with one or more leaves and may symbolize light bulbs to convey sustainability. As shown in FIGS. 19A and B, additional information 301-*d* may also illustrate plants and/or plant parts on the package. In FIGS. 19A and B, overlapping the plant parts 301-*d* with the sanitary tissue imagery 105 functions to strongly communicate that plant fibers make up the actual paper—this methodology is an especially effective communication when the plant illustrations travel from a leading edge of the paper to the top of the illustrated sanitary tissue roll 105 as in FIG. 19B.

Figure 19B:
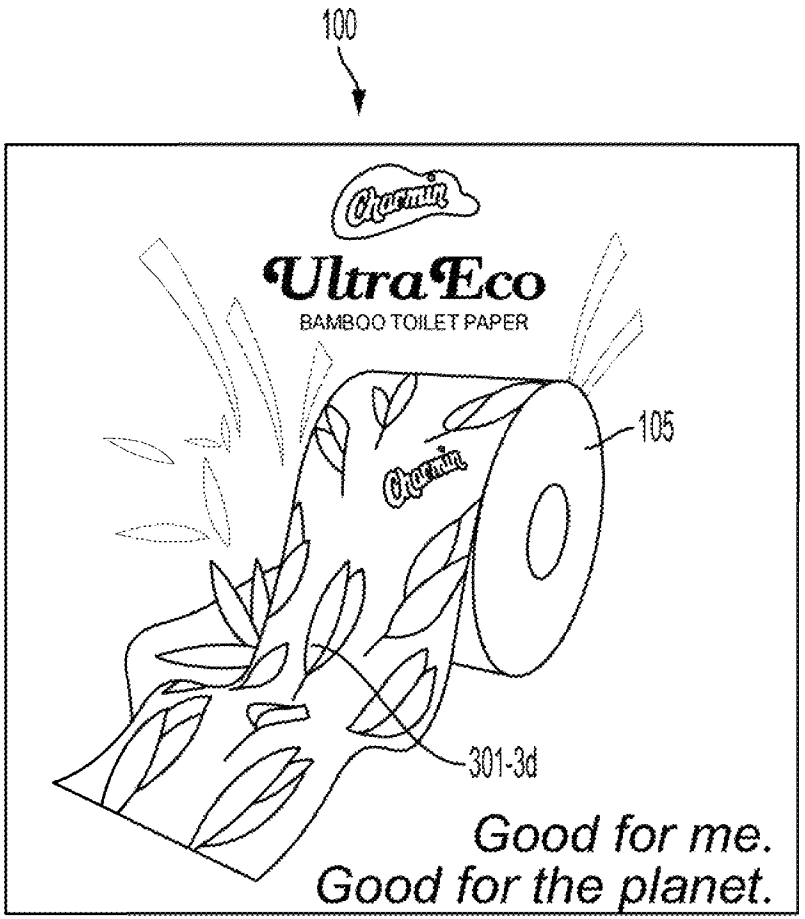
FIG. 19B illustrates a package conveying sustainability using an illustration of a rolled sanitary tissue product overlapped with illustrations of plant/tree parts.

It may also be desirable to make the plant part illustrations 301-*d* less realistic (e.g., more cartoon-like), while making the illustrated sanitary tissue roll 105 more realistic or even a photograph of an actual sanitary tissue product roll. Such a contrast helps the user to better understand that the actual sanitary tissue product 106 is not really printed with plant parts, nor does it have leaf parts adhered to or extending from a top surface of the paper. Rather, as illustrated in FIGS. 19A and 19B, it communicates that the actual sanitary tissue roll looks as it normally would, as a white roll, but that it comprises non-wood fibers (e.g., bamboo) that are more sustainable.

Figure 18:
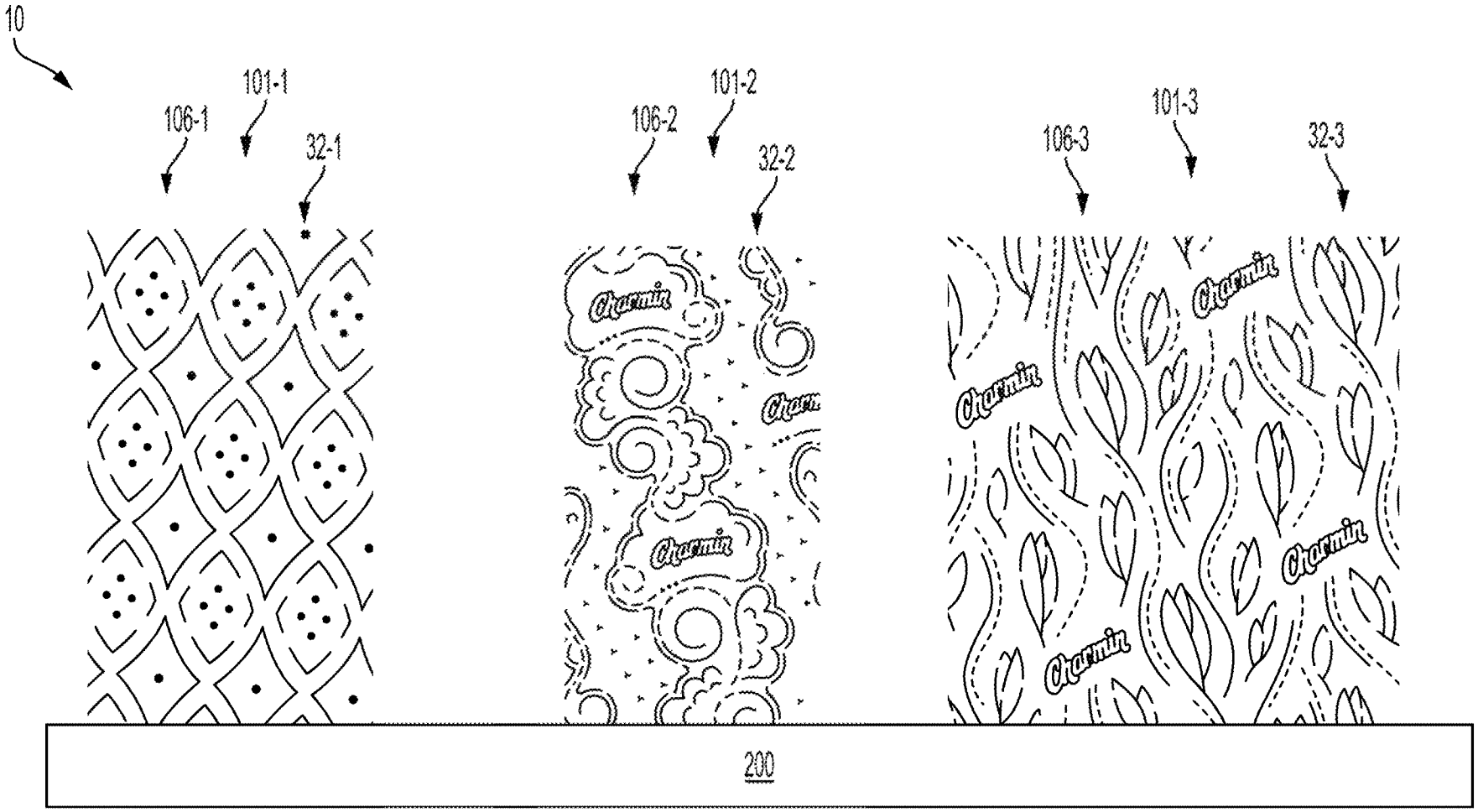
FIG. 18 is an array of portions of a fibrous structures of the present disclosure, each comprising an emboss pattern.

An array 10 comprising a sustainable product, as illustrated in FIG. 18, may comprise portions of fibrous structures 101-1, 101-2, and 101-3 that make up portions of a first sanitary tissue product 106-1, a second sanitary tissue product 106-2, and a third sanitary tissue product 106-3, each having a unique emboss 32-1, 2, and 3. More particularly, the sanitary tissue packages (100-1, 100-2, and 100-3) of FIG. 4E, comprising sanitary tissue products (106-1, 106-2, and 106-3) may comprise the emboss patterns of the sanitary tissue products (106-1, 106-2, and 106-3) of FIG. 18, respectively, such that emboss 32-1 of 106-1 in FIG. 18 is part of the "strong" toilet tissue of FIG. 4E and helps to convey strength, such that the emboss 32-2 of 106-2 in FIG. 18 is part of the "soft" toilet tissue of FIG. 4E and helps to convey softness, and such that the emboss 32-3 of 106-3 in FIG. 18 is part of the "eco" toilet tissue of FIG. 4E and helps to convey sustainability.

The sanitary tissue products 106-1, 106-2, and 106-3 of FIG. 4E may, alternatively, comprise a common emboss 32 or may comprise a common texture, where the common texture is differentiated on each of the packages—for example, each of the packages of an array may have a common paper structure or texture (e.g., peaks and valleys or waves), but the first package 106-1 may convey that the structure or texture is responsible for softness or comfort, the second package 106-2 may convey that the structure or texture is responsible for strength or cleaning capability, and the third package 106-3 may convey that the structure or texture is responsible for, or associated, with sustainability (e.g., the texture is an "eco" texture). An "eco" texture is not obvious. While texture may deliver a paper characteristic (e.g., softness, strength, etc.), texture is not normally associated with sustainability because texture isn't correlated to whether a fiber is sustainable or not.

Multi-Product Arrays of the Present Disclosure

As indicated above, it may be desirable to incorporate non-wood fibers into one or more products of a line-up. For instance, as illustrated in FIG. 4E, the Charmin offerings may include a sustainable ("Eco") product 106-3, in addition to Charmin Soft 106-2 and Charmin Strong 106-1. It may, however, be desirable to include an Eco product in multiple product offerings or line-ups. For instance, as illustrated in FIG. 4L, an Eco product may be offered across two or three different product line-ups or product types. More particularly, an Eco product may be offered in paper towels, toilet tissues, napkins, and/or facial tissues. The same sub-branding, slogans, and/or additional information may be used for different Eco products across multiple products manufactured by or on behalf of the same company or the different Eco products may part of a common portfolio of products, such as a collection of brands associated (e.g., on a web-site sponsored by a company) with the same company. It is not obvious for two, three, and/or four different product types to have the same sub-brand/additional information. Rather, one might more naturally expect that because the two, three, and/or four product types are different types of products, that they would have different sub-brands 301-1*b*, 2*b*, and 3*b* or different sub-brand name portions and/or different additional information 301-1*c*, 2*c*, and 3*c*. Because sanitary tissue products tend to utilize sub-brands and additional information that links to specific functional properties of the product (e.g., towels focus on strength and absorbency, while toilet tissues focus on softness and strength).

For example, as illustrated in FIG. 4L, an array 10 of sanitary tissue products 106 may comprise first, second, and third sanitary tissue products 106-1, 106-2, and 106-3. The first sanitary tissue product 106-1 may be contained in a first package 100-1 and may convey sustainability 301-1*b* and 301-1*c*. The first sanitary tissue product 106-1 may be paper towels. The second sanitary tissue product 106-2 may be contained in a second package 100-2 that also conveys sustainability 301-2*b* and 301-2*c*. The second sanitary tissue product 106-2 may be a different sanitary tissue product than the first sanitary tissue product 106-1, such as toilet tissue. The third sanitary tissue product 106-3 may be contained in a third package 100-3 that also conveys sustainability 301-3*b* and 301-3*c*. The third sanitary tissue product 106-3 may be a different sanitary tissue product than the first and/or second sanitary tissue product 106-1 and 106-2, such as facial tissue. Each of the first, second, and third sanitary tissue products 106-1, 106-2, and 106-3 may comprise non-wood fibers. Each may comprise the same type of non-wood fibers or each may comprise different types of non-wood fibers—for instance, each of sanitary tissue products 106-1, 106-2, and 106-3 may comprise bamboo fibers. Each may comprise the same or different percentage of non-wood fibers. The first, second, and third sanitary tissue product packages 100-1, 100-2, and 100-3 may be separate from each other. The first, second, and third sanitary tissue products 106-1, 106-2, and 106-3 may be manufactured by or on behalf of the same company. Each of the first, second, and third sanitary tissue product packages 100-1, 100-2, and 100-3 may comprise different single source identifiers 300-1, 300-2, and 300-3. The first, second, and third sanitary tissue product packages 100-1, 100-2, and 100-3 may comprise the same sub-brands 301-1*b*, 301-2*b*, and 301-3*b* and additional information 301-1*c*, 301-2*c*, and 301-3*c*. For instance, the first, second, and third sanitary tissue products 106-1, 106-2, and 106-3 may be "Eco," such as "Bounty Eco," "Charmin Eco," and "Puffs Eco."

Digital Arrays of the Present Disclosure

Any of the above arrays 10 may be represented digitally on a digital display 70 (computer, tablet, phone, etc.). While the digital packages are just images (e.g., 107), said image of a package represents an actual package 100 comprising actual sanitary tissue products 106. For instance, the physical arrays of FIGS. 2A, 2C, 3, 4A-F and 4K may be represented digitally. The digital arrays may be divided between screens. For instance, as a consumer searches "Charmin," screens of various sanitary tissue products may be presented (across pages on Amazon, Target, Walmart, etc.). There may be several Charmin, as well as others, such as Cottonelle and/or Quilted Northern and/or store brands and/or private label offerings on a first screen, and still more Charmin on second and third screens/pages. Such screens may comprise an array 10 (i.e., the requirements of the array may comprise products over multiple screens/pages). For instance, if the array 10 is defined as having sanitary tissue product packages 100 having a common brand name 300, then all of the representations of sanitary tissue product packages 100 having a common brand 300 across the screens of a search result would be part of the digital array.

Figure 4K:
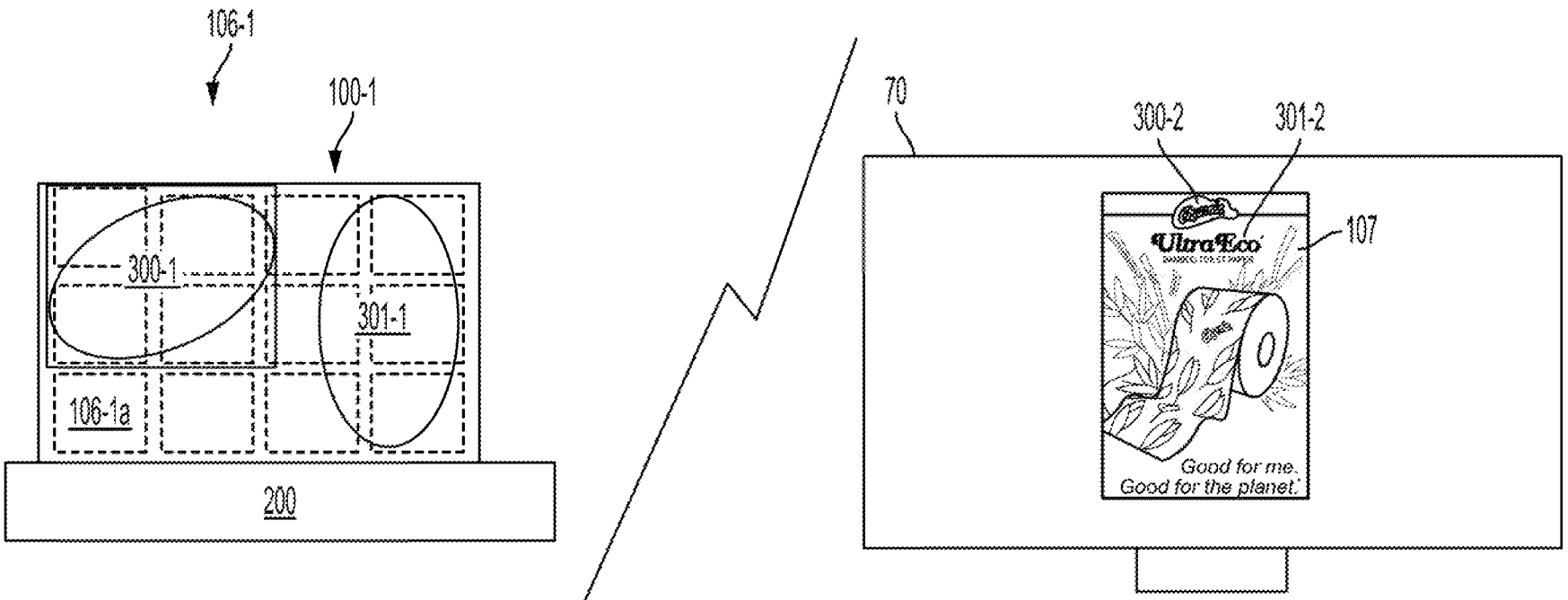
FIG. 4K illustrates on a right side: a front view of a digital display 70 comprising a digital image of a sanitary tissue product package 107 available for sale, and on a left side: a front view of a sanitary tissue product package 106 on a shelf 200. The digital display and sanitary tissue product package are in different physical locations.
Figure 4L:
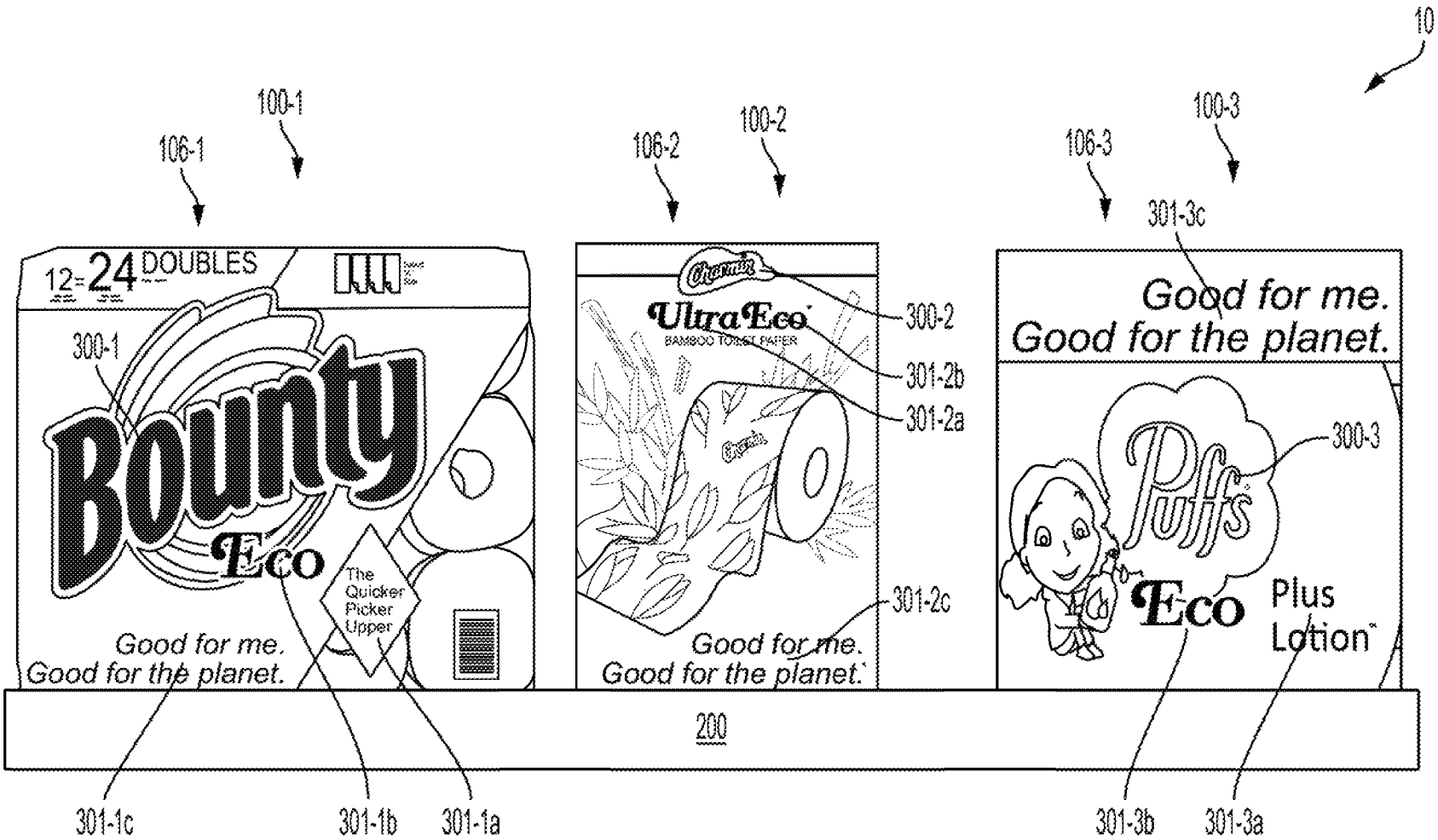
FIG. 4L is a front view of an array of packages comprising sanitary tissue products on a retail store shelf.

For example, as illustrated in FIG. 4K, an array 10 of sanitary tissue products 106 may comprise a first sanitary tissue product 106-1 in a first package 100-1 and a digital image 107 representative of an actual second package (e.g., 100-2). The first sanitary tissue product 106-1 may be disposed in a first package 100-1 that conveys strength and/or softness 301-1, and the first package 100-1 may be disposed on a retail store shelf 200. The digital image 107 may be representative of an actual second package that conveys sustainability, and that is for sale. The second sanitary tissue product (e.g., 106-2) may disposed in a location other than the retail store shelf 200, such as a warehouse. Lint, TDT, basis weight, TS7, and absorbency may be common intensive properties of the first and second sanitary tissue products. The first sanitary tissue product 106-1 may have at least one of a lint, TDT, basis weight, TS7, and absorbency within about 25% of at least one of a lint, TDT, basis weight, TS7, and absorbency of the second sanitary tissue product (e.g., 106-2) (for example, if a second sanitary tissue product has a lint value of 10, then "within about 25%" is calculated by multiplying 10 by 25%, which equals 2.5; and then adding 2.5 to 10 and subtracting 2.5 from 10 to get a range; so that "within 25%" means a value of or between about 12.5 and about 7.5). The second sanitary tissue product (e.g., 106-2) may have a higher non-wood fiber content than the first sanitary tissue product 106-1. The first and second sanitary tissue product packages 100-1 and 100-2 may be separate from each other. Each of the first and second sanitary tissue product packages 100-1 and 100-2 may each comprise a common single source identifier 300-1 and 300-2 (e.g., both are "Charmin"). The first and second sanitary tissue product packages 100-1 and 100-2 may comprise different sub-brands or comprise different sub-brand name portions or different additional information 301-1 and 301-2 (e.g., "strong" and "eco").

Another example of an array of sanitary tissue products may comprise first and second digital images. The first digital image may be representative of an actual first package that conveys strength and/or softness, and that is representative of an actual first sanitary tissue product. The second digital image may be representative of an actual second package that conveys sustainability, and that is representative of an actual second sanitary tissue product.

Lint, TDT, basis weight, TS7, and absorbency may be common intensive properties of the first and second sanitary tissue products. The first sanitary tissue product may have at least one of a lint, TDT, basis weight, TS7, and absorbency within about 25% of at least one of a lint, TDT, basis weight, TS7, and absorbency of the second sanitary tissue product (for example, if a second sanitary tissue product has a lint value of 10, then "within about 25%" is calculated by multiplying 10 by 25%, which equals 2.5; and then adding 2.5 to 10 and subtracting 2.5 from 10 to get a range; so that "within 25%" means a value of or between about 12.5 and about 7.5). The second sanitary tissue product may have a higher non-wood fiber content than the first sanitary tissue product. The first and second digital images representative of first and second packages may be made to appear separate from each other. Each of the first and second digital images and the corresponding first and second sanitary tissue product packages may each comprise a common single source identifier. The first and second digital images and the corresponding first and second sanitary tissue product packages may comprise different sub-brands or comprise different sub-brand name portions.

Relative Array Properties

Referring to FIGS. 2A-4L:

- a dominant sustainable sanitary tissue product (e.g., a third sanitary tissue product) of an array may have a greater (more positive) lint value (i.e., more lint) than a dominant strong sanitary tissue product (e.g., a first sanitary tissue product), and may have a lesser (less positive) lint value (i.e., less lint) than a dominant soft sanitary tissue product (e.g., a second sanitary tissue product);
- a dominant sustainable sanitary tissue product (e.g., a third sanitary tissue product) of an array may have a lesser (less positive) TDT, wet burst strength, dry burst strength, and/or TDT value (i.e., less strong) than a dominant strong sanitary tissue product (e.g., a first sanitary tissue product), and may have a greater (more positive) TDT, wet burst strength, dry burst strength, and/or TDT value (i.e., more strong) than a dominant soft sanitary tissue product (e.g., a second sanitary tissue product); and/or
- a dominant sustainable sanitary tissue product (e.g., a third sanitary tissue product) of an array may have a lesser (less positive) TS7 value (i.e., more soft) than a dominant strong sanitary tissue product (e.g., a first sanitary tissue product), and may have a greater (more positive) TS7 value (i.e., less soft) than a dominant soft sanitary tissue product (e.g., a second sanitary tissue product).

Common Intensive Property Differences of Sanitary Tissue Products in Arrays

Two Package Array

In an array comprising at least first and second sanitary tissue products, the first sanitary tissue product may have a first TS7, a first VFS, a first lint, a first basis weight, and a first TDT (collectively, first common intensive properties) and the second sanitary tissue product may have a second TS7, a second VFS, a second lint, a second basis weight, and a second TDT (collectively, second common intensive properties). The second sanitary tissue product package may convey the second sanitary tissue product as a dominant sustainable sanitary tissue product, relative to the first sanitary tissue product. The second sanitary tissue product package may also convey that the second sanitary tissue product is soft, strong, and/or absorbent; and the first sanitary tissue product package may convey that the first sanitary tissue product is soft, strong, absorbent, and/or sustainable (but if the first package does convey sustainability, such conveyance will be lesser than the conveyance of sustainability by the second package). In certain aspects of the present disclosure, one or more of the first and second common intensive properties may differ, but not by too much, as it may be desirable that the user accepts that the first and second sanitary tissue products are deserving of being co-branded. In this way, the user trusts the branding because important characteristics associated with the brand are maintained, such as softness and strength for bath and facial tissues and also for napkins, absorbency and strength for paper towels. More particularly, one, two, three, four, five, or each of the first common intensive properties may be different from the second common intensive properties (e.g., at least 5%, 10%, 15%, 20%, including all 1% increments, different), but within 25% of each other. More particularly, the first and second TS7 values may be different (e.g., at least 5%, 10%, 15%, 20%, including all 1% increments), but within 25%, 20%, 15%, 10%, or within 5%, including all 1% increments of each other. The first and second VFS values may be different (e.g., at least 5%, 10%, 15%, 20%, including all 1% increments), but within 25%, 20%, 15%, 10%, or within 5%, including all 1% increments of each other. The first and second lint values may be different (e.g., at least 5%, 10%, 15%, 20%, including all 1% increments), but within 25%, 20%, 15%, 10%, or within 5%, including all 1% increments of each other. The first and second basis weight values may be different (e.g., at least 5%, 10%, 15%, 20%, including all 1% increments), but within 25%, 20%, 15%, 10%, or within 5%, including all 1% increments of each other. The first and second TDT values may be different (e.g., at least 5%, 10%, 15%, 20%, including all 1% increments), but within 25%, 20%, 15%, 10%, or within 5%, including all 1% increments of each other.

A particular, non-limiting, example within the scope of this at least two product array is a first sanitary tissue product package that conveys the first sanitary tissue product as a dominant strong and/or soft sanitary tissue product, relative to the second sanitary tissue product; a second sanitary tissue product package conveying the second sanitary tissue products as dominant sustainable sanitary tissue products, relative to the first sanitary tissue product; such that a purchaser evaluating the array would conclude that the first sanitary tissue product package is a traditional strong and/or soft product, that the second sanitary tissue product package is a sustainable product. The first and second sanitary tissue products may be the same tier of product.

Three Package Array

In an array comprising at least first, second, and third sanitary tissue products, the first sanitary tissue product may have a first TS7, a first VFS, a first lint, a first basis weight, and a first TDT (collectively, first common intensive properties), the second sanitary tissue product may have a second TS7, a second VFS, a second lint, a second basis weight, and a second TDT (collectively, second common intensive properties), and the third sanitary tissue product may have a third TS7, a third VFS, a third lint, a third basis weight, and a third TDT (collectively, third common intensive properties). The third sanitary tissue product package may convey the third sanitary tissue product as a dominant sustainable sanitary tissue product, relative to the first and second sanitary tissue products. The third sanitary tissue product package may also convey that the third sanitary tissue product is soft, strong, and/or absorbent; and the first and second sanitary tissue product packages may convey that the first and second sanitary tissue products are soft, strong, absorbent, and/or sustainable (but if the first and/or second packages do convey sustainability, such conveyance will be lesser than the conveyance of sustainability by the third package).

In certain aspects of the present disclosure, one or more of the first, second, and third common intensive properties may differ, but not by too much, as it may be desirable that the user accepts that the first, second and third sanitary tissue products are deserving of being co-branded. In this way, the user trusts the branding because important characteristics associated with the brand are maintained, such as softness and strength for bath and facial tissues and also for napkins, absorbency and strength for paper towels.

More particularly, one, two, three, four, five, or each of the first, second, and third common intensive properties may be different from each other (e.g., at least 5%, 10%, 15%, 20%, including all 1% increments, different), but within 25% of each other. More particularly, the third TS7 may be different (e.g., at least 5%, 10%, 15%, 20%, including all 1% increments) from the first and/or second TS7 values, but within 25%, 20%, 15%, 10%, or within 5%, including all 1% increments of each the first and/or second TS7 values. The third VFS may be different (e.g., at least 5%, 10%, 15%, 20%, including all 1% increments) from the first and/or second VFS values, but within 25%, 20%, 15%, 10%, or within 5%, including all 1% increments of each the first and/or second VFS values. The third lint may be different (e.g., at least 5%, 10%, 15%, 20%, including all 1% increments) from the first and/or second lint values, but within 25%, 20%, 15%, 10%, or within 5%, including all 1% increments of each the first and/or second lint values. The third basis weight may be different (e.g., at least 5%, 10%, 15%, 20%, including all 1% increments) from the first and/or second basis weight values, but within 25%, 20%, 15%, 10%, or within 5%, including all 1% increments of each the first and/or second basis weight values. The third TDT may be different (e.g., at least 5%, 10%, 15%, 20%, including all 1% increments) from the first and/or second TDT values, but within 25%, 20%, 15%, 10%, or within 5%, including all 1% increments of each the first and/or second TDT values.

A particular, non-limiting, example within the scope of this at least three product array is a first sanitary tissue product package that conveys the first sanitary tissue product as a dominant strong sanitary tissue product, relative to the second and third sanitary tissue products; a second sanitary tissue product package that conveys the second sanitary tissue product as a dominant soft sanitary tissue product, relative to the first and third sanitary tissue products; a third sanitary tissue product package conveying the third sanitary tissue products as dominant sustainable sanitary tissue products, relative to the first and second sanitary tissue products; such that a purchaser evaluating the array would conclude that the first sanitary tissue product package is a traditional strong product, that the second sanitary tissue product package is a traditional soft product, and that the third sanitary tissue product package is a sustainable product. The first, second, and third sanitary tissue products may be in the same tier of product.

Four Package Array

In an array comprising at least first, second, third, and fourth sanitary tissue products, the first sanitary tissue product may have a first TS7, a first VFS, a first lint, a first basis weight, and a first TDT (collectively, first common intensive properties), the second sanitary tissue product may have a second TS7, a second VFS, a second lint, a second basis weight, and a second TDT (collectively, second common intensive properties), the third sanitary tissue product may have a third TS7, a third VFS, a third lint, a third basis weight, and a third TDT (collectively, third common intensive properties), and the fourth sanitary tissue product may have a fourth TS7, a fourth VFS, a fourth lint, a fourth basis weight, and a fourth TDT (collectively, fourth common intensive properties). The third and/or fourth sanitary tissue product packages may convey the third and/or fourth sanitary tissue products, respectively, as dominant sustainable sanitary tissue product, relative to the first and/or second sanitary tissue products. The third and/or fourth sanitary tissue product packages may convey sustainability in the same manner, such that the third and/or fourth sanitary tissue product packages do not convey dominant sustainable sanitary tissue products relative to each other. The third and/or fourth sanitary tissue product packages may also convey that the third and/or fourth sanitary tissue products are soft, strong, and/or absorbent; and the first and/or second sanitary tissue product package may convey that the first and/or second sanitary tissue products are soft, strong, absorbent, and/or sustainable (but if the first and/or second packages do convey sustainability, such conveyance will be lesser than the conveyance of sustainability by the third and/or fourth packages).

In certain aspects of the present disclosure, one or more of the first and third common intensive properties may differ, but not by too much, as it may be desirable that the user accepts that the first and third sanitary tissue products are deserving of being co-branded. In this way, the user trusts the branding because important characteristics associated with the brand are maintained, such as softness and strength for bath and facial tissues and also for napkins, absorbency and strength for paper towels. More particularly, one, two, three, four, five, or each of the first common intensive properties may be different from the third common intensive properties (e.g., at least 5%, 10%, 15%, 20%, including all 1% increments, different), but within 25% of each other. More particularly, the first and third TS7 values may be different (e.g., at least 5%, 10%, 15%, 20%, including all 1% increments), but within 25%, 20%, 15%, 10%, or within 5%, including all 1% increments of each other. The first and third VFS values may be different (e.g., at least 5%, 10%, 15%, 20%, including all 1% increments), but within 25%, 20%, 15%, 10%, or within 5%, including all 1% increments of each other. The first and third lint values may be different (e.g., at least 5%, 10%, 15%, 20%, including all 1% increments), but within 25%, 20%, 15%, 10%, or within 5%, including all 1% increments of each other. The first and third basis weight values may be different (e.g., at least 5%, 10%, 15%, 20%, including all 1% increments), but within 25%, 20%, 15%, 10%, or within 5%, including all 1% increments of each other. The first and third TDT values may be different (e.g., at least 5%, 10%, 15%, 20%, including all 1% increments), but within 25%, 20%, 15%, 10%, or within 5%, including all 1% increments of each other.

Further, in certain aspects of the present disclosure, one or more of the second and fourth common intensive properties may differ, but not by too much, as it may be desirable that the user accepts that the second and fourth sanitary tissue products are deserving of being co-branded. In this way, the user trusts the branding because important characteristics associated with the brand are maintained, such as softness and strength for bath and facial tissues and also for napkins, absorbency and strength for paper towels. More particularly, one, two, three, four, five, or each of the second common intensive properties may be different from the fourth common intensive properties (e.g., at least 5%, 10%, 15%, 20%, including all 1% increments, different), but within 25% of each other. More particularly, the second and fourth TS7 values may be different (e.g., at least 5%, 10%, 15%, 20%, including all 1% increments), but within 25%, 20%, 15%, 10%, or within 5%, including all 1% increments of each other. The second and fourth VFS values may be different (e.g., at least 5%, 10%, 15%, 20%, including all 1% increments), but within 25%, 20%, 15%, 10%, or within 5%, including all 1% increments of each other. The second and fourth lint values may be different (e.g., at least 5%, 10%, 15%, 20%, including all 1% increments), but within 25%, 20%, 15%, 10%, or within 5%, including all 1% increments of each other. The second and fourth basis weight values may be different (e.g., at least 5%, 10%, 15%, 20%, including all 1% increments), but within 25%, 20%, 15%, 10%, or within 5%, including all 1% increments of each other. The second and fourth TDT values may be different (e.g., at least 5%, 10%, 15%, 20%, including all 1% increments), but within 25%, 20%, 15%, 10%, or within 5%, including all 1% increments of each other.

A particular, non-limiting, example within the scope of this at least four product array is a first sanitary tissue product package that conveys the first sanitary tissue product as a dominant strong sanitary tissue product, relative to the second and fourth sanitary tissue products; a second sanitary tissue product package that conveys the second sanitary tissue product as a dominant soft sanitary tissue product, relative to the first and third sanitary tissue products; third and fourth sanitary tissue product packages conveying the third and fourth sanitary tissue products as dominant sustainable sanitary tissue products, relative to the first and second sanitary tissue products; such that a purchaser evaluating the array would conclude that the first sanitary tissue product package is a traditional strong product, that the third sanitary tissue product package is a sustainable strong product, that the second sanitary tissue product package is a traditional soft product, and that the fourth sanitary tissue product package is a sustainable soft product. The first and second sanitary tissue products may be the highest tier and the third and fourth sanitary tissue products may also be the highest tier, or may be a lesser tier relative to the first and second sanitary tissue products.

Six Package Array

In an array comprising at least first, second, third, fourth, fifth, and sixth sanitary tissue products, the first sanitary tissue product may have a first TS7, a first VFS, a first lint, a first basis weight, and a first TDT (collectively, first common intensive properties), the second sanitary tissue product may have a second TS7, a second VFS, a second lint, a second basis weight, and a second TDT (collectively, second common intensive properties), the third sanitary tissue product may have a third TS7, a third VFS, a third lint, a third basis weight, and a third TDT (collectively, third common intensive properties), and the fourth sanitary tissue product may have a fourth TS7, a fourth VFS, a fourth lint, a fourth basis weight, and a fourth TDT (collectively, fourth common intensive properties), the fifth sanitary tissue product may have a fifth TS7, a fifth VFS, a fifth lint, a fifth basis weight, and a fifth TDT (collectively, fifth common intensive properties), the sixth sanitary tissue product may have a sixth TS7, a sixth VFS, a sixth lint, a sixth basis weight, and a sixth TDT (collectively, sixth common intensive properties).

The third and/or sixth sanitary tissue product packages may convey the third and/or sixth sanitary tissue products, respectively, as dominant sustainable sanitary tissue product, relative to the first, second, fourth, and/or fifth sanitary tissue products. The third and/or sixth sanitary tissue product packages may convey sustainability in the same manner, such that the third and/or sixth sanitary tissue product packages do not convey dominant sustainable sanitary tissue products relative to each other. The third and/or sixth sanitary tissue product packages may also convey that the third and/or sixth sanitary tissue products are soft, strong, and/or absorbent; and the first, second, fourth, and/or fifth sanitary tissue product package may convey that the first, second, fourth, and/or fifth sanitary tissue products are soft, strong, absorbent, and/or sustainable (but if the first, second, fourth, and/or fifth packages do convey sustainability, such conveyance will be lesser than the conveyance of sustainability by the third and/or sixth packages).

In certain aspects of the present disclosure, one or more of the first, second, third, fourth, fifth, and sixth common intensive properties may differ, but not by too much, as it may be desirable that the user accepts that the first, second, third, fourth, fifth, and sixth sanitary tissue products are deserving of being co-branded. In this way, the user trusts the branding because important characteristics associated with the brand are maintained, such as softness and strength for bath and facial tissues and also for napkins, absorbency and strength for paper towels.

More particularly, one, two, three, four, five, or each of the first, second, and third common intensive properties may be different from each other (e.g., at least 5%, 10%, 15%, 20%, including all 1% increments, different), but within 25% of each other.

More particularly, the third TS7 may be different (e.g., at least 5%, 10%, 15%, 20%, including all 1% increments) from the first and/or second TS7 values, but within 25%, 20%, 15%, 10%, or within 5%, including all 1% increments of each the first and/or second TS7 values. The third VFS may be different (e.g., at least 5%, 10%, 15%, 20%, including all 1% increments) from the first and/or second VFS values, but within 25%, 20%, 15%, 10%, or within 5%, including all 1% increments of each the first and/or second VFS values. The third lint may be different (e.g., at least 5%, 10%, 15%, 20%, including all 1% increments) from the first and/or second lint values, but within 25%, 20%, 15%, 10%, or within 5%, including all 1% increments of each the first and/or second lint values. The third basis weight may be different (e.g., at least 5%, 10%, 15%, 20%, including all 1% increments) from the first and/or second basis weight values, but within 25%, 20%, 15%, 10%, or within 5%, including all 1% increments of each the first and/or second basis weight values. The third TDT may be different (e.g., at least 5%, 10%, 15%, 20%, including all 1% increments) from the first and/or second TDT values, but within 25%, 20%, 15%, 10%, or within 5%, including all 1% increments of each the first and/or second TDT values.

Further, the sixth TS7 may be different (e.g., at least 5%, 10%, 15%, 20%, including all 1% increments) from the fourth and/or fifth TS7 values, but within 25%, 20%, 15%, 10%, or within 5%, including all 1% increments of each the fourth and/or fifth TS7 values. The sixth VFS may be different (e.g., at least 5%, 10%, 15%, 20%, including all 1% increments) from the fourth and/or fifth VFS values, but within 25%, 20%, 15%, 10%, or within 5%, including all 1% increments of each the fourth and/or fifth VFS values. The sixth lint may be different (e.g., at least 5%, 10%, 15%, 20%, including all 1% increments) from the fourth and/or fifth lint values, but within 25%, 20%, 15%, 10%, or within 5%, including all 1% increments of each the fourth and/or fifth lint values. The sixth basis weight may be different (e.g., at least 5%, 10%, 15%, 20%, including all 1% increments) from the fourth and/or fifth basis weight values, but within 25%, 20%, 15%, 10%, or within 5%, including all 1% increments of each the fourth and/or fifth basis weight values. The sixth TDT may be different (e.g., at least 5%, 10%, 15%, 20%, including all 1% increments) from the fourth and/or fifth TDT values, but within 25%, 20%, 15%, 10%, or within 5%, including all 1% increments of each the fourth and/or fifth TDT values.

A particular, non-limiting, example within the scope of this at least six product array is first and fourth sanitary tissue product packages that convey the first and fourth sanitary tissue products as dominant strong sanitary tissue products, relative to the second, third, fifth, and sixth sanitary tissue products; second and fifth sanitary tissue product packages that convey the second and fifth sanitary tissue products as dominant soft sanitary tissue products, relative to the first, third, fourth, and sixth sanitary tissue products; third and sixth sanitary tissue product package conveying the third and sixth sanitary tissue products as dominant sustainable sanitary tissue products, relative to the first, second, fourth, and fifth sanitary tissue products; such that a purchaser evaluating the array would conclude that the first and fourth sanitary tissue product packages are traditional strong products, that the second and fifth sanitary tissue product packages are traditional soft products, and that the third and sixth sanitary tissue product packages are sustainable products. The first, second, and third sanitary tissue products may be in a higher tier and the fourth, fifth, and sixth sanitary tissue products may be in a lesser tier relative to the first, second and third sanitary tissue products.

In each of the at least 2, 3, 4, and 6 product arrays as disclosed in this Common Intensive Properties Differences of Sanitary Tissue Products in Arrays Section, the TS7 of the dominant soft sanitary tissue product may be the least positive value relative to the other products in the array, or at least no other product in the array may have a less positive TS7 value than the dominant soft sanitary tissue product (except that in arrays where there are two dominant soft sanitary tissue products, one of the dominant soft sanitary tissue products may have a less positive TS7 than the other).

In each of the at least 2, 3, 4, and 6 product arrays as disclosed in this Common Intensive Properties Differences of Sanitary Tissue Products in Arrays Section, the lint of the dominant soft sanitary tissue product may be the most positive value relative to the other products in the array, or at least no other product in the array may have a more positive lint value than the dominant soft sanitary tissue product.

In each of the at least 2, 3, 4, and 6 product arrays as disclosed in this Common Intensive Properties Differences of Sanitary Tissue Products in Arrays Section, the most positive TDT of the dominant strong sanitary tissue product may be the most positive value relative to the other products in the array, or at least no other product in the array may have a more positive TDT value than the dominant strong sanitary tissue product.

In each of the at least 2, 3, 4, and 6 product arrays as disclosed in this Common Intensive Properties Differences of Sanitary Tissue Products in Arrays Section, the least positive tensile ratio of the dominant sustainable sanitary tissue product may be the least positive value relative to the other products in the array, or at least no other product in the array may have a lesser tensile ratio value than the dominant sustainable sanitary tissue product.

In each of the at least 2, 3, 4, and 6 product arrays as disclosed in this Common Intensive Properties Differences of Sanitary Tissue Products in Arrays Section, percent inclusion of the non-wood content of the dominant sustainable sanitary tissue product may be the most positive value relative to the other products in the array, or at least no other product in the array may have a more positive non-wood content than the dominant sustainable sanitary tissue product.

In each of the at least 2, 3, 4, and 6 product arrays as disclosed in this Common Intensive Properties Differences of Sanitary Tissue Products in Arrays Section, the compressive slope of the dominant soft sanitary tissue product may be the most positive value relative to the other products in the array, or at least no other product in the array may have a more positive compressive slope value than the dominant soft sanitary tissue product.

In each of the at least 2, 3, 4, and 6 product arrays as disclosed in this Common Intensive Properties Differences of Sanitary Tissue Products in Arrays Section, the formation index of the dominant soft sanitary tissue product may be the most positive value relative to the other products in the array, or at least no other product in the array may have a more positive formation index value than the dominant soft sanitary tissue product.

Array Examples of the Present Disclosure

Each of the tables illustrated in FIGS. 22A-I include an array of sanitary tissue products within the scope of the present disclosure. Each package comprises a sanitary tissue product having the properties listed. The "brand" and what the package "connotes" is visible on the package. "Sustainable % difference from listed product" means that the sanitary tissue product in that row has the listed % difference from the sanitary tissue product housed in the package that connotes "sustainable." Each sanitary tissue product housed within the package that connotes "sustainable" comprises a non-wood. The higher the tier (1 being the highest), the more premium the package of sanitary tissue product(s).

Aspects of the Present Disclosure

Each of the Aspects of the Invention of U.S. Pub. No. 2023/0406608, including the Aspects of paragraphs [0359] through [0508], are incorporated herein by reference.

Beyond the "Aspects Of The Present Disclosure" disclosed above, the "Aspects Of The Present Disclosure," including Aspects 1-16, disclosed in U.S. Provisional Patent Application Ser. No. 63/472,379, titled "Sanitary Tissue Products and Arrays Comprising Non-wood Fibers," filed on Jun. 12, 2023, Schwerdtfeger as the first-named inventor, are within the scope of the present disclosure and are incorporated, in their entirety, herein by reference.

Test Methods of the Present Disclosure

Unless otherwise specified, all tests described herein including those described under the Definitions section and the following test methods are conducted on samples that have been conditioned in a conditioned room at a temperature of 23° C.±1.0° C. and a relative humidity of 50%±2% for a minimum of 2 hours prior to the test. The samples tested are "usable units." "Usable units" as used herein means sheets, flats from roll stock, pre-converted flats, and/or single or multi-ply products. All tests are conducted in such conditioned room. Do not test samples that have defects such as wrinkles, tears, holes, and like. All instruments are calibrated according to manufacturer's specifications.

Coverage and Fiber Count-Area Test Method:

Coverage and Fiber Count are calculated using measurements acquired by analyzing fibers obtained from fibrous structures, such as sanitary tissue products, with a Fiber Quality Analyzer (FQA), available from OpTest Equipment Inc., Ontario, Canada. Prior to analysis in the FQA fibers from a finished product specimen must be dispersed and diluted to get an accurate measurement of the oven dry fiber mass in an aliquot of very dilute fiber and distilled water, which is utilized during the FQA analysis to determine specimen coarseness and fiber width. The resultant FQA values, in conjunction with basis weight, are then used to calculate fiber coverage and fiber count in a specimen.

Sample Preparation

Allow the fibrous structure finished product to be tested to equilibrate in a temperature-controlled room at a temperature of 73° F.±2° F. (23° C.±1° C.) and a relative humidity of 50%±2% for at least 24 hours. Further prepare the finished product for testing by removing and discarding any product which might have been abraded in handling, e.g., on the outside of the roll.

Determine the percent oven dry solids of the equilibrated test product. This is done on a moisture balance using least a 0.5 gram specimen from a selected usable unit of the test product. An exemplary balance is the Ohaus MB45 balance set to a drying temperature of 130° C., with moisture determined after the weight changes less than 1 mg in 60 seconds (A60 hold time).

Using another usable unit from the same equilibrated finished product, gently pull approximately 0.03 grams of fiber specimen from the center. The specimen should be equally pulled from all plies and layers of the substrate. Place the collected fibers into a 27 mm diameter, 70 mm tall clear glass vial, or similar. Record the net weight of collected fibers to the nearest 0.001 gram as $M_0$. The intent of this step is to get an even sampling across all plies and layers in the usable unit, pulled from the center of the usable unit so that no cutting of fibers at the end of the sheet or perforations is included.

The oven dry weight of the fiber specimen ($M_1$) is then calculated by multiplying the fiber specimen weight ($M_0$) by the previously determined percent oven dry solids.

$$M_1 = M_0 \times \%\text{ oven dry solids}$$

To fully disperse the fiber specimen, begin by pouring DI or distilled water into the vial until approximately ½ full, adding about ten 5 mm diameter glass beads, and then closing the vial with a cap. Next, allow the specimen to sit for at least two hours with occasional shaking. Lastly, stir the vial with a Fisher Scientific vortex genie, or similar, until fiber clusters are dispersed, and the fibers appear fully individualized.

To quantitatively dilute the dispersed fiber sample, begin by transferring the entire vial contents into a 5 L plastic beaker that has been weighed to the nearest 0.1 g. To accomplish this, slowly pour the contents of vial through a #6 US Standard Sieve (3.35 mm), trying to keep the glass beads in the vial as long as possible. Then rinse the vial and cap at least three times with DI or distilled water and continue to pour the liquid slowly through the #6 sieve. Once the vial has been at least triple rinsed, pour the glass beads into the sieve and wash thoroughly with a DI water squeeze bottle, being sure to collect all water used to rinse the beads.

Continue with the dilution procedure by filling the 5 L plastic beaker to approximately the 1.75 L mark with DI or distilled water. Weigh the beaker and record the net weight of the contents to the nearest 0.1 g as $M_{2.1}$. Using a second clean 5 L beaker, transfer the 1.75 L of solution back and forth at least 3 times from beaker to beaker to ensure that the suspension is homogenously mixed. Next, transfer approximately 150 g of the solution into a third clean 5 L beaker that has been weighed to the nearest 0.1 g. Weigh the beaker and record the net weight of the contents to the nearest 0.1 g as $M_{2.2}$. Then add approximately 1600 g of DI or distilled water to the third 5 L beaker. Weigh the beaker and record the net weight of the contents to the nearest 0.1 g as $M_{2.3}$. With a fourth clean 5 L beaker, transfer the approximately 1.75 L of solution back and forth at least 3 times from beaker to beaker to ensure that the suspension is homogenously mixed. Lastly, immediately after mixing, pour a 500 mL aliquot of the diluted fiber solution into a 600 mL plastic beaker that has been weighed to the nearest 0.1 g. Weigh the beaker and record the net weight of the contents to the nearest 0.1 g as $M_3$.

Upon completion of the dilution procedure, calculate the oven dry weight of fibers present in the testing beaker ($M_4$) according to the following equation:

$$M_4 = M_1 \times \left(\frac{M_{2.2}}{M_{2.1}}\right) \times \left(\frac{M_3}{M_{2.3}}\right)$$

Measurement of Samples

Set up, calibrate, and operate the Fiber Quality Analyzer (FQA) instrument according to the manufacturer's instructions. Place the beaker containing the diluted fiber suspension on carrousel of the FQA, select the "Optest default" for coarseness method, and when prompted, enter $M_4$ (the oven dry weight of fibers present in the testing beaker) in the cell for "sample mass" to determine coarseness.

Calculations

Once the analysis has been performed, open the report file and record each of the following measurements: Arithmetic Mean Width, Coarseness, Arithmetic Mean Length, and Length Weighted Mean Length.

Calculate Coverage, which has the units of fiber layers, using the following equation:

$$\text{Coverage} = \frac{\text{Basis Weight of product tested}}{\dfrac{\text{Coarseness}}{\text{Arithmetic mean width}}}$$

Where basis weight has units of grams/m$^2$, Coarseness has units of mg/m, and Arithmetic Mean Width has the units of mm.

Calculate Fiber Count-Area, which has the units of millions fibers/m$^2$, using one of these two equations:

$$\text{Fiber Count-Area}(C(n)) = \frac{\text{Basis Weight of product tested}}{\text{Coarseness} \times \text{Arithmetic Mean Length}}$$

Where basis weight has the units of g/m$^2$, Coarseness has the units of mg/m, and Arithmetic Mean Length has the units of mm.

$$\text{Fiber Count-Area}(C(l)) = \frac{\text{Basis Weight of product tested}}{\text{Coarseness} \times \text{Length Weighted Mean Length}}$$

Where basis weight has the units of g/m$^2$, Coarseness has the units of mg/m, and Length Weighted Mean Length has the units of mm.

Pore Volume Distribution Test Method:

The Pore Volume Distribution (PVD) Test Method is used to determine the average amount of fluid (mg) retained by a specimen within an effective pore radius range of 2.5 to 160 microns. This method makes use of stepped, controlled differential pressure and measurement of associated fluid movement into and out of a porous specimen, where the radius of a pore is related to the differential pressure required to fill or empty the pore. The fluid retained (mg) by each specimen during its first absorption cycle of decreasing differential pressures is measured, this is followed by measurement of fluid retained (mg) by the specimen during its first drainage or desorption cycle of increasing differential pressures. The sum of fluid retained (mg) by the specimen within the effective pore radius range of 2.5 to 160 microns for the absorption and desorption cycles, as well as a calculated hysteresis (difference of fluid retained during the absorption and desorption cycles) in the effective pore radius range of 2.5 to 100 microns are reported.

Method Principle

For uniform cylindrical pores, the radius of a pore is related to the differential pressure required to fill or empty the pore by the equation $$\text{Differential pressure} = (2\gamma \cos \Theta)/r,$$

where $\gamma$=liquid surface tension, $\Theta$=contact angle, and r=effective pore radius.

Pores contained in natural and manufactured porous materials are often thought of in terms such as voids, holes or conduits, and these pores are generally not perfectly cylindrical nor all uniform. One can nonetheless use the above equation to relate differential pressure to an effective pore radius, and by monitoring liquid movement into or out of the material as a function of differential pressure characterize the effective pore radius distribution in a porous material. (Because nonuniform pores are approximated as uniform by the use of an effective pore radius, this general methodology may not produce results precisely in agreement with measurements of void dimensions obtained by other methods such as microscopy.)

The Pore Volume Distribution Test Method uses the above principle and is reduced to practice using the apparatus and approach described in "Liquid Porosimetry: New Methodology and Applications" by B. Miller and I. Tyomkin published in The Journal of Colloid and Interface Science (1994), volume 162, pages 163-170, incorporated herein by reference. This method relies on measuring the increment of liquid volume that enters or leaves a porous material as the differential air pressure is changed between ambient ("lab") air pressure and a slightly elevated air pressure (positive differential pressure) surrounding the specimen in a sample test chamber. The specimen is introduced to the sample chamber dry, and the sample chamber is controlled at a positive differential pressure (relative to the lab) sufficient to prevent fluid uptake into the specimen after the fluid bridge is opened. After opening the fluid bridge, the differential air pressure is decreased in steps to 0, and in this process subpopulations of pores acquire liquid according to their effective pore radius. After reaching a minimal differential pressure at which the mass of fluid within the specimen is at a maximum, differential pressure is increased stepwise again toward the starting pressure, and the liquid is drained from the specimen. It is during this latter draining sequence (from minimal differential pressure, or largest corresponding effective pore radius, to the largest differential pressure, or smallest corresponding effective pore radius), that the fluid retention by the sample (mg) at each differential pressure is determined in this method. After correcting for any fluid movement for each particular pressure step measured on the chamber while empty, the fluid retention by the sample (mg) for each pressure step is determined. The fluid retained may be normalized by dividing the equilibrium quantity of retained liquid (mg) associated with this particular step by the dry weight of the sample (mg).

Sample Conditioning and Specimen Preparation

The Pore Volume Distribution Test Method is conducted on samples that have been conditioned in a room at a temperature of 23° C.±2.0° C. and a relative humidity of 50%±5%, all tests are conducted under the same environmental conditions and in such conditioned room. Any damaged product or samples that have defects such as wrinkles, tears, holes, and similar are not tested. Samples conditioned as described herein are considered dry samples for purposes of this invention. A 5.5 cm square specimen to be tested is die cut from the conditioned product or sample. The dry specimen weight is measured and recorded.

Apparatus

Apparatus suitable for this method is described in: "Liquid Porosimetry: New Methodology and Applications" by B. Miller and I. Tyomkin published in The Journal of Colloid and Interface Science (1994), volume 162, pages 163-170. Further, any pressure control scheme capable of achieving the required pressures and controlling the sample chamber differential pressure may be used in place of the pressure-control subsystem described in this reference. One example of suitable overall instrumentation and software is the TRI/Autoporosimeter (Textile Research Institute (TRI)/Princeton Inc. of Princeton, N.J., U.S.A.). The TRI/Autoporosimeter is an automated computer-controlled instrument for measuring pore volume distributions in porous materials (e.g., the volumes of different size pores within the range from 1 to 1000 μm effective pore radii). Computer programs such as Automated Instrument Software Releases 2000.1 or 2003.1/2005.1 or 2006.2; or Data Treatment Software Release 2000.1 (available from TRI Princeton Inc.), and spreadsheet programs may be used to capture and analyse the measured data.

Method Procedure

The wetting liquid used is a degassed 0.2 weight % solution of octylphenoxy polyethoxy ethanol (Triton X-100 from Sigma-Aldrich) in distilled water. The instrument calculation constants are as follows: ρ(density)=1 g/cm$^3$; γ(surface tension)=31 dynes/cm; cos Θ=1. A 90-mm diameter mixed-cellulose-ester filter membrane with a characteristic pore size of 1.2 m (such Millipore Corporation of Bedford, MA, Catalogue #RAWP09025) is affixed to the porous frit (Monel plates with diameter of 90 mm, 6.4 mm thickness from Mott Corp., Farmington, CT, or equivalent) of the sample chamber. A plexiglass plate weighing about 34 g (supplied with the instrument) is placed on the sample to ensure the sample rests flat on the membrane/frit assembly. No additional weight is placed on the sample.

Someone skilled in the art knows that it is critical to degas the test fluid as well as the frit/membrane/tubing system such that the system is free from air bubbles.

The sequence of pore sizes (differential pressures) for this application is as follows (effective pore radius in μm): 2.5, 5, 10, 15, 20, 30, 40, 50, 60, 70, 80, 90, 100, 120, 140, 160, 180, 200, 225, 250, 275, 300, 350, 400, 500, 600, 800, 1000. This sequence is then replicated in reverse order. The criterion for moving from one pressure step to the next is that fluid uptake/drainage from the specimen is measured to be less than 10 mg/min for 10 s.

A separate "blank" measurement is performed by following this method procedure on an empty sample chamber with no specimen or weight present on the membrane/frit assembly. Any fluid movement observed is recorded (mg) at each of the pressure steps. Fluid retention data for a specimen are corrected for any fluid movement associated with the empty sample chamber by subtracting fluid retention values of this "blank" measurement from corresponding values in the measurement of the specimen.

Determination of Parameters

Data from the PVD instrument can be presented in a cumulative fashion, so that the cumulative mass absorbed is tabulated alongside the diameter of pore, which allow the following parameters to be calculated:

2.5-160 micron PVD Absorption (mg)=[mg at 160 micron absorbed]−[mg at 2.5 micron absorbed] from the advancing curve, 2.5-160 micron PVD Desorption (mg)=[mg at 160 micron desorbed]−[mg at 2.5 micron desorbed] from the receding curve, and 2.5-100 micron hysteresis (mg)=[mg at 100 micron desorbed−mg at 2.5 micron desorbed]−[mg at 100 micron absorbed−mg at 2.5 micron absorbed]

Horizontal Full Sheet (HFS) Test Method:

The Horizontal Full Sheet (HFS) test method determines the amount of distilled water absorbed and retained by a fibrous structure of the present invention. This method is performed by first weighing a sample of the fibrous structure to be tested (referred to herein as the "dry weight of the sample"), then thoroughly wetting the sample, draining the wetted sample in a horizontal position and then reweighing (referred to herein as "wet weight of the sample"). The absorptive capacity of the sample is then computed as the amount of water retained in units of grams of water absorbed by the sample. When evaluating different fibrous structure samples, the same size of fibrous structure is used for all samples tested.

The apparatus for determining the HFS capacity of fibrous structures comprises the following:

An electronic balance with a sensitivity of at least ±0.01 grams and a minimum capacity of 1200 grams. The balance should have a special balance pan to be able to handle the size of the sample tested (i.e.; a fibrous structure sample of about 27.9 cm by 27.9 cm).

Figure 14:
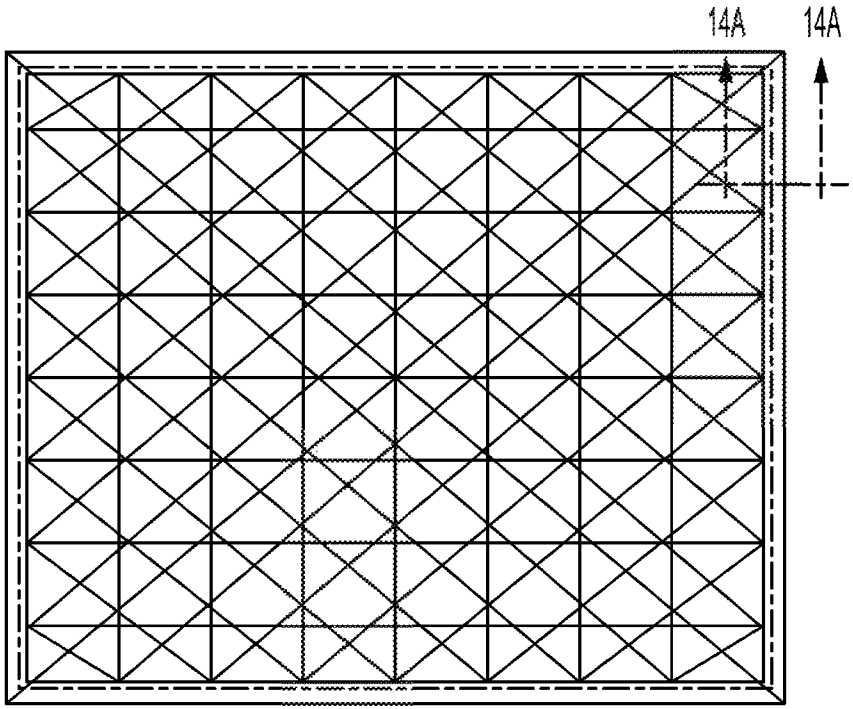
FIG. 14 is an example of a sample support rack used in the HFS and VFS Test Methods.

A sample support rack (FIGS. 14 and 14A) and sample support rack cover (FIGS. 15 and 15A) is also required. Both the support rack (FIGS. 14 and 14A) and support rack cover (FIGS. 15 and 15A) are comprised of a lightweight metal frame, strung with 0.305 cm diameter monofilament so as to form a grid as shown in FIG. 14. The size of the support rack (FIGS. 14 and 14A) and support rack cover (FIGS. 15 and 15A) is such that the sample size can be conveniently placed between the two.

The HFS test is performed in an environment maintained at 23±1° C. and 50±2% relative humidity. A water reservoir or tub is filled with distilled water at 23±1° C. to a depth of 3 inches (7.6 cm).

Figure 14A:
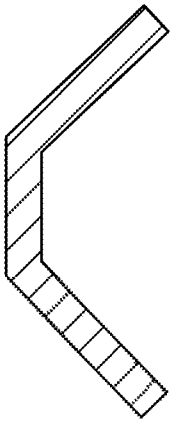
FIG. 14A is a cross-sectional view of the sample support rack of FIG. 14.

Samples are tested in duplicate. The dry weight of each sample is reported to the nearest 0.01 grams. The empty sample support rack (FIGS. 14 and 14A) is placed on the balance with the special balance pan described above. The balance is then zeroed (tared). One sample is carefully placed on the sample support rack (FIGS. 14 and 14A), "face up" or with the outside of the sample facing up, away from the sample support rack (FIGS. 14 and 14A). The support rack cover (FIGS. 15 and 15A) is placed on top of the support rack (FIGS. 14 and 14A). The sample (now sandwiched between the rack and cover) is submerged in the water reservoir. After the sample is submerged for 30±3 seconds, the sample support rack (FIGS. 14 and 14A) and support rack cover (FIGS. 15 and 15A) are gently raised out of the reservoir.

Figure 15:
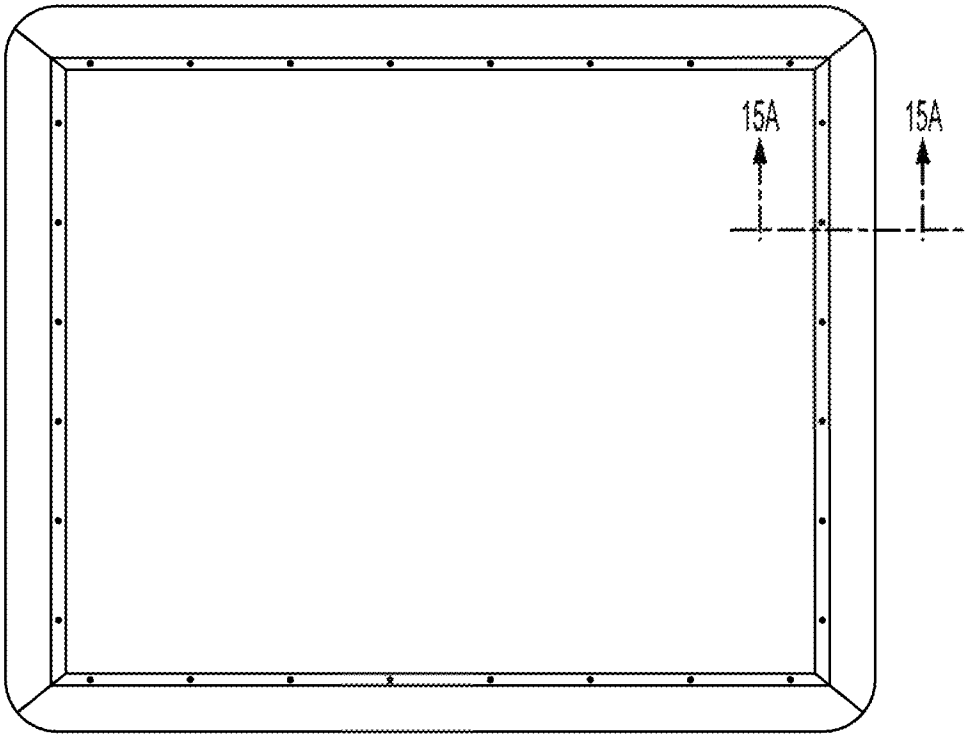
FIG. 15 is an example of a sample support rack cover used in the HFS and VFS Test Methods.
Figure 15A:
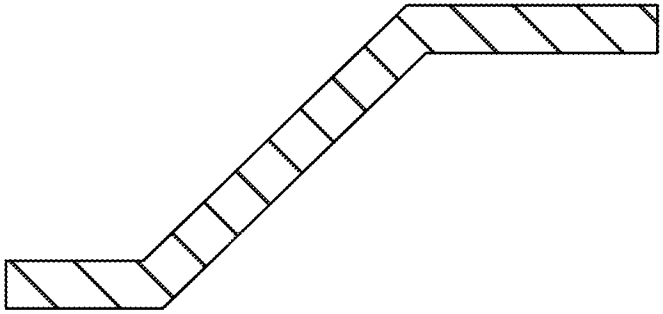
FIG. 15A is a cross-sectional view of the sample support rack cover of FIG. 15.

The sample, support rack (FIGS. 14 and 14A) and support rack cover (FIGS. 15 and 15A) are allowed to drain horizontally for 120±5 seconds, taking care not to excessively shake or vibrate the sample. While the sample is draining, the support rack cover (FIGS. 15 and 15A) is carefully removed and all excess water is wiped from the support rack (FIGS. 15 and 15A). The wet sample and the support rack (FIGS. 14 and 14A) are weighed on the previously tared balance. The weight is recorded to the nearest 0.01 g. This is the wet weight of the sample after horizontal drainage.

The HFS gram per gram fibrous structure sample absorptive capacity is defined as: absorbent capacity=(wet weight of the sample after horizontal drainage−dry weight of the sample)/(dry weight of the sample) and has a unit of gram/gram.

The HFS gram per sheet fibrous structure sample absorptive capacity is defined as (wet weight of the sample after horizontal drainage minus dry weight of the sample) and has a unit of gram/sheet.

Vertical Full Sheet (VFS) Test Method:

The Vertical Full Sheet (VFS) test method is similar to the HFS method described previously, and determines the amount of distilled water absorbed and retained by a fibrous structure when held at an angle of 75°.

After setting up the apparatus, preparing the sample, taking the initial weights, and submerging the sample, according to the HFS method, the support rack (FIGS. 14 and 14A) and sample are removed from the reservoir and inclined at an angle of 75° and allowed to drain for 60±5 seconds. Care should be taken so that the sample does not slide or move relative to the support rack (FIGS. 14 and 14A) If there is difficulty keeping the sample from sliding down the support rack (FIGS. 14 and 14A) sample can be held with the fingers.

At the end of this time frame (60±5 seconds), carefully bring the sample and support rack (FIGS. 14 and 14A) to the horizontal position and wipe the bottom edge of the sample support rack (FIGS. 14 and 14A) that water dripped onto during vertical drainage. Return the sample and support rack (FIGS. 14 and 14A) to the balance and take the weight to the nearest 0.01 g. This value represents the wet weight of the sample after vertical drainage.

The VFS gram per gram fibrous structure sample absorptive capacity is defined as the wet weight of the sample after vertical drainage minus the dry weight of the sample divided by the dry weight of the sample, and has a unit of gram/gram (g/g).

The VFS gram per sheet fibrous structure sample absorptive capacity is defined as the wet weight of the sample after vertical drainage minus the dry weight of the sample, and has a unit of gram/sheet.

The calculated VFS is the average of the absorptive capacities of the two samples of the fibrous structure.

Dry Bulk Ratio Method:

"Dry Bulk Ratio" may be calculated as follows: (Dry Compression×Flexural Rigidity (avg))/TDT.

Wet Bulk Ratio Method:

"Wet Bulk Ratio" may be calculated as follows: (Wet Compression×Geometric Mean Wet Modulus)/Total Wet Tensile.

Fiber Length, Width, Coarseness, and Fiber Count Test Method:

Fiber Length values are generated by running the test procedure as defined in U.S. Patent Application No. 2004-0163782 and informs the following procedure:

The length, width, and coarseness of the-fibers (which are averages of the plurality of fibers being analyzed in a sample), as well as the fiber count (number and/or length average), may be determined using a Valmet FS5 Fiber Image Analyzer commercially available from Valmet, Kajaani Finland (as the Kajaani Fiber Lab is less available) following the procedures outlined in the manual. If in-going or raw pulp is not accessible, samples may be taken from commercially available product (e.g., a roll of sanitary tissue product) to determine length, width, coarseness and fiber count (number and/or length average) using the FS5 by obtaining samples as outlined in the "Sample Preparation" section of the Coverage and Fiber Count Test Method in the Test Methods Section. As used herein, fiber length is defined as the "length weighted average fiber length". The instructions supplied with the unit detail the formula used to arrive at this average. The length can be reported in units of millimeters (mm) or in inches (in). As used herein, fiber width is defined as the "width weighted average fiber width" and can be reported in units of micrometers (μm) or in millimeters (mm). The instructions supplied with the unit detail the formula used to arrive at this average. The width can be reported in units of millimeters (mm) or in inches (in). The instructions supplied with the unit detail the formula used to arrive at this average. Fiber count (number and/or length average) can be reported in units of million fibers/g. As used herein, fiber length/width ratio is defined as the "length weighted average fiber length (mm)/width weighted average fiber width (mm)."

Fiber count (length average, million/g) is calculated from length weighted fiber average and coarseness via the following equation (where L(1) has the units of mm/fiber and coarseness has the units of mg/m): Fiber count=1/(L(1)×coarseness). And, fiber count (number average, million/g) is calculated from length weighted fiber average and coarseness via the following equation (where L(n) has the units of mm/fiber and coarseness has the units of mg/m): Fiber count=1/(L(n)×coarseness). (L(1)) means length weighted averaged and (L(n)) means number weighted averaged.

It should be understood that the values from different fiber image analyzers can differ significantly, even as much as 59%—see "Fiber Quality Analysis: OpTest Fiber Quality Analyzer versus L&W Fiber Tester," Bin Li, Rohan Bandekar, Quanqing Zha, Ahmed Alsaggaf, and Yonghao Ni, *Industrial & Engineering Chemistry Research* 2011 50 (22), 12572-12578, DOI: 10.1021/ie201631q, which compares values from the FQA fiber analyzer to the FT fiber analyzer, stating: "These new instruments, such as PQM (pulp quality monitor), Galai CIS-100, Fiberlab, MorFi, FiberMaster, FQA (fiber quality analyzer), and L&W Fiber Tester (FT), provide fast measurements with the capability of both laboratory and online analysis. However, the measurement differences among these instruments are expected due to the different designs of hardware and software."

Figure 7:
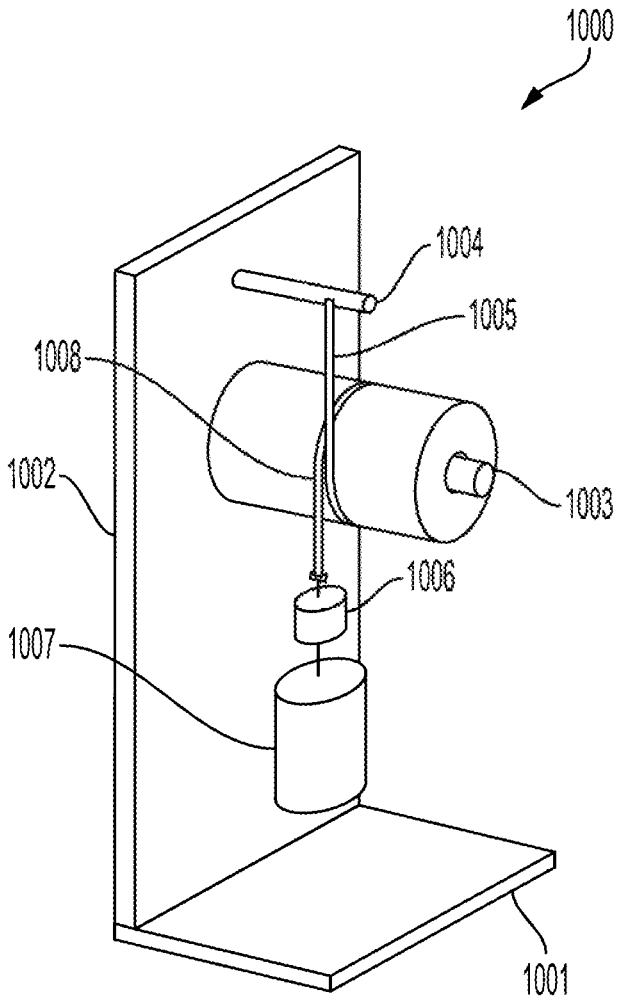
FIG. 7 is a perspective view of a test stand for measuring roll compressibility properties as detailed herein.

Percent Roll Compressibility Method:

Percent Roll Compressibility (Percent Compressibility) is determined using the Roll Diameter Tester 1000 as shown in FIG. 7. It is comprised of a support stand made of two aluminum plates, a base plate 1001 and a vertical plate 1002 mounted perpendicular to the base, a sample shaft 1003 to mount the test roll, and a bar 1004 used to suspend a precision diameter tape 1005 that wraps around the circumference of the test roll. Two different weights 1006 and 1007 are suspended from the diameter tape to apply a confining force during the uncompressed and compressed measurement. All testing is performed in a conditioned room maintained at about 23° C.±2 C.° and about 50%±2% relative humidity.

The diameter of the test roll is measured directly using a Pi® tape or equivalent precision diameter tape (e.g., an Executive Diameter tape available from Apex Tool Group, LLC, Apex, NC, Model No. W606PD) which converts the circumferential distance into a diameter measurement, so the roll diameter is directly read from the scale. The diameter tape is graduated to 0.01 inch increments with accuracy certified to 0.001 inch and traceable to NIST. The tape is 0.25 in wide and is made of flexible metal that conforms to the curvature of the test roll but is not elongated under the 1100 g loading used for this test. If necessary, the diameter tape is shortened from its original length to a length that allows both of the attached weights to hang freely during the test, yet is still long enough to wrap completely around the test roll being measured. The cut end of the tape is modified to allow for hanging of a weight (e.g., a loop). All weights used are calibrated, Class F hooked weights, traceable to NIST.

The aluminum support stand is approximately 600 mm tall and stable enough to support the test roll horizontally throughout the test. The sample shaft 1003 is a smooth aluminum cylinder that is mounted perpendicularly to the vertical plate 1002 approximately 485 mm from the base. The shaft has a diameter that is at least 90% of the inner diameter of the roll and longer than the width of the roll. A small steal bar 1004 approximately 6.3 mm diameter is mounted perpendicular to the vertical plate 1002 approximately 570 mm from the base and vertically aligned with the sample shaft. The diameter tape is suspended from a point along the length of the bar corresponding to the midpoint of a mounted test roll. The height of the tape is adjusted such that the zero mark is vertically aligned with the horizontal midline of the sample shaft when a test roll is not present.

Condition the samples at about 23° C.±2 C.° and about 50%±2% relative humidity for 2 hours prior to testing. Rolls with cores that are crushed, bent, or damaged should not be tested. Place the test roll on the sample shaft 1003 such that the direction the paper was rolled onto its core is the same direction the diameter tape will be wrapped around the test roll. Align the midpoint of the roll's width with the suspended diameter tape. Loosely loop the diameter tape 1004 around the circumference of the roll, placing the tape edges directly adjacent to each other with the surface of the tape lying flat against the test sample. Carefully, without applying any additional force, hang the 100 g weight 1006 from the free end of the tape, letting the weighted end hang freely without swinging. Wait 3 seconds. At the intersection of the diameter tape 1008, read the diameter aligned with the zero mark of the diameter tape and record as the Original Roll Diameter to the nearest 0.01 inches. With the diameter tape still in place, and without any undue delay, carefully hang the 1000 g weight 1007 from the bottom of the 100 g weight, for a total weight of 1100 g. Wait 3 seconds. Again read the roll diameter from the tape and record as the Compressed Roll Diameter to the nearest 0.01 inch. Calculate percent compressibility to the according to the following equation and record to the nearest 0.1%:

$$\%\ \text{Compressibility} = \frac{(\textit{Orginal}\ \text{Roll Diameter}) - (\text{Compressed Roll Diameter})}{\text{Original Roll Diameter}} \times 100$$

Repeat the testing on 10 replicate rolls and record the separate results to the nearest 0.1%. Average the 10 results and report as the Percent Compressibility to the nearest 0.1%.

Roll Firmness Method:

Roll Firmness is measured on a constant rate of extension tensile tester with computer interface (a suitable instrument is the MTS Alliance using Testworks 4.0 Software, as available from MTS Systems Corp., Eden Prairie, MN) using a load cell for which the forces measured are within 10% to 90% of the limit of the cell. The roll product is held horizontally, a cylindrical probe is pressed into the test roll, and the compressive force is measured versus the depth of penetration. All testing is performed in a conditioned room maintained at 23° C.±2 C.° and 50%±2% relative humidity.

Figure 8:
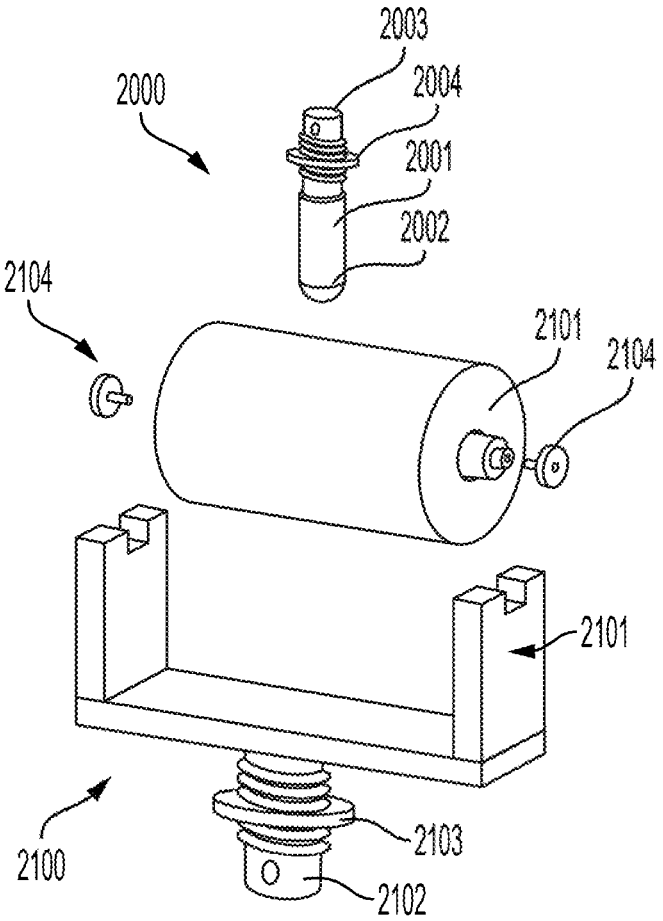
FIG. 8 is perspective view of the testing device used in the roll firmness measurement detailed herein.

Referring to FIG. 8, the upper movable fixture 2000 consist of a cylindrical probe 2001 made of machined aluminum with a 19.00±0.05 mm diameter and a length of 38 mm. The end of the cylindrical probe 2002 is hemispheric (radius of 9.50±0.05 mm) with the opposing end 2003 machined to fit the crosshead of the tensile tester. The fixture includes a locking collar 2004 to stabilize the probe and maintain alignment orthogonal to the lower fixture. The lower stationary fixture 2100 is an aluminum fork with vertical prongs 2101 that supports a smooth aluminum sample shaft 2101 in a horizontal position perpendicular to the probe. The lower fixture has a vertical post 2102 machined to fit its base of the tensile tester and also uses a locking collar 2103 to stabilize the fixture orthogonal to the upper fixture.

The sample shaft 2101 has a diameter that is 85% to 95% of the inner diameter of the roll and longer than the width of the roll. The ends of sample shaft are secured on the vertical prongs with a screw cap 2104 to prevent rotation of the shaft during testing. The height of the vertical prongs 2101 should be sufficient to assure that the test roll does not contact the horizontal base of the fork during testing. The horizontal distance between the prongs must exceed the length of the test roll.

Program the tensile tester to perform a compression test, collecting force and crosshead extension data at an acquisition rate of 100 Hz. Lower the crosshead at a rate of 10 mm/min until 5.00 g is detected at the load cell. Set the current crosshead position as the corrected gage length and zero the crosshead position. Begin data collection and lower the crosshead at a rate of 50 mm/min until the force reaches 10 N. Return the crosshead to the original gage length.

Remove all of the test rolls from their packaging and allow them to condition at about 23° C.±2 C.° and about 50%±2% relative humidity for 2 hours prior to testing. Rolls with cores that are crushed, bent, or damaged should not be tested. Insert sample shaft through the test roll's core and then mount the roll and shaft onto the lower stationary fixture. Secure the sample shaft to the vertical prongs then align the midpoint of the roll's width with the probe. Orient the test roll's tail seal so that it faces upward toward the probe. Rotate the roll 90 degrees toward the operator to align it for the initial compression.

Position the tip of the probe approximately 2 cm above the surface of the sample roll. Zero the crosshead position and load cell and start the tensile program. After the crosshead has returned to its starting position, rotate the roll toward the operator 120 degrees and in like fashion acquire a second measurement on the same sample roll.

From the resulting Force (N) verses Distance (mm) curves, read the penetration at 7.00 N as the Roll Firmness and record to the nearest 0.1 mm. In like fashion analyze a total of ten (10) replicate sample rolls. Calculate the arithmetic mean of the 20 values and report Roll Firmness to the nearest 0.1 mm.

Slip Stick Coefficient of Friction and Kinetic Coefficient of Friction Method:

The Kinetic Coefficient of Friction values (actual measurements) and Slip Stick Coefficient of Friction (based on standard deviation from the mean Kinetic Coefficient of Friction) are generated by running the test procedure as defined in U.S. Pat. No. 9,896,806.

Lint Value Test Method:

The amount of lint generated from a finished fibrous structure is determined with a Sutherland Rub Tester (available from Danilee Co., Medina, Ohio) and a color spectrophotometer (a suitable instrument is the HunterLab LabScan XE, as available from Hunter Associates Laboratory Inc., Reston, VA, or equivalent). such as the Hunter LabScan XE. The rub tester is a motor-driven instrument for moving a weighted felt test strip over a finished fibrous structure specimen (referred to throughout this method as the "web") along an arc path. The Hunter Color L value is measured on the felt test strip before and after the rub test. The difference between these two Hunter Color L values is then used to calculate a lint value. This lint method is designed to be used with white or substantially white fibrous structures and/or sanitary toilet tissue products. Therefore, if testing of a non-white tissue, such as blue-colored or peach-colored tissue is desired, the same formulation should be used to make a sample without the colored dye, pigment, etc., using bleached kraft pulps.

i. Sample Preparation

Prior to the lint rub testing, the samples to be tested should be conditioned according to Tappi Method T402OM-88. Here, samples are preconditioned for 24 hours at a relative humidity level of 10 to 35% and within a temperature range of 22° C. to 40° C. After this preconditioning step, samples should be conditioned for 24 hours at a relative humidity of 48 to 52% and within a temperature range of 22° C. to 24° C. This rub testing should also take place within the confines of the constant temperature and humidity room.

The web is first prepared by removing and discarding any product which might have been abraded in handling, e.g., on the outside of the roll. For products formed from multiple plies of webs, this test can be used to make a lint measurement on the multi-ply product, or, if the plies can be separated without damaging the specimen, a measurement can be taken on the individual plies making up the product. If a given sample differs from surface to surface, it is necessary to test both surfaces and average the values in order to arrive at a composite lint value. In some cases, products are made from multiple-plies of webs such that the facing-out surfaces are identical, in which case it is only necessary to test one surface. If both surfaces are to be tested, it is necessary to obtain six specimens for testing (Single surface testing only requires three specimens). Each specimen should measure approximately 9.5 by 4.5 in. (241.3 mm by 114 mm) with the 9.5 in. (241.3 mm) dimension running in the machine direction (MD). Specimens can be obtained directly from a finished product roll, if the appropriate width, or cut to size using a paper cutter. Each specimen should be folded in half such that the crease is running along the cross direction (CD) of the web sample. For two-surface testing, make up 3 samples with a first surface "out" and 3 with the second-side surface "out". Keep track of which samples are first surface "out" and which are second surface out.

Obtain a 30 in. by 40 in. piece of Crescent #300 cardboard. Using a paper cutter, cut out six pieces of cardboard to dimensions of 2.5 in. by 6 in. Puncture two holes into each of the six cards by forcing the cardboard onto the hold down pins of the Sutherland Rub tester.

Center and carefully place each of the 2.5 in. by 6 in. cardboard pieces on top of the six previously folded samples. Make sure the 6 in. dimension of the cardboard is running parallel to the machine direction (MD) of each of the tissue samples. Center and carefully place each of the cardboard pieces on top of the three previously folded samples. Once again, make sure the 6 in. dimension of the cardboard is running parallel to the machine direction (MD) of each of the web samples.

Fold one edge of the exposed portion of the web specimen onto the back of the cardboard. Secure this edge to the cardboard with adhesive tape obtained from 3M Inc. (¾ in. wide Scotch Brand, St. Paul, Minn.). Carefully grasp the other over-hanging tissue edge and snugly fold it over onto the back of the cardboard. While maintaining a snug fit of the web specimen onto the board, tape this second edge to the back of the cardboard. Repeat this procedure for each sample.

Turn over each sample and tape the cross-direction edge of the web specimen to the cardboard. One half of the adhesive tape should contact the web specimen while the other half is adhering to the cardboard. Repeat this procedure for each of the samples. If the tissue sample breaks, tears, or becomes frayed at any time during the course of this sample preparation procedure, discard and make up a new sample with a new tissue sample strip.

There will now be 3 first-side surface "out" samples on cardboard and (optionally) 3 second-side surface "out" samples on cardboard.

ii. Felt Preparation

Obtain a 30 in. by 40 in. piece of Crescent #300 cardboard. Using a paper cutter, cut out six pieces of cardboard to dimensions of 2.25 in. by 7.25 in. Draw two lines parallel to the short dimension and down 1.125 in. from the top and bottom most edges on the white side of the cardboard. Carefully score the length of the line with a razor blade using a straight edge as a guide. Score it to a depth about halfway through the thickness of the sheet. This scoring allows the cardboard/felt combination to fit tightly around and rest flat against the weight of the Sutherland Rub tester. Draw an arrow running parallel to the long dimension of the cardboard on this scored side of the cardboard.

Cut six pieces of black felt (F-55, or equivalent) to the dimensions of 2.25 in. by 8.5 in. Place a felt piece on top of the unscored, green side of the cardboard such that the long edges of both the felt and cardboard are parallel and in alignment. Make sure the fluffy side of the felt is facing up. Also allow about 0.5" to overhang the top and bottom most edges of the cardboard. Snugly fold over both overhanging felt edges onto the backside of the cardboard and attach with Scotch brand tape. Prepare a total of six of these felt/cardboard combinations. For best reproducibility, all samples should be run with the same lot of felt.

iii. Care of 4-Pound Weight

The four-pound weight has four square inches of effective contact area providing a contact pressure of one pound per square inch. Since the contact pressure can be changed by alteration of the rubber pads mounted on the face of the weight, it is important to use only the rubber pads supplied by the instrument manufacturer and mounted according to their instructions. These pads must be replaced if they become hard, abraded, or chipped off. When not in use, the weight must be positioned such that the pads are not supporting the full weight of the weight. It is best to store the weight on its side.

iv. Rub Tester Instrument Calibration

Set up and calibrate the Sutherland Rub Tester according to the manufacturer's instructions. For this method, the tester is preset to run for five strokes (one stroke is a full forward and reverse cycle of the movable arm) and operates at 42 cycles per minute.

v. Color Spectrophotometer Calibration

Setup and standardize the color instrument using a 2 in. measurement area port size utilizing the manufacturer supplied black tile, then white tile. Calibrate the instrument according to manufacturer's specifications using their supplied standard tiles and configure it to measure Hunter L, a, b values.

vi. Measurement of Samples

The first step in the measurement of lint is to measure the Hunter color values of the black felt/cardboard samples prior to being rubbed on the web sample. Center a felt covered cardboard, with the arrow pointing to the back of the color meter, over the measurement port backing it with a standard white plate. Since the felt width is only slightly larger than the viewing area diameter, make sure the felt completely covers the measurement area. After confirming complete coverage, take a reading and record the Hunter L value.

Measure the Hunter Color L values for all the felt covered cardboards using this technique. If the Hunter Color L values are all within 0.3 units of one another, take the average to obtain the initial L reading. If the Hunter Color L values are not within the 0.3 units, discard those felt/cardboard combinations outside the limit. Prepare new samples and repeat the Hunter Color L measurement until all samples are within 0.3 units of one another.

For the rubbing of the web sample/cardboard combinations, secure a prepared web sample card on the base plate of the rub tester by slipping the holes in the board over the hold-down pins. Clip a prepared felt covered card (with established initial "L" reading) onto the four-pound weight by pressing the card ends evenly under the clips on the sides of the weight. Make certain the card is centered score bend to score bend on the weight, positioned flat against the rubber pads, with the felt side facing away from the rubber pads. Hook the weight onto the tester arm and gently lower onto the prepared web sample card. It is important to check that the felt is resting flat on the web sample and that the weight does not bind on the arm.

Next, activate the tester allowing the weighted felt test strip to complete five full rubbing strokes against the web sample surface. At the end of the five strokes the tester will automatically stop. Remove the weight with the felt covered cardboard. Inspect the web sample. If torn, discard the felt and web sample and start over. If the web sample is intact, remove the felt covered cardboard from the weight. Measure the Hunter Color L value on the felt covered cardboard in the same location as described above for the blank felts. Record the Hunter Color L readings for the felt after rubbing. Rub, measure, and record the Hunter Color L values for all remaining samples. After all web specimens have been measured, remove and discard all felt. Felts strips are not used again. Cardboards are used until they are bent, torn, limp, or no longer have a smooth surface.

vii. Calculations

For samples measured on both surfaces, subtract the average initial L reading found for the unused felts from each of the three first-side surface L readings and each of the three second-side surface L readings. Calculate the average delta for the three first-side surface values. Calculate the average delta for the three second-side surface values. Finally, calculate the average of the lint value on the first-side surface and the second-side surface, and record as the lint value to the nearest whole unit.

For samples measured on only one surface, subtract the average initial L reading found for the unused felts from each of the three L readings. Calculate the average delta L for the three surface values and record as the lint value to the nearest whole unit.

Formation Index Test Method:

The formation index is a ratio of the contrast and size distribution components of the nonwoven substrate. The higher the formation index, the better the formation uniformity. Conversely, the lower the formation index, the worse the formation uniformity. The "formation index" is measured using a commercially available PAPRICAN Micro-Scanner Code LAD94, manufactured by OpTest Equipment, Incorporated, utilizing the software developed by PAPRICAN & OpTest, Version 9.0, both commercially available from OpTest Equipment Inc., Ontario, Canada. The PAPRICAN Micro-Scanner Code LAD94 uses a video camera system for image input and a light box for illuminating the sample. The camera is a CCD camera with 65 μm/pixel resolution.

The video camera system views a nonwoven sample placed on the center of a light box having a diffuser plate. To illuminate the sample for imaging, the light box contains a diffused quartz halogen lamp of 82V/250 W that is used to provide a field of illumination. A uniform field of illumination of adjustable intensity is provided. Specifically, samples for the formation index testing are cut from a cross direction width strip of the nonwoven substrate. The samples are cut into 101.6 mm (4 inches) by 101.6 mm (4 inches) squares, with one side aligned with the machine direction of the test material. The side aligned with the machine direction of the test material is placed onto the testing area and held in place by the specimen plate with the machine direction pointed towards the instrument support arm that holds the camera. Each specimen is placed on the light box such that the side of the web to be measured for uniformity is facing up, away from the diffuser plate. To determine the formation index, the light level must be adjusted to indicate MEAN LCU GRAY LEVEL of 128±1.

The specimen is set on the light box between the specimen plate so that the center of the specimen is aligned with the center of the illumination field. All other natural or artificial room light is extinguished. The camera is adjusted so that its optical axis is perpendicular to the plane of the specimen and so that its video field is centered on the center of the specimen. The specimen is then scanned and calculated with the OpTest Software.

Fifteen specimens of the nonwoven substrate were tested for each sample and the values were averaged to determine the formation index.

Density and Bulk (Dry) Test Method:

The density of a fibrous structure and/or sanitary tissue product is calculated as the quotient of the Basis Weight of a fibrous structure or sanitary tissue product expressed in lbs/3000 ft2 divided by the Caliper (at 95 g/in2) of the fibrous structure or sanitary tissue product expressed in mils. The final Density value is calculated in lbs/ft^3 and/or g/cm3, by using the appropriate converting factors. The bulk of a fibrous structure and/or sanitary tissue product is the reciprocal of the density method (i.e., Bulk=1/Density).

Dry Thick Compression and Recovery Test Method ("Dry Compression" or "Compressive Slope (Dry)"):

Dry Thick Compression and Dry Thick Compressive Recovery are measured using a constant rate of extension tensile tester (a suitable instrument is the EJA Vantage, Thwing-Albert, West Berlin NJ, or equivalent) fitted with compression fixtures, a circular compression foot having an area of 1.0 $in^2$ and a circular anvil having an area of at least 4.9 $in^2$. The thickness (caliper in mils) is measured at varying pressure values ranging from 10-1500 $g/in^2$ in both the compression and relaxation directions.

Four (4) samples are prepared by the cutting of a usable unit obtained from the outermost sheets of a finished product roll after removing at least the leading five sheets by unwinding and tearing off via the closest line of weakness, such that each cut sample is 2.5×2.5 inches, avoiding creases, folds, and obvious defects.

The compression foot and anvil surfaces are aligned parallel to each other, and the crosshead zeroed at the point where they are in contact with each other. The tensile tester is programmed to perform a compression cycle, immediately followed by an extension (recovery) cycle. Force and extension data are collected at a rate of 50 Hz, with a crosshead speed of 0.10 in/min. Force data is converted to pressure ($g/in^2$, or gsi). The compression cycle continues until a pressure of 1500 gsi is reached, at which point the crosshead stops and immediately begins the extension (recovery) cycle with the data collection and crosshead speed remaining the same.

The sample is placed flat on the anvil fixture, ensuring the sample is centered beneath the foot so that when contact is made the edges of the sample will be avoided. Start the tensile tester and data collection. Testing is repeated in like fashion for all four samples.

The thickness (mils) vs. pressure ($g/in^2$, or gsi) data is used to calculate the sample's compressibility, near-zero load caliper, and compressive modulus. A least-squares linear regressions is performed on the thickness vs. the logarithm (base10) of the applied pressure data using nine discrete data points at pressures of 10, 25, 50, 75, 100, 125, 150, 200, 300 gsi and their respective thickness readings. Compressibility (m) equals the slope of the linear regression line, with units of mils/log (gsi). The higher the magnitude of the negative value the more "compressible" the sample is. Near-zero load caliper (b) equals the y-intercept of the linear regression line, with units of mils. This is the extrapolated thickness at log (1 gsi pressure). Compressive Modulus is calculated as the y-intercept divided by the negative slope (−b/m) with units of log (gsi).

Dry Thick Compression is defined as:

$$\text{Dry Thick Compression}\left(\text{mil}\cdot\text{mils/log}\,(gsi)\right) = -1\times\text{Near Zero Load Caliper}\,(b)\times\text{Compressibility}\,(m)$$

Compression Slope is defined as −1×Compressibility (m).

Multiplication by −1 turns formula into a positive. Larger results represent thick products that compress when a pressure is applied. Calculate the arithmetic mean of the four replicate values and report Dry Thick Compression to the nearest integer value mils*mils/log (gsi).

Dry Thick Compressive Recovery is defined as:

$$\text{Dry Thick Compressive Recovery}\,(mils\cdot mils/\text{log}\,(gsi)) = -1\times\text{Near Zero Load Caliper}\,(b)\times\text{Compressibility}\,(m)\times\frac{\text{Recovered Thickness at 10 }gsi}{\text{Compressed Thickness at 10 }gsi}$$

Multiplication by −1 turns formula into a positive. Larger results represent thick products that compress when a pressure is applied and maintain fraction recovery at 10 g/in$^2$. Compressed thickness at 10 g/in$^2$ is the thickness of the material at 10 g/in$^2$ pressure during the compressive portion of the test. Recovered thickness at 10 g/in$^2$ is the thickness of the material at 10 g/in$^2$ pressure during the recovery portion of the test. Calculate the arithmetic mean of the four replicate values and report Dry Thick Compressive Recovery to the nearest integer value mils*mils/log (gsi).

Wet Thick Compression and Recovery Test Method (Wet Compression):

Wet Thick Compression and Wet Thick Compressive Recovery are measured using a constant rate of extension tensile tester (a suitable instrument is the EJA Vantage, Thwing-Albert, West Berlin NJ, or equivalent) fitted with compression fixtures, a circular compression foot having an area of 1.0 in$^2$ and a circular anvil having an area of at least 4.9 in$^2$. The thickness (caliper in mils) is measured at varying pressure values ranging from 10-1500 g/in$^2$ in both the compression and relaxation directions.

Four (4) samples are prepared by the cutting of a usable unit obtained from the outermost sheets of a finished product roll after removing at least the leading five sheets by unwinding and tearing off via the closest line of weakness, such that each cut sample is 2.5×2.5 inches, avoiding creases, folds, and obvious defects.

The compression foot and anvil surfaces are aligned parallel to each other, and the crosshead zeroed at the point where they are in contact with each other. The tensile tester is programmed to perform a compression cycle, immediately followed by an extension (recovery) cycle. Force and extension data are collected at a rate of 50 Hz, with a crosshead speed of 0.10 in/min. Force data is converted to pressure (g/in$^2$, or gsi). The compression cycle continues until a pressure of 1500 gsi is reached, at which point the crosshead stops and immediately begins the extension (recovery) cycle with the data collection and crosshead speed remaining the same.

The sample is placed flat on the anvil fixture, ensuring the sample is centered beneath the foot so that when contact is made the edges of the sample will be avoided. Using a pipette, fully saturate the entire sample with distilled or deionized water until there is no observable dry area remaining and water begins to run out of the edges. Start the tensile tester and data collection. Testing is repeated in like fashion for all four samples.

The thickness (mils) vs. pressure (g/in$^2$, or gsi) data is used to calculate the sample's compressibility, "near-zero load caliper", and compressive modulus. A least-squares linear regressions is performed on the thickness vs. the logarithm (base10) of the applied pressure data using nine discrete data points at pressures of 10, 25, 50, 75, 100, 125, 150, 200, 300 gsi and their respective thickness readings. Compressibility (m) equals the slope of the linear regression line, with units of mils/log (gsi). The higher the magnitude of the negative value the more "compressible" the sample is. Near-zero load caliper (b) equals the y-intercept of the linear regression line, with units of mils. This is the extrapolated thickness at log (1 gsi pressure). Compressive Modulus is calculated as the y-intercept divided by the negative slope (−b/m) with units of log (gsi).

Wet Thick Compression is defined as:

$$\text{Dry Thick Compression}\left(\text{mils}\cdot\text{mils/log}\,(gsi)\right) = -1\times\text{Near Zero Load Caliper}\,(b)\times\text{Compressibility}\,(m)$$

Multiplication by −1 turns formula into a positive. Larger results represent thick products that compress when a pressure is applied. Calculate the arithmetic mean of the four replicate values and report Wet Thick Compression to the nearest integer value mils*mils/log (gsi).

Wet Thick Compressive Recovery is defined as:

$$\text{Dry Thick Compressive Recovery}\,(mils\cdot mils/\text{log}\,(gsi)) = -1\times\text{Near Zero Load Caliper}\,(b)\times\text{Compressibility}\,(m)\times\frac{\text{Recovered Thickness at 10 }gsi}{\text{Compressed Thickness at 10 }gsi}$$

Multiplication by −1 turns formula into a positive. Larger results represent thick products that compress when a pressure is applied and maintain fraction recovery at 10 g/in$^2$. Compressed thickness at 10 g/in$^2$ is the thickness of the material at 10 g/in$^2$ pressure during the compressive portion of the test. Recovered thickness at 10 g/in$^2$ is the thickness of the material at 10 g/in$^2$ pressure during the recovery portion of the test. Calculate the arithmetic mean of the four replicate values and report Wet Thick Compressive Recovery to the nearest integer value mils*mils/log (gsi).

Moist Towel Surface Structure Test Method:

This test method measures the surface topography of a towel surface, both in a dry and moist state, and calculates the % contact area and the median depth of the lowest 10% of the projected measured area, with the test sample under a specified pressure using a smooth and rigid transparent plate with an anti-reflective coating (to minimize and/or eliminate invalid image pixels).

Condition the samples or useable units of product, with wrapper or packaging materials removed, in a room conditioned at 50±2% relative humidity and 23° C.±1° C. (73°±2° F.) for a minimum of two hours prior to testing. Do not test useable units with defects such as wrinkles, tears, holes, effects of tail seal or core adhesive, etc., and when necessary, replace with other useable units free of such defects. Test sample dimensions shall be of the size of the usable unit, removed carefully at the perforations if they are present. If perforations are not present, or for samples larger than 8 inches MD by 11 inches CD, cut the sample to a length of approximately 6 inches in the MD and 11 inches in the CD. In this test only the inside surface of the usable unit(s) is analyzed. The inside surface is identified as the surface oriented toward the interior core when wound on a product roll (i.e., the opposite side of the surface visible on the outside roll as presented to a consumer).

Figure 10:
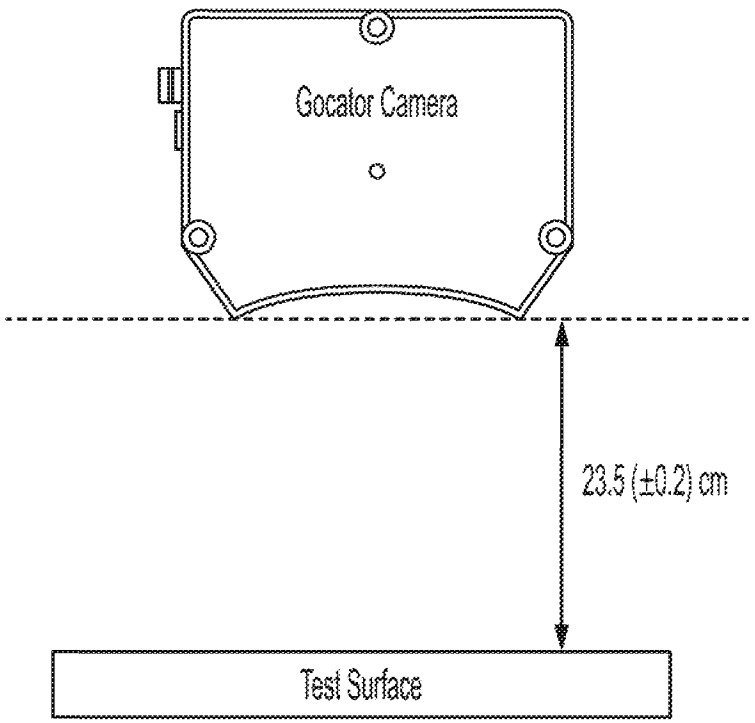
FIG. 10 is a schematic illustrating the Position of Gocator camera to a testing surface relating to the Moist Towel Surface Structure Method.

The instrument used in this method is a Gocator 3210 Snapshot System (LMI Technologies, Inc., 9200 Glenlyon Parkway, Burnaby, BC V5J 5J8 Canada), or equivalent. This instrument is an optical 3D surface topography measurement system that measures the surface height of a sample using a projected structured light pattern technique. The result of the measurement is a topography map of surface height (z-directional or z-axis) versus displacement in the x-y plane. This particular system has a field of view of approximately 100×154 mm, however the captured images are cropped to 80×130 mm (from the center) prior to analysis. The system has an x-y pixel resolution of 86 microns. The clearance distance from the camera to the testing surface (which is smooth and flat, and perpendicular to the camera view) is 23.5 (+/−0.2) cm—see FIG. 10. Calibration plates can be used to verify that the system is accurate to manufacturer's specifications. The system is set to a Brightness value of 7, and a Dynamic value of 3, in order to most accurately capture the surface topography and minimize non-measured pixels and noise. Other camera settings may be used, with the objective of most accurately measuring the surface topography, while minimizing the number of invalid and non-measurable points.

Test samples are handled only at their corners. The test sample is first weighted on a scale with at least 0.001 gram accuracy, and its dry weight recorded to the nearest 0.01 gram. It is then placed on the testing surface, with its inside face oriented towards the Gocator camera, and centered with respect to the imaging view. A smooth and rigid transparent plate (8×10 inches) is gently placed on top of the test sample, centered with respect to its x-y dimensions. Equal size weights are placed on the four corners of the transparent plate such that they are close to the four corners of the projected imaged area, but do not interfere in any way with the measurement image. The size of each equal sized weight is such that the total weight of transparent plate and the four weights delivers a total pressure of 25 (+/−1) grams per square inch (gsi) to the test sample under the plate. Within 15 seconds of placing the four weights in their proper position, the Gocator system is then initiated to acquire the topography image of the test sample in its 'dry' state.

Immediately after saving the Gocator image of the 'dry' state image, the weights and plate are removed from the test sample. The test sample is then moved to a smooth, clean countertop surface, with its inside face still up. Using a pipette, 15-30 ml of deionized water is distributed evenly across the entire surface of the test sample until it is visibly apparent that the water has fully wetted the entire test sample, and no unwetted area is observed. The wetting process is to be completed in less than a minute. The wet test sample is then gently picked up by two adjacent corners, so that it hangs freely (dripping may occur), and carefully placed on a sheet of blotter paper (Whatman cellulose blotting paper, grade GB003, cut to dimensions larger than the test sample). The wet test sample must be placed flat on the blotting paper without wrinkles or folds present. A smooth, 304 stainless steel cylindrical rod (density of ~8 g/cm$^3$), with dimensions of 1.75 inch diameter and 12 inches long, is then rolled over the entire test sample at a speed of 1.5-2.0 inches per second, in the direction of the shorter of the two dimensions of the test sample. If creases or folds are created during the rolling process, and are inside the central area of the sample to be measured (i.e., if they cannot slightly adjusted or avoided in the topography measurement), then the test sample is to be discarded for a new test sample, and the measurement process started over. Otherwise, the moist sample is picked up by two adjacent corners and weighed on the scale to the nearest 0.01 gram (i.e., its moist weight). At this point, the moist test paper towel test sample will have a moisture level between 1.25 and 2.00 grams $H_2O$ per gram of initial dry material.

The moist test sample is then placed flat on the Gocator testing surface (handling it carefully, only touching its corners), with its inside surface pointing towards the Gocator camera, and centered with respect to the imaging view (as close to the same position it was for the 'dry' state image). After ensuring that the sample is flat, and no folds or creases are present in the imaging area, the smooth and rigid transparent plate (8×10 inches) is gently placed on top of the test sample, centered with respect to its x-y dimensions. The equal size weights are placed on the four corners of the transparent plate (i.e., the same weights that were used in the dry sample testing) such that they are close to the four corners of the projected imaged area, but do not interfere in any way with the measurement image. Within 15 seconds of placing the four weights in their proper position, the Gocator system is then initiated to acquire the topography image of the test sample in its 'moist' state.

At this point, the test sample has both 'dry' and 'moist' surface topography (3D) images. These are processed using surface texture analysis software such as MountainsMap® (available from Digital Surf, France) or equivalent, as follows: 1) The first step is to crop the image. As stated previously, this particular system has a field of view of approximately 100×154 mm, however the image is cropped to 80×130 mm (from the center). 2) Remove 'invalid' and non-measured points. 3) Apply a 3×3 median filter (to reduce effects of noise). 4) Apply an 'Align' filter, which subtracts a least squares plane to level the surface (to create an overall average of heights centered at zero). 5) Apply a Gaussian filter (according to ISO 16610-61) with a nesting index (cut-off wavelength) of 25 mm (to flatten out large scale waviness, while preserving finer structure).

From these processed 3D images of the surface, the following parameters are calculated, using software such as MountainsMap® or equivalent: Dry Depth (um), Dry Contact Area (%), Moist Depth (um), and Moist Contact Area (%).

Height measurements are derived from the Areal Material Ratio (Abbott-Firestone) curve described in the ISO 13565-2:1996 standard extrapolated to surfaces. This curve is the cumulative curve of the surface height distribution histogram versus the range of surface heights measured. A material ratio is the ratio, expressed as a percent, of the area corresponding to points with heights equal to or above an intersecting plane passing through the surface at a given height, or cut depth, to the cross-sectional area of the evaluation region (field of view area). For calculating contact area, the height at a material ratio of 2% is first identified. A cut depth of 100 μm below this height is then identified, and the material ratio at this depth is recorded as the "Dry Contact Area" and "Moist Contact Area", respectively, to the nearest 0.1%.

In order to calculate "Depth" (Dry and Moist, respectively), the depth at the 95% material ratio relative to the mean plane (centered height data) of the specimen surface is identified. This corresponds to a depth equal to the median of the lowest 10% of the projected area (valleys) of the specimen surface and is recorded as the "Dry Depth" and "Moist Depth", respectively, to the nearest 1 micron (um). These values will be negative as they represent depths below the mean plane of the surface heights having a value of zero.

Three replicate samples are prepared and measured in this way, to produce an average for each of the four parameters: Dry Depth (um), Dry Contact Area (%), Moist Depth (um), and Moist Contact Area (%). Additionally, from these parameters, the difference between the dry and moist depths can be calculated to demonstrate the change in depth from the dry to the moist state.

Micro-CT Intensive Property Measurement Method:

The micro-CT intensive property measurement method measures the basis weight, thickness and density values within visually discernable zones or regions of a substrate sample. It is based on analysis of a 3D x-ray sample image obtained on a micro-CT instrument (a suitable instrument is the Scanco μCT 50 available from Scanco Medical AG, Switzerland, or equivalent). The micro-CT instrument is a cone beam microtomograph with a shielded cabinet. A maintenance free x-ray tube is used as the source with an adjustable diameter focal spot. The x-ray beam passes through the sample, where some of the x-rays are attenuated by the sample. The extent of attenuation correlates to the mass of material the x-rays have to pass through. The transmitted x-rays continue on to the digital detector array and generate a 2D projection image of the sample. A 3D image of the sample is generated by collecting several individual projection images of the sample as it is rotated, which are then reconstructed into a single 3D image. The instrument is interfaced with a computer running software to control the image acquisition and save the raw data. The 3D image is then analyzed using image analysis software (a suitable image analysis software is MATLAB available from The Mathworks, Inc., Natick, MA, or equivalent) to measure the basis weight, thickness and density intensive properties of regions within the sample.

Sample Preparation

To obtain a sample for measurement, lay a single layer of the dry substrate material out flat and die cut a circular piece with a diameter of 16 mm. If the sample being measured is a 2 (or more) ply finished product, carefully separate an individual ply of the finished product prior to die cutting. The sample weight is recorded. A sample may be cut from any location containing the region or cells to be analyzed. Regions, zones, or cells within different samples taken from the same substrate material can be analyzed and compared to each other. Care should be taken to avoid embossed regions, folds, wrinkles, or tears when selecting a location for sampling.

Image Acquisition

Set up and calibrate the micro-CT instrument according to the manufacturer's specifications. Place the sample into the appropriate holder, between two rings of low-density material, which have an inner diameter of 12 mm. This will allow the central portion of the sample to lay horizontal and be scanned without having any other materials directly adjacent to its upper and lower surfaces. Measurements should be taken in this region. The 3D image field of view is approximately 20 mm on each side in the xy-plane with a resolution of approximately 3400 by 3400 pixels, and with a sufficient number of 6 micron thick slices collected to fully include the z-direction of the sample. The reconstructed 3D image contains isotropic voxels of 6 microns. Images were acquired with the source at 45 kVp and 133 μA with no additional low energy filter. These current and voltage settings should be optimized to produce the maximum contrast in the projection data with sufficient x-ray penetration through the sample, but once optimized held constant for all substantially similar samples. A total of 1700 projections images are obtained with an integration time of 500 ms and 4 averages. The projection images are reconstructed into the 3D image and saved in 16-bit format to preserve the full detector output signal for analysis.

Image Processing

Load the 3D image into the image analysis software. The largest cross-sectional area of the sample should be nearly parallel with the x-y plane, with the z-axis being perpendicular. Threshold the 3D image at a value which separates, and removes, the background signal due to air, but maintains the signal from the sample fibers within the substrate.

Five 2D intensive property images are generated from the thresholded 3D image. The first is the Basis Weight Image, which is a projection image. Each x-y pixel in this image represents the summation of the intensity values along voxels in the z-direction. This results in a 2D image where each pixel now has a value equal to the cumulative signal through the entire sample.

The weight of the sample divided by the z-direction projected area of the punched sample provides the actual average basis weight of the sample. This correlates with the average signal intensity from the Basis Weight image described above, allowing it to be represented in units of $g/m^2$ (gsm).

The second intensive property 2D image is the Thickness Image. To generate this image the upper and lower surfaces of the sample are identified, and the distance between these surfaces is calculated giving the sample thickness. The upper surface of the sample is identified by starting at the uppermost z-direction slice and evaluating each slice going through the sample to locate the z-direction voxel for all pixel positions in the xy-plane where sample signal was first detected. The same procedure is followed for identifying the lower surface of the sample, except the z-direction voxels located are all the positions in the xy-plane where sample signal was last detected. Once the upper and lower surfaces have been identified they are smoothed with a 15×15 median filter to remove signal from stray fibers. The 2D Thickness Image is then generated by counting the number of voxels that exist between the upper and lower surfaces for each of the pixel positions in the xy-plane. This raw thickness value is then converted to actual distance, in microns, by multiplying the voxel count by the 6 μm slice thickness resolution.

Figure 12:
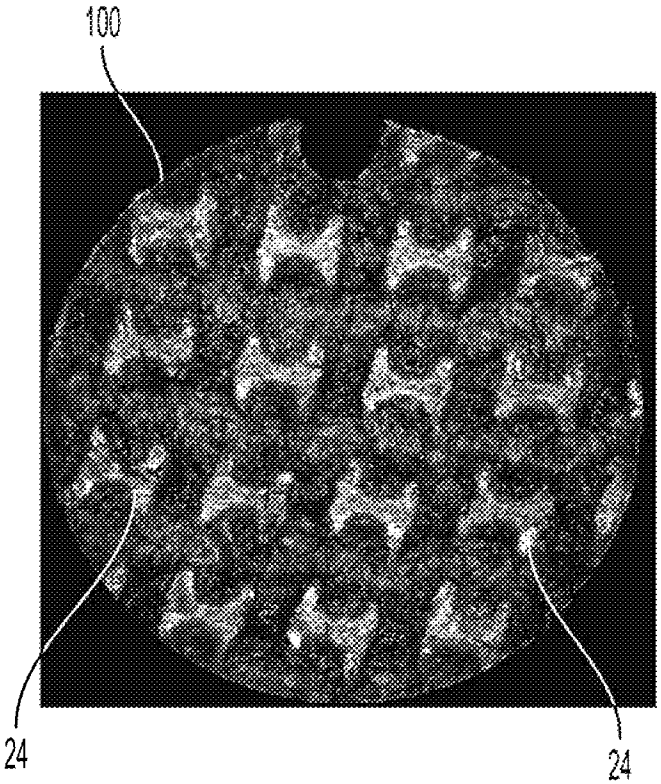
FIG. 12 is a density image for use in the Micro-CT Intensive Property Measurement Method.

The third intensive property 2D image is the Density Image (see for example FIG. 12). To generate this image, divide each xy-plane pixel value in the Basis Weight Image, in units of gsm, by the corresponding pixel in the Thickness Image, in units of microns. The units of the Density Image are grams per cubic centimeter (g/cc).

For each x-y location, the first and last occurrence of a thresholded voxel position in the z-direction is recorded. This provides two sets of points representing the Top Layer and Bottom Layer of the sample. Each set of points are fit to a second-order polynomial to provide smooth top and bottom surfaces. These surfaces define fourth and fifth 2D intensive property images, the top-layer and bottom-layer of the sample. These surfaces are saved as images with the gray values of each pixel representing the z-value of the surface point.

Micro-CT Basis Weight, Thickness and Density Intensive Properties

This sub-section of the method may be used to measure zones or regions generally. Begin by identifying the zone or region to be analyzed. Next, identify the boundary of the identified region to be analyzed. The boundary of a region is identified by visual discernment of differences in intensive properties when compared to other regions within the sample. For example, a region boundary can be identified based by visually discerning a thickness difference when compared to another region in the sample. Any of the intensive properties can be used to discern region boundaries on either on the physical sample itself or any of the micro-CT intensive property images. Once the boundary of a zone or region has been identified draw the largest circular region of interest that can be inscribed within the region. From each of the first three intensive property images calculate the average basis weight, thickness, and density within the region of interest. Record these values as the region's micro-CT basis weight to the nearest 0.01 gsm, micro-CT thickness to the nearest 0.1 micron and micro-CT density to the nearest 0.0001 g/cc.

To calculate the percent difference between zones or regions may be calculated according to the "Percent (%) difference" definition above.

Concavity Ratio and Packing Fraction Measurements

As outlined above, five different types of 2D intensive property images are created. These images include: (1) a basis weight image, (2) a thickness image, (3) a density image, (4) a top-layer image, and (5) a bottom-layer image.

To measure discrete pillow and knuckle Concavity Ratio and Packing Fraction, begin by identifying the boundary of the selected discrete pillow or knuckle cells. The boundary of a cell is identified by visual discernment of differences in intensive properties when compared to other cells within the sample. For example, a cell boundary can be identified based by visually discerning a density difference when compared to another cell in the sample. Any of the intensive properties (basis weight, thickness, density, top-layer, and bottom-layer) can be used to discern cell boundaries on either the physical sample itself or any of the micro-CT 2D intensive property images.

Figure 13:
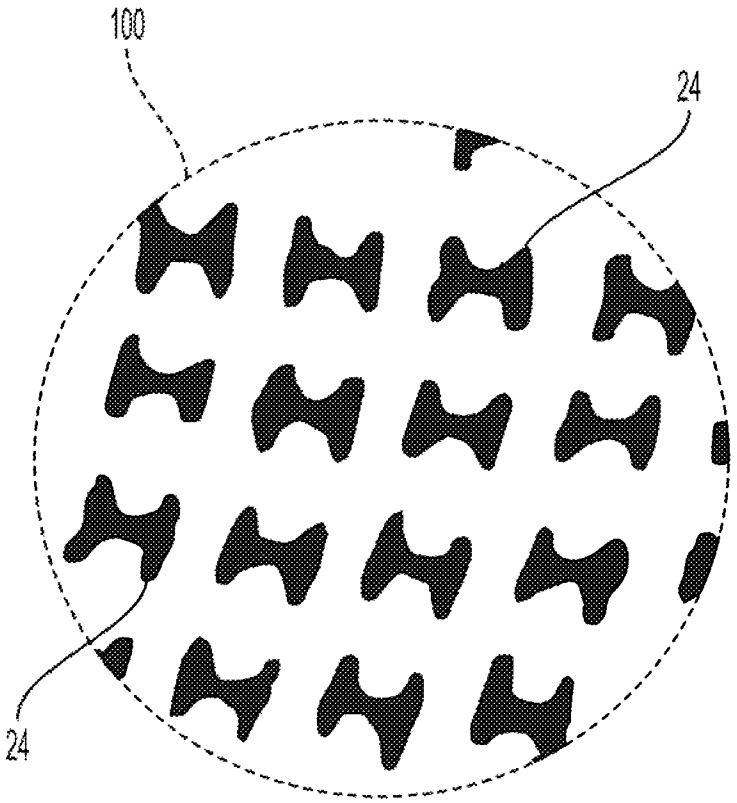
FIG. 13 is a binary image for use in the Micro-CT Intensive Property Measurement Method.

Using the image analysis software, manually draw a line tracing the identified boundary of each individual whole and partial discrete knuckle or discrete pillow cell 24 visible within the sample boundary 100, and generate a new binary image containing only the closed filled in shapes of all the identified discrete cells (see for example FIG. 13). Analyze all the individual discrete cell shapes in the binary image and record the following measurements for each: 1) Area and 2) Convex Hull Area.

The Concavity Ratio is a measure of the presence and extent of concavity within the shapes of the discrete knuckle or pillow cells. Using the recorded measurements calculate the Concavity Ratio for each of the analyzed discrete cells as the ratio of the shape area to its convex hull area. Identify ten substantially similar replicate discrete knuckle or pillow cells and average together their individual Concavity Ratio values and report the average Concavity Ratio as a unitless value to the nearest 0.01. If ten replicate cells cannot be identified in a single sample, then a sufficient number of replicate samples are to be analyzed according to the described procedure. If the sample contains discrete knuckle or pillow cells of differing size or shape, identify ten substantially similar replicates of each of the different shapes and sizes, calculate an average Concavity Ratio for each and report the minimum average Concavity Ratio value.

The Packing Fraction is the fraction of the sample area filled by the discrete knuckle and pillow shapes. The Packing Fraction value for the sample is calculated by summing all the recorded whole and partial identified shape areas, regardless of shape or size, and dividing that total by the sample area within the sample boundary 100. The Packing Fraction is reported as a unitless value to the nearest 0.01.

Continuous Region Density Difference Measurement

Figure 11:
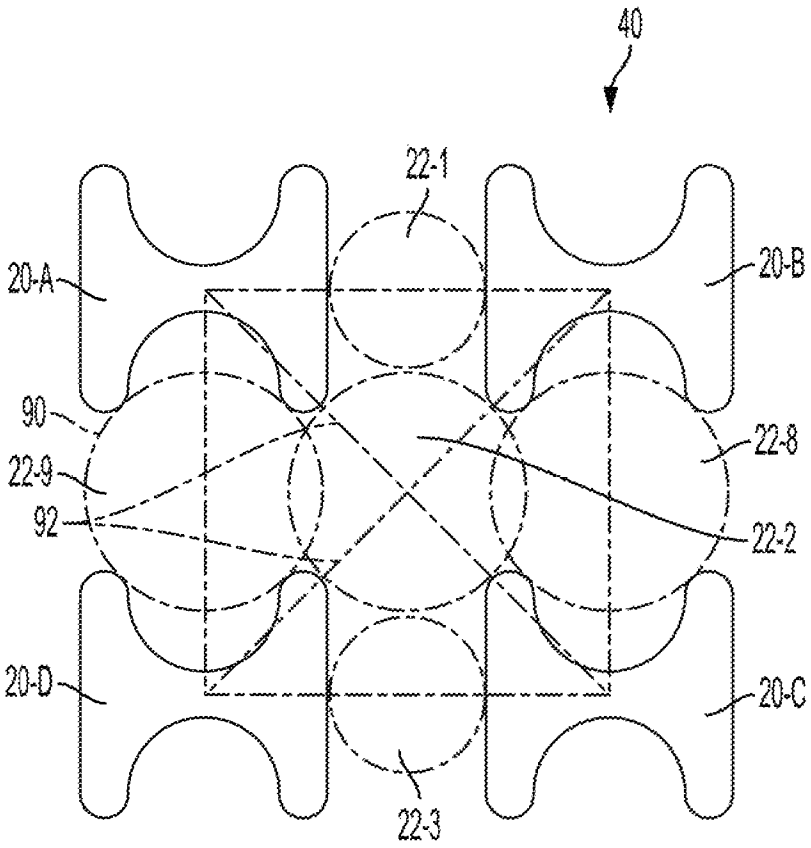
FIG. 11 is an enlarged view of a cell group overlapped by a quadrilateral related to the Continuous Region Density Difference Measurement.

This sub-section of the method may be used when a continuous region is present. To measure the Continuous Region Density Difference, first identify a Cell Group 40 of four adjacent and nearest-neighboring discrete knuckle (e.g., FIG. 11, knuckles 20-A through 20-D) or pillow cells and their boundaries as described above, such that when the centroids of each of the four cells are connected a quadrilateral will be formed having four edges 90 and two diagonals 92 (see for example FIG. 11). Avoid analyzing any Cells Groups containing embossing. Within this Cell Group identify the continuous pillow or knuckle region. Select five locations to analyze within the identified continuous region: One will be located on each of the cell centroid connecting lines forming the four edges of the quadrilateral, and one located in the middle where the quadrilateral diagonals intersect. At each of the selected locations draw the largest circular region of interest that can be inscribed within the continuous region, with the center of each of the four edge regions of interest lying on the centroid connecting line (e.g., pillow regions 22-1, 22-3, 22-8, 22-9) and the middle region of interest centered at the location where the diagonals intersect (e.g., 22-2). From the density intensive property image calculate and record the average density within each of the five regions of interest. Calculate and record the percent difference between the highest and lowest recorded density values. Percent difference is calculated by: subtracting the lowest density value from the highest density value and then dividing that value by the average of the lowest and highest density values, and then multiplying the result by 100. Perform this analysis for three substantially similar replicate Cell Groups of four discrete knuckle or pillow locations within the sample and report the average percent difference value to the nearest whole percent.

Continuous Region Density Difference Measurement

This sub-section of the method may be used when a continuous region is present. To measure the Continuous Region Density Difference, first identify a Cell Group 40 of four adjacent and nearest-neighboring discrete knuckle (e.g., FIG. 11, knuckles 20-A through 20-D) or pillow cells and their boundaries as described above, such that when the centroids of each of the four cells are connected a quadrilateral will be formed having four edges 90 and two diagonals 92 (see for example FIG. 11). Avoid analyzing any Cells Groups containing embossing. Within this Cell Group identify the continuous pillow or knuckle region. Select five locations to analyze within the identified continuous region:

One will be located on each of the cell centroid connecting lines forming the four edges of the quadrilateral, and one located in the middle where the quadrilateral diagonals intersect. At each of the selected locations draw the largest circular region of interest that can be inscribed within the continuous region, with the center of each of the four edge regions of interest lying on the centroid connecting line (e.g., pillow regions 22-1, 22-3, 22-8, 22-9) and the middle region of interest centered at the location where the diagonals intersect (e.g., 22-2). From the density intensive property image calculate and record the average density within each of the five regions of interest. Calculate and record the percent difference between the highest and lowest recorded density values. Percent difference is calculated by: subtracting the lowest density value from the highest density value and then dividing that value by the average of the lowest and highest density values, and then multiplying the result by 100. Perform this analysis for three substantially similar replicate Cell Groups of four discrete knuckle or pillow locations within the sample and report the average percent difference value to the nearest whole percent.

Micro-CT Basis Weight, Thickness and Density Intensive Properties

This sub-section of the method may be used to measure zones or regions generally. Once the boundary of a zone or region has been identified draw the largest circular region of interest that can be inscribed within the region. From each of the first three intensive property images calculate the average basis weight, thickness and density within the region of interest. Record these values as the region's micro-CT basis weight to the nearest 0.01 gsm, micro-CT thickness to the nearest 0.1 micron and micro-CT density to the nearest 0.0001 g/cc. To calculate and record the percent difference between ZONES OR REGIONS: the highest and lowest recorded density values. Percent difference is calculated by: subtracting the lowest density value from the highest density value and then dividing that value by the average of the lowest and highest density values, and then multiplying the result by 100.

Basis Weigh—Method:

Basis weight of a fibrous structure and/or sanitary tissue product (TAPPI conditioned as follows: Temperature is controlled from 23° C.±1° C. and Relative Humidity is controlled from 50%±2%) is measured on stacks of twelve usable units using a top loading analytical balance with a resolution of ±0.001 g. The balance is protected from air drafts and other disturbances using a draft shield. A precision cutting die, measuring 3.500 in±0.0035 in by 3.500 in±0.0035 in is used to prepare all samples.

With a precision cutting die, cut the samples into squares. Combine the cut squares to form a stack twelve samples thick. Measure the mass of the sample stack and record the result to the nearest 0.001 g.

The Basis Weight is calculated in lbs/3000 $ft^2$ or $g/m^2$ as follows:

Basis Weight=(Mass of stack)/[(Area of 1 square in stack)×(No. of squares in stack)]

For example:

Basis Weight(lbs/3000$ft^2$)=[[Mass of stack(g)/453.6 (g/lbs)]/[12.25($in^2$)/144($in^2/ft^2$)×12]]×3000 or,

Basis Weight($g/m^2$)=Mass of stack(g)/[79.032($cm^2$)/10,000($cm^2/m^2$)×12].

Report the numerical result to the nearest 0.1 lbs/3000 $ft^2$ or 0.1 $g/m^2$ or "gsm." Sample dimensions can be changed or varied using a similar precision cutter as mentioned above, so as at least 100 square inches of sample area in stack.

Emtec Test Method:

TS7 and TS750 values are measured using an EMTEC Tissue Softness Analyzer ("Emtec TSA") (Emtec Electronic GmbH, Leipzig, Germany) interfaced with a computer running Emtec TSA software (version 3.19 or equivalent). According to Emtec, the TS7 value correlates with the real material softness, while the TS750 value correlates with the felt smoothness/roughness of the material. The Emtec TSA comprises a rotor with vertical blades which rotate on the test sample at a defined and calibrated rotational speed (set by manufacturer) and contact force of 100 mN. Contact between the vertical blades and the test piece creates vibrations, which create sound that is recorded by a microphone within the instrument. The recorded sound file is then analyzed by the Emtec TSA software. The sample preparation, instrument operation and testing procedures are performed according the instrument manufacture's specifications.

Sample Preparation

Test samples are prepared by cutting square or circular samples from a finished product. Test samples are cut to a length and width (or diameter if circular) of no less than about 90 mm, and no greater than about ("no greater than about" used interchangeably with "less than about" herein) 120 mm, in any of these dimensions, to ensure the sample can be clamped into the TSA instrument properly. Test samples are selected to avoid perforations, creases or folds within the testing region. Prepare 8 substantially similar replicate samples for testing. Equilibrate all samples at TAPPI standard temperature and relative humidity conditions (23° C.±2 C.° and 50%±2%) for at least 1 hour prior to conducting the TSA testing, which is also conducted under TAPPI conditions.

Testing Procedure

Calibrate the instrument according to the manufacturer's instructions using the 1-point calibration method with Emtec reference standards ("ref.2 samples"). If these reference samples are no longer available, use the appropriate reference samples provided by the manufacturer. Calibrate the instrument according to the manufacturer's recommendation and instruction, so that the results will be comparable to those obtained when using the 1-point calibration method with Emtec reference standards ("ref.2 samples").

Mount the test sample into the instrument and perform the test according to the manufacturer's instructions. When complete, the software displays values for TS7 and TS750. Record each of these values to the nearest 0.01 dB $V^2$ rms. The test piece is then removed from the instrument and discarded. This testing is performed individually on the top surface (outer facing surface of a rolled product) of four of the replicate samples, and on the bottom surface (inner facing surface of a rolled product) of the other four replicate samples.

The four test result values for TS7 and TS750 from the top surface are averaged (using a simple numerical average); the same is done for the four test result values for TS7 and TS750 from the bottom surface. Report the individual average values of TS7 and TS750 for both the top and bottom surfaces on a particular test sample to the nearest 0.01 dB $V^2$ rms. Additionally, average together all eight test value results for TS7 and TS750, and report the overall average values for TS7 and TS750 on a particular test sample to the nearest 0.01 dB $V^2$ rms. Unless otherwise specified, the reported values for TS7 and TS750 will be the overall average of the eight test values from the top and bottom surfaces.

SST Absorbency Rate Method:

This test incorporates the Slope of the Square Root of Time (SST) Test Method. The SST method measures rate over a wide spectrum of time to capture a view of the product pick-up rate over the useful lifetime. In particular, the method measures the absorbency rate via the slope of the mass versus the square root of time from 2-15 seconds.

Overview

The absorption (wicking) of water by a fibrous sample is measured over time. A sample is placed horizontally in the instrument and is supported with minimal contact during testing (without allowing the sample to droop) by an open weave net structure that rests on a balance. The test is initiated when a tube connected to a water reservoir is raised and the meniscus makes contact with the center of the sample from beneath, at a small negative pressure. Absorption is controlled by the ability of the sample to pull the water from the instrument for approximately 20 seconds. Rate is determined as the slope of the regression line of the outputted weight vs sqrt(time) from 2 to 15 seconds.

Apparatus

Conditioned Room—Temperature is controlled from 73° F.±2° F. (23° C.±1° C.). Relative Humidity is controlled from 50%±2%

Sample Preparation—Product samples are cut using hydraulic/pneumatic precision cutter into 3.375 inch diameter circles.

Capacity Rate Tester (CRT)—The CRT is an absorbency tester capable of measuring capacity and rate. The CRT consists of a balance (0.001 g), on which rests on a woven grid (using nylon monofilament line having a 0.014" diameter) placed over a small reservoir with a delivery tube in the center. This reservoir is filled by the action of solenoid valves, which help to connect the sample supply reservoir to an intermediate reservoir, the water level of which is monitored by an optical sensor. The CRT is run with a −2 mm water column, controlled by adjusting the height of water in the supply reservoir.

Figure 9:
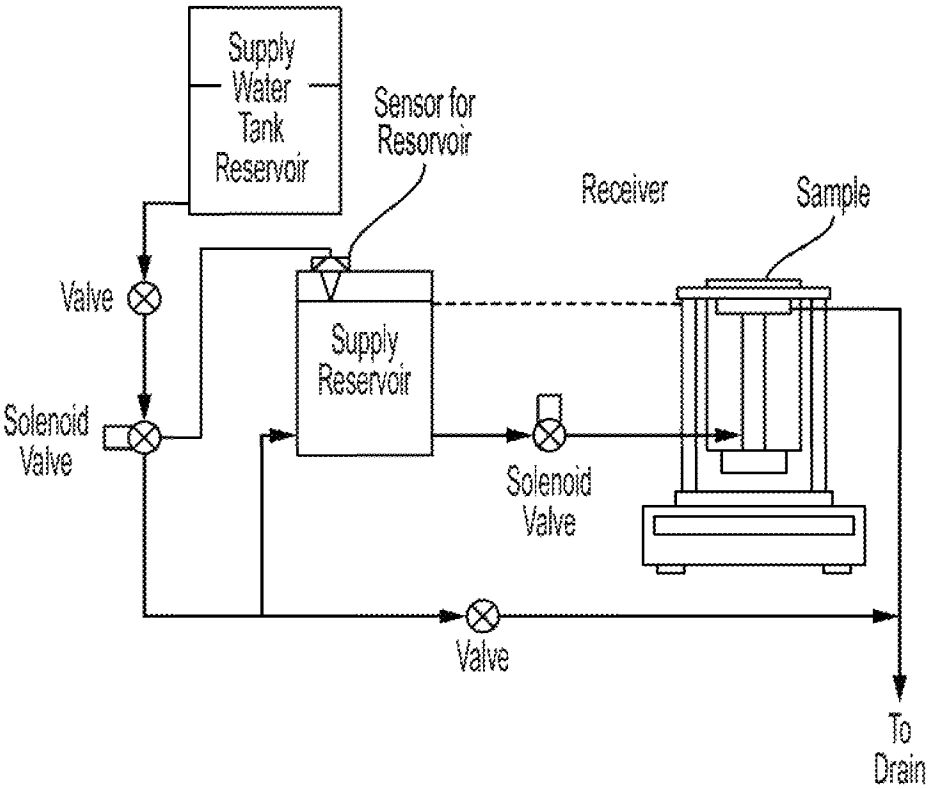
FIG. 9 is a diagram of an SST Test Method set up as detailed herein.

A diagram of the testing apparatus set up is shown in FIG. 9.

Software—LabView based custom software specific to CRT Version 4.2 or later.

Water—Distilled water with conductivity <10 μS/cm (target <5 μS/cm) @ 25° C.

Sample Preparation

For this method, a usable unit is described as one finished product unit regardless of the number of plies. Condition all samples with packaging materials removed for a minimum of 2 hours prior to testing. Discard at least the first ten usable units from the roll. Remove two usable units and cut one 3.375-inch circular sample from the center of each usable unit for a total of 2 replicates for each test result. Do not test samples with defects such as wrinkles, tears, holes, etc. Replace with another usable unit which is free of such defects Sample Testing Pre-Test Set-Up 1. The water height in the reservoir tank is set −2.0 mm below the top of the support rack (where the towel sample will be placed).
2. The supply tube (8 mm I.D.) is centered with respect to the support net.
3. Test samples are cut into circles of 3⅜" diameter and equilibrated at Tappi environment conditions for a minimum of 2 hours.

Test Description

1. After pressing the start button on the software application, the supply tube moves to 0.33 mm below the water height in the reserve tank. This creates a small meniscus of water above the supply tube to ensure test initiation. A valve between the tank and the supply tube closes, and the scale is zeroed.
2. The software prompts you to "load a sample". A sample is placed on the support net, centering it over the supply tube, and with the side facing the outside of the roll placed downward.
3. Close the balance windows and press the "OK" button—the software records the dry weight of the circle.
4. The software prompts you to "place cover on sample". The plastic cover is placed on top of the sample, on top of the support net. The plastic cover has a center pin (which is flush with the outside rim) to ensure that the sample is in the proper position to establish hydraulic connection. Four other pins, 1 mm shorter in depth, are positioned 1.25-1.5 inches radially away from the center pin to ensure the sample is flat during the test. The sample cover rim should not contact the sheet. Close the top balance window and click "OK".
5. The software re-zeroes the scale and then moves the supply tube towards the sample. When the supply tube reaches its destination, which is 0.33 mm below the support net, the valve opens (i.e., the valve between the reserve tank and the supply tube), and hydraulic connection is established between the supply tube and the sample. Data acquisition occurs at a rate of 5 Hz and is started about 0.4 seconds before water contacts the sample.
6. The test runs for at least 20 seconds. After this, the supply tube pulls away from the sample to break the hydraulic connection.
7. The wet sample is removed from the support net. Residual water on the support net and cover are dried with a paper towel.
8. Repeat until all samples are tested.
9. After each test is run, a *.txt file is created (typically stored in the CRT/data/rate directory) with a file name as typed at the start of the test. The file contains all the test set-up parameters, dry sample weight, and cumulative water absorbed (g) vs. time (sec) data collected from the test.

Calculation of Rate of Uptake

Take the raw data file that includes time and weight data.

First, create a new time column that subtracts 0.4 seconds from the raw time data to adjust the raw time data to correspond to when initiation actually occurs (about 0.4 seconds after data collection begins).

Second, create a column of data that converts the adjusted time data to square root of time data (e.g., using a formula such as SQRT( ) within Excel).

Third, calculate the slope of the weight data vs the square root of time data (e.g., using the SLOPE( ) function within Excel, using the weight data as the y-data and the sqrt(time) data as the x-data, etc.). The slope should be calculated for the data points from 2 to 15 seconds, inclusive (or 1.41 to 3.87 in the sqrt(time) data column).

Calculation of Slope of the Square Root of Time (SST)

The start time of water contact with the sample is estimated to be 0.4 seconds after the start of hydraulic connection is established between the supply tube and the sample (CRT Time). This is because data acquisition begins while the tube is still moving towards the sample and incorporates the small delay in scale response. Thus, "time zero" is actually at 0.4 seconds in CRT Time as recorded in the *.txt file.

The slope of the square root of time (SST) from 2-15 seconds is calculated from the slope of a linear regression line from the square root of time between (and including) 2 to 15 seconds (x-axis) versus the cumulative grams of water absorbed. The units are g/sec$^{0.5}$.

Reporting Results

Report the average slope to the nearest 0.01 g/s$^{0.5}$.

Plate Stiffness Test Method:

As used herein, the "Plate Stiffness" test is a measure of stiffness of a flat sample as it is deformed downward into a hole beneath the sample. For the test, the sample is modeled as an infinite plate with thickness "t" that resides on a flat surface where it is centered over a hole with radius "R". A central force "F" applied to the tissue directly over the center of the hole deflects the tissue down into the hole by a distance "w". For a linear elastic material, the deflection can be predicted by:

$$w = \frac{3F}{4\pi Et^3}(1-\nu)(3+\nu)R^2$$

where "E" is the effective linear elastic modulus, "ν" is the Poisson's ratio, "R" is the radius of the hole, and "t" is the thickness of the tissue, taken as the caliper in millimeters measured on a stack of 5 tissues under a load of about 0.29 psi. Taking Poisson's ratio as 0.1 (the solution is not highly sensitive to this parameter, so the inaccuracy due to the assumed value is likely to be minor), the previous equation can be rewritten for "w" to estimate the effective modulus as a function of the flexibility test results:

$$E \approx \frac{3R^2}{4t^3}\frac{F}{w}$$

The test results are carried out using an MTS Alliance RT/1, Insight Renew, or similar model testing machine (MTS Systems Corp., Eden Prairie, Minn.), with a 50 newton load cell, and data acquisition rate of at least 25 force points per second. As a stack of five tissue sheets (created without any bending, pressing, or straining) at least 2.5-inches by 2.5 inches, but no more than 5.0 inches by 5.0 inches, oriented in the same direction, sits centered over a hole of radius 15.75 mm on a support plate, a blunt probe of 3.15 mm radius descends at a speed of 20 mm/min. For typical perforated rolled bath tissue, sample preparation consists of removing five (5) connected usable units, and carefully forming a 5 sheet stack, accordion style, by bending only at the perforation lines. When the probe tip descends to 1 mm below the plane of the support plate, the test is terminated. The maximum slope (using least squares regression) in grams of force/mm over any 0.5 mm span during the test is recorded (this maximum slope generally occurs at the end of the stroke). The load cell monitors the applied force and the position of the probe tip relative to the plane of the support plate is also monitored. The peak load is recorded, and "E" is estimated using the above equation.

The Plate Stiffness "S" per unit width can then be calculated as:

$$S = \frac{Et^3}{12}$$

and is expressed in units of Newtons*millimeters. The Testworks program uses the following formula to calculate stiffness (or can be calculated manually from the raw data output):

$$S = \left(\frac{F}{w}\right)\left[\frac{(3+\nu)R^2}{16\pi}\right]$$

wherein "F/w" is max slope (force divided by deflection), "ν" is Poisson's ratio taken as 0.1, and "R" is the ring radius.

The same sample stack (as used above) is then flipped upside down and retested in the same manner as previously described. This test is run three more times (with different sample stacks). Thus, eight S values are calculated from four 5-sheet stacks of the same sample. The numerical average of these eight S values is reported as Plate Stiffness for the sample.

Stack Compressibility and Resilient Bulk Test Method:

Stack thickness (measured in mils, 0.001 inch) is measured as a function of confining pressure (g/in$^2$) using a Thwing-Albert (14 W. Collings Ave., West Berlin, NJ) Vantage Compression/Softness Tester (model 1750-2005 or similar) or equivalent instrument, equipped with a 2500 g load cell (force accuracy is +/−0.25% when measuring value is between 10%-100% of load cell capacity, and 0.025% when measuring value is less than 10% of load cell capacity), a 1.128 inch diameter steel pressure foot (one square inch cross sectional area) which is aligned parallel to the steel anvil (2.5 inch diameter). The pressure foot and anvil surfaces must be clean and dust free, particularly when performing the steel-to-steel test. Thwing-Albert software (MAP) controls the motion and data acquisition of the instrument.

The instrument and software are set-up to acquire crosshead position and force data at a rate of 50 points/sec. The crosshead speed (which moves the pressure foot) for testing samples is set to 0.20 inches/min (the steel-to-steel test speed is set to 0.05 inches/min). Crosshead position and force data are recorded between the load cell range of approximately 5 and 1500 grams during compression. The crosshead is programmed to stop immediately after surpassing 1500 grams, record the thickness at this pressure (termed $T_{max}$), and immediately reverse direction at the same speed as performed in compression. Data is collected during this decompression portion of the test (also termed recovery) between approximately 1500 and 5 grams. Since the foot area is one square inch, the force data recorded corresponds to pressure in units of g/in$^2$. The MAP software is programmed to the select 15 crosshead position values (for both compression and recovery) at specific pressure trap points of 10, 25, 50, 75, 100, 125, 150, 200, 300, 400, 500, 600, 750, 1000, and 1250 g/in$^2$ (i.e., recording the crosshead position of very next acquired data point after the each pressure point trap is surpassed). In addition to these 30 collected trap points, $T_{max}$ is also recorded, which is the thickness at the maximum pressure applied during the test (approximately 1500 g/in$^2$).

Since the overall test system, including the load cell, is not perfectly rigid, a steel-to-steel test is performed (i.e., nothing in between the pressure foot and anvil) at least twice for each batch of testing, to obtain an average set of steel-to-steel crosshead positions at each of the 31 trap points described above. This steel-to-steel crosshead position data is subtracted from the corresponding crosshead position data at each trap point for each tested stacked sample, thereby resulting in the stack thickness (mils) at each pressure trap point during the compression, maximum pressure, and recovery portions of the test.

$$\text{StackT (trap)}=\text{StackCP (trap)}-\text{SteelCP (trap)}$$

Where:

trap=trap point pressure at either compression, recovery, or max

StackT=Thickness of Stack (at trap pressure)

StackCP=Crosshead position of Stack in test (at trap pressure)

SteelCP=Crosshead position of steel-to-steel test (at trap pressure)

A stack of five (5) usable units thick is prepared for testing as follows. The minimum usable unit size is 2.5 inch by 2.5 inch; however a larger sheet size is preferable for testing, since it allows for easier handling without touching the central region where compression testing takes place. For typical perforated rolled bath tissue, this consists of removing five (5) sets of 3 connected usable units. In this case, testing is performed on the middle usable unit, and the outer 2 usable units are used for handling while removing from the roll and stacking. For other product formats, it is advisable, when possible, to create a test sheet size (each one usable unit thick) that is large enough such that the inner testing region of the created 5 usable unit thick stack is never physically touched, stretched, or strained, but with dimensions that do not exceed 14 inches by 6 inches.

The 5 sheets (one usable unit thick each) of the same approximate dimensions, are placed one on top the other, with their MD aligned in the same direction, their outer face all pointing in the same direction, and their edges aligned +/−3 mm of each other. The central portion of the stack, where compression testing will take place, is never to be physically touched, stretched, and/or strained (this includes never to 'smooth out' the surface with a hand or other apparatus prior to testing).

The 5 sheet stack is placed on the anvil, positioning it such that the pressure foot will contact the central region of the stack (for the first compression test) in a physically untouched spot, leaving space for a subsequent (second) compression test, also in the central region of the stack, but separated by ¼ inch or more from the first compression test, such that both tests are in untouched, and separated spots in the central region of the stack. From these two tests, an average crosshead position of the stack at each trap pressure (i.e., StackCP(trap)) is calculated for compression, maximum pressure, and recovery portions of the tests. Then, using the average steel-to-steel crosshead trap points (i.e., SteelCP(trap)), the average stack thickness at each trap (i.e., StackT(trap) is calculated (mils).

Stack Compressibility is defined here as the absolute value of the linear slope of the stack thickness (mils) as a function of the log(10) of the confining pressure (grams/in$^2$), by using the 15 compression trap points discussed previously (i.e., compression from 10 to 1250 g/in$^2$), in a least squares regression. The units for Stack Compressibility are [mils/(log(g/in$^2$))], and is reported to the nearest 0.1 [mils/(log(g/in$^2$))].

Resilient Bulk is calculated from the stack weight per unit area and the sum of 8 StackT(trap) thickness values from the maximum pressure and recovery portion of the tests: i.e., at maximum pressure ($T_{max}$) and recovery trap points at R1250, R1000, R750, R500, R300, R100, and R10 g/in$^2$ (a prefix of "R" denotes these traps come from recovery portion of the test). Stack weight per unit area is measured from the same region of the stack contacted by the compression foot, after the compression testing is complete, by cutting a 3.50 inch square (typically) with a precision die cutter, and weighing on a calibrated 3-place balance, to the nearest 0.001 gram. The weight of the precisely cut stack, along with the StackT(trap) data at each required trap pressure (each point being an average from the two compression/recovery tests discussed previously), are used in the following equation to calculate Resilient Bulk, reported in units of cm$^3$/g, to the nearest 0.1 cm$^3$/g.

$$\text{Resilient Bulk} = \frac{\text{SUM}(\text{Stack}T(T_{max}, R1250, R1000, R750, R500, R300, R100, R10)) * 0.00254}{M/A}$$

Where:

StackT=Thickness of Stack (at trap pressures of $T_{max}$ and recovery pressures listed above), (mils)

M=weight of precisely cut stack, (grams)

A=area of the precisely cut stack, (cm$^2$)

Wet Burst Method:

"Wet Burst Strength" as used herein is a measure of the ability of a fibrous structure and/or a fibrous structure product incorporating a fibrous structure to absorb energy, when wet and subjected to deformation normal to the plane of the fibrous structure and/or fibrous structure product. The Wet Burst Test is run according to ISO 12625-9:2005, except for any deviations or modifications described below.

Wet burst strength may be measured using a Thwing-Albert Burst Tester Cat. No. 177 equipped with a 2000 g load cell commercially available from Thwing-Albert Instrument Company, Philadelphia, Pa, or an equivalent instrument.

Wet burst strength is measured by preparing four (4) multi-ply fibrous structure product samples for testing. First, condition the samples for two (2) hours at a temperature of 73° F.±2° F. (23° C.±1° C.) and a relative humidity of 50% (±2%). Take one sample and horizontally dip the center of the sample into a pan filled with about 25 mm of room temperature distilled water. Leave the sample in the water four (4) (±0.5) seconds. Remove and drain for three (3) (±0.5) seconds holding the sample vertically so the water runs off in the cross-machine direction. Proceed with the test immediately after the drain step.

Place the wet sample on the lower ring of the sample holding device of the Burst Tester with the outer surface of the sample facing up so that the wet part of the sample completely covers the open surface of the sample holding ring. If wrinkles are present, discard the samples and repeat with a new sample. After the sample is properly in place on the lower sample holding ring, turn the switch that lowers the upper ring on the Burst Tester. The sample to be tested is now securely gripped in the sample holding unit. Start the burst test immediately at this point by pressing the start button on the Burst Tester. A plunger will begin to rise (or lower) toward the wet surface of the sample. At the point when the sample tears or ruptures, report the maximum reading. The plunger will automatically reverse and return to its original starting position. Repeat this procedure on three (3) more samples for a total of four (4) tests, i.e., four (4) replicates. Report the results as an average of the four (4) replicates, to the nearest gram.

Wet Tensile Method:

Wet Elongation, Tensile Strength, and TEA are measured on a constant rate of extension tensile tester with computer interface (a suitable instrument is the EJA Vantage from the Thwing-Albert Instrument Co. West Berlin, NJ) using a load cell for which the forces measured are within 10% to 90% of the limit of the load cell. Both the movable (upper) and stationary (lower) pneumatic jaws are fitted with smooth stainless steel faced grips, with a design suitable for testing 1 inch wide sheet material (Thwing-Albert item #733GC). An air pressure of about 60 psi is supplied to the jaws.

Eight usable units of fibrous structures are divided into two stacks of four usable units each. The usable units in each stack are consistently oriented with respect to machine direction (MD) and cross direction (CD). One of the stacks is designated for testing in the MD and the other for CD. Using a one inch precision cutter (Thwing Albert) take a CD stack and cut one, 1.00 in±0.01 in wide by at least 3.0 in long stack of strips (long dimension in CD). In like fashion cut the remaining stack in the MD (strip long dimension in MD), to give a total of 8 specimens, four CD and four MD strips. Each strip to be tested is one usable unit thick, and will be treated as a unitary specimen for testing.

Program the tensile tester to perform an extension test (described below), collecting force and extension data at an acquisition rate of 100 Hz as the crosshead raises at a rate of 2.00 in/min (10.16 cm/min) until the specimen breaks. The break sensitivity is set to 50%, i.e., the test is terminated when the measured force drops below 50% of the maximum peak force, after which the crosshead is returned to its original position.

Set the gage length to 2.00 inches. Zero the crosshead and load cell. Insert the specimen into the upper and lower open grips such that at least 0.5 inches of specimen length is contained each grip. Align the specimen vertically within the upper and lower jaws, then close the upper grip. Verify the specimen is hanging freely and aligned with the lower grip, then close the lower grip. Initiate the first portion of the test, which pulls the specimen at a rate of 0.5 in/min, then stops immediately after a load of 10 grams is achieved. Using a pipet, thoroughly wet the specimen with DI water to the point where excess water can be seen pooling on the top of the lower closed grip. Immediately after achieving this wetting status, initiate the second portion of the test, which pulls the wetted strip at 2.0 in/min until break status is achieved. Repeat testing in like fashion for all four CD and four MD specimens.

Program the software to calculate the following from the constructed force (g) verses extension (in) curve:

Wet Tensile Strength (g/in) is the maximum peak force (g) divided by the specimen width (1 in), and reported as g/in to the nearest 0.1 g/in.

Adjusted Gage Length (in) is calculated as the extension measured (from original 2.00 inch gage length) at 3 g of force during the test following the wetting of the specimen (or the next data point after 3 g force) added to the original gage length (in). If the load does not fall below 3 g force during the wetting procedure, then the adjusted gage length will be the extension measured at the point the test is resumed following wetting added to the original gage length (in).

Wet Peak Elongation (%) is calculated as the additional extension (in) from the Adjusted Gage Length (in) at the maximum peak force point (more specifically, at the last maximum peak force point, if there is more than one) divided by the Adjusted Gage Length (in) multiplied by 100 and reported as % to the nearest 0.1%.

Wet Peak Tensile Energy Absorption (TEA, g*in/in$^2$) is calculated as the area under the force curve (g*in$^2$) integrated from zero extension (i.e., the Adjusted Gage Length) to the extension at the maximum peak force elongation point (more specifically, at the last maximum peak force point, if there is more than one) (in), divided by the product of the adjusted Gage Length (in) and specimen width (in). This is reported as g*in/in$^2$ to the nearest 0.01 g*in/in$^2$.

The Wet Tensile Strength (g/in), Wet Peak Elongation (%), Wet Peak TEA (g*in/in$^2$ are calculated for the four CD specimens and the four MD specimens. Calculate an average for each parameter separately for the CD and MD specimens.

Calculations

Geometric Mean Initial Wet Tensile Strength=Square Root of [MD Wet Tensile Strength (g/in)×CD Wet Tensile Strength (g/in)]

Geometric Mean Wet Peak Elongation=Square Root of [MD Wet Peak Elongation (%)×CD Wet Peak Elongation (%)]

Geometric Mean Wet Peak TEA=Square Root of [MD Wet Peak TEA (g*in/in$^2$)×CD Wet Peak TEA (g*in/in$^2$)]

Total Wet Tensile (TWT)=MD Wet Tensile Strength (g/in)+CD Wet Tensile Strength (g/in)

Total Wet Peak TEA=MD Wet Peak TEA (g*in/in$^2$)+CD Wet Peak TEA (g*in/in$^2$)

Wet Tensile Ratio=MD Wet Peak Tensile Strength (g/in)/CD Wet Peak Tensile Strength (g/in)

Wet Tensile Geometric Mean (GM) Modulus=Square Root of [MD Modulus (at 38 g/cm)×CD Modulus (at 38 g/cm)]

This method is typically used for sanitary tissue products in the form of a paper towel. In the present application, unless the term "Finch" or "Finch cup" is coupled with wet tensile terminology, this is the method being referred to. If "Finch" or "Finch cup" is coupled with wet tensile terminology, the Finch Cup Wet Tensile Test Method should be referred to.

Dry Elongation, Tensile Strength, TEA and Modulus Test Methods for Toilet Paper (for Paper Towels, use: "Dry Elongation, Tensile Strength, TEA and Modulus Test Methods for Paper Towels;" for Facial Tissue, use: "Dry Elongation, Tensile Strength, TEA and Modulus Test Methods for Facial Tissue"):

Elongation, Tensile Strength, TEA and Tangent Modulus are measured on a constant rate of extension tensile tester with computer interface (a suitable instrument is the EJA Vantage from the Thwing-Albert Instrument Co. Wet Berlin, NJ) using a load cell for which the forces measured are within 10% to 90% of the limit of the load cell. Both the movable (upper) and stationary (lower) pneumatic jaws are fitted with smooth stainless steel faced grips, with a design suitable for testing 1 inch wide sheet material (Thwing-Albert item #733GC). An air pressure of about 60 psi is supplied to the jaws.

Twenty usable units of fibrous structures are divided into four stacks of five usable units each. The usable units in each stack are consistently oriented with respect to machine direction (MD) and cross direction (CD). Two of the stacks are designated for testing in the MD and two for CD. Using a one inch precision cutter (Thwing Albert) take a CD stack and cut two, 1.00 in±0.01 in wide by at least 3.0 in long strips from each CD stack (long dimension in CD). Each strip is five usable unit layers thick and will be treated as a unitary specimen for testing. In like fashion cut the remaining CD stack and the two MD stacks (long dimension in MD) to give a total of 8 specimens (five layers each), four CD and four MD.

Program the tensile tester to perform an extension test, collecting force and extension data at an acquisition rate of 20 Hz as the crosshead raises at a rate of 4.00 in/min (10.16 cm/min) until the specimen breaks. The break sensitivity is set to 50%, i.e., the test is terminated when the measured force drops to 50% of the maximum peak force, after which the crosshead is returned to its original position.

Set the gage length to 2.00 inches. Zero the crosshead and load cell. Insert the specimen into the upper and lower open grips such that at least 0.5 inches of specimen length is contained each grip. Align specimen vertically within the upper and lower jaws, then close the upper grip. Verify specimen is aligned, then close lower grip. The specimen should be under enough tension to eliminate any slack, but less than 0.05 N of force measured on the load cell. Start the tensile tester and data collection. Repeat testing in like fashion for all four CD and four MD specimens.

Program the software to calculate the following from the constructed force (g) verses extension (in) curve:

Tensile Strength is the maximum peak force (g) divided by the product of the specimen width (1 in) and the number of usable units in the specimen (5), and then reported as g/in to the nearest 1 g/in.

Adjusted Gage Length is calculated as the extension measured at 11.12 g of force (in) added to the original gage length (in).

Elongation is calculated as the extension at maximum peak force (in) divided by the Adjusted Gage Length (in) multiplied by 100 and reported as % to the nearest 0.1%.

Tensile Energy Absorption (TEA) is calculated as the area under the force curve integrated from zero extension to the extension at the maximum peak force (g*in), divided by the product of the adjusted Gage Length (in), specimen width (in), and number of usable units in the specimen (5). This is reported as $g*in/in^2$ to the nearest 1 $g*in/in^2$.

Replot the force (g) verses extension (in) curve as a force (g) verses strain curve. Strain is herein defined as the extension (in) divided by the Adjusted Gage Length (in).

Program the software to calculate the following from the constructed force (g) verses strain curve:

Tangent Modulus is calculated as the least squares linear regression using the first data point from the force (g) verses strain curve recorded after 190.5 g (38.1 g×5 layers) force and the 5 data points immediately preceding and the 5 data points immediately following it. This slope is then divided by the product of the specimen width (2.54 cm) and the number of usable units in the specimen (5), and then reported to the nearest 1 g/cm.

The Tensile Strength (g/in), Elongation (%), TEA ($g*in/in^2$) and Tangent Modulus (g/cm) are calculated for the four CD specimens and the four MD specimens. Calculate an average for each parameter separately for the CD and MD specimens.

Calculations

Geometric Mean Tensile=Square Root of [MD Tensile Strength (g/in)×CD Tensile Strength (g/in)]

Geometric Mean Peak Elongation=Square Root of [MD Elongation (%)×CD Elongation (%)]

Geometric Mean TEA=Square Root of [MD TEA ($g*in/in^2$)×CD TEA ($g*in/in^2$)]

Geometric Mean Modulus=Square Root of [MD Modulus (g/cm)×CD Modulus (g/cm)]

Total Dry Tensile Strength (TDT)=MD Tensile Strength (g/in)+CD Tensile Strength (g/in)

Total TEA=MD TEA ($g*in/in^2$)+CD TEA ($g*in/in^2$)

Total Modulus=MD Modulus (g/cm)+CD Modulus (g/cm)

Tensile Ratio=MD Tensile Strength (g/in)/CD Tensile Strength (g/in)

Dry Elongation, Tensile Strength, TEA and Modulus Test Methods for Facial Tissue (for Paper Towels, use: "Dry Elongation, Tensile Strength, TEA and Modulus Test Methods for Paper Towels;" for Toilet Paper, use: "Dry Elongation, Tensile Strength, TEA and Modulus Test Methods for Toilet Paper"):

Elongation, Tensile Strength, TEA and Tangent Modulus are measured on a constant rate of extension tensile tester with computer interface (a suitable instrument is the EJA Vantage from the Thwing-Albert Instrument Co. Wet Berlin, NJ) using a load cell for which the forces measured are within 10% to 90% of the limit of the load cell. Both the movable (upper) and stationary (lower) pneumatic jaws are fitted with smooth stainless steel faced grips, with a design suitable for testing 1 inch wide sheet material (Thwing-Albert item #733GC). An air pressure of about 60 psi is supplied to the jaws.

Eight usable units of fibrous structures are divided into two stacks of four usable units each. The usable units in each stack are consistently oriented with respect to machine direction (MD) and cross direction (CD). One of the stacks is designated for testing in the MD and the other for CD. Using a one inch precision cutter (Thwing Albert) take a CD stack and cut one, 1.00 in±0.01 in wide by at least 5.0 in long stack of strips (long dimension in CD). In like fashion cut the remaining stack in the MD (strip long dimension in MD), to give a total of 8 specimens, four CD and four MD strips. Each strip to be tested is one usable unit thick, and will be treated as a unitary specimen for testing.

Program the tensile tester to perform an extension test, collecting force and extension data at an acquisition rate of 20 Hz as the crosshead raises at a rate of 6.00 in/min (15.24 cm/min) until the specimen breaks. The break sensitivity is set to 50%, i.e., the test is terminated when the measured force drops to 50% of the maximum peak force, after which the crosshead is returned to its original position.

Set the gage length to 4.00 inches. Zero the crosshead and load cell. Insert the specimen into the upper and lower open grips such that at least 0.5 inches of specimen length is contained each grip. Align specimen vertically within the upper and lower jaws, then close the upper grip. Verify specimen is aligned, then close lower grip. The specimen should be under enough tension to eliminate any slack, but less than 0.05 N of force measured on the load cell. Start the tensile tester and data collection. Repeat testing in like fashion for all four CD and four MD specimens.

Program the software to calculate the following from the constructed force (g) verses extension (in) curve:

Tensile Strength is the maximum peak force (g) divided by the specimen width (1 in), and reported as g/in to the nearest 1 g/in.

Adjusted Gage Length is calculated as the extension measured at 11.12 g of force (in) added to the original gage length (in).

Elongation is calculated as the extension at maximum peak force (in) divided by the Adjusted Gage Length (in) multiplied by 100 and reported as % to the nearest 0.1%.

Tensile Energy Absorption (TEA) is calculated as the area under the force curve integrated from zero extension to the extension at the maximum peak force (g*in), divided by the product of the adjusted Gage Length (in) and specimen width (in). This is reported as $g*in/in^2$ to the nearest 1 $g*in/in^2$.

Replot the force (g) verses extension (in) curve as a force (g) verses strain curve. Strain is herein defined as the extension (in) divided by the Adjusted Gage Length (in).

Program the software to calculate the following from the constructed force (g) verses strain curve:

Tangent Modulus is calculated as the least squares linear regression using the first data point from the force (g) verses strain curve recorded after 38.1 g force and the 5 data points immediately preceding and the 5 data points immediately following it. This slope is then divided by the specimen width (2.54 cm), and then reported to the nearest 1 g/cm.

The Tensile Strength (g/in), Elongation (%), TEA ($g*in/in^2$) and Tangent Modulus (g/cm) are calculated for the four CD specimens and the four MD specimens. Calculate an average for each parameter separately for the CD and MD specimens.

Calculations

Geometric Mean Tensile=Square Root of [MD Tensile Strength (g/in)×CD Tensile Strength (g/in)]

Geometric Mean Peak Elongation=Square Root of [MD Elongation (%)×CD Elongation (%)]

Geometric Mean TEA=Square Root of [MD TEA ($g*in/in^2$)×CD TEA ($g*in/in^2$)]

Geometric Mean Modulus=Square Root of [MD Modulus (g/cm)×CD Modulus (g/cm)]

Total Dry Tensile Strength (TDT)=MD Tensile Strength (g/in)+CD Tensile Strength (g/in)

Total TEA=MD TEA ($g*in/in^2$)+CD TEA ($g*in/in^2$)

Total Modulus=MD Modulus (g/cm)+CD Modulus (g/cm)

Tensile Ratio=MD Tensile Strength (g/in)/CD Tensile Strength (g/in)

Dry Elongation, Tensile Strength, TEA and Modulus Test Methods for Paper Towels (for Facial Tissue, use: "Dry Elongation, Tensile Strength, TEA and Modulus Test Methods for Facial Tissue;" for Toilet Paper, use: "Dry Elongation, Tensile Strength, TEA and Modulus Test Methods for Toilet Paper"):

Elongation, Tensile Strength, TEA and Tangent Modulus are measured on a constant rate of extension tensile tester with computer interface (a suitable instrument is the EJA Vantage from the Thwing-Albert Instrument Co. Wet Berlin, NJ) using a load cell for which the forces measured are within 10% to 90% of the limit of the load cell. Both the movable (upper) and stationary (lower) pneumatic jaws are fitted with smooth stainless steel faced grips, with a design suitable for testing 1 inch wide sheet material (Thwing-Albert item #733GC). An air pressure of about 60 psi is supplied to the jaws.

Eight usable units of fibrous structures are divided into two stacks of four usable units each. The usable units in each stack are consistently oriented with respect to machine direction (MD) and cross direction (CD). One of the stacks is designated for testing in the MD and the other for CD. Using a one inch precision cutter (Thwing Albert) take a CD stack and cut one, 1.00 in±0.01 in wide by at least 5.0 in long stack of strips (long dimension in CD). In like fashion cut the remaining stack in the MD (strip long dimension in MD), to give a total of 8 specimens, four CD and four MD strips. Each strip to be tested is one usable unit thick, and will be treated as a unitary specimen for testing.

Program the tensile tester to perform an extension test, collecting force and extension data at an acquisition rate of 20 Hz as the crosshead raises at a rate of 4.00 in/min (10.16 cm/min) until the specimen breaks. The break sensitivity is set to 50%, i.e., the test is terminated when the measured force drops to 50% of the maximum peak force, after which the crosshead is returned to its original position.

Set the gage length to 4.00 inches. Zero the crosshead and load cell. Insert the specimen into the upper and lower open grips such that at least 0.5 inches of specimen length is contained each grip. Align specimen vertically within the upper and lower jaws, then close the upper grip. Verify specimen is aligned, then close lower grip. The specimen should be under enough tension to eliminate any slack, but less than 0.05 N of force measured on the load cell. Start the tensile tester and data collection. Repeat testing in like fashion for all four CD and four MD specimens.

Program the software to calculate the following from the constructed force (g) verses extension (in) curve:

Tensile Strength is the maximum peak force (g) divided by the specimen width (1 in), and reported as g/in to the nearest 1 g/in.

Adjusted Gage Length is calculated as the extension measured at 11.12 g of force (in) added to the original gage length (in).

Elongation is calculated as the extension at maximum peak force (in) divided by the Adjusted Gage Length (in) multiplied by 100 and reported as % to the nearest 0.1%.

Tensile Energy Absorption (TEA) is calculated as the area under the force curve integrated from zero extension to the extension at the maximum peak force (g*in), divided by the product of the adjusted Gage Length (in) and specimen width (in). This is reported as $g*in/in^2$ to the nearest 1 $g*in/in^2$.

Replot the force (g) verses extension (in) curve as a force (g) verses strain curve. Strain is herein defined as the extension (in) divided by the Adjusted Gage Length (in).

Program the software to calculate the following from the constructed force (g) verses strain curve:

Tangent Modulus is calculated as the least squares linear regression using the first data point from the force (g) verses strain curve recorded after 38.1 g force and the 5 data points immediately preceding and the 5 data points immediately following it. This slope is then divided by the specimen width (2.54 cm), and then reported to the nearest 1 g/cm.

The Tensile Strength (g/in), Elongation (%), TEA ($g*in/in^2$) and Tangent Modulus (g/cm) are calculated for the four CD specimens and the four MD specimens. Calculate an average for each parameter separately for the CD and MD specimens.

Calculations

Geometric Mean Tensile=Square Root of [MD Tensile Strength (g/in)×CD Tensile Strength (g/in)]

Geometric Mean Peak Elongation=Square Root of [MD Elongation (%)×CD Elongation (%)]

Geometric Mean TEA=Square Root of [MD TEA ($g*in/in^2$)×CD TEA ($g*in/in^2$)]

Geometric Mean Modulus=Square Root of [MD Modulus (g/cm)×CD Modulus (g/cm)]

Total Dry Tensile Strength (TDT)=MD Tensile Strength (g/in)+CD Tensile Strength (g/in)

Total TEA=MD TEA (g*in/in$^2$)+CD TEA (g*in/in$^2$)

Total Modulus=MD Modulus (g/cm)+CD Modulus (g/cm)

Tensile Ratio=MD Tensile Strength (g/in)/CD Tensile Strength (g/in)

Flexural Rigidity Method:

This test is based on the cantilever beam principle. A Cantilever Bending Tester such as described in ASTM Standard D1388 is used to measure the distance a strip of sample can be extended beyond a horizontal flat platform before it bends to a ramp angle of 41.5±0.5°. The measured Bend Length, in addition to the Basis Weight and Caliper, of the sample is used to calculate Flexural Rigidity.

Using a 1 inch (2.54 cm) JDC Cutter (available from Thwing-Albert Instrument Company, Philadelphia, PA), carefully cut eight (8) 1 inch (2.54 cm) wide test strips from a fibrous structure sample oriented in the MD direction. From a second fibrous structure sample from the same sample set, carefully cut eight (8) 1 inch (2.54 cm) wide strips of the fibrous structure in the CD direction.

The sample strip must be adjusted to 4.0±0.1 in (101.5±2.5 mm), or 6.0±0.1 in (152±2.5 mm) in length. Towel samples and those products which are perforated into usable units 6 inches (152 mm) or greater in both dimensions without folds or perforations are tested as 6 in (152 mm) strips. Toilet tissue samples and facial tissue samples are tested as 4 in (101.5 mm) long strips. To adjust the strips to length, carefully make a cut exactly perpendicular to the long dimension of the strip near one end using a paper cutter. It is important that the cut be exactly perpendicular to the long dimension of the strip. Make a second cut exactly 4.0±0.1 in (101.5 mm), or 6.0±0.1 in (152±2.5 mm) along the strip, again being careful that the cut is exactly perpendicular to the long dimension of the strip. In the case of perforated or folded products, be sure that all cuts are made in such a way that perforations and/or folds are excluded from the 4.0 (101.5 mm) or 6.0 in (152 mm) strip which will be used for the test. All sample strips should be cut individually with minimal mechanical manipulation. No fibrous structure sample which is creased, bent, folded, perforated, or in any other way weakened should be tested using this test.

Mark the direction (MD or CD) very lightly on one end of the strip, keeping the same surface of the sample up for all strips. Later, half of the strips will be turned over for testing, thus it is important that one surface of the strip be clearly identified, however, it makes no difference which surface of the sample is designated as the upper surface.

Using other portions of the fibrous structure sample (not the cut strips), determine the basis weight of the fibrous structure sample in lbs/3000 ft$^2$ and the caliper of the fibrous structure in mils (thousandths of an inch) using the standard procedures disclosed herein. Place the Cantilever Bending Tester level on a bench or table that is relatively free of vibration, excessive heat and most importantly air drafts. Adjust the platform of the Tester to horizontal as indicated by the leveling bubble and verify that the ramp angle is at 41.5±0.5°. Remove the sample slide bar from the top of the platform of the Tester. Lay one of the strips flat on the horizontal platform using care to align the strip to be parallel with the movable sample slide. Align the end of the strip exactly even with the vertical edge of the Tester where the angular ramp is attached or where the zero mark line is scribed on the Tester. Carefully place the sample slide bar on top of the sample strip in the Tester. The sample slide bar must be carefully placed so that the strip is not wrinkled or moved from its initial position.

Using the sample slide bar, move the strip at a rate of approximately 0.5±0.2 in/second (1.3±0.5 cm/second) toward the end of the Tester to which the angular ramp is attached. This can be accomplished with either a manual or automatic Tester. Ensure that no slippage between the strip and movable sample slide occurs. As the sample slide bar and strip project over the edge of the Tester, the strip will begin to bend, or drape downward. Stop moving the sample slide bar the instant the leading edge of the strip falls level with the ramp edge. Read and record the overhang length from the linear scale to the nearest 0.5 mm. Record the distance the sample slide bar has moved in cm as overhang length. This test sequence is performed a total of eight (8) times for each fibrous structure in each direction (MD and CD). The first four strips are tested with the upper surface as the fibrous structure was cut facing up. The last four strips are inverted so that the upper surface as the fibrous structure was cut is facing down as the strip is placed on the horizontal platform of the Tester.

The average Overhang Lengths (MD, CD, and Avg) and Bend Lengths (MD, CD, and Avg) are determined by the following calculations:

$$\text{Overhang Length } MD = \frac{\text{Sum of 8 } MD \text{ readings}}{8}$$

$$\text{Overhang Length } CD = \frac{\text{Sum of 8 } CD \text{ readings}}{8}$$

$$\text{Overhang Length Average } (Avg) = \frac{\text{Sum of all 16 readings}}{16}$$

$$\text{Bend Length } MD = \frac{\text{Overhang Length } MD}{2}$$

$$\text{Bend Length } CD = \frac{\text{Overhang Length } CD}{2}$$

$$\text{Bend Length Average } (Avg) = \frac{\text{Overhang Length Total}}{2}$$

$$\text{Flexural Rigidity} = 0.1629 \times W \times C^3$$

Where W is the basis weight of the fibrous structure in lbs/3000 ft$^2$; C is the Bend Length (MD, CD, or Avg) in cm; and the constant 0.1629 is used to convert the basis weight from English to metric units. The results are expressed in mg-cm to the nearest 0.1 mg-cm.

GM Flexural Rigidity=Square root of (MD Flexural Rigidity×CD Flexural Rigidity)

CRT Rate and Capacity Method:

CRT Rate and Capacity values are generated by running the test procedure as defined in U.S. Patent Application No. US 2017-0183824.

Dry and Wet Caliper Test Methods:

Dry and Wet Caliper values are generated by running the test procedure as defined in U.S. Pat. No. 7,744,723 and states, in relevant part:

Dry Caliper Method:

Samples are conditioned at 23+/−1° C. and 50%+/−2% relative humidity for two hours prior to testing.

Dry Caliper of a sample of fibrous structure product is determined by cutting a sample of the fibrous structure product such that it is larger in size than a load foot loading surface where the load foot loading surface has a circular surface area of about 3.14 in 2. The sample is confined between a horizontal flat surface and the load foot loading surface. The load foot loading surface applies a confining pressure to the sample of 14.7 g/cm$^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in mils.

Wet Caliper Method:

Samples are conditioned at 23+/−1° C. and 50% relative humidity for two hours prior to testing.

Wet Caliper of a sample of fibrous structure product is determined by cutting a sample of the fibrous structure product such that it is larger in size than a load foot loading surface where the load foot loading surface has a circular surface area of about 3.14 in$^2$. Each sample is wetted by submerging the sample in a distilled water bath for 30 seconds. The caliper of the wet sample is measured within 30 seconds of removing the sample from the bath. The sample is then confined between a horizontal flat surface and the load foot loading surface. The load foot loading surface applies a confining pressure to the sample of 14.7 g/cm$^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in mils.

Finch Cup Wet Tensile Test Method:

The Wet Tensile Strength test method is utilized for the determination of the wet tensile strength of a sanitary tissue product or web strip after soaking with water, using a tensile-strength-testing apparatus operating with a constant rate of elongation. The Wet Tensile Strength test is run according to ISO 12625-5:2005, except for any deviations or modifications described below. This method uses a vertical tensile-strength tester, in which a device that is held in the lower grip of the tensile-strength tester, called a Finch Cup, is used to achieve the wetting.

Using a one inch JDC precision sample cutter (Thwing Albert) cut six 1.00 in±0.01 in wide strips from a sanitary tissue product sheet or web sheet in the machine direction (MD), and six strips in the cross machine direction (CD). An electronic tensile tester (Model 1122, Instron Corp., or equivalent) is used and operated at a crosshead speed of 1.0 inch (about 1.3 cm) per minute and a gauge length of 1.0 inch (about 2.5 cm). The two ends of the strip are placed in the upper jaws of the machine, and the center of the strip is placed around a stainless steel peg. The strip is soaked in distilled water at about 20° C. for the identified soak time, and then measured for peak tensile strength. Reference to a machine direction means that the sample being tested is prepared such that the length of the strip is cut parallel to the machine direction of manufacture of the product.

The MD and CD wet peak tensile strengths are determined using the above equipment and calculations in the conventional manner. The reported value is the arithmetic average of the six strips tested for each directional strength to the nearest 0.1 grams force. The total wet tensile strength for a given soak time is the arithmetic total of the MD and CD tensile strengths for that soak time. Initial total wet tensile strength ("ITWT") is measured when the paper has been submerged for 5±0.5 seconds. Decayed total wet tensile ("DTWT") is measured after the paper has been submerged for 30±0.5 minutes.

This method is typically used for sanitary tissue products in the form of toilet (or bath) tissue.

Wet Decay Test Method:

Wet decay (loss of wet tensile) for a sanitary tissue product or web is measured according to the Wet Tensile Test Method described herein and is the wet tensile of the sanitary tissue product or web after it has been standing in the soaked condition in the Finch Cup for 30 minutes. Wet decay is reported in units of "%". Wet decay is the % loss of Initial Total Wet Tensile after the 30 minute soaking.

Dry Burst ("Dry Burst Strength" or "Dry Burst (Peak Load) Strength") Test Method:

The Dry Burst Test is run according to ISO 12625-9:2005, except for any deviations described below. Sanitary tissue product samples or web samples for each condition to be tested are cut to a size appropriate for testing, a minimum of five (5) samples for each condition to be tested are prepared.

A burst tester (Burst Tester Intelect-II-STD Tensile Test instrument. Cat. No. 1451-24PGB available from Thwing-Albert Instrument Co., Philadelphia, Pa., or equivalent) is set up according to the manufacturer's instructions and the following conditions: Speed: 12.7 centimeters per minute; Break Sensitivity: 20 grains; and Peak Load: 2000 grams. The load cell is calibrated according to the expected burst strength.

A sanitary tissue product sample or web sample to be tested is clamped and held between the annular clamps of the burst tester and is subjected to increasing force that is applied by a 0.625 inch diameter, polished stainless steel ball upon operation of the burst tester according to the manufacturer's instructions. The burst strength is that force that causes the sample to fail.

The burst strength for each sanitary tissue product sample or web sample is recorded. An average and a standard deviation for the burst strength for each condition is calculated.

The Dry Burst is reported as the average and standard deviation for each condition to the nearest gram.

Residual Water ($R_w$) Test Method:

This method measures the amount of distilled water absorbed by a paper product. In general a finite amount of distilled water is deposited to a standard surface. A paper towel is then placed over the water for a given amount of time. After the elapsed time the towel is removed and the amount of water left behind and amount of water absorbed are calculated.

The temperature and humidity are controlled within the following limits:

Temperature: 23° C.±1° C. (73° F.±2° F.)

Relative humidity: 50%±2%

The following equipment is used in this test method. A top loading balance is used with sensitivity: ±0.01 grams or better having the capacity of grains minimum A pipette is used having a capacity of 5 mL, and a Sensitivity±1 mL. A Formica™ Tile 6 in×7 in is used. A stop watch or digital timer capable of measuring time in seconds to the nearest 0.1 seconds is also used.

Sample and Solution Preparation

For this test method, distilled water is used, controlled to a temperature of 23° C.±1° C. (73° F.±2° F.). For this method, a usable unit is described as one finished product unit regardless of the number of plies. Condition the rolls or usable units of products, with wrapper or packaging materials removed in a room conditioned at 50%±2% relative humidity, 23° C.±1° C. (73° F.±2° F.) for a minimum of two hours. Do not test usable units with defects such as wrinkles, tears, holes etc.

Paper Samples

Remove and discard at least the four outermost usable units from the roll. For testing remove usable units from each roll of product submitted as indicated below. For Paper Towel products, select five (5) usable units from the roll. For Paper Napkins that are folded, cut and stacked, select five (5) usable units from the sample stack submitted for testing. For all napkins, either double or triple folded, unfold the usable units to their largest square state. One-ply napkins will have one 1-ply layer; 2-ply napkins will have one 2-ply layer. With 2-ply napkins, the plies may be either embossed (just pressed) together, or embossed and laminated (pressed and glued) together. Care must be taken when unfolding 2-ply usable units to keep the plies together. If the unfolded usable unit dimensions exceed 279 mm (11 inches) in either direction, cut the usable unit down to 279 mm (11 inches). Record the original usable unit size if over 279 mm (11 inches). If the unfolded usable unit dimensions are less than 279 mm (11 inches) in either direction, record the usable unit dimensions.

Place the Formica Tile (standard surface) in the center of the cleaned balance surface. Wipe the Formica Tile to ensure that it is dry and free of any debris. Tare the balance to get a zero reading. Slowly dispense 2.5 mL of distilled water onto the center of the standard surface using the pipette. Record the weight of the water to the nearest 0.001 g. Drop 1 usable unit of the paper towel onto the spot of water with the outside ply down. Immediately start the stop watch. The sample should be dropped on the spot such that the spot is in the center of the sample once it is dropped. Allow the paper towel to absorb the distilled water for 30 seconds after hitting the stop watch. Remove the paper from the spot after the 30 seconds has elapsed. The towel must be removed when the stop watch reads 30 seconds±0.1 sec. The paper towel should be removed using a quick vertical motion. Record the weight of the remaining water on the surface to the nearest 0.001 g.t Calculations where:

n=the number of replicates which for this method is 5.

Record the RWV to the nearest 0.001 g.

Breaking Length Test Method:

Handsheet Preparation

Low Density handsheets are made essentially according to TAPPI standard T205, with the following modifications which are believed to more accurately reflect the tissue manufacturing process.

(1) tap water, with no pH adjustment, is used;

(2) the embryonic web is formed in a 12 in. by 12 in. handsheet making apparatus on a monofilament polyester wire supplied by Appelton Wire Co., Appelton, Wis. with the following specifications:

Size: 13.5 inch×13.5 inch

Machine direction Warp Count: 84 1.5 fibers/inch

Cross direction Warp Count: 76±3.0 fibers/inch

Warp size/type: 0.17 millimeters/9FU

Shute size/type: 0.17 millimeters/WP-110

Caliper: 0.016±0.0005 inch

Air permeability: 720±25 cubic feet/minute (3) the embryonic web is transferred by vacuum from the monofilament polyester wire to a monofilament polyester papermaking fabric supplied by Appelton Wire Co., Appelton, Wis. and dewatered by vacuum suction instead of pressing; Fabric specifications:

Size: 16 inch×14 inch

Machine direction Warp Count: 36±1 fibers/inch

Cross direction Warp Count: 30±3 fibers/inch

Warp size/type: Shute size/type: 0.40 millimeters/WP-87-12A-W 0.40 milimeters/WP-801-12A-W Caliper: 0.0270±0.001 inch Air permeability: 397±25 cubic feet/minute Sheet Side to be Monoplane Transfer and dewatering details: The embryonic web and papermaking wire are placed on top of the fabric such that the embryonic web contacts the fabric. The trilayer (wire, web, fabric with fabric side down) is then passed lengthwise across a 13 in.×1/16 in. wide vacuum slot box with a 90 degree flare set at a peak gauge reading of approximately 4.0 in. of mercury vacuum. The rate of the trilayer passing across the vacuum slot should be uniform at a velocity of 16±5 in./sec.

The vacuum is then increased to achieve a peak gauge reading of approximately 9 in, of mercury vacuum and the trilayer is passed lengthwise across the same vacuum slot at the same rate of 16±5 in./sec 2 more times. Note that the peak gauge reading is the amount of vacuum measured as the trilayer passes across the slot. The web is carefully removed from the wire to ensure that no fibers stick to the wire.

(4) the sheet is then dried on a rotary drum drier with a drying felt by passing the web and fabric between the felt and drum with the fabric against the drum surface and again with a second pass with the web against the drum surface.

Dryer specifications: Stainless steel polished finish cylinder with internal steam heating, horizontally mounted.

External dimensions: 17 inches length×13 inches diameter

Temperature: 230±5 degrees Fahrenheit.

Rotation speed: 0.90±0.05 revolutions/minute

Dryer felt: Endless, 80 inches circumference by 16 inches wide, No. 11614, style X225, all wool. Noble and Wood Lab Machine Company, Hoosick Falls, NY.

Felt tension: As low and even as possible without any slippage occurring between the felt and dryer drum and uniform tracking.

(5) the resulting handsheet is 12 in.×12 in. with a resulting target basis weight of 16.5±1.5 pounds per 3,000 $ft^2$ and a target density of 0.15±0.06 g/cc, unless otherwise noted.

Sample Preparation

Condition the handsheet to be tested for a minimum of 2 hours in a room controlled to 73° F.±2° F. (23° C.±1° C.) 50±2% relative humidity. After conditioning the handsheet for at least the minimum time period, measure and record the Basis Weight of the handsheet. The Basis Weight should be within the range 15.0-18.0 pounds per 3000 square feet, if the Basis Weight of the handsheet falls outside of this range the handsheet should be discarded and a new one made. From the handsheet, cut eight sample strips 1.00 inch wide and at least 6-7 inches long in the cross direction (only) using a precision 1" cutter or an appropriate die.

Measurement

Using an electronic tensile tester (Thwing Albert EJA or Intellect II-STD, Corp., Philadelphia, Pa., or equivalent) measure the Tensile Strength of each of the eight sample strips. To perform the test, set the gage length to 4.00 inches, properly secure the sample strip into the upper and lower grips, and perform an extension test, collecting force and extension data as the crosshead raises at a rate of 0.5 in/min until the sample breaks. The resulting Tensile Strength values for each of the eight individual sample strips are recorded in g/in. The Tensile Strength is the maximum peak force (g) divided by the specimen width (1 in), and reported as g/in to the nearest 1 g/in.

Calculations

Calculate the Average Tensile Strength of the eight test strips using the following formula:

$$\text{Average Tensile Strength} = \frac{\text{Sum of tensile strengths measured}}{\text{number of strips tested}}$$

Basis weight corrected tensile (BWCT) is calculated via the following formula:

$$BWCT = \text{Average Tensile Strength} \times \frac{10.5}{(\text{Basis Weight} - 6.0)}$$

Where Basis Weight has the units of pounds per 3000 $ft^2$ and Average Tensile Strength and BWCT have the units of g/in. This equation has the effect of normalizing the strength of the tensile strip to a standard 16.5 pound/3000 $ft^2$ weight when the handsheet is in the specified 15-18 pound/3000 $ft^2$ range.

Breaking Length is then calculated by the following formula:

$$\text{Breaking Length} = BWCT \times 1.4673$$

Where Breaking Length has the units of meters reported to the nearest whole meter.

Any test methods described in U.S. Ser. No. 63/456,020, titled "Fibrous Structures Comprising Non-wood Fibers," filed on Mar. 31, 2023 or any of the test methods described in U.S. Ser. No. 18/131,384, titled "Premium Sanitary Tissue Products Comprising Non-wood Fibers," filed on April 6, that are not otherwise described herein, may be used for the present disclosure.

Regarding the Present Disclosure

In the interests of brevity and conciseness, any ranges of values set forth in this specification are to be construed as written description support for Claims reciting any sub-ranges having endpoints which are whole number values within the specified range in question. By way of a hypothetical illustrative example, a disclosure in this specification of a range of 1-5 shall be considered to support Claims to any of the following sub-ranges: 1-4; 1-3; 1-2; 2-5; 2-4; 2-3; 3-5; 3-4; and 4-5.

The dimensions and values disclosed herein in this application are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any example disclosed or claimed herein or that it alone, or in any combination with any other reference or references, teaches, suggests or discloses any such example. Further, to the extent that any meaning or definition of a term in this document conflicts with any meaning or definition of the same term in a document incorporated by reference, the meaning or definition assigned to that term in this document shall govern.

While particular examples of the present disclosure have been illustrated and described, it would be obvious to those skilled in the art that various other changes and modifications can be made without departing from the spirit and scope of the present disclosure. It is therefore intended to cover in the appended Claims all such changes and modifications that are within the scope of this disclosure.

What is claimed is:

1. An array of sanitary tissue products, comprising:

a first sanitary tissue product in a first package that conveys at least one selected from the group consisting of strength, absorption, softness, and combinations thereof;

a second sanitary tissue product in a second package that conveys sustainability;

wherein TS7, TS750, lint, slip stick, tensile ratio, VFS, and SST are common intensive properties of the first and second sanitary tissue products;

wherein at least one of TS7, TS750, lint, slip stick, tensile ratio, VFS, and SST of the first sanitary tissue product is at least 5% different than, but within 25% of, the TS7, TS750, lint, slip stick, tensile ratio, VFS, and SST, respectively, of the second sanitary tissue product;

wherein the second sanitary tissue product comprises a non-wood;

wherein the first and second sanitary tissue product packages are separate from and adjacent to each other;

wherein each of the first and second sanitary tissue product packages comprises a common single source identifier; and wherein the first and second sanitary tissue product packages comprise different sub-brand name portions.

2. The array of sanitary tissue products of claim 1, wherein the first package conveys strength, and wherein the tensile ratio of the first sanitary tissue product is at least 5% different than, but within 15% of, the tensile ratio of the second sanitary tissue product.

3. The array of sanitary tissue products of claim 2, wherein the tensile ratio of the first sanitary tissue product is less than about 1.7.

4. The array of sanitary tissue products of claim 1, wherein the first package conveys softness, and wherein at least one of TS7, TS750, lint, and slip stick of the first sanitary tissue product is at least 5% different than, but within 15% of, the TS7, TS750, and slip stick, respectively, of the second sanitary tissue product.

5. The array of sanitary tissue products of claim 4, wherein the TS7 of the first sanitary tissue product is less than about 14 dB $V^2$ rms.

6. The array of sanitary tissue products of claim 4, wherein the TS750 of the first sanitary tissue product is less than about 20 dB $V^2$ rms.

7. The array of sanitary tissue products of claim 4, wherein the slip stick of the first sanitary tissue product is less than about 435 dB $V^2$ rms.

8. The array of sanitary tissue products of claim 4, wherein the lint of the first sanitary tissue product is greater than about 6.

9. The array of sanitary tissue products of claim 1, wherein the first package conveys absorption, wherein at least one of VFS and SST of the first sanitary tissue product is at least 5% different than, but within 15% of, the VFS and SST, respectively, of the second sanitary tissue product, and wherein the sanitary tissue product is in the form of a paper towel.

10. The array of sanitary tissue products of claim 9, wherein the VFS of the first sanitary tissue product is greater than about 7.3 g/g.

11. The array of sanitary tissue products of claim 9, wherein the SST of the first sanitary tissue product is greater than about 0.45 g/s^0.5.

12. The array of sanitary tissue products of claim 1, wherein the non-wood fibers are selected from the group consisting of cotton, flax, abaca, hemp, bamboo, bagasse, sisal, jute, and combinations thereof.

13. The array of sanitary tissue products of claim 1, wherein the first sanitary tissue product consists of wood fibers.

14. The array of sanitary tissue products of claim 1, wherein the first sanitary tissue product comprises non-wood fibers.

15. The array of sanitary tissue products of claim 14, wherein the non-wood fibers of the first and second sanitary tissue products are different non-wood fiber types.

16. The array of sanitary tissue products of claim 15, wherein the first sanitary tissue product comprises abaca and wherein the second sanitary tissue product comprises bamboo.

17. The array of sanitary tissue products of claim 14, wherein the second sanitary tissue product comprises a greater content of non-wood fibers by weight.

18. The array of sanitary tissue products of claim 17, wherein the non-wood content of the second sanitary tissue product is at least 10% greater by weight than the non-wood content of the first sanitary tissue product.

19. The array of sanitary tissue products of claim 17, wherein the non-wood content of the second sanitary tissue product is at least 30% greater by weight than the non-wood content of the first sanitary tissue product.

20. The array of sanitary tissue products of claim 1, wherein the first and second packages are immediately adjacent to each other on a shelf.

21. The array of sanitary tissue products of claim 1, wherein each of the first package and the second package convey that the first sanitary tissue product and the second sanitary tissue product are on a same higher tier of one of strength, absorption or softness.

22. The array of sanitary tissue products of claim 1, further comprising:

a third sanitary tissue product in a third package that conveys at least one selected from the group consisting of strength, absorption, softness, and combinations thereof;

wherein the first sanitary tissue product is a first tier of strength, absorption softness and combination thereof;

wherein the third sanitary tissue product is a second tier of strength, absorption, softness and combination thereof which is lower than the first tier; and wherein the first sanitary tissue product has a higher percentage of non-wood fibers than the third sanitary tissue product.

* * * * *